US008404411B2

(12) United States Patent
Mitsumori et al.

(10) Patent No.: US 8,404,411 B2
(45) **Date of Patent: *Mar. 26, 2013**

(54) ELECTROPHOTOGRAPHIC PHOTORECEPTOR, IMAGE-FORMING APPARATUS, AND ELECTROPHOTOGRAPHIC CARTRIDGE

(75) Inventors: Teruyuki Mitsumori, Yokohama (JP); Kozo Ishio, Odawara (JP); Hiroe Fuchigami, Odawara (JP); Hiroaki Takamura, Odawara (JP); Yasunori Kawai, Minato-ku (JP)

(73) Assignee: Mitsubishi Chemical Corporation, Tokyo (JP)

( * ) Notice: Subject to any disclaimer, the term of this patent is extended or adjusted under 35 U.S.C. 154(b) by 578 days.

This patent is subject to a terminal disclaimer.

(21) Appl. No.: 12/301,121

(22) PCT Filed: May 18, 2007

(86) PCT No.: PCT/JP2007/060218

§ 371 (c)(1),
(2), (4) Date: Jan. 26, 2009

(87) PCT Pub. No.: WO2007/135983

PCT Pub. Date: Nov. 29, 2007

(65) Prior Publication Data

US 2009/0208250 A1 Aug. 20, 2009

(30) Foreign Application Priority Data

May 18, 2006 (JP) ..... 2006-138776
May 18, 2006 (JP) ..... 2006-139534
May 18, 2006 (JP) ..... 2006-139535
May 18, 2006 (JP) ..... 2006-139537
May 18, 2006 (JP) ..... 2006-139585
May 19, 2006 (JP) ..... 2006-140860
May 19, 2006 (JP) ..... 2006-140861
May 19, 2006 (JP) ..... 2006-140862

(51) Int. Cl.
*G03G 5/14* (2006.01)

(52) U.S. Cl. ..... 430/58.45; 430/58.4; 430/60; 430/63; 430/65; 399/159; 399/111

(58) Field of Classification Search ..... 430/59.6, 430/60, 65, 63, 58.45, 58.4; 399/159, 111
See application file for complete search history.

(56) References Cited

U.S. PATENT DOCUMENTS 4,123,269 A 10/1978 Von Hoene et al.
4,150,987 A 4/1979 Anderson et al.
4,588,666 A 5/1986 Stolka et al.
4,751,163 A 6/1988 Hagiwara et al.
5,120,627 A 6/1992 Nozomi et al.
5,173,386 A * 12/1992 Murasawa ..... 430/84
5,246,808 A 9/1993 Hanatani et al.
5,391,448 A 2/1995 Katayama et al.
5,882,246 A 3/1999 Inkyo et al.
6,185,398 B1 * 2/2001 Tanaka et al. ..... 430/59.6
6,864,027 B2 * 3/2005 Suzuki ..... 430/60
2006/0073400 A1 4/2006 Kumano et al.
2006/0088778 A1 4/2006 Itami et al.
2007/0077507 A1 * 4/2007 Otsubo et al. ..... 430/60
2009/0162097 A1 * 6/2009 Fuchigami ..... 399/159

FOREIGN PATENT DOCUMENTS

EP 1640808 3/2006
JP 50 98332 8/1975
JP 55 42380 10/1980
JP 56 135844 10/1981
JP 58 32372 7/1983
JP 58 198043 11/1983
JP 59 71057 4/1984
JP 59 184251 10/1984
JP 61 295558 12/1986
JP 1-116560 5/1989
JP 3 6567 1/1991
JP 3 63653 3/1991
JP 3 136059 6/1991
JP 4 292663 10/1992
JP 4 328168 11/1992
JP 5 42661 6/1993
JP 6 202366 7/1994
JP 6 273962 9/1994
JP 7 21646 3/1995
JP 7 271078 10/1995
JP 9 106084 4/1997
JP 09304958 A * 11/1997

(Continued)

OTHER PUBLICATIONS

English language machine translation of JP JP 09-304958 (Nov. 1997).*
English language machine translation of JP 10-069116 (Mar. 1998).*
English language machine translation of JP JP 2003-084472 (Mar. 2003).*
U.S. Appl. No. 12/612,982, filed Nov. 5, 2009, Fuchigami.
U.S. Appl. No. 12/613,023, filed Nov. 5, 2009, Fuchigami.
U.S. Appl. No. 12/300,943, filed Nov. 14, 2008, Mitsumori, et al.
U.S. Appl. No. 12/301,088, filed Nov. 17, 2008, Mitsumori, et al.
U.S. Appl. No. 12/301,109, filed Nov. 17, 2008, Mitsumori, et al.
U.S. Appl. No. 12/301,376, filed Nov. 18, 2008, Mitsumori, et al.
U.S. Appl. No. 12/300,853, filed Nov. 14, 2008, Fuchigami, et al.
U.S. Appl. No. 12/301,361, filed Nov. 18, 2008, Mitsumori, et al.
U.S. Appl. No. 13/188,743, filed Jul. 22, 2011, Fuchigami.

(Continued)

*Primary Examiner* — Christopher Rodee
(74) *Attorney, Agent, or Firm* — Oblon, Spivak, McClelland, Maier & Neustadt, L.L.P.

(57) ABSTRACT

An electrophotographic photoreceptor having high sensitivity and hardly affected by the transfer in an electrophotographic process is provided. The electrophotographic photoreceptor includes an undercoat layer containing metal oxide particles and a binder resin and a photosensitive layer disposed on the undercoat layer, wherein the metal oxide particles have a volume average particle diameter of 0.1 μm or less and a 90% cumulative particle diameter of 0.3 μm or less which are measured by a dynamic light-scattering method in a liquid of the undercoat layer dispersed in a solvent mixture of methanol and 1-propanol at a weight ratio of 7:3, and the photosensitive layer contains a binder resin having an ester bond.

8 Claims, 8 Drawing Sheets

FOREIGN PATENT DOCUMENTS

| | | | | |
|---|---|---|---|---|
| JP | 10 69116 | | | 3/1998 |
| JP | 10069116 | A | * | 3/1998 |
| JP | 10 260545 | | | 9/1998 |
| JP | 10 288845 | | | 10/1998 |
| JP | 11 202519 | | | 7/1999 |
| JP | 2000 242016 | | | 9/2000 |
| JP | 2000 258939 | | | 9/2000 |
| JP | 2002-107971 | | | 4/2002 |
| JP | 2002 107971 | | | 4/2002 |
| JP | 2003084472 | A | * | 3/2003 |
| JP | 2004-240027 | | | 8/2004 |
| JP | 2005 55888 | | | 3/2005 |
| JP | 2005 181467 | | | 7/2005 |
| JP | 2005-263732 | | | 9/2005 |
| JP | 2005 292782 | | | 10/2005 |
| JP | 2005 338445 | | | 12/2005 |
| JP | 2006 10918 | | | 1/2006 |
| JP | 2006 35167 | | | 2/2006 |
| JP | 2006-078533 | | | 3/2006 |
| JP | 2006 154753 | | | 6/2006 |
| JP | 2006-171401 | | | 6/2006 |
| JP | 2006-171703 | | | 6/2006 |
| JP | 2007-298566 | | | 11/2007 |
| WO | 96 39251 | | | 12/1996 |
| WO | 2006 054397 | | | 5/2006 |

OTHER PUBLICATIONS

Japanese Office Action mailed Jan. 10, 2012 in corresponding Japanese Application No. 2007-132294 with English Translation (7 pp.).

Japanese Office Action mailed Dec. 6, 2011 for corresponding Japanese Patent Application No. 2007-133460 with English Translation, (8 pp.).

Japanese Office Action mailed Dec. 6, 2011 for corresponding Japanese Patent Application No. 2007-133459 with English Translation, (7 pp.).

Extended European Search Report dated Jan. 30, 2012 issued in European Patent Application No. 07743653.3.

* cited by examiner

ELECTROPHOTOGRAPHIC PHOTORECEPTOR, IMAGE-FORMING APPARATUS, AND ELECTROPHOTOGRAPHIC CARTRIDGE

TECHNICAL FIELD

The present invention relates to an electrophotographic photoreceptor having an undercoat layer, an image-forming apparatus and an electrophotographic cartridge that employ the photoreceptor.

BACKGROUND ART

Electrophotographic technology has been widely applied to the field of printers, as well as the field of copiers, due to its immediacy and formation of high-quality images. Electrophotographic photoreceptors (hereinafter, optionally, referred to as "photoreceptor") lie in the core technology of electrophotography, and organic photoreceptors using organic photoconductive materials have been developed, since they have advantages such as non-pollution and ease in production in comparison with inorganic photoconductive materials.

In general, an organic photoreceptor is composed of an electroconductive support and a photosensitive layer disposed thereon. Photoreceptors are classified into a so-called single-layer photoreceptor having a single photosensitive layer (single photosensitive layer) containing a binder resin dissolving or dispersing a photoconductive material therein; and a so-called multilayered photoreceptor composed of a plurality of laminated layers (laminated photosensitive layer) including a charge-generating layer containing a charge-generating material and a charge-transporting layer containing a charge-transporting material.

In the organic photoreceptor, changes in use environment of the photoreceptor or changes in electric characteristics during repeated use may cause various defects in an image formed with the photoreceptor. In a method as one technique for solving such disadvantages, an undercoat layer containing a binder resin and titanium oxide particles is provided between an electroconductive substrate and a photosensitive layer in order to stably form a good image (for example, refer to Patent Document 1).

The layer of the organic photoreceptor is generally formed by applying and drying a coating liquid prepared by dissolving or dispersing a material in a solvent, because of its high productivity. In such a case, since the titanium oxide particles and the binder resin are incompatible with each other in the undercoat layer, the coating liquid for forming the undercoat layer is provided in the form of a dispersion of titanium oxide particles.

Such a coating liquid has generally been produced by wet-dispersing titanium oxide particles in an organic solvent using a known mechanical pulverizer, such as a ball mill, a sand grind mill, a planetary mill, or a roll mill, by spending a long period of time (for example, refer to Patent Document 1). Furthermore, it is disclosed that when titanium oxide particles are dispersed in a coating liquid for forming an undercoat layer using a dispersion medium, an electrophotographic photoreceptor that exhibits excellent characteristics in repeated charging-exposure cycles even under conditions of low temperature and low humidity can be provided using titania or zirconia as the dispersion medium (for example, refer to Patent Document 2).

The electrophotographic photoreceptor is repeatedly used in an electrophotographic process, i.e., a cycle of charging, exposure, development, transfer, cleaning, neutralization, and the like. In this occasion, since the photoreceptor is repeatedly used, it undergoes various stresses causing deterioration. Examples of such deterioration include chemical damage of the photosensitive layer caused by ozone or NOx, which are highly oxidative, generated from a charging device; and chemical and electrical deterioration caused by a flow of carriers (electric current), which is generated through image exposure, in the photosensitive layer or degradation of the photosensitive layer composition due to neutralization light or external light. In addition, the photoreceptor undergoes mechanical damage, e.g., wear of the photosensitive layer surface, scratching, and delamination, which are caused by friction with a charging roller or a charging brush, which are in contact with the electrophotographic photoreceptor for charging the photoreceptor, a cleaning blade for removing excess toner, a transfer roller for transferring an image, a developer, and paper. In particular, such deterioration occurring on the photoreceptor surface readily affects an image and directly decreases image quality, which is a major cause of limitation of the photoreceptor life.

In a general photoreceptor not having functional layers such as a surface-protecting layer, the photosensitive layer receives these stresses. The photosensitive layer is generally composed of a binder resin and a photoconductive material, and the binder resin substantially determines the strength. However, since the amount of the photoconductive material as a dopant is considerably large, the photoreceptor cannot have sufficient mechanical strength.

Furthermore, a material that can respond to a higher speed of an electrophotographic printing process is required with an increase in demand for high-performance printing. In such a case, the photoreceptor is also demanded to have a good response for shortening the time from exposure to development, in addition to high sensitivity and a long service life.

Furthermore, each layer of the electrophotographic photoreceptor is generally formed by applying a coating liquid containing, for example, a photoconductive material and a binder resin onto a support by dipping, spraying, nozzle coating, bar coating, roll coating, or blade coating. In the process for forming these layers, a coating solution is prepared and applied by a known method in which a material to be contained in a layer is dissolved in a solvent. Furthermore, in many cases, the coating solution is previously prepared and stored.

Examples of the binder resin in the photosensitive layer include vinyl polymers, such as polymethylmethacrylate, polystyrene, polyvinyl chloride, and copolymers thereof; thermoplastic resins, such as polycarbonate, polyester, polysulfone, phenoxy, epoxy, and silicone resins; and various thermosetting resins. Among such a large number of binder resins, the polycarbonate resin shows relatively excellent performance, and various kinds of polycarbonate resins have been developed and practically used (refer to Patent Documents 3 to 6).

On the other hand, it has been reported that an electrophotographic photoreceptor containing a polyarylate resin, which is commercially available under the trade name "U-polymer", as the binder resin exhibits improved sensitivity compared to that containing a polycarbonate resin (refer to Patent Document 7).

In addition, it has been reported that when a polyarylate resin including a divalent phenol component having a particular structure is used as the binder resin, the coating solution used for producing an electrophotographic photoreceptor exhibits improved mechanical strength and wear resistance, as well as improved stability (refer to Patent Documents 8 and 9).

Furthermore, in the organic photoreceptor, known hole-transporting materials, which are charge-transporting materials, are, for example, hydrazone compounds, triphenylamine compounds, benzidine compounds, stilbene compounds, and butadiene compounds. Known electron-transporting materials, which are charge-transporting materials, are, for example, diphenoquinone compounds.

The charge-transporting material is selected in consideration of characteristics demanded in the photoreceptor. Examples of the characteristics demanded in the photoreceptor include (1) electrostatic charge generated by corona discharge is high in a dark place, (2) attenuation of the charge generated by the corona discharge is low in a dark place, (3) the charge is rapidly dissipated by light irradiation, (4) the residual electric charge after the light irradiation is low, (5) an increase in the residual potential and a decrease in the initial potential are small in repeated use, and (6) changes in the electrophotographic characteristics caused by environmental changes, such as temperature and humidity, are small.

Various charge-transporting materials, such as a hydrazone compound, have been hitherto proposed for improving these characteristics (for example, refer to Patent Documents 10 to 15).

[Patent Document 1] Japanese Unexamined Patent Application Publication No. HEI 11-202519

[Patent Document 2] Japanese Unexamined Patent Application Publication No. HEI 6-273962

[Patent Document 3] Japanese Unexamined Patent Application Publication No. SHO 50-098332

[Patent Document 4] Japanese Unexamined Patent Application Publication No. SHO 59-071057

[Patent Document 5] Japanese Unexamined Patent Application Publication No. SHO 59-184251

[Patent Document 6] Japanese Unexamined Patent Application Publication No. HEI 03-063653

[Patent Document 7] Japanese Unexamined Patent Application Publication No. SHO 56-135844

[Patent Document 8] Japanese Unexamined Patent Application Publication No. HEI 03-006567

[Patent Document 9] Japanese Unexamined Patent Application Publication No. HEI 10-288845

[Patent Document 10] Japanese Patent Publication No. SHO 55-42380

[Patent Document 11] Japanese Patent Publication No. SHO 58-32372

[Patent Document 12] Japanese Unexamined Patent Application Publication No. SHO 61-295558

[Patent Document 13] Japanese Unexamined Patent Application Publication No. SHO 58-198043

[Patent Document 14] Japanese Patent Publication No. HEI 5-42661

[Patent Document 15] Japanese Patent Publication No. HEI 7-21646

DISCLOSURE OF INVENTION

Problems to be Solved by the Invention

A photoreceptor is repeatedly used in an electrophotographic process, i.e., a cycle of charging, exposure, development, transfer, cleaning, neutralization, and the like. In this occasion, since the photoreceptor is repeatedly used, it undergoes various stresses causing deterioration. Examples of such deterioration include chemical damage of the photosensitive layer caused by ozone or NOx, which are highly oxidative, generated from a charging device; chemical and electrical deterioration caused by a flow of carrier (electric current), which is generated through image exposure, in the photosensitive layer or degradation of the photosensitive layer composition due to neutralization light or external light; and mechanical damage, for example, by a charging roller or a charging brush, which are in contact with the electrophotographic photoreceptor for charging the photoreceptor, a cleaning blade for removing excessive toner, and a transfer roller for transferring an image.

In particular, as the demand for improving image quality increases, so-called transfer memory, i.e., occurrence of a change in image density as a result of repeated positive charging of the photoreceptor due to transfer, has become important (for example, refer to Japanese Unexamined Patent Application Publication Nos. 7-295268 and 2003-316035).

Recently, both of copiers and printers have been directed from monochrome to full-color systems. Full-color image-forming systems are mainly classified into a tandem system or a four-cycle system. Transfer systems onto a printing medium include, for example, a direct transfer system, a transfer drum system, an intermediate transfer system, and a multiple development-batch transfer system. Among them, in the tandem system, that is, a color image-forming apparatus that forms images corresponding to individual colors with respective image-forming units and serially transfer the images, there are many types of available recording media, the quality of full-color is high, and the full-color image can be formed at a high speed. Thus, the tandem system is an excellent image-forming process. In particular, the advantage in that a full-color image can be formed at a high speed is hardly obtained by other systems.

The tandem system, which achieves high speed printing, forms individual color images with the corresponding image-forming units and serially transfers the images. Therefore, in the tandem system, the toner image transferred on a transfer medium (intermediate transfer medium or recording material) becomes thick according to the number of the image-forming units used, and, in many cases, a higher transfer voltage is necessary for transferring the toner layer formed on an electrophotographic photoreceptor. As a result, the charge is more significantly injected into the photosensitive layer when the opposite polarity is applied, and the contrast on the image may become clearer in some portions.

On the other hand, high sensitivity is demanded as one characteristic of the electrophotographic photoreceptor in association with a recent speed-up of the electrophotographic process, and therefore an optimization of a charge-generating material is demanded. In addition, as the entire photosensitive layer, it is demanded to achieve a photoreceptor that shows high sensitivity and is hardly affected by the aforementioned transfer.

The present invention has been made in view of the above-described problems, and it is an object to provide an electrophotographic photoreceptor that is hardly affected by the transfer in an electrophotographic process, an image-forming apparatus and an electrophotographic cartridge that include the photoreceptor.

The present inventors have conducted intensive studies for solving the aforementioned problems and, as a result, have found the fact that an electrophotographic photoreceptor showing a high sensitivity and being hardly affected by transfer in the electrophotographic process can be obtained, without adversely affecting the photoreceptor and other various characteristics thereof, by a combination of a specific undercoat layer and a photosensitive layer containing a specific binder resin for the electrophotographic photoreceptor.

Accordingly, an aspect of the present invention provides an electrophotographic photoreceptor including an undercoat layer containing metal oxide particles and a binder resin on an electroconductive support, and a photosensitive layer disposed on the undercoat layer, wherein the metal oxide particles have a volume average particle diameter of 0.1 μm or less and a 90% cumulative particle diameter of 0.3 μm or less which are measured by a dynamic light-scattering method in a liquid of the undercoat layer dispersed in a solvent mixture of methanol and 1-propanol at a weight ratio of 7:3; and the photosensitive layer contains a binder resin having an ester bond.

The aforementioned binder resin having an ester bond is preferably polycarbonate or polyester.

Furthermore, the polyester is preferably polyarylate.

Furthermore, the binder resin having an ester bond is preferably produced by interfacial polymerization.

Furthermore, the photosensitive layer preferably contains a compound represented by the following Formula (I):

[Chemical Formula 1]

(I)

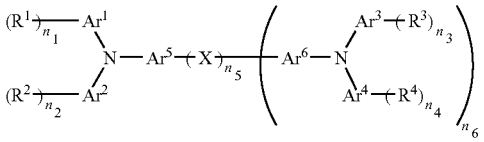

(In Formula (I), $Ar^1$ to $Ar^6$ each independently represents an aromatic residue that may have a substituent or an aliphatic residue that may have a substituent; X represents an organic residue; $R^1$ to $R^4$ each independently represents an organic group having a hydrazone structure; $n_1$ represents 1 or 2; and $n_2$ to $n_6$ each represents an integer of 0 to 2).

Furthermore, in the aforementioned Formula (I), all of $Ar^1$ to $Ar^6$ are preferably benzene residues.

Furthermore, in the aforementioned Formula (I), $R^1$ to $R^4$ are preferably represented by the following Formula (II):

[Chemical Formula 2]

(II)

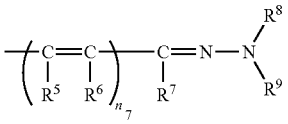

(In Formula (II), $R^5$ to $R^9$ each independently represents a hydrogen atom or an alkyl group or aryl group that may have a substituent; and $n_7$ denotes an integer of 0 to 5).

Another aspect of the present invention lies in an image-forming apparatus including the electrophotographic photoreceptor, charging means for charging the electrophotographic photoreceptor, image exposing means for forming an electrostatic latent image by conducting image exposure to the charged electrophotographic photoreceptor, development means for developing the electrostatic latent image with toner, and transfer means for transferring the toner to a transfer object.

Furthermore, another aspect of the present invention lies in an electrophotographic cartridge including the electrophotographic photoreceptor and at least one selected from charging means for charging the electrophotographic photoreceptor, image exposing means for forming an electrostatic latent image by conducting image exposure to the charged electrophotographic photoreceptor, development means for developing the electrostatic latent image with toner, transfer means for transferring the toner to a transfer object, fixing means for fixing the toner transferred to the transfer object, and cleaning means for recovering the toner adhering to the electrophotographic photoreceptor.

ADVANTAGES OF THE INVENTION

The present invention can provide an electrophotographic photoreceptor having a high sensitivity and being hardly affected by the transfer in an electrophotographic process, and an image-forming apparatus and an electrophotographic cartridge that include the photoreceptor.

BRIEF DESCRIPTION OF DRAWINGS

FIG. 5(A) is a longitudinal cross-sectional view of the wet agitating mill, and FIG. 5(B) is a horizontal cross-sectional view of the wet agitating mill;

REFERENCE NUMERALS

Figure 1:
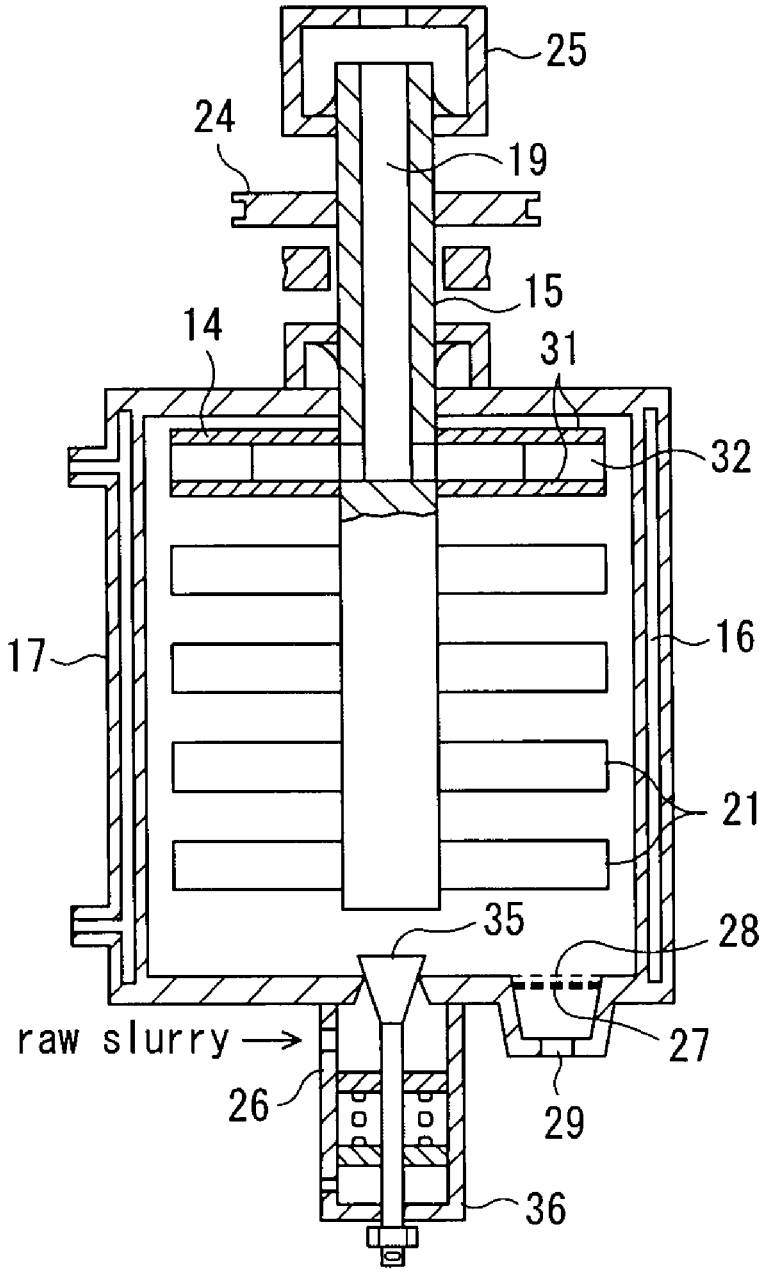
FIG. 1 is a longitudinal cross-sectional view schematically illustrating a structure of a wet agitating ball mill according to an embodiment of the present invention.

1 photoreceptor
2 charging device (charging roller)
3 exposure device
4 development device
5 transfer device
6 cleaning device
7 fixing device
14 separator
15 shaft
16 jacket
17 stator
19 discharging path
21 rotor
24 pulley
25 rotary joint

26 raw slurry supplying port
27 screen support
28 screen
29 product slurry retrieval port
31 disk
32 blade
35 valve element
41 development bath
42 agitator
43 supply roller
44 development roller
45 regulation member
71 upper fixing member (fixing roller)
72 lower fixing member (fixing roller)
73 heating device
100 sealing
101 mating ring
102 spring
103 fitting groove
104 O-ring
105 shaft
106 separator
107 spacer
108 rotor
109 stopper
110 screw
111 discharging path
112 pore
113 spacer
114 blade fitting groove
115 disk
116 blade
201 pulverizer (medium agitating mill)
202 container
203 lid member
204 bottom member
205 pulverizing chamber
206 agitating shaft
207 agitating member
212 hollow portion
213 slurry outlet
214 screen
215 inlet for medium circulation
216 slit
217 outlet for medium circulation
218 slurry outlet tube
T toner
P transfer material (paper, medium)

Best Modes for Carrying Out The Invention

Embodiments of the present invention will now be described in detail, but the description of components below is merely exemplary embodiments of the present invention. Accordingly, various modifications can be made within the scope of the present invention.

An electrophotographic photoreceptor according to the present invention includes an undercoat layer containing metal oxide particles and a binder resin on an electroconductive support, and a photosensitive layer disposed on the undercoat layer. Furthermore, in the electrophotographic photoreceptor of the present invention, the metal oxide particles contained in the undercoat layer have a predetermined particle diameter distribution, and the photosensitive layer contains a binder resin having an ester bond (hereinafter, optionally, referred to as "ester-containing resin").

[I. Electroconductive Support]

Any electroconductive support can be used without particular limitation, and mainly formed of metal materials such as aluminum, aluminum alloys, stainless steel, copper, and nickel; resin materials provided with conductivity by being mixed with an electroconductive powder, such as a metal, carbon, or tin oxide powder; and resins, glass, and paper on which the surfaces are coated with an electroconductive material, such as aluminum, nickel, or ITO (indium oxide-tin oxide alloy), by vapor deposition or coating.

In addition, the shape of the electroconductive support may be, for example, a drum, a sheet, or a belt. Furthermore, an electroconductive material having an appropriate resistance value may be coated on an electroconductive support of a metal material for controlling conductivity or surface properties or for covering defect.

Furthermore, in the case of the electroconductive support composed of a metal material such as an aluminum alloy, the metal material may be used after anodization treatment. If the anodization treatment is performed, it is desirable to conduct pore sealing treatment by a known method.

For example, an anodic oxide coating is formed by anodization in an acidic bath of, for example, chromic acid, sulfuric acid, oxalic acid, boric acid, or sulfamic acid. Among these acidic baths, anodization in sulfuric acid gives particularly effective result. In the case of the anodization in sulfuric acid, preferred conditions are a sulfuric acid concentration of 100 to 300 g/L (gram/liter, hereinafter, optionally, liter is abbreviated to "L"), a dissolved aluminum concentration of 2 to 15 g/L, a liquid temperature of 15 to 30° C., a bath voltage of 10 to 20 V, and a current density of 0.5 to 2 A/dm$^2$, but the conditions are not limited thereto.

It is preferable to conduct pore sealing to the resulting anodic oxide coating. The pore sealing may be conducted by a known method and is preferably performed by, for example, low-temperature pore sealing treatment, dipping in an aqueous solution containing nickel fluoride as a main component, or high-temperature pore sealing treatment, dipping in an aqueous solution containing nickel acetate as a main component.

The concentration of the nickel fluoride aqueous solution used in the low-temperature pore sealing treatment may be appropriately determined, but the concentration in the range of 3 to 6 g/L can give a better result. Furthermore, in order to smoothly carry out the pore sealing treatment, the treatment temperature range is usually 25° C. or higher and preferably 30° C. or higher and usually 40° C. or lower and preferably 35° C. or lower. In addition, from the same viewpoint, the pH range of the nickel fluoride aqueous solution is usually 4.5 or higher and preferably 5.5 or higher and usually 6.5 or lower and preferably 6.0 or lower. Examples of a pH regulator include oxalic acid, boric acid, formic acid, acetic acid, sodium hydroxide, sodium acetate, and aqueous ammonia. The treating time is preferably in the range of one to three minutes per micrometer of coating thickness. Furthermore, the nickel fluoride aqueous solution may contain, for example, cobalt fluoride, cobalt acetate, nickel sulfate, or a surfactant in order to further improve the coating physical properties. Then, washing with water and drying complete the low-temperature pore sealing treatment.

On the other hand, examples of the pore sealing agent for the high-temperature pore sealing treatment can include a metal salt aqueous solutions of nickel acetate, cobalt acetate, lead acetate, nickel-cobalt acetate, and barium nitrate, and a nickel acetate aqueous solution is particularly preferred. The nickel acetate aqueous solution is preferably used in the concentration range of 5 to 20 g/L. The treatment temperature range is usually 80° C. or higher and preferably 90° C. or higher and usually 100° C. or lower and preferably 98° C. or lower. In addition, the pH of the nickel acetate aqueous solution is preferably in the range of 5.0 to 6.0. Here, examples of the pH regulator can include aqueous ammonia and sodium acetate. The treating time is usually 10 minutes or more, preferably 15 minutes or more, and more preferably 20 minutes or more. Furthermore, the nickel acetate aqueous solution may also contain, for example, sodium acetate, organic carboxylic acid, or an anionic or nonionic surfactant in order to improve physical properties of the coating. In addition, high-temperature water or high-temperature water vapor substantially not containing salts may be used for the treatment. Then, washing with water and drying complete the high-temperature pore sealing treatment.

When the anodic oxide coating has a large average thickness, severer pore sealing conditions may be required for treatment in a higher concentration of pore sealing solution at higher temperature for a longer period of time. In such a case, the productivity is decreased, and also surface defects, such as stains, blot, or blooming, may tend to occur on the coating surface. From these viewpoints, the anodic oxide coating is preferably formed so as to have an average thickness of usually 20 μm or less and particularly 7 μm or less.

The surface of the electroconductive support may be smooth or may be roughened by specific milling or by grinding treatment. In addition, the surface may be roughened by mixing particles having an appropriate particle diameter to the material constituting the support. Furthermore, a drawing tube can be directly used, without conducting milling treatment, for cost reduction. In particular, in the case of use of an aluminum support without milling treatment, such as drawing, impacting, or die processing, blot or adherents such as foreign materials present on the surface or small scratches are eliminated by the treatment to give a uniform and clean support, and it is therefore preferred.

[II. Undercoat Layer]

The undercoat layer contains metal oxide particles and a binder resin. In addition, the undercoat layer may contain other components that do not significantly impair the effects of the present invention.

The undercoat layer according to the present invention is provided between the electroconductive support and the photosensitive layer and has at least one function selected from the group including an improvement in adhesion between the electroconductive support and the photosensitive layer, covering of blot and scratches of the electroconductive support, prevention of carrier injection due to impurities or non-uniform surface properties, an improvement in uniformity of electric characteristics, prevention of a decrease in surface potential during repeated use, and prevention of a change in local surface potential, which causes image defects. The undercoat layer is not essential for achieving photoelectric characteristics.

[II-1. Metal Oxide Particles]

[II-1-1. Kind of Metal Oxide Particles]

Any metal oxide particle that can be used in an electrophotographic photoreceptor can be used as the metal oxide particles according to the present invention.

Examples of metal oxides that form the metal oxide particles include metal oxides containing single metal elements, such as titanium oxide, aluminum oxide, silicon oxide, zirconium oxide, zinc oxide, and iron oxide; and metal oxides containing multiple metal elements, such as calcium titanate, strontium titanate, and barium titanate. In particular, metal oxide particles composed of a metal oxide having a band gap of 2 to 4 eV are preferred. When the band gap is too small, carrier injection from the electroconductive support easily occurs, resulting in image defects such as black spots and color spots. When the band gap is too large, charge transfer is precluded by electron trapping, resulting in deterioration of electronic characteristics.

Furthermore, the metal oxide particles may be composed of one kind of particles or any combination of different kinds of particles in any ratio. In addition, the metal oxide particles may be composed of one metal oxide or may be any combination of two or more metal oxides in any ratio.

The metal oxide forming the metal oxide particles is preferably titanium oxide, aluminum oxide, silicon oxide, or zinc oxide, more preferably titanium oxide or aluminum oxide, and most preferably titanium oxide.

Furthermore, the metal oxide particles may have any crystal form that does not significantly impair the effects of the present invention. For example, the crystal form of the metal oxide particles composed of titanium oxide (i.e., titanium oxide particles) is not limited and may be any of rutile, anatase, brookite, or amorphous. In addition, these crystal forms of the titanium oxide particles may be present together.

Furthermore, the metal oxide particles may be subjected to various kinds of surface treatment, for example, treatment with a treating agent such as an inorganic material, e.g., tin oxide, aluminum oxide, antimony oxide, zirconium oxide, or silicon oxide or an organic material, e.g., stearic acid, a polyol, or an organic silicon compound.

In particular, when titanium oxide particles are used as the metal oxide particles, surface treatment is preferably conducted with an organic silicon compound. Examples of the organic silicon compound include silicone oils such as dimethylpolysiloxane and methylhydrogenpolysiloxane; organosilanes such as methyldimethoxysilane and diphenyldimethoxysilane; silazanes such as hexamethyldisilazane; and silane coupling agents such as vinyltrimethoxysilane, γ-mercaptopropyltrimethoxysilane, and γ-aminopropyltriethoxysilane.

Furthermore, the metal oxide particles are preferably treated with a silane treating agent represented by the following Formula (i). This silane treating agent has high reactivity with metal oxide particles and is a favorable treating agent.

[Chemical Formula 3]

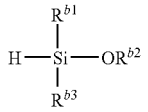

(i)

In the aforementioned Formula (I), $R^{b1}$ and $R^{b2}$ each independently represent an alkyl group. The carbon numbers of $R^{b1}$ and $R^{b2}$ are not limited, but are each usually one or more and usually 18 or less, preferably 10 or less, more preferably 6 or less, and most preferably 3 or less. This has an advantage of improved reactivity with metal oxide particles. A larger number of carbon atoms may cause a decrease in the reactivity with metal oxide particles or a decrease in the dispersion stability, in a coating liquid, of the metal oxide particles after treatment. Preferable examples of $R^{b1}$ and $R^{b2}$ include a methyl group, an ethyl group, and a propyl group, and, in particular, a methyl group and an ethyl group are more preferred.

In addition, in Formula (I), $R^{b3}$ represents an alkyl group or an alkoxy group. The carbon number of $R^{b3}$ is not limited, but is usually one or more and usually 18 or less, preferably 10 or less, more preferably 6 or less, and most preferably 3 or less.

This has an advantage of improved reactivity with metal oxide particles. A larger number of carbon atoms may cause a decrease in the reactivity with metal oxide particles or a decrease in the dispersion stability, in a coating liquid, of the metal oxide particles after treatment. Preferable examples of $R^{b3}$ include a methyl group, an ethyl group, a methoxy group, and an ethoxy group.

Larger carbon numbers of $R^{b1}$ to $R^{b3}$ may cause less reactivity with metal oxide particles, or lower dispersion stability of the metal oxide particles, in a coating liquid for forming an undercoat layer, after treatment.

The outermost surfaces of these surface-treated metal oxide particles are usually treated with a treating agent described above. In such a case, the above-described surface treatment may be one type of treatment or may be any combination of two or more types of treatment. For example, before the surface treatment with a silane treating agent represented by Formula (i), treatment with a treating agent, such as aluminum oxide, silicon oxide, or zirconium oxide, may be conducted. Furthermore, any combination of metal oxide particles subjected to different types of surface treatment in any ratio may be employed.

Examples of commercial products of the metal oxide particles according to the present invention are shown below, but the metal oxide particles according to the present invention are not limited to the products shown below.

Commercially available examples of the titanium oxide particles include ultrafine titanium oxide particles without surface treatment, "TTO-55 (N)"; ultrafine titanium oxide particles coated with $Al_2O_3$, "TTO-55 (A)" and "TTO-55 (B)"; ultrafine titanium oxide particles surface-treated with stearic acid, "TTO-55 (C)"; ultrafine titanium oxide particles surface-treated with $Al_2O_3$ and organosiloxane, "TTO-55 (S)"; high-purity titanium oxide "CR-EL"; titanium oxide produced by a sulfate process, "R-550", "R-580", "R-630", "R-670", "R-680", "R-780", "A-100", "A-220", and "W-10"; titanium oxide produced by a chlorine process, "CR-50", "CR-58", "CR-60", "CR-60-2", and "CR-67"; and electroconductive titanium oxide, "SN-100P", "SN-100D", and "ET-300 W" (these are manufactured by Ishihara Industry Co., Ltd.); titanium oxide such as "R-60", "A-110", and "A-150"; titanium oxide coated with $Al_2O_3$, "SR-1", "R-GL", "R-5N", "R-5N-2", "R-52N", "RK-1", and "A-SP"; titanium oxide coated with $SiO_2$ and $Al_2O_3$, "R-GX" and "R-7E"; titanium oxide coated with ZnO, $SiO_2$, and $Al_2O_3$, "R-650"; titanium oxide coated with $ZrO_2$ and $Al_2O_3$, "R-61N" (these are manufactured by Sakai Chemical Industry Co., Ltd.); and titanium oxide surface-treated with $SiO_2$ and $Al_2O_3$, "TR-700"; titanium oxide surface-treated with ZnO, $SiO_2$, and $Al_2O_3$, "TR-840" and "TA-500"; titanium oxide without surface treatment, "TA-100", "TA-200", and "TA-300"; titanium oxide surface-treated with $Al_2O_3$, "TA-400" (these are manufactured by Fuji Titanium Industry Co., Ltd.); titanium oxide without surface treatment, "MT-150 W" and "MT-500B"; titanium oxide surface-treated with $SiO_2$ and $Al_2O_3$, "MT-100SA" and "MT-500SA"; and titanium oxide surface-treated with $SiO_2$, $Al_2O_3$ and organosiloxane, "MT-100SAS" and "MT-500SAS" (these are manufactured by Tayca Corp.).

Commercially available examples of the aluminum oxide particles include "Aluminium Oxide C" (manufactured by Nippon Aerosil Co., Ltd.).

Commercially available examples of the silicon oxide particles include "200CF" and "R972" (manufactured by Nippon Aerosil Co., Ltd.) and "KEP-30" (manufactured by Nippon Shokubai Co., Ltd.).

Commercially available examples of the tin oxide particles include "SN-100P" (manufactured by Ishihara Industry Co., Ltd.).

Commercially available examples of the zinc oxide particles include "MZ-305S" (manufactured by Tayca Corp.).

[II-1-2. Physical Properties of Metal Oxide Particles]

The metal oxide particles in the undercoat layer according to the present invention are desirably present in the form of primary particles. However, in general, it is rare, and, in many cases, the metal oxide particles are aggregated into secondary particles or are present as a mixture of the both. Therefore, the state of the particle size distribution of the metal oxide particles is significantly important in the undercoat layer.

The metal oxide particles according to the present invention satisfy the following requirements for the particle diameter distribution. That is, the metal oxide particles have a volume average particle diameter Mv of 0.1 μm or less and a 90% cumulative particle diameter D90 of 0.3 μm or less which are measured by a dynamic light-scattering method in a liquid of the undercoat layer of the present invention dispersed in a solvent mixture of methanol and 1-propanol at a weight ratio of 7:3 (hereinafter, optionally, referred to as "dispersion for undercoat layer measurement").

This point will be described in detail below.

[Regarding Volume Average Particle Diameter Mv of Metal Oxide Particles]

The metal oxide particles according to the present invention have a volume average particle diameter Mv of 0.1 μm or less, preferably 95 nm or less, and more preferably 90 nm or less which is measured by the dynamic light-scattering method in a dispersion for undercoat layer measurement. Controlling the volume average particle diameter Mv of the metal oxide particles to such a range (0.1 μm or less) can suppress precipitation and a change in viscosity in the dispersion for undercoat layer measurement. As a result, the thickness and surface characteristics of the undercoat layer can become uniform. On the other hand, a larger volume average particle diameter Mv of the metal oxide particles (in the case of larger than 0.1 μm) accelerates precipitation and a change in viscosity in the dispersion for undercoat layer measurement. As a result, the thickness and surface characteristics of the undercoat layer become uneven, thereby the quality of the overlying layers (such as a charge-generating layer) may be adversely affected. In conclusion, the electrophotographic photoreceptor of the present invention, which satisfies the aforementioned range, is stabilized in repeated exposure-charge characteristics under low temperature and low humidity, and the obtained image does not have image defects such as black spots and color spots.

Furthermore, the volume average particle diameter Mv has no lower limit, but is generally 5 nm or more, preferably 10 nm or more, and more preferably 20 nm or more. When the volume average particle diameter Mv is excessively low, the metal oxide particles may be agglomerated. In such a case, the storage stability of the coating liquid for forming the undercoat layer may be impaired.

[Regarding 90% Cumulative Particle Diameter D90 of Metal Oxide Particles]

The metal oxide particles according to the present invention have a 90% cumulative particle diameter D90 of 0.3 μm or less, preferably 0.25 μm or less, more preferably 0.2 μm or less, and most preferably 0.15 μm or less which is measured by the dynamic light-scattering method in a dispersion for undercoat layer measurement. In addition, the 90% cumulative particle diameter D90 has no lower limit, but is generally 10 nm or more, preferably 20 nm or more, and more preferably 50 nm or more. In conventional electrophotographic photoreceptors, the undercoat layer contains huge metal oxide particle agglomerates that are formed by agglomeration of the metal oxide particles and extend across the undercoat layer from one surface to the other. Such huge metal oxide particle agglomerates may cause defect in an image formed. Furthermore, in the case using contact-type charging means, charge may migrate from the charged photosensitive layer to an electroconductive support through the metal oxide particles, and thereby the charging cannot be properly achieved. However, in the electrophotographic photoreceptor of the present invention, by controlling the 90% cumulative particle diameter D90 into the aforementioned range (0.3 μm or less), the number of metal oxide particles having a large size such as to cause the aforementioned defect is significantly reduced. Therefore, the thickness and surface characteristics of the undercoat layer are uniformalized. As a result, in the electrophotographic photoreceptor of the present invention, occurrence of defect and improper charging can be prevented, and thereby a high-quality image can be formed.

[Regarding Ratio Mv/Mp of Volume Average Particle Diameter Mv to Number Average Diameter Mp]

Furthermore, the metal oxide particles according to the present invention preferably satisfy the following Expression (1) relating to the ratio Mv/Mp of a volume average particle diameter Mv to a number average diameter Mp measured by the dynamic light-scattering method in a coating liquid for undercoat layer measurement.

$$1.10 \leqq Mv/Mp \leqq 1.40 \quad (1)$$

Particularly, in the metal oxide particles according to the present invention, the ratio Mv/Mp of a volume average particle diameter Mv to a number average diameter Mp is usually 1.10 or more and preferably 1.20 or more and usually 1.40 or less and preferably 1.35 or less. Therefore, the metal oxide particles according to the present invention usually satisfy the following Expression (1) and preferably satisfy the following Expression (3).

$$1.10 \leqq Mv/Mp \leqq 1.40 \quad (1)$$

$$1.20 \leqq Mv/Mp \leqq 1.35 \quad (3)$$

If the metal oxide particles according to the present invention are spherical in shape and present in the form of primary particles, the ratio Mv/Mp is 1.0, which is ideal. However, such metal oxide particles having a ratio Mv/Mp of 1.0 cannot be practically obtained. The present inventors have found the fact that as long as the metal oxide particles aggregate into a substantially spherical shape, specifically, as long as the range of Expression (1) is satisfied, a coating liquid for forming the undercoat layer shows reduced gelation tendency and a small change in viscosity and therefore can be stored for a long period of time, even if the metal oxide particles aggregate, and that the thickness and surface characteristics of the formed undercoat layer can be uniform. On the other hand, when the metal oxide particles in a coating liquid for forming an undercoat layer do not satisfy the aforementioned Expression (1), gelation and a change in viscosity of the liquid are noticeable. As a result, the thickness and surface characteristics of the formed undercoat layer become uneven. This may also adversely affect the quality of the overlying layers (such as a charge-generating layer). Furthermore, according to the investigation by the present inventors, when the aforementioned range is not satisfied, the exposure-charging repeating characteristics under low temperature and low humidity are unstable as a photoreceptor, and the resulting image may have image defects such as black spots and color spots.

Furthermore, it is more preferable that the metal oxide particles according to the present invention have a volume average particle diameter Mv of 0.1 μm or less and that the ratio Mv/Mp satisfy Expression (1).

[Regarding Volume Particle Size Distribution Width Index SD]

In addition, in the metal oxide particles according to the present invention, the volume particle size distribution width index SD measured by the dynamic light-scattering method in a coating liquid for undercoat layer measurement preferably satisfy the following Expression (2):

$$0.010 \leqq SD \leqq 0.040 \quad (2)$$

(where SD=(D84−D16)/2, D84 represents the particle diameter (μm) at a point of 84% in the cumulative volume particle size distribution curve, and D16 represents the particle diameter (μm) at a point of 16% in the cumulative volume particle size distribution curve; and the cumulation of particle size distribution is conducted from the smaller particle size side).

Furthermore, in the metal oxide particles according to the present invention, the volume particle size distribution width index SD is usually 0.010 or more and preferably 0.020 or more and usually 0.040 or less and preferably 0.030 or less. Therefore, the metal oxide particles according to the present invention usually satisfy the following Expression (2) and preferably satisfy the following Expression (4):

$$0.010 \leqq SD \leqq 0.040 \quad (2)$$

$$0.020 \leqq SD \leqq 0.030 \quad (4)$$

The volume particle size distribution width index SD shows the sharpness of particle size distribution after aggregation of the metal oxide particles. If the metal oxide particles according to the present invention are present in the form of a monodispersed state with a single particle diameter, the volume particle size distribution width index SD is zero, which is ideal. However, actually, it is very difficult to practically obtain such an ideal state. The present inventors have discovered the fact that as long as the aggregation state is appropriately narrow, specifically, as long as the range of the Expression (2) is satisfied, a coating liquid for forming the undercoat layer exhibits suppressed gelation tendency and a small change in viscosity and therefore can be stored for a long period of time, even if the metal oxide particles aggregate, and that the thickness and surface characteristics of the formed undercoat layer can be uniform. On the other hand, when the metal oxide particles in a coating liquid for undercoat layer measurement do not satisfy Expression (2), for example, when D84 is too large, deposition of coarse particles is observed in the coating liquid for forming the undercoat layer; while, for example, when D16 is too small, agglomeration of fine particles is observed in the liquid. Thus, the gelation and a change in viscosity of the liquid are noticeable and, as a result, the thickness and surface characteristics of the formed undercoat layer are uneven. This may also adversely affect the quality of the overlying layers (such as a charge-generating layer).

Furthermore, it is more preferable that the metal oxide particles according to the present invention have a volume average particle diameter Mv of 0.1 μm or less and that the volume particle size distribution width index SD satisfy Expression (2).

[Methods for Measuring Volume Average Particle Diameter Mv, 90% Cumulative Particle Diameter D90, Number Average Diameter Mp, and Volume Particle Size Distribution Width Index SD]

It is very difficult to directly evaluate particle size distribution of metal oxide particles in an undercoat layer, but particle size distribution of metal oxide particles in an undercoat layer can be determined by dispersing the undercoat layer in a specific solvent and evaluating the dispersion.

The volume average particle diameter Mv, 90% cumulative particle diameter D90, number average diameter Mp, and volume particle size distribution width index SD of the metal oxide particles according to the present invention are determined by preparing a dispersion for undercoat layer measurement by dispersing the undercoat layer in a solvent mixture of methanol and 1-propanol at a weight ratio of 7:3 (this functions as a dispersion medium in the measurement of the particle size); and measuring particle size distribution of the metal oxide particles in the dispersion for undercoat layer by a dynamic light-scattering method. On this occasion, values determined by the dynamic light-scattering method are used regardless of the form of the metal oxide particles.

In the dynamic light-scattering method, the particle size distribution is determined as follows: Finely dispersed particles are irradiated with laser light to detect the scattering (Doppler shift) of light beams having different phases depending on the velocity of the Brownian motion of these particles. Values of the volume average particle diameter Mv, 90% cumulative particle diameter D90, number average diameter Mp, particle diameter at 84% cumulative volume particle size distribution D84, and particle diameter at 16% cumulative volume particle size distribution D16 in the dispersion for undercoat layer measurement are those when the metal oxide particles are stably dispersed in the dispersion for undercoat layer measurement and do not mean particle diameters in the formed undercoat layer.

Specifically, actual measurements of the volume average particle diameter Mv, 90% cumulative particle diameter D90, particle diameter at 84% cumulative volume particle size distribution D84, and particle diameter at 16% cumulative volume particle size distribution D16 are conducted with a dynamic light-scattering particle size analyzer (manufactured by Nikkiso Co., Ltd., MICROTRAC UPA model: 9340-UPA, hereinafter abbreviated to UPA) under the conditions shown below. The actual measurement is conducted according to the instruction manual of the particle size analyzer (Nikkiso Co., Ltd., Document No. T15-490A00, revision No. E).

Setting of the Dynamic Light-Scattering Particle Size Analyzer

Upper measurement limit: 5.9978 μm
Lower measurement limit: 0.0035 μm
Number of channels: 44
Measurement time: 300 sec
Particle transparency: absorptive
Particle refractive index: N/A (not available)
Particle shape: non-spherical
Density: 4.20 g/cm$^3$ (*)
Dispersion medium: methanol/1-propanol=7/3
Refractive index of dispersion medium: 1.35

(*) This density value is applicable to titanium dioxide particles, and, for other particles, values described in the instruction manual are used.

The amount of a solvent mixture used, as a dispersion medium, of methanol and 1-propanol (weight ratio: methanol/1-propanol=7/3, refractive index=1.35) is adjusted so that the sample concentration index (signal level) of the dispersion for undercoat layer measurement ranges from 0.6 to 0.8.

The particle size by dynamic light-scattering is measured at 25° C.

The volume average particle diameter Mv and the 90% cumulative particle diameter D90 of the metal oxide particles according to the present invention are defined as follows: When the particle size distribution is measured by the dynamic light-scattering method describe above, and when the cumulative curve of the volume particle size distribution is plotted from the minimum particle size by the dynamic light-scattering method where the total volume of the metal oxide particles is 100%, the particle size at a point of 50% in the cumulative curve is defined as the volume average particle diameter Mv (median diameter), and the particle size at a point of 90% in the cumulative curve is defined as the 90% cumulative particle diameter D90. The cumulation is conducted from the minimum particle diameter.

The particle diameter at the 84% cumulative volume particle size distribution D84 and the particle diameter at the 16% cumulative volume particle size distribution D16 for determining the number average diameter Mp and the volume particle size distribution width index SD can be similarly obtained by direct measurement of the particle diameters of the metal oxide particles in a coating liquid for undercoat layer measurement by the dynamic light-scattering method.

The number average diameter Mp can be calculated by the following Expression (B):

[Expression 1]

$$Mp = \frac{\sum (n \cdot d)}{\sum (n)} \qquad \text{Expression (B)}$$

In Expression (B), n represents the number of particles, v represents the volume of particles, and d represents the diameter of particles.

The volume particle size distribution width index SD is defined as follows: when the particle diameter (μm) at a point of 84% in a cumulative curve (cumulative volume particle size distribution curve) of volume particle size distribution cumulated from the minimum particle diameter is defined as D84, and, similarly, the particle diameter (μm) at a point of 16% in a cumulative curve is defined as D16, the volume particle size distribution width index SD is represented by the following Expression (C):

$$SD(\mu m)=(D84-D16)/2 \qquad \text{(C).}$$

[Other Physical Properties]

The metal oxide particles according to the present invention may have any average primary particle diameter that does not significantly impair the effects of the present invention. However, the average primary particle diameter of the metal oxide particles according to the present invention is usually 1 nm or more and preferably 5 nm or more and usually 500 nm or less, preferably 100 nm or less, more preferably 70 nm or less, and most preferably 50 nm or less.

Furthermore, this average primary particle diameter can be determined based on the arithmetic mean value of the diameters of particles that are directly observed by a transmission electron microscope (hereinafter, optionally, referred to as "TEM").

Also, the refractive index of the metal oxide particles according to the present invention does not have any limitation, and those that can be used in electrophotographic photoreceptors can be used. The refractive index of the metal oxide particles according to the present invention is usually 1.3 or more, preferably 1.4 or more, and most preferably 1.5 or more and usually 3.0 or less, preferably 2.9 or less, and most preferably 2.8 or less.

In addition, as the refractive index of metal oxide particles, reference values described in various publications can be used. For example, they are shown in the following Table 1 according to Filler Katsuyo Jiten (Filler Utilization Dictionary, edited by Filler Society of Japan, Taiseisha LTD., 1994).

TABLE 1

| | Refractive index |
|---|---|
| Titanium oxide (rutile) | 2.76 |
| Lead titanate | 2.70 |
| Potassium titanate | 2.68 |
| Titanium oxide (anatase) | 2.52 |
| Zirconium oxide | 2.40 |
| Zinc sulfide | 2.37 to 2.43 |
| Zinc oxide | 2.01 to 2.03 |
| Magnesium oxide | 1.64 to 1.74 |
| Barium sulfate (precipitated) | 1.65 |
| Calcium sulfate | 1.57 to 1.61 |
| Aluminum oxide | 1.56 |
| Magnesium hydroxide | 1.54 |
| Calcium carbonate | 1.57 to 1.60 |
| Quartz glass | 1.46 |

The undercoat layer of the present invention can contain the metal oxide particles and the binder resin at any ratio that does not significantly impair the effects of the present invention. However, in the undercoat layer of the present invention, the amount of the metal oxide particles to one part by weight of the binder resin is usually 0.5 part by weight or more, preferably 0.6 part by weight or more, more preferably 0.7 part by weight or more, and most preferably 1.0 part by weight or more and usually 4 parts by weight or less, preferably 3.9 parts by weight or less, more preferably 3.8 parts by weight or less, and most preferably 3.5 parts by weight or less. A smaller ratio of the metal oxide particles to the binder resin may cause unsatisfactory electric characteristics of the resulting electrophotographic photoreceptor, in particular, an increase in the residual potential. A larger ratio may cause noticeable image defects, such as black spots and color spots in an image formed with the electrophotographic photoreceptor.

[II-2. Binder Resin]

The undercoat layer of the present invention can contain any binder resin that does not significantly impair the effects of the present invention. In general, a binder resin that can be used is soluble in a solvent such as an organic solvent, and is substantially insoluble in a solvent such as an organic solvent that is used in a coating liquid for forming a photosensitive layer.

Examples of such a binder resin include phenoxy resins, epoxy resins, and other resins, e.g., polyvinylpyrrolidone, polyvinyl alcohol, casein, polyacrylic acid, celluloses, gelatin, starch, polyurethane, polyimide, and polyamide. These resins may be used alone or in the cured form with a curing agent. Furthermore, curing resins such as a thermosetting resin and a photosetting resin are preferred from the viewpoints of favorable coating characteristics, favorable image characteristics, and favorable environmental characteristics. In particular, polyamide resins such as alcohol-soluble copolymerized polyamides and modified polyamides exhibit favorable dispersibility and coating characteristics and are preferred.

Examples of the polyamide resin include so-called copolymerized nylons, such as copolymers of 6-nylon, 66-nylon, 610-nylon, 11-nylon, and 12-nylon; and alcohol-soluble nylon resins, such as chemically modified nylons, e.g., N-alkoxymethyl-modified nylon and N-alkoxyethyl-modified nylon. Examples of commercially available products include "CM4000" and "CM8000" (these are manufactured by Toray Industries, Inc.), "F-30K", "MF-30", and "EF-30T" (these are manufactured by Nagase Chemtex Corporation).

Among these polyamide resins, particularly preferred is a copolymerized polyamide resin containing a diamine component corresponding to a diamine represented by the following Formula (ii). (Hereinafter, the diamine component is optionally referred to as "diamine component corresponding to Formula (ii).")

[Chemical Formula 4]

(ii)

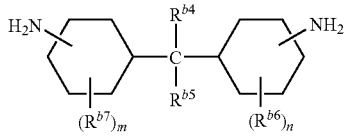

In Formula (ii), each of $R^{b4}$ to $R^{b7}$ represents a hydrogen atom or an organic substituent, and m and n each independently represents an integer of from 0 to 4. When a plurality of the substituents are present, these substituents may be the same or different from each other.

Preferable examples of the organic substituent represented by $R^{b4}$ to $R^{b7}$ include a hydrocarbon group that may contain a hetero atom. Among them, preferred examples are alkyl groups such as a methyl group, an ethyl group, a n-propyl group, and an isopropyl group; alkoxy groups such as a methoxy group, an ethoxy group, a n-propoxy group, and an isopropoxy group; and aryl groups such as a phenyl group, a naphthyl group, an anthryl group, and a pyrenyl group. More preferred are an alkyl group and an alkoxy group; and most preferred are a methyl group and an ethyl group.

The number of the carbon atoms in the organic substituent represented by $R^{b4}$ to $R^{b7}$ is not limited as long as the effects of the present invention are not significantly impaired, but is usually 20 or less, preferably 18 or less, and most preferably 12 or less and usually 1 or more. When the number of the carbon atoms is too large, the solubility to a solvent for preparing a coating liquid for forming an undercoat layer is decreased. Consequently, the coating liquid gelates or becomes cloudy or gelates with a lapse of time, even if the resin can be dissolved. Thus, the coating liquid for forming the undercoat layer tends to have poor storage stability.

The copolymerized polyamide resin containing a diamine component corresponding to Formula (ii) may contain as a constitutional unit other than the diamine component corresponding to Formula (ii) (hereinafter, optionally, referred to as "other polyamide constituent" simply). Examples of the other polyamide constituent include lactams such as γ-butyrolactam, ∈-caprolactam, and lauryllactam; dicarboxylic acids such as 1,4-butanedicarboxylic acid, 1,12-dodecanedicarboxylic acid, and 1,20-eicosanedicarboxylic acid; diamines such as 1,4-butanediamine, 1,6-hexamethylenediamine, 1,8-octamethylenediamine, and 1,12-dodecanediamine; and piperazine. Furthermore, the copolymerized polyamide resin may be, for example, a binary, tertiary, or quaternary copolymer of the constituent.

When the copolymerized polyamide resin containing the diamine component corresponding to Formula (ii) contains another polyamide constitutional unit, the amount of the diamine component corresponding to Formula (ii) to the total constituents is not limited, but is usually 5 mol % or more, preferably 10 mol % or more, and most preferably 15 mol % or more and usually 40 mol % or less and preferably 30 mol % or less. A significantly large amount of diamine component corresponding to Formula (ii) may lead to poor stability of the coating liquid for forming the undercoat layer. A significantly small amount may lead to considerably low stability of the electric characteristics under conditions of high temperature and high humidity against environmental changes.

Examples of the copolymerized polyamide resin are shown below. In these examples, the copolymerization ratio represents the feed ratio (molar ratio) of monomers.

[Chemical Formula 5]

[concrete examples of copolymerized polyamide resin]

1

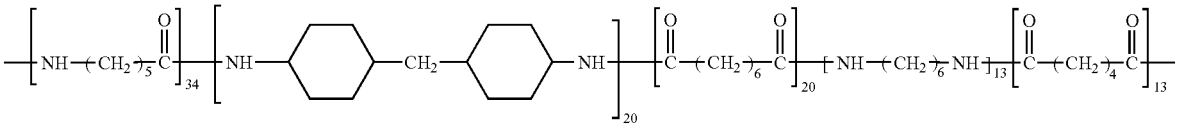

2

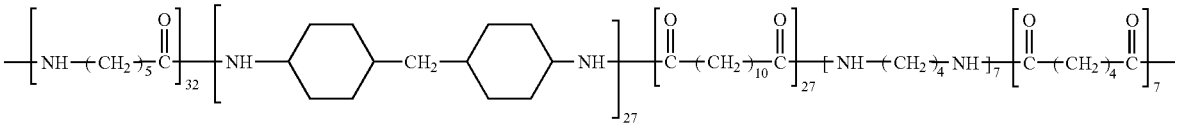

3

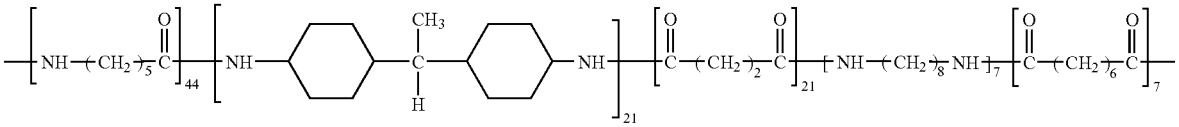

4

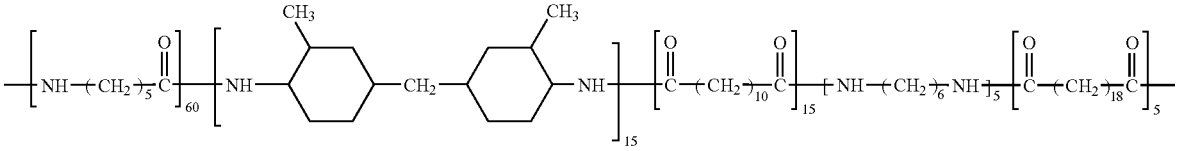

5

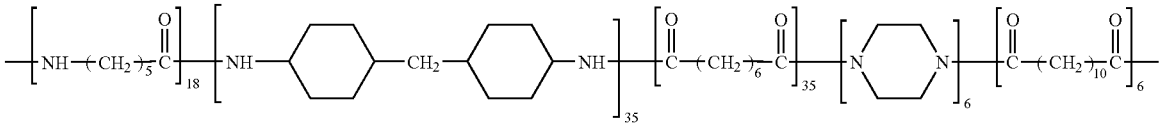

6

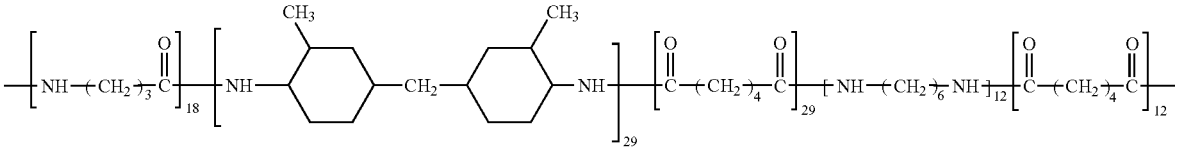

7

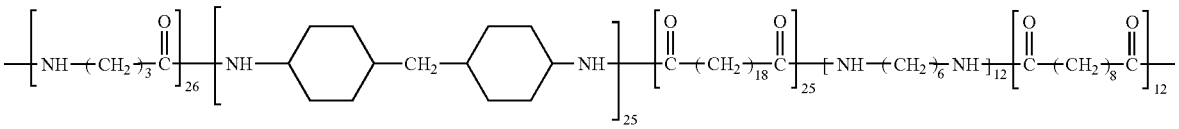

The copolymerized polyamide may be produced by any method without particular limitation and is properly produced by usual polycondensation of polyamide. For example, polycondensation such as melt polymerization, solution polymerization, or interfacial polymerization can be properly employed. Furthermore, in the polymerization, for example, monobasic acids such as acetic acid or benzoic acid; or monoacidic bases such as hexylamine or aniline may be contained in a polymerization system as a molecular weight adjuster.

The binder resin may be used alone or in any combination of two or more kinds in any ratio.

Furthermore, the binder resin according to the present invention may have any number average molecular weight without limitation. For example, for a binder resin of copolymerized polyamide, the number average molecular weight of the copolymerized polyamide is usually 10000 or more and preferably 15000 or more and usually 50000 or less and preferably 35000 or less. If the number average molecular weight is too small or too large, the undercoat layer tends to be difficult to maintain the uniformity.

[II-3. Other Component]

The undercoat layer of the present invention may contain other components in addition to the metal oxide particles and the binder resin within the scope that does not significantly impair the effects of the present invention. For example, the undercoat layer may contain any additive as the other component.

Examples of the additive include thermal stabilizers represented by sodium phosphite, sodium hypophosphite, phosphorous acid, hypophosphorous acid, and hindered phenol; other polymerization additives; and antioxidants. The additives may be used alone or in any combination of two or more kinds in any ratio.

[II-4. Physical Properties of Undercoat Layer]

[Film Thickness]

The undercoat layer may have any thickness. However, from the viewpoints of improvements in photoreceptive characteristics of the electrophotographic photoreceptor of the present invention and in coating characteristics, the thickness is usually 0.1 pin or more, preferably 0.2 μm or more, and more preferably 0.3 μm or more, and most preferably 0.5 μm or more and usually 20 μm or less, preferably 18 μm or less, more preferably 15 μm or less, and most preferably 10 μm or less.

[Surface Roughness]

The undercoat layer according to the present invention may have any surface profile, but usually has characteristic in-plane root mean square roughness (RMS), in-plane arithmetic mean roughness (Ra), and in-plane maximum roughness (P-V). These numerical values are obtained by applying the reference lengths of the root mean square height, arithmetic mean height, and maximum height in the specification of JIS B 0601:2001 to a reference plane. The in-plane root mean square roughness (RMS) represents the root mean square of Z(x)'s, which are values in the height direction in the reference plane; the in-plane arithmetic mean roughness (Ra) represents the average of the absolute values of Z(x)'s, and the in-plane maximum roughness (P-V) represents the sum of the maximum height and the maximum depth of Z(x).

The in-plane root mean square roughness (RMS) of the undercoat layer according to the present invention is usually 10 nm or more and preferably 20 nm or more and usually 100 nm or less and preferably 50 nm or less. A smaller in-plane root mean square roughness (RMS) may impair the adhesion to an overlying layer. A larger roughness may cause an uneven coating thickness of the overlying layer.

The in-plane arithmetic mean roughness (Ra) of the undercoat layer according to the present invention is usually 10 nm or more and preferably 20 nm or more and usually 100 nm or less and preferably 50 nm or less. A smaller in-plane arithmetic mean roughness (Ra) may impair the adhesion to an overlying layer. A larger roughness may cause an uneven coating thickness of the overlying layer.

The in-plane maximum roughness (P-V) of the undercoat layer according to the present invention is usually 100 nm or more and preferably 300 nm or more and usually 1000 nm or less and preferably 800 nm or less. A smaller in-plane maximum roughness (P-V) may impair adhesion to an overlying layer. A larger roughness may cause an uneven coating thickness of the overlying layer.

The measures (RMS, Ra, P-V) representing the surface state may be determined with any surface analyzer that can precisely measure irregularities in the reference plane. Particularly, it is preferred to determine these measures by a method of detecting irregularities on the surface of the sample by combining high-precision phase shift detection with counting of the order of interference fringes using an optical interferometer. More specifically, they are preferably measured by an interference fringe addressing method at a wave mode using Micromap manufactured by Ryoka Systems Inc.

In the undercoat layer according to the present invention, when an arbitrary small rectangular area of the undercoat layer is subjected to measurement of the areal surface roughness (not line roughness), Ra (arithmetic average roughness), Ry (maximum height), and Rz (ten points average roughness) defined in JIS B 0601:1994 generally fall within the following ranges.

That is, Ra (arithmetic average roughness) of the undercoat layer according to the present invention is usually 10 nm or less;

Ry (maximum height) of the undercoat layer according to the present invention is usually 70 nm or less; and Rz (ten points average roughness) of the undercoat layer according to the present invention is usually 50 nm or less.

The measures (Ra, Ry, and Rz) representing the surface state are each expressed by a mean value of the surface roughnesses of arbitrary five small areas of approximately 10000 nm×10000 nm in one image of the surface of the undercoat layer using an AFM (atomic force microscope), model VN-8000 (Keyence Corp.). The measurement input mode is "discrete", the analysis shape is "rectangular", and waving of the undercoat is amended.

[Absorbance in Dispersion]

When the undercoat layer according to the present invention is dispersed in a solvent that can dissolve the binder resin binding the undercoat layer to prepare a dispersion (hereinafter, optionally, referred to as "dispersion for absorbance measurement"), the absorbance of the dispersion has specific physical properties.

The absorbance of the dispersion for absorbance measurement can be measured with a generally known absorption spectrophotometer. Since the conditions for measuring absorbance, such as a cell size and sample concentration, vary depending on physical properties of the metal oxide particles used, such as particle diameter and refractive index, in general, the sample concentration is properly adjusted so as not to exceed the detection limit of the detector within the wavelength region (400 to 1000 nm in the present invention) to be measured.

The cell size (light path length) used for the measurement is 10 mm. Any cell can be used as long as the cell is substantially transparent in the range of 400 to 1000 nm. Quartz cells are preferably used, and matched cells having different transmittance characteristics within a predetermined range between a sample cell and a standard cell are particularly preferably used.

Before preparation of a dispersion for absorbance measurement by dispersing the undercoat layer according to the present invention, overlying layers, such as photosensitive layer, disposed on the undercoat layer are removed by dissolving the layers in a solvent that can dissolve these layers on the undercoat layer, but not substantially dissolve the binder resin binding the undercoat layer, and then the binder resin in the undercoat layer is dissolved in a solvent to give the dispersion for absorbance measurement. The solvent that can dissolve the undercoat layer preferably does not have high light absorption in the wavelength region of 400 to 1000 nm.

Examples of the solvent that can dissolve the undercoat layer include alcohols such as methanol, ethanol, 1-propanol, and 2-propanol. In particular, methanol, ethanol, and 1-propanol are preferred. These solvents may be used alone or in any combination of two or more kinds in any ratio.

In particular, in a dispersion for absorbance measurement dispersing the undercoat layer according to the present invention in a solvent mixture of methanol and 1-propanol at a weight ratio of 7:3, the difference between the absorbance to light with 400 nm wavelength and the absorbance to light with 1000 nm wavelength (absorbance difference) is as follows: For a refractive index of metal oxide particles of 2.0 or more, the absorbance difference is usually 0.3 (Abs) or less and preferably 0.2 (Abs) or less. For a refractive index of metal oxide particles of less than 2.0, the absorbance difference is usually 0.02 (Abs) or less and preferably 0.01 (Abs) or less.

The absorbance depends on the solid content of a liquid to be measured. Therefore, in the measurement of absorbance, the concentration of the metal oxide particles dispersed in the dispersion is preferably adjusted to the range of 0.003 to 0.0075 weight %.

[Regular Reflection Rate of Undercoat Layer]

The regular reflection rate of the undercoat layer according to the present invention usually shows a value specific to the present invention. The regular reflection rate of the undercoat layer according to the present invention means the rate of the regular reflection of an undercoat layer on an electroconductive support to that of the electroconductive support. Since the regular reflection rate of the undercoat layer varies depending on the thickness of the undercoat layer, the reflectance here is defined as that when the thickness of the undercoat layer is 2 μm.

In the undercoat layer according to the present invention, for a refractive index of the metal oxide particles contained in the undercoat layer of 2.0 or more, the ratio of the regular reflectance of 480 nm light on the undercoat layer to the regular reflectance of 480 nm light on the electroconductive support is usually 50% or more, where the ratio is converted into that of the undercoat layer with a thickness of 2 μm.

On the other hand, for a refractive index of the metal oxide particles contained in the undercoat layer of less than 2.0, the ratio of the regular reflectance of 400 nm light on the undercoat layer to the regular reflectance of 400 nm light on the electroconductive support is usually 50% or more, where the ratio is converted into that of the undercoat layer with a thickness of 2 μm.

Here, even if the undercoat layer contains different kinds of metal oxide particles with refractive indices of 2.0 or more or different kinds of metal oxide particles with refractive indices less than 2.0, the regular reflection rate is preferably in the above-mentioned range.

Furthermore, even if the undercoat layer contains both metal oxide particles with a refractive index of 2.0 or more and metal oxide particles with a refractive index less than 2.0, as in the case of the undercoat layer containing metal oxide particles with a refractive index of 2.0 or more, the ratio of the regular reflection of the undercoat layer to light with a 480 nm wavelength to the regular reflection of the electroconductive support to light with 480 nm wavelength is preferably in the above-mentioned range (50% or more), where the regular reflection rate is converted into that of the undercoat layer with a thickness of 2 μm.

Hetherto, cases of the undercoat layer having a thickness of 2 μm are described in detail In the electrophotographic photoreceptor according to the present invention, however, the thickness of the undercoat layer is not limited to 2 μm and may have any thickness. In the case of the undercoat layer having a thickness other than 2 μm, the regular reflection rate can be measured using a coating liquid for forming an undercoat layer (described below) that is used for forming the undercoat layer having a thickness other than 2 μm and forming an undercoat layer having a thickness of 2 μm on an electroconductive support equivalent to the electrophotographic photoreceptor and measuring the regular reflection rate of the undercoat layer. Alternatively, the regular reflection rate of the undercoat layer of the electrophotographic photoreceptor is measured, and then the regular reflection rate may be converted into that of an undercoat layer with a thickness of 2 μm.

A conversion process will be described below.

A layer having a small thickness dL and being perpendicular to the light is supposed for the detection of specific monochromatic light that passes through the undercoat layer, is regularly reflected on the electroconductive support, and then passes again through the undercoat layer.

A decrease in intensity −dI of the light that passed through the layer with a small thickness dL is proportional to the intensity I before the light passes through the layer and the layer thickness dL, as is expressed by the equation (k is a constant) below.

$$-dI=kIdL \qquad \text{Equation (a).}$$

Equation (a) can be modified as follows:

$$-dI/I=kdL \qquad \text{Equation (b).}$$

By integrating both sides of Equation (b) over the intervals from $I_0$ to I and from 0 to L, respectively, the following equation is obtained. Here, $I_0$ represents the intensity of the incident light.

$$\log(I_0/I)=kL \qquad \text{Equation (c).}$$

Equation (c) is identical to one called Lambert's law in a solution system and can be applied to measurement of the reflectance in the present invention.

Equation (c) can be modified as follows:

$$I=I_0\exp(-kL) \qquad \text{Equation (d).}$$

The behavior of the incident light before it reaches the surface of an electroconductive support is represented by Equation (d).

The regular reflectance on the surface of the cylinder is represented by $R=I_1/I_0$ where $I_1$ represents the intensity of the reflected light, since the denominator is reflected light to the conductive support of the incident light.

The light that reaches the surface of the electroconductive support in accordance with Equation (d) is regularly reflected after being multiplied by the reflectance R and then passes through the optical path L again toward the surface of the undercoat layer. That is, the following expression is obtained:

$$I=I_0\exp(-kL)\cdot R\cdot\exp(-kL) \quad \text{Equation (e).}$$

$R=I_1/I_0$ is assigned and the equation is further modified to obtain a relationship:

$$I/I_1=\exp(-2kL) \quad \text{Equation (f).}$$

This is the reflectance of the undercoat layer relative to the reflectance of the electroconductive support and is defined as the regular reflection rate.

As described above, in the case of a 2 μm undercoat layer, the to-and-fro optical path length is 4 μm, and the reflectance T of the undercoat layer on an optional electroconductive support is a function of the thickness L of the undercoat layer (in this case, the optical path length is 2 L) and is represented by T(L). From Equation (f), the following equation is obtained:

$$T(L)=I/I_1=\exp(-2kL) \quad \text{Equation (g).}$$

Furthermore, since the value that should be determined is T(2), L=2 is assigned to Equation (g) to obtain:

$$T(2)=I/I_1=\exp(-4k) \quad \text{Equation (h),}$$

and k is deleted by Equations (g) and (h) to obtain:

$$T(2)=T(L)^{2/L} \quad \text{Equation (i).}$$

That is, at a thickness L (μm) of the undercoat layer, the reflectance T(2) for an undercoat layer of 2 μm thickness can be estimated with considerable accuracy by measuring the reflectance T(L) of the undercoat layer. The thickness L of the undercoat layer can be measured by any film thickness measuring apparatus such as a roughness meter.

[III. Method for Forming Undercoat Layer]

The undercoat layer according to the present invention can be formed by any method without limitation. However, in general, the undercoat layer can be obtained by applying a coating liquid for forming an undercoat layer containing metal oxide particles and a binder resin onto the surface of an electroconductive support and drying the liquid.

[III-1. Coating Liquid for Forming Undercoat Layer]

The coating liquid for forming the undercoat layer according to the present invention contains metal oxide particles and a binder resin. In addition, the coating liquid for forming the undercoat layer according to the present invention generally contains a solvent. Furthermore, the coating liquid for forming the undercoat layer according to the present invention may contain other components in amounts that do not significantly impair the effects of the present invention.

[III-1-1. Metal Oxide Particle]

The metal oxide particles are the same as those described as the metal oxide particles contained in the undercoat layer.

However, the particle diameter distribution of the metal oxide particles in the coating liquid for forming the undercoat layer according to the present invention, in general, should meet the following requirements: the volume average particle diameter Mv, 90% cumulative particle diameter D90, number average diameter Mp, and volume particle size distribution width index SD, measured by a dynamic light-scattering method, of the metal oxide particles in the coating liquid for forming the undercoat layer according to the present invention are the same as the volume average particle diameter Mv, 90% cumulative particle diameter D90, number average diameter Mp, and volume particle size distribution width index SD, measured by a dynamic light-scattering method, respectively, of the metal oxide particles in the dispersion for undercoat layer measurement described above.

Accordingly, in the coating liquid for forming the undercoat layer according to the present invention, the volume average particle diameter Mv of the metal oxide particles is usually 0.1 μm or less (refer to [Regarding volume average particle diameter Mv of metal oxide particles]).

The metal oxide particles in the coating liquid for forming the undercoat layer according to the present invention are desirably present in the form of primary particles. However, in general, it is rare, and, in many cases, the metal oxide particles are aggregated into secondary particles or are present as a mixture of the both. Therefore, the profile of the particle size distribution is significantly important in such a state.

Therefore, in the coating liquid for forming the undercoat layer according to the present invention, precipitation and a change in viscosity in the coating liquid for forming the undercoat layer are suppressed by controlling the volume average particle diameter Mv of the metal oxide particles in the coating liquid for forming the undercoat layer to the aforementioned range (0.1 μm or less), resulting in uniformity of the thickness and the surface characteristics of the undercoat layer. On the other hand, a larger volume average particle diameter Mv (larger than 0.1 μm) of the metal oxide particles leads to accelerated precipitation and a large change in viscosity in the coating liquid for forming the undercoat, resulting in irregularity of the thickness and the surface characteristics of the formed undercoat layer. This may adversely affect the quality of overlying layers (such as a charge-generating layer).

Furthermore, in the coating liquid for forming the undercoat layer according to the present invention, the metal oxide particles usually have a 90% cumulative particle diameter D90 of 0.3 μm or less (refer to [Regarding 90% cumulative particle diameter D90 of metal oxide particles]).

The metal oxide particles in the coating liquid for forming the undercoat layer according to the present invention are desirably present in the form of primary particles. However, actually, such metal oxide particles cannot be practically obtained. The present inventors have found the fact that when the 90% cumulative particle diameter D90 is sufficiently small, i.e., when the 90% cumulative particle diameter D90 is 0.3 μm or less, the coating liquid for forming the undercoat layer exhibits less gelation and a small change in viscosity and therefore can be stored for a long period of time, even if the metal oxide particles aggregate and that, as a result, the thickness and surface characteristics of the formed undercoat layer can be uniform. On the other hand, when the diameter of the metal oxide particles in the coating liquid for forming the undercoat layer is too large, the gelation and a change in viscosity of the liquid are large and the thickness and surface characteristics of the formed undercoat layer are not uniform. This may also adversely affect the quality of overlying layers (such as a charge-generating layer).

Furthermore, in the coating liquid for forming the undercoat layer according to the present invention, the ratio Mv/Mp of a volume average particle diameter Mv to a number average diameter Mp, measured by a dynamic light-scattering method, of the metal oxide particles in the coating liquid preferably satisfies the aforementioned Expression (1) (refer to [Regarding ratio Mv/Mp of volume average particle diameter Mv to number average diameter Mp]).

In addition, in the coating liquid for forming the undercoat layer according to the present invention, the volume particle size distribution width index SD, measured by the dynamic light-scattering method, of the metal oxide particles of the coating liquid preferably satisfies the aforementioned Expression (2) (refer to [Regarding volume particle size distribution width index SD]).

The volume average particle diameter Mv, the 90% cumulative particle diameter D90, the number average diameter Mp, and the volume particle size distribution width index SD of the metal oxide particles in the coating liquid for forming the undercoat layer are directly measured with the coating liquid for forming the undercoat layer, not the metal oxide particles in the coating liquid for forming the undercoat layer. This method for measurement is different from that for measuring the volume average particle diameter Mv, the 90% cumulative particle diameter D90, the number average diameter Mp, and the volume particle size distribution width index SD of the metal oxide particles in the dispersion for undercoat layer measurement in the following points (in other points, this method for measuring the volume average particle diameter Mv, the 90% cumulative particle diameter D90, the number average diameter Mp, and the volume particle size distribution width index SD of the metal oxide particles in the coating liquid for forming the undercoat layer is the same as that of the volume average particle diameter Mv, the 90% cumulative particle diameter D90, the number average diameter Mp, and the volume particle size distribution width index SD of the metal oxide particles in the dispersion for undercoat layer measurement).

That is, in the measurement of the volume average particle diameter Mv and the 90% cumulative particle diameter D90 of the metal oxide particles in the coating liquid for forming the undercoat layer, the dispersion medium is the solvent used in the coating liquid for forming the undercoat layer, and the dispersion refractive index is that of the solvent used in the coating liquid for forming the undercoat layer. In addition, in the present invention, the dispersion medium (i.e., the solvent used in the coating liquid for forming the undercoat layer) is preferably a solvent mixture of methanol/propanol=7/3, unless specifically mentioned otherwise. If the concentration of the coating liquid for forming the undercoat layer is too high and is outside of the range that a measurement apparatus can measure, the coating liquid for forming the undercoat layer is diluted with a solvent mixture of methanol and 1-propanol (weight ratio: methanol/1-propanol=7/3, refractive index=1.35) such that the resulting concentration of the coating liquid for forming the undercoat layer is within the measurable range of the measurement apparatus. For example, in the case of the aforementioned UPA, the coating liquid for forming the undercoat layer is diluted with a solvent mixture of methanol and 1-propanol into a sample concentration index (SIGNAL LEVEL) within the range from 0.6 to 0.8, which is suitable for measurement. Since, even if such dilution is conducted, it is believed that the volume particle diameter of the metal oxide particles in the coating liquid for forming the undercoat layer does not vary, the volume average particle diameter Mv, the 90% cumulative particle diameter D90, the number average diameter Mp, and the volume particle size distribution width index SD after the dilution are regarded as the volume average particle diameter Mv, the 90% cumulative particle diameter D90, the number average diameter Mp, and the volume particle size distribution width index SD in the coating liquid for forming the undercoat layer.

However, values of the volume average particle diameter Mv, the number average diameter Mp, the 90% cumulative particle diameter D90, the particle diameter at 84% cumulative volume particle size distribution D84, and the particle diameter at 16% cumulative volume particle size distribution D16 of the metal oxide particles in the coating liquid for forming the undercoat layer according to the present invention represent those when the metal oxide particles are stably dispersed in the coating liquid for forming the undercoat layer, but do not represent those of the metal oxide particles as powder before the dispersion or particle sizes of wet cake.

The absorbance of the coating liquid for forming the undercoat layer according to the present invention can be measured by a generally known absorption spectrophotometer. Since the conditions for measuring absorbance, such as a cell size and sample concentration, vary depending on physical properties, such as particle diameter and refractive index, of metal oxide particles used, the sample concentration is properly adjusted so as not to exceed the detection limit of a detector in a wavelength region (400 to 1000 nm in the present invention) to be measured. The volume average particle diameter Mv and the 90% cumulative particle diameter D90 of the metal oxide particles in the coating liquid for forming the undercoat layer according to the present invention are measured, after the concentration of the metal oxide particles in the coating liquid for the forming undercoat layer is controlled to 0.0075 to 0.012 weight %. In general, the solvent for adjusting the sample concentration is also used as the solvent of the coating liquid for forming the undercoat layer. However, any solvent that has compatibility to the solvent of the coating liquid for forming the undercoat layer and the binder resin and does not cause roiling or the like and does not have high light absorption in a wavelength region of 400 to 1000 nm can be used. Examples of such solvents include alcohols such as methanol, ethanol, 1-propanol, and 2-propanol; hydrocarbons such as toluene and xylene; ethers such as tetrahydrofuran; and ketones such as methyl ethyl ketone and methyl isobutyl ketone.

The cell size (light path length) used for the measurement is 10 mm. Any cell substantially transparent in the thickness range of 400 to 1000 nm can be used. Quartz cells are preferably used, and matched cells having different transmittance characteristics within a predetermined range between a sample cell and a standard cell are particularly preferred.

In a dispersion prepared by dispersing the coating liquid for forming the undercoat layer of the present invention in a solvent mixture of methanol and 1-propanol at a weight ratio of 7:3, the difference between the absorbance to light with 400 nm wavelength and the absorbance to light with 1000 nm wavelength is preferably 1.0 (Abs) or less for a refractive index of metal oxide particles of 2.0 or more, or is preferably 0.02 (Abs) or less for a refractive index of metal oxide particles of less than 2.0.

[III-1-2. Binder Resin]

The binder resin contained in the coating liquid for forming the undercoat layer is the same as that contained in the undercoat layer, which has been described.

However, the binder resin may be contained in the coating liquid for forming the undercoat layer at any content that does not significantly impair the effects of the present invention, but is used in the range of usually 0.5 weight % or more and preferably 1 weight % or more and usually 20 weight % or less and preferably 10 weight % or less.

[III-1-3. Solvent]

Any solvent can be used as a solvent for the coating liquid for forming the undercoat layer (solvent for the undercoat layer) according to the present invention as long as it can dissolve the binder resin according to the present invention. The solvent is usually an organic solvent, and examples thereof include alcohols containing at most five carbon atoms, such as methanol, ethanol, isopropyl alcohol, and normal propyl alcohol; halogenated hydrocarbons such as chloroform, 1,2-dichloroethane, dichloromethane, trichlene, carbon tetrachloride, and 1,2-dichloropropane; nitrogen-containing organic solvents such as dimethylformamide; and aromatic hydrocarbons such as toluene and xylene.

Furthermore, these solvents may be used alone or in any combination of two or more kinds in any ratio. Furthermore, even if a solvent cannot dissolve the binder resin according to the present invention, the solvent can be used in the form of a mixture with another solvent (for example, the organic solvents described above) that can dissolve the binder resin. In general, a solvent mixture can advantageously reduce unevenness in coating.

In the coating liquid for forming the undercoat layer according to the present invention, the ratio of solid components, such as the metal oxide particles and the binder resin, to the solvent varies depending on the method for coating the coating liquid for forming the undercoat layer and may be determined such that uniform coating can be formed in the coating method that is applied. Specifically, the solid content in the coating liquid for forming the undercoat layer is usually 1 weight % or more and preferably 2 weight % or more and usually 30 weight % or less and preferably 25 weight % or less, from the viewpoints of stability and coating characteristics of the coating liquid for forming the undercoat layer.

[III-1-4. Other Components]

Other components contained in the coating liquid for forming the undercoat layer are the same as those contained in the undercoat layer, which has been described above.

[III-1-5. Advantage of Coating Liquid for Forming the Undercoat Layer]

The coating liquid for forming the undercoat layer according to the present invention has high storage stability. There are many measures of storage stability, for example, in the coating liquid for forming the undercoat layer according to the present invention, the rate of change in viscosity after storage for 120 days at room temperature compared to that immediately after the production (i.e., the value obtained by dividing a difference between the viscosity after storage for 120 days and the viscosity immediately after the producing by the viscosity immediately after the producing) is usually 20% or less, preferably 15% or less, and more preferably 10% or less. The viscosity can be measured by a method in accordance with JIS Z 8803 using an E-type viscometer (Tokimec Inc., product name: ED).

The coating liquid for forming the undercoat layer according to the present invention is usually stable and can be stored and used for a long time, without gelation or precipitation of the dispersed titanium oxide particles. In addition, changes in the physical properties, such as viscosity during the use of the coating liquid, are small, whereby, the thickness of each of photosensitive layers, which are formed by applying the liquid sequentially on supports, can be uniform.

Furthermore, the use of the coating liquid for forming the undercoat layer according to the present invention enables highly efficient production of electrophotographic photoreceptors with high quality. In addition, the resulting photoreceptor usually has stable electric characteristics even under conditions of low temperature and low humidity and is thus excellent in the electric characteristics.

[III-2. Method of Producing Coating Liquid for Forming the Undercoat Layer]

The coating liquid for forming the undercoat layer according to the present invention may be produced by any method without limitation. However, the coating liquid for forming the undercoat layer according to the present invention contains metal oxide particles as described above, and the metal oxide particles are present in the form of dispersion in the coating liquid for forming the undercoat layer. Therefore, the method of producing the coating liquid for forming the undercoat layer according to the present invention usually include a step of dispersing the metal oxide particles.

The metal oxide particles may be dispersed in a solvent (hereinafter, optionally, the solvent used for dispersion is referred to as "dispersion solvent") by, for example, wet dispersion using a known mechanical pulverizer (dispersing apparatus), such as a ball mill, a sand grind mill, a planetary mill, or a roll mill. It is believed that the metal oxide particles according to the present invention are dispersed so as to have the above-described predetermined particle diameter distribution through this dispersion step. The dispersion solvent may be that used in the coating liquid for forming the undercoat layer or may be another solvent. However, when a solvent other than the solvent used in the coating liquid for forming the undercoat layer is used as the dispersion solvent, the metal oxide particles after the dispersion and the solvent to be used in the coating liquid for forming the undercoat layer are mixed or subjected to solvent exchange. In such an occasion, it is preferable that the mixing or the solvent exchange be carried out so as to avoid aggregation of the metal oxide particles in order to maintain the predetermined particle diameter distribution.

Among wet dispersion methods, a dispersion using a dispersion medium is particularly preferred.

Any known dispersing apparatus can be used for dispersing using a dispersion medium, and examples thereof include a pebble mill, a ball mill, a sand mill, a screen mill, a gap mill, a vibration mill, a paint shaker, and an attritor.

Among them, a method using a wet agitating mill is preferred. The wet agitating mill wet-disperses metal oxide particles in a dispersion solvent. The metal oxide particles, when they are dispersed, are present in the form of slurry. That is, the slurry is a composition containing at least the metal oxide particles and the dispersion solvent. In particular, a wet agitating ball mill is preferred.

Furthermore, a wet agitating ball mill of which at least a part of the portion that is in contact with metal oxide particles during dispersion treatment is made of a ceramic material with a Young's modulus of 150 to 250 GPa is preferred.

The Young's modulus of the ceramic material in the present invention is measured according to the "testing methods for elastic modulus of fine ceramics" of JIS R 1602-1995, which prescribes tests for measuring elastic modulus of fine ceramics at room temperature. The Young's modulus of the ceramic material is not substantially affected by ambient temperature, and, in the present invention, it is measured at 20° C.

The ceramic material can be any known ceramic material that has a Young's modulus of 150 to 250 GPa. In general, examples such materials include sintered metal oxides, sintered metal carbides, and sintered metal nitrides.

A ceramic material having a Young's modulus higher than 250 GPa is worn during dispersion treatment of metal oxide particles used in the undercoat layer of the present invention, and the worn ceramic material is undesirably present in the undercoat layer. This may deteriorate electrophotographic photoreceptive characteristics. However, the use of a ceramic material with a Young's modulus of 150 to 250 GPa, as described above, allows the coating liquid for forming undercoat layer to be efficiently produced and also to have higher storage stability. Consequently, an electrophotographic photoreceptor with higher quality can be efficiently obtained.

The Young's modulus varies depending on the composition of the ceramic material and the particle diameter and the particle size distribution of material before sintering and is therefore adjusted properly to the range of 150 to 250 GPa prescribed in the present invention. In general, metastable zirconia doped with 2 to 3 mol % of yttrium oxide and alumina-reinforced zirconia in which metastable zirconia doped with 20 to 30 mol % of aluminum oxide have the Young's modulus in the range of 150 to 250 GPa in many cases.

Furthermore, in the wet agitating ball mill, at least a part of the portion that is in contact with the metal oxide particles during the dispersion treatment may be preferably made of a resin material with a flexural modulus of 500 to 2000 MPa.

The flexural modulus of a resin material in the present invention is a value measured according to the "plastics—determination of flexural properties" of JIS K 7171 1994, which prescribes tests for flexural modulus of plastics. Since the flexural modulus is highly affected by temperature and also is, in a hygroscopic material, affected by humidity, measurement conditions must to be controlled in accordance with JIS K 7171 1994. The flexural modulus values are measured under conditions of a temperature of 23° C.±2° C. and a relative humidity of 50%±10%.

Any known resin material that has a flexural modulus of 500 to 2000 MPa can be used as the resin material constituting at least a part of the wet agitating ball mill according to the present invention. The resin material may be a thermosetting resin or a thermoplastic resin. Examples of the thermosetting resin include polyurethanes, urea resins, and epoxy resins, and examples of the thermoplastic resin include polyethylene and polypropylene.

The flexural modulus is preferably 1800 MPa or less and more preferably 1500 MPa or less. In a resin material having a flexural modulus exceeding 2000 MPa, it may be worn during dispersion treatment of metal oxide particles used in the undercoat layer of the present invention and be undesirably present in the undercoat layer. This may deteriorate electrophotographic photoreceptive characteristics. The flexural modulus is preferably 600 MPa or more and more preferably 750 MPa or more.

The flexural modulus varies depending on the molecular weight and the repeating unit structure of the resin material and additives such as an plasticizer and a filler and is therefore adjusted properly to the range of 500 to 2000 MPa prescribed in the present invention. In general, high-density polyethylene and polyurethane have a flexural modulus in the range of 500 to 2000 MPa in many cases.

In addition, the dispersion apparatus can preferably disperse metal oxide particles by circulation. Furthermore, from the viewpoints of, for example, dispersion efficiency, final particle size, and facility of continuous operation, wet agitating ball mills such as a sand mill, a screen mill, and a gap mill are particularly preferred. These mills may be either of a vertical type or a horizontal type. In addition, the disk of the mill may have any shape, and, for example, a flat plate type, a vertical pin type, or a horizontal pin type can be used. A liquid circulating type sand mill is preferred.

The dispersion may be conducted with one kind of dispersion apparatus or with any combination of two or more kinds.

The dispersion is conducted using a dispersion medium, such that the volume average particle diameter Mv, the 90% cumulative particle diameter D90, the number average diameter Mp, and the volume particle size distribution width index SD of the metal oxide particles in the coating liquid for forming undercoat layer is adjusted in the above-mentioned ranges using a dispersion medium having a predetermined average particle diameter.

That is, in the method of producing a coating liquid for forming the undercoat layer according to the present invention, metal oxide particles is dispersed in a wet agitating ball mill, such that the dispersion medium of the wet agitating ball mill have an average particle diameter of usually 5 μm or more, preferably 10 μm or more, and more preferably 30 μm or more and usually 200 μm or less, preferably 100 μm or less, and more preferably 90 μm or less. A dispersion medium having a smaller particle diameter tends to give a homogeneous dispersion within a shorter period of time. However, a dispersion medium having an excessively small particle diameter has significantly small mass causing small impact force, which may preclude efficient dispersion. On the other hand, a dispersion medium having an excessively large average particle diameter applies an excessively large force to metal oxide particles to cause agglomeration of the metal oxide particles into coarse metal oxide particle agglomerates.

It is believed that the use of the dispersion medium having the above-described average particle diameter is a factor for adjusting the volume average particle diameter Mv, the 90% cumulative particle diameter D90, the number average diameter Mp, and the volume particle size distribution width index SD of metal oxide particles in a coating liquid for forming the undercoat layer within the desired ranges by the aforementioned production method. Therefore, the coating liquid for forming the undercoat layer produced in a wet agitating ball mill with metal oxide particles dispersed using a dispersion medium having the aforementioned average particle diameter favorably satisfies the requirements of the coating liquid for forming the undercoat layer according to the present invention. In addition, when the average particle diameter of the dispersion medium is within the range described above, in general, a coating liquid for forming the undercoat layer that is excellent in uniformity and dispersion stability can be obtained in a short time.

The "average particle diameter" of the dispersion medium can be measured by image analysis. Since typical dispersion medium is substantially spherical, the average particle diameter can be measured by image analysis. Specifically, the average particle diameter of the dispersion medium is measured with an image analyzer, LUZEX50 manufactured by Nireco Corp., and the resulting average particle diameter is defined as the "average particle diameter of the dispersion medium" in the present invention.

Since the dispersion medium is substantially spherical, the average particle diameter can be determined by a sieving method using sieves described in, for example, JIS Z 8801: 2000 or image analysis, and the density can be measured by Archimedes's method. For example, the average particle diameter and the sphericity of the dispersion medium can be measured with an image analyzer represented by LUZEX50 manufactured by Nireco Corp.

The density of the dispersion medium is not limited, but is usually 5.5 g/cm$^3$ or more, preferably 5.9 g/cm$^3$ or more, and more preferably 6.0 g/cm$^3$ or more. In general, a dispersion medium having a higher density tends to give homogeneous dispersion within a shorter time. The density measured by Archimedes's method is defined as the "density" of the dispersion medium.

The sphericity of the dispersion medium used is preferably 1.08 or less and more preferably 1.07 or less. The sphericity is measured with an image analyzer, LUZEX50 manufactured by Nireco Corp., and the resulting value is defined as the sphericity.

As the material of the dispersion medium, any known dispersion medium can be used, as long as it is insoluble in the aforementioned slurry containing a dispersion solvent, has a specific gravity higher than that of the slurry, and does not react with the slurry nor decompose the slurry. Examples of the dispersion medium include steel balls such as chrome balls (bearing steel balls) and carbon balls (carbon steel balls); stainless steel balls; ceramic balls such as silicon nitride, silicon carbide, zirconium, and alumina balls; and balls coated with films of, for example, titanium nitride or titanium carbonitride. In particular, ceramic balls are preferred, fired alumina balls and fired zirconium balls are more preferred, and fired zirconium balls are particularly preferred. More specifically, fired zirconium beads described in Japanese Patent No. 3400836 are particularly preferred.

The dispersion media may be used alone or in any combination of two or more kinds in any ratio.

Appropriate examples of the dispersion apparatus will now be specifically described with reference to drawings, but the dispersion apparatus is not limited to the following examples.

[First Embodiment of Preferable Dispersion Apparatus]

Among the aforementioned wet agitating ball mills, particularly preferred is one including a cylindrical stator, a slurry supplying port disposed at one end of the stator, a slurry discharging port disposed at the other end of the stator, a rotor for agitating and mixing a dispersion medium packed in the stator and slurry supplied from the supplying port, and a separator that is rotatably connected to the discharging port and separates the dispersion medium and the slurry by the centrifugal force to discharge the slurry from the discharging port.

Here, the slurry contains at least metal oxide particles and a dispersion solvent.

Now, the structure of this wet agitating ball mill will now be described in detail.

The stator is a tubular (usually, cylindrical) container having a hollow portion and is provided with a slurry supplying port at one end and a slurry discharging port at the other end. In addition, the hollow portion of the inside is filled with a dispersion medium so that metal oxide particles in slurry are dispersed by the dispersion medium. Furthermore, the slurry is supplied to the inside of the stator from the supplying port, and the slurry in the stator is discharged from the discharging port to the exterior of the stator.

The rotor is disposed in the interior of the stator and promotes mixing of the dispersion medium and the slurry by agitation. The rotor may have any shape that can agitate the slurry. For example, the rotor may be of a flat plate type, a vertical pin type, or a horizontal pin type. In particular, a rotor of, for example, a pin, disk, or annular type, is preferred from the viewpoint of agitation efficiency.

Furthermore, the separator separates the dispersion medium and the slurry. This separator is connected to the discharging port of the stator, separates the slurry and the dispersion medium in the stator, and discharges the slurry from the discharging port of the stator to the exterior of the stator.

The separator may be of any type, for example, a separator that conducts separation with a screen, a separator that conducts separation by centrifugal force, or a separator utilizing the both. The separator used here is rotatable. This separator may have any shape that can separate the dispersion medium and the slurry by centrifugal force effect generated by the rotation of the separator, but an impeller-type is preferable from the viewpoint of separation efficiency.

The separator may be rotated in synchronization with the rotor or independently of the rotor.

Furthermore, the wet agitating ball mill preferably includes a shaft serving as a rotary shaft of the separator. In addition, this shaft is preferably provided with a hollow discharging path communicating with the discharging port, at the center of the shaft. That is, it is preferable that the wet agitating ball mill includes at least a cylindrical stator, a slurry supplying port disposed at one end of the stator, a slurry discharging port disposed at the other end of the stator, a rotor mixing a dispersion medium packed in the stator and slurry supplied from the supplying port, an impeller separator that is connected to the discharging port and is rotatable to separate the dispersion medium and the slurry by centrifugal force effect and discharge the slurry from the discharging port, and a shaft serving as the rotary shaft of the separator where a hollow discharging path connected to the discharging port is disposed in the center of the shaft.

The aforementioned discharging path provided to the shaft connects the rotary center of the separator and the discharging port of the stator. Therefore, the slurry separated from the dispersion medium by the separator is transported to the discharging port through the discharging path and is then discharged from the discharging port to the exterior of the stator. The discharging path extends through the center of the shaft. Since the centrifugal force does not work at the center of the shaft, the slurry discharged has no kinetic energy. Since wasteful kinetic energy is not generated, excess energy is not consumed.

Such a wet agitating ball mill may be horizontally disposed, but is preferably vertically disposed in order to increase the filling ratio of the dispersion medium. On this occasion, the discharging port is preferably disposed at the upper end of the mill. Furthermore, the separator is desirably disposed at a position above the level of the packed dispersion medium.

When the discharging port is disposed at the upper end of the mill, the supplying port is disposed at the bottom of the mill. In this case, more preferably, the supplying port consists of a valve seat and a vertically movable valve element that is fitted to the valve seat and has a V-shape, a trapezoidal shape, or a cone shape to be in line contact with the edge of the valve seat. With this, an annular slit can be formed between the edge of the valve seat and the valve element to prevent a dispersion medium from passing through. Therefore, at the supplying port, slurry is supplied without deposition of the dispersion medium. In addition, it is possible to discharge the dispersion medium by spreading the slit by lifting the valve element or to seal the mill by closing the slit by lowering the valve element. Furthermore, since the slit is defined by the valve element and the edge of the valve seat, coarse particles (metal oxide particles) in the slurry barely remain and the remaining slurry readily removes upward or downward. Thus, occlusion hardly occurs.

In addition, coarse particles remaining in the slit can be removed from the slit by vertical vibration of the valve element with vibration means, and trapping of the particles can also be prevented by the vibration. Furthermore, the vibration of the valve element applies shearing force to the slurry to decrease the viscosity thereof, resulting in an increased amount of slurry passing through the slit (i.e., the amount of supply). Any means can be used for vibrating the valve element without limitation. For example, in addition to mechanical means such as a vibrator, and means of changing the pressure of compressed air that acts on a piston combined with the valve element, such as a reciprocating compressor or an electromagnetic switching valve of switching supply and discharge of compressed air, can be used.

Such a wet agitating ball mill is desirably provided with a screen for separating the dispersion medium and a slurry outlet at the bottom so that the slurry remaining in the wet agitating ball mill can be discharged after the completion of dispersion.

Furthermore, when the wet agitating ball mill is vertically disposed, when the shaft is pivoted at the upper end of the stator, when an O-ring and a mechanical seal having a mating ring are disposed at a bearing portion bearing the shaft disposed at the upper end of the stator, and when the bearing portion is provided with an annular groove for fitting the O-ring, it is preferable that a tapered cut broadening downward be provided at the lower side of the annular groove. That is, it is preferable that the wet agitating ball mill include a cylindrical vertical stator, a slurry supplying port disposed at the bottom of the stator, a slurry discharging port disposed at the upper end of the stator, a shaft pivoted at the upper end of the stator and rotated by driving means such as a motor, a pin-, disk-, or annular rotor fixed to the shaft and mixing the dispersion medium packed in the stator and the slurry upplied from the supplying port, a separator disposed near the discharging port and separating the slurry from the dispersion medium, and a mechanical seal disposed at the bearing portion bearing the shaft at the upper end of the stator, and that a tapered cut broadening downward provided at the lower side of an annular groove for fitting an O-ring being in contact with a mating ring of the mechanical seal is fitted.

In this wet agitating ball mill, the mechanical seal is provided at the upper end of the stator above the level of the liquid in the center of the shaft at which the dispersion medium and the slurry substantially do not have kinetic energy. This can significantly reduce intrusion of the dispersion medium and the slurry into a gap between the mating ring of the mechanical seal and the lower side portion of the O-ring fitting groove.

Furthermore, the lower side of the annular groove for fitting the O-ring broadens downward by a cut so that the clearance spreads. Therefore, intrusion of the slurry and the dispersion medium or clogging caused by solidification thereof hardly occurs, and the mating ring smoothly follows the seal ring to maintain the functions of the mechanical seal. In addition, the lower portion of the fitting groove to which the O-ring is fitted has a V-shaped cross-section. Since the entire wall is not thin, the strength is maintained, and the O-ring has high holding ability.

In particular, the separator preferably includes two disks having blade-fitting grooves on the inner faces facing each other, a blade fitted to the fitting grooves and lying between the disks, and supporting means supporting the disks having the blade therebetween from both sides. That is, it is preferable that the wet agitating ball mill includes a cylindrical stator, a slurry supplying port disposed at one end of the stator, a slurry discharging port disposed at the other end of the stator, a rotor agitating and mixing the dispersion medium packed in the stator and the slurry supplied from the supplying port, and a rotatable separator provided in the stator, connected to the discharging port, separating the slurry from the dispersion medium by centrifugal force, and discharging the slurry from the discharging port, and that the separator includes two disks having fitting grooves for a blade on the inner faces facing each other, the blade fitted to the fitting grooves and lying between the disks, and supporting means supporting the disks having the blade therebetween from both sides. On this occasion, in a preferable embodiment, the supporting means is defined by a shoulder of a shouldered shaft and cylindrical pressing means fitted to the shaft and pressing the disks and supports the disks having the blade therebetween by pinching them from both sides with the shoulder of the shaft and the pressing means. With such a wet agitating ball mill, the metal oxide particles in the undercoat layer can readily have a volume average particle diameter Mv and a 90% cumulative particle diameter D90 within the aforementioned ranges. Furthermore, in a wet agitating ball mill having such a separator, the dispersion medium and the dispersion can be efficiently separated to improve the productivity of the dispersion. Thus, a large amount of the dispersion can be produced in a short time. In particular, it is generally recognized that suitable separation of the dispersion medium having the above-described average particle diameter from the slurry (dispersion) is difficult, but the separation can be suitably carried out using the aforementioned wet agitating ball mill. In addition, the separator preferably has an impeller-type structure.

The structure of the above-described vertical wet agitating ball mill will now be more specifically described with reference to an embodiment of the wet agitating ball mill. However, the agitating apparatus used for producing the coating liquid for the undercoat layer of the present invention is not limited to those exemplified here.

FIG. 1 is a longitudinal cross-sectional view schematically illustrating a structure of a wet agitating ball mill according to this embodiment. In FIG. 1, slurry (not shown) is supplied to the vertical wet agitating ball mill and is agitated with a dispersion medium (not shown) in the mill for pulverization. Then, the slurry is separated from the dispersion medium by a separator 14 and is discharged through a discharging path 19 in the center of a shaft 15 and then is recycled via a return path (not shown) for further milling.

As shown in FIG. 1 in detail, the vertical wet agitating ball mill has a stator 17 provided with a vertically cylindrical jacket 16 that allows a flow of water for cooling the mill; a shaft 15 that is rotatably born on the upper portion of the stator 17 at the center of the stator 17 and has a mechanical seal shown in FIG. 2 (described below) at a bearing portion and has a hollow center as a discharging path 19 at the upper portion; pin- or disk-shaped rotors 21 protruding in the radial direction at the lower portion of the shaft 15; a pulley 24, for transmitting driving force, fixed to the upper portion of the shaft 15; a rotary joint 25 mounted on an open end at the upper end of the shaft 15; a separator 14, for separating the medium, fixed to the shaft 15 near the upper portion in the stator 17; a slurry supplying port 26 disposed to the bottom of the stator 17 so as to oppose to the end of the shaft 15; and a screen 28, for separating the dispersion medium, mounted on a grid screen support 27 that is provided to a slurry retrieval port 29 disposed at an eccentric position of the bottom of the stator 17.

The separator 14 consists of a pair of disks 31 fixed to the shaft 15 with a predetermined interval and a blade 32 connecting these disks 31 to define an impeller and rotates with the shaft 15 to apply centrifugal force to the dispersion medium and the slurry entrapped between the disks 31 for centrifuging the dispersion medium in the radial direction and discharging the slurry through the discharging path 19 in the center of the shaft 15 by the difference in specific gravity.

The slurry supplying port 26 consists of an inverted trapezoidal valve element 35 that is vertically movable and is fitted to a valve seat disposed at the bottom of the stator 17 and a cylindrical body 36 having a bottom and protruding downward from the bottom of the stator 17. The valve element 35 is lifted upon the supply of slurry to form an annular slit (not shown) with the valve seat, whereby the slurry is supplied to the inside of the stator 17.

When a raw material is supplied, the valve element 35 is lifted by a supply pressure due to the slurry supplied to the inside of the cylindrical body 36, against the pressure in the mill, to form a slit between itself and the valve seat.

In order to prevent clogging of the slit, the valve element 35 repeats vertical shock involving lifting to the upper limit position within a short cycle. This vibration of the valve element 35 may be constantly performed, or may be performed when a large amount of coarse particles are contained in the slurry or in conjunction with an increase in supply pressure of the slurry due to clogging.

Figure 2:
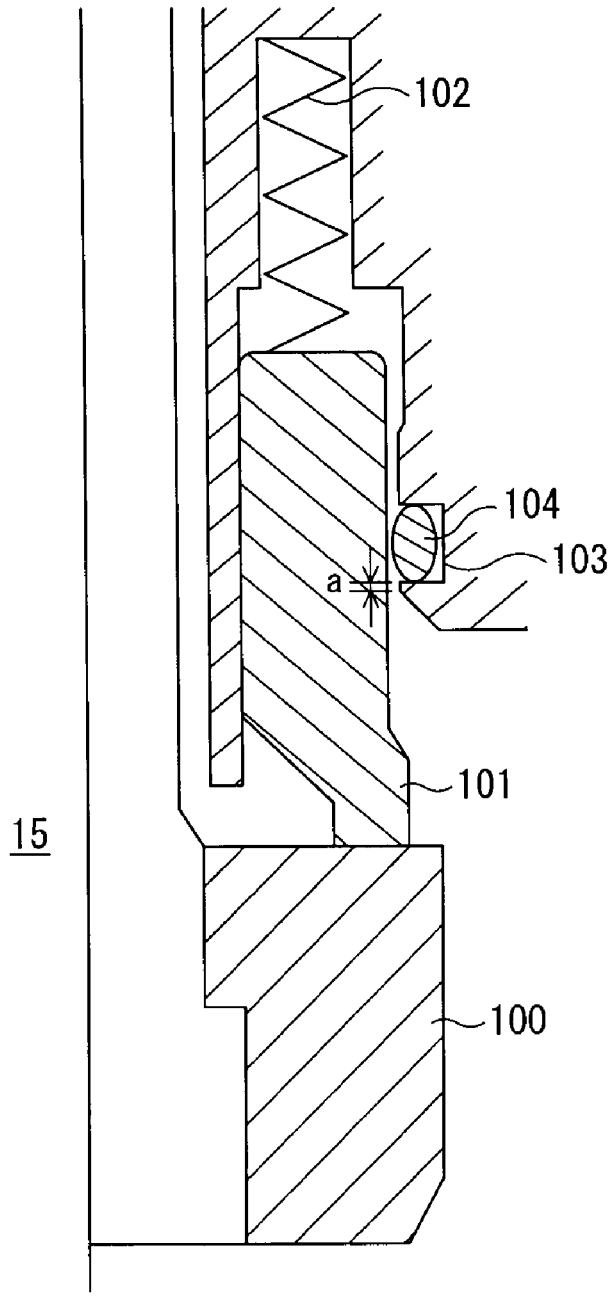
FIG. 2 is an enlarged longitudinal cross-sectional view schematically illustrating a mechanical seal used in a wet agitating ball mill according to an embodiment of the present invention.

In the mechanical seal, as shown in FIG. 2 in detail, a mating ring 101 at the stator side is biased by a spring 102 to a seal ring 100 fixed to the shaft 15. The stator 17 and the mating ring 101 are sealed by an O-ring 104 that is fitted to a fitting groove 103 at the stator side. In FIG. 2, a tapered cut (not shown) broadening downward is provided at the lower portion of the O-ring fitting groove 103. The length "a" of minimum clearance between the lower portion of the fitting groove 103 and the mating ring 101 is small in order to prevent deterioration of the sealing between the mating ring 101 and the seal ring 100 due to inhibited motion of the mating ring 101 by solidification of trapped medium or slurry.

In the above embodiment, the rotors 21 and the separator 14 are fixed to the same shaft 15. In another embodiment, however, they are fixed to different shafts coaxially arranged and are independently rotated. In the embodiment shown above, since the rotor and the separator are provided to the same shaft, a single driving apparatus is required, resulting in simplification of the structure. In the latter embodiment, the rotor and the shaft are mounted on the different shafts and are independently rotated by the respective driving apparatuses, and thus the rotor and the separator are independently driven at their optimum rotation rates.

Figure 3:
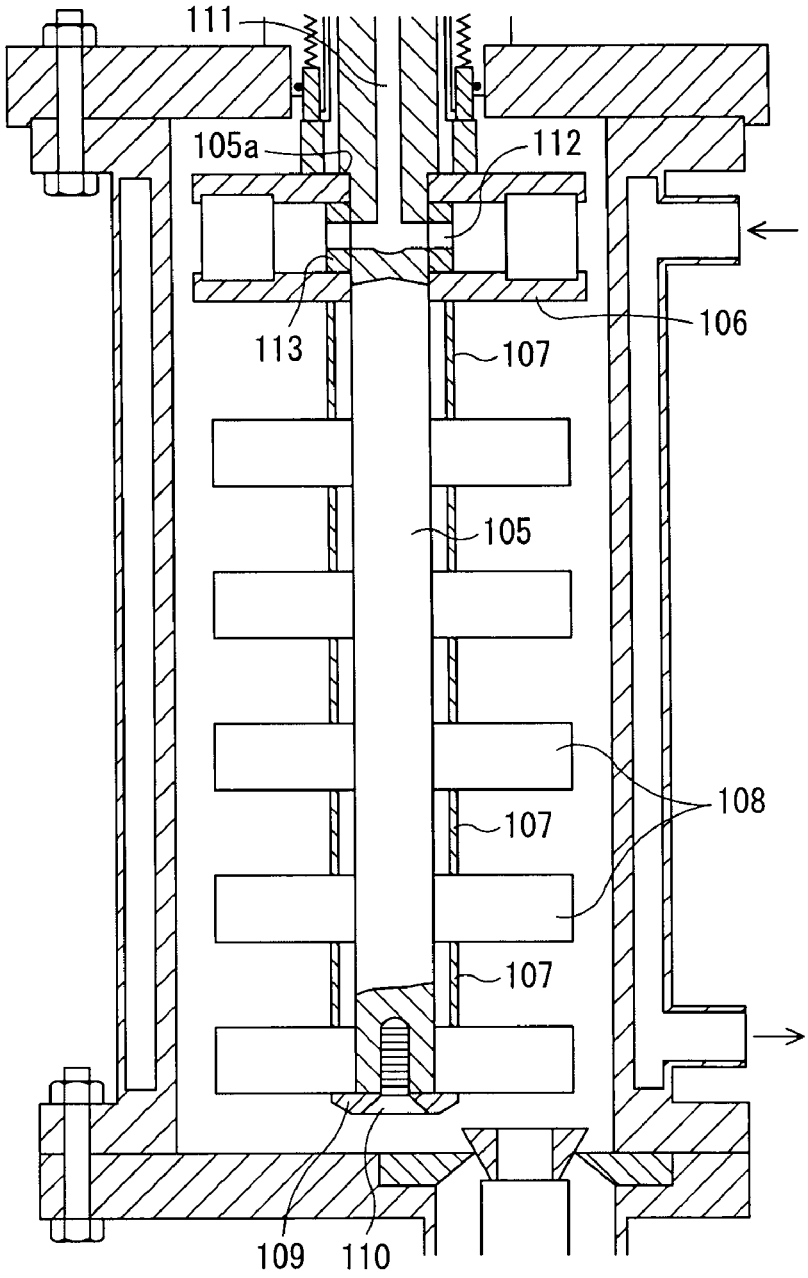
FIG. 3 is a longitudinal cross-sectional view schematically illustrating another example of a wet agitating ball mill according to an embodiment of the present invention.
Figure 4:
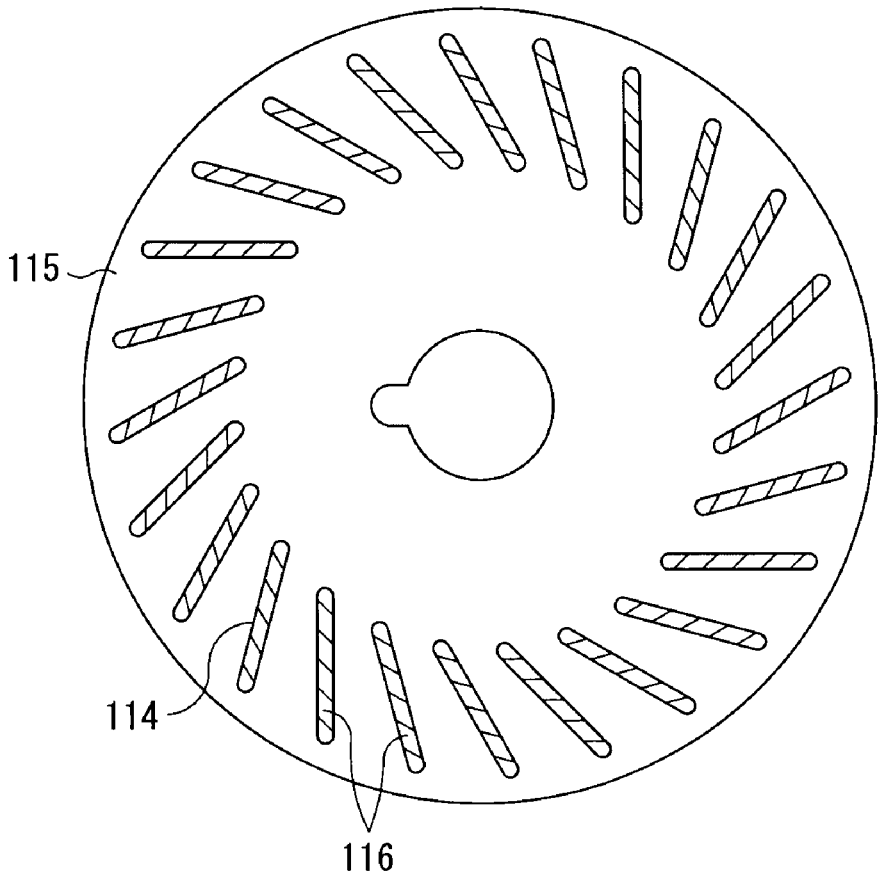
FIG. 4 is a horizontal cross-sectional view schematically illustrating a separator of the wet agitating ball mill shown in FIG. 3.

In the ball mill shown in FIG. 3, the shaft 105 is a shouldered shaft. A separator 106 is put on and fitted to the shaft from the lower end of the shaft, then spacers 107 and disk or pin rotors 108 are alternately put on and fitted to the shaft. Then a stopper 109 is fixed to the lower end of the shaft with a screw 110. Thus, the separator 106, the spacers 107, and the rotors 108 are interposed between the shoulder 105*a* of the shaft 105 and the stopper 109, and fixed in conjunction with each other. The separator 106 includes a pair of disks 115 each provided with blade fitting grooves 114, as shown in FIG. 4, on the inner surfaces facing each other, blades 116 interposing between both of the disks and fitted to the blade fitting grooves 114, and an annular spacer 113 for securing a predetermined distance between these disks 115 and having a hole 112 communicating with a discharging path 111 to define an impeller.

An example of the wet agitating ball mill having a structure shown in this embodiment is an Ultra Apex Mill manufactured by Kotobuki Industries Co., Ltd.

Using the wet agitating ball mill of this embodiment having such a structure, slurry is dispersed through the following procedures: A dispersion medium (not shown) is packed in the stator 17 of the wet agitating ball mill of this embodiment, the rotors 21 and the separator 14 are rotated by driving force from an external power source, while a predetermined amount of slurry is supplied from the supplying port 26. As a result, the slurry is supplied to the interior of the stator 7 through the slit (not shown) formed between the edge of the valve seat and the valve element 35.

The slurry and the dispersion medium in the stator 7 are stirred and mixed by the rotation of the rotors 21 to pulverize the slurry. Furthermore, the dispersion medium and the slurry transferred by the rotation of the separator 14 into the inside of the separator 14 are separated from each other by the difference in specific gravity. The dispersion medium, which has a larger specific gravity, is centrifuged in the radial direction, and the slurry, which has a smaller specific gravity, is discharged through the discharging path 19 in the center of the shaft 15 toward a raw material tank. When the pulverization proceeds to some extent, the particle size may be optionally measured. If a desired particle size is obtained, the raw material pump is stopped once, and then mill driving is stopped to terminate the pulverization.

The wet agitating ball mill used for dispersing metal oxide particles may have a separator of a screen or slit mechanism, but, as described above, an impeller-type is desirable and a vertical impeller type is preferable. The wet agitating ball mill is desirably of a vertical type having a separator at the upper portion of the mill. In particular, when the filling rate of the dispersion medium is adjusted to the aforementioned range, pulverization is most efficiently performed, and the separator can be placed at a position higher than the level of the packed medium. This can prevent leakage of a dispersion medium which is carried on the separator.

[Second Embodiment of Preferable Dispersion Apparatus]

Wet agitating ball mills other than the above-described wet agitating ball mill can be used in the dispersion step. For example, in order to ensure the separation of a dispersion medium from dispersion slurry, a wet agitating mill by a screen separation system is superior to that by a gap, slit, or centrifugation system. A wet agitating mill by the screen separation system has a screen for separating a medium, and slurry and a dispersion medium are separated by filtration through this screen. The wet agitating mill by the screen separation system has an advantage in that it can constantly separate metal oxide particles having a particle diameter distribution according to the present invention from a dispersion medium. In particular, in the case of use of a fine dispersion medium with a 5 to 100 μm diameter, the separation of the dispersion medium by a wet agitating mill of the gap system or the slit system is practically very difficult. Furthermore, in a wet agitating mill by the centrifugation system, the dispersion medium is readily mixed with slurry. In such a case, a coating liquid for an undercoat layer may readily form coating defects, such as streaks.

The screen may have any pore size that can separate a dispersion medium and slurry, and usually is not larger than a half of the diameter of the dispersion medium and preferably not larger than one third of the diameter of the dispersion medium.

Among wet agitating mills by the screen separation system, particularly preferred is a wet agitating mill including a cylindrical container having a slurry inlet at one end, a rotatable agitating shaft extending in the longitudinal direction in the container, and a driving device connected to the agitating shaft at the outside of the container. The agitating shaft includes an agitating member. A medium is placed in a space defined by the agitating shaft and the inner face of the container. The agitating shaft is rotated by the driving device while slurry is fed from the slurry inlet, to pulverize solid components in the slurry. The agitating shaft is provided with a hollow portion having a medium inlet near the other end of the container and is also provided with a slit for connecting the hollow portion to the space defined by the agitating shaft and the inner face of the container. The medium reaches the other end of the container in association with the movement of the slurry, enters the hollow portion of the agitating shaft from the slurry inlet, and then returns from the slit to the space defined by the agitating shaft and the inner face of the container. Thus, the medium circulates. The agitating shaft is provided with a slurry outlet in the hollow portion, and the screen is disposed in the hollow portion so as to surround the slurry outlet and is rotated.

In the wet agitating mill having the above-mentioned preferred structure, more preferably the slurry outlet is provided to the agitating shaft, the screen is fixed to the agitating shaft and is rotated together with the agitating shaft, and a slurry outlet path connected to the slurry outlet is provided in the agitating shaft.

Furthermore, in the wet agitating mill having the above-mentioned preferred structure, more preferably the slurry outlet consists of a rotatable tubular slurry outlet arranged in the hollow portion of the agitating shaft, the screen is fixed to the tubular member, and the tubular member is rotated by a means other than that driving the agitating shaft.

Thus, in the wet agitating mill having such a preferable structure, the screen for separating the dispersion medium from the slurry is rotated. Accordingly, rotary movement is induced in the slurry and the dispersion medium near the screen. Since the centrifugal force in the dispersion medium due to this rotary movement is higher than that in the slurry, the dispersion medium is provided with biasing force departing from the screen. As a result, the dispersion medium is circulated without approaching the screen, and thereby metal oxide particles can be dispersed without causing abnormal heating or abrasion or clogging of the screen.

The preferable structure of the wet agitating mill will now be described in more detail with reference to an embodiment of the wet agitating mill. However, the wet agitating mill used in the present invention is not limited to that exemplified here.

Figure 5A:
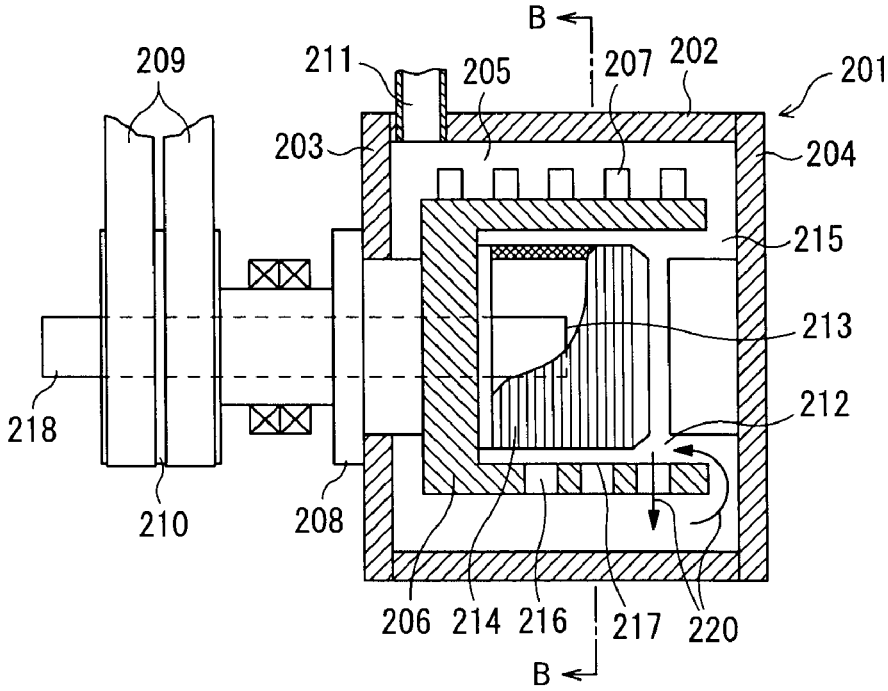
FIGS. 5(A) and 5(B) are both illustrating a first embodiment of a wet agitating mill according to the present invention.
Figure 5B:
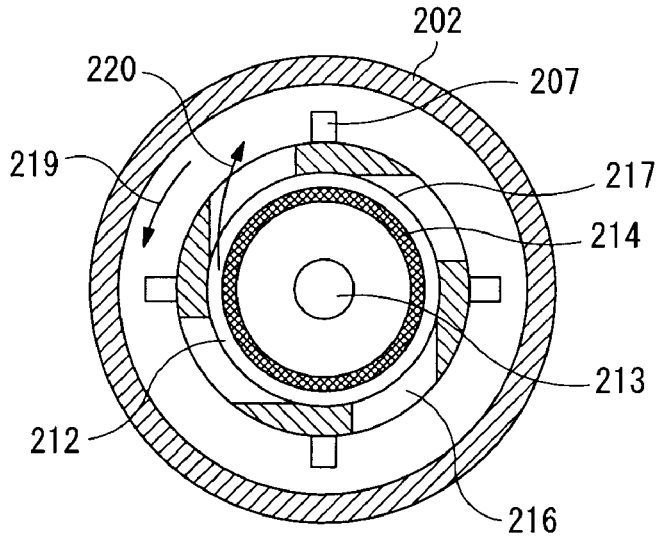

FIGS. 5(A) and 5(B) are a longitudinal cross-sectional view and a horizontal cross-sectional view, respectively, illustrating a first embodiment of the wet agitating mill having such a preferred structure.

As shown in FIGS. 5(A) and 5(B), the wet agitating mill 201 includes a cylindrical container 202 on which a lid member 203 and a bottom member 204 are liquid-tightly mounted. An agitating shaft 206 is rotatably disposed inside the container 202 and extends in the axial direction. A space, i.e., a milling chamber 205, is defined by the agitating shaft 206 and the inner face of the container 202. This milling chamber 205 is filled with a dispersion medium (not shown) such as glass beads or ceramic beads. The dispersion medium has an average particle diameter of 5 to 100 μm, as described above, in order to perform pulverization into a size on the order of nanometer.

To the agitating shaft 206, a plurality of bar-like agitating members 207 are fixed and radially protrude outward in the axial direction with intervals in the circumferential direction. The agitating members 207 may be disk-like instead of bar-like. In the case of being disk-like, a plurality of agitating members 207 is fixed to the agitating shaft 206 with intervals in the axial direction.

A slurry inlet tube 211 serving as an inlet for slurry is fixed to the container 202, to adjacent to the lid member 203 near one end in the axial direction. The agitating shaft 206 has a shaft portion passing through the lid member 203 and extending toward the exterior of the container 202. This shaft portion is supported by a supporting member 208 so as to be rotatable with respect to the container 202, but not movable in the axial direction. A driving device for rotating the agitating shaft 206 is an electric motor or any other appropriate motor, which is not shown in the drawing. The shaft portion of the agitating shaft 206 includes a pulley 210 which is coupled to another pulley (not shown) of the output shaft of a motor via a conveyance belt 209. With this coupling, the agitating shaft 206 is rotated by the motor such as an electric motor.

The agitating shaft 206 has a cup-shaped opening, indicated by reference numeral 215, at an end apart from the slurry inlet tube 211 of the container 202. The agitating shaft 206 has slits 216 in the wall adjacent to the hollow portion 212. The opening 215 at the end of the agitating shaft 206 serves as an inlet for dispersion medium circulation, and the slits 216 serve as outlets 217 for dispersion medium circulation.

In the hollow portion 212 of the agitating shaft 206, a slurry outlet tube 218 passing through the agitating shaft 206 and extending to the inside of the hollow portion 212 is arranged. An end of the slurry outlet tube 218 is located in the hollow portion 212 of the agitating shaft 206 and serves as a slurry outlet 213. The slurry outlet tube 218 communicating with the slurry outlet 213 to form a slurry outlet path running through the agitating shaft 206 in the axial direction.

The hollow portion 212 of the agitating shaft 206 is provided with a screen 214 that surrounds the slurry outlet 213. This screen 214 is fixed to the agitating shaft 206 and is rotated together with the agitating shaft 206.

For the operation, while the agitating shaft 206 is continuously rotated, slurry containing solid components to be dispersed (i.e., metal oxide particles) is continuously introduced from the slurry inlet tube 211 at a predetermined flow rate using a slurry pump (not shown). Since the operation of the wet agitating mill is commonly well known, detailed description is omitted.

In the vicinity of the end apart from the slurry inlet tube 211 of the milling chamber 205, the slurry and the dispersion medium, as shown by arrows 220, enter the inside of the hollow portion 212, which is defined by the opening 215 at the end of the agitating shaft 206, of the agitating shaft 206 from the inlet for dispersion medium circulation. The slurry passes through the screen 214 and is discharged through the slurry outlet tube 218 from the slurry outlet 213. The dispersion medium is biased in the radial direction by the centrifugal force and thereby departs from the screen 214 and return to the milling chamber 205 through the outlet 217 for dispersion medium circulation defined by the slits 216. Therefore, in the case that the dispersion medium has a small diameter, the screen 214 will not be clogged with the dispersion medium. As a result, abnormal abrasion of the screen 214 is prevented and no abnormal heat is generated.

Figure 6:
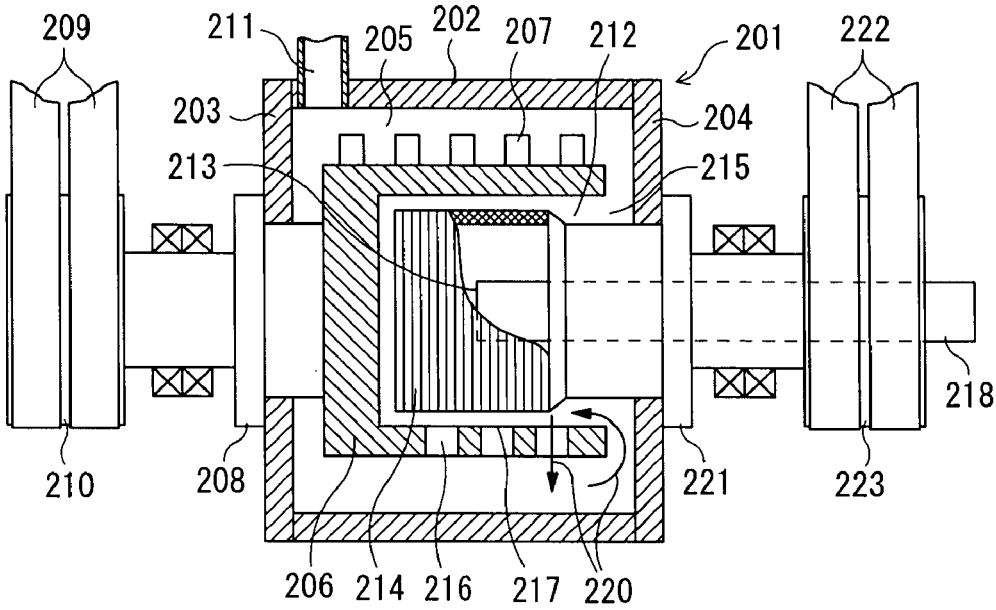
FIG. 6 is a longitudinal cross-sectional view illustrating a second embodiment of a wet agitating mill according to the present invention.

FIG. 6 is a longitudinal cross-sectional view illustrating a second embodiment of a wet agitating mill having the above-described preferable structure. In this embodiment, the components corresponding to the embodiment of FIG. 5 are denoted by the same reference numerals as those in FIG. 5, and only differences from the embodiment of FIG. 5 will be described.

In this embodiment, the slurry outlet tube 218 is separated from the agitating shaft 206. An end of the slurry outlet tube 218 is located in the hollow portion 212 of the agitating shaft 206 and serves as a slurry outlet 213. The screen 214 surrounding the slurry outlet 213 has a rotary shaft passing through the bottom member 204 in the axial direction and extending to the outside of the container 202. This rotary shaft is supported by a supporting member 221 so as to be rotatable relative to the bottom member 204, but not movable in the axial direction. A pulley 223 is fixed to the outside end of the rotary shaft of the screen 214, and this rotary shaft is rotated by a driving device (not shown), such as an electric motor, via conveyance belt 222 wound on the pulley 223. The operation of this embodiment is the same as that of the embodiment of FIG. 5, and the detailed description thereof is omitted.

The wet agitating mill of this embodiment also does not cause clogging of the screen 214 with the dispersion medium, like the first embodiment, in the case that the dispersion medium has a small diameter. As a result, abnormal abrasion of the screen 214 is prevented and no abnormal heat is generated.

Examples of the wet agitating mill having such a preferable structure are Star Mills ZRS2, ZRS4, and ZRS10 (manufactured by Ashizawa Finetech Ltd.) and Pico Mills PCMH-C2M, PCMH-C5M, and PCMH-C20M (manufactured by Asada Iron Works Co., Ltd.).

[Operation Conditions of Dispersion Apparatus]

When metal oxide particles are dispersed in a wet agitating mill such as the aforementioned wet agitating ball mill, the filling rate of the dispersion medium packed in the wet agitating mill is not limited, as long as the metal oxide particles can be dispersed into a predetermined particle size distribution. The filling rate of the dispersion medium packed in the wet agitating mill is usually 50% or more, preferably 70% or more, and more preferably 80% or more and usually 100% or less, preferably 95% or less, and more preferably 90% or less.

The operation conditions of the wet agitating ball mill applied to the dispersion of metal oxide particles are not limited within the scope that does not significantly impair the effects of the present invention. However, the operation conditions affect the volume average particle diameter Mv and the 90% cumulative particle diameter D90 of the metal oxide particles in a coating liquid for forming an undercoat layer, the stability of the coating liquid for forming the undercoat layer, the surface shape of the undercoat layer formed by applying the coating liquid for forming the undercoat layer, and characteristics of an electrophotographic photoreceptor having the undercoat layer formed by applying the coating liquid for forming the undercoat layer. In particular, the coating rate of the slurry and the rotation velocity of the rotor have significant influences.

In dispersion using a wet agitating mill, a dispersion medium having a small particle diameter is used, and metal oxide particles are supplied at a high rate (a high flow rate of the slurry) while the rotor is driven at a low rotation velocity (a low circumferential velocity), so that the impact force against the metal oxide particles in the slurry can be reduced. Accordingly, the size of the particles can be reduced. In addition, the size distribution of the resulting metal oxide particles can be narrowed (the number of fine particles and coarse particles is small) and the particles have rounded shapes. Accordingly, such conditions are desirable.

The slurry-supplying rate depends on the residence time on the slurry in the wet agitating mill because it varies depending on the volume and shape of the mill. In the case of a stator usually used, it is generally 20 kg/hr or more and preferably 30 kg/hr and usually 80 kg/hr or less and preferably 70 kg/hr or less per liter of the wet agitating ball mill.

The rotation velocity of the rotor is affected by parameters such as the shape of the rotor or the distance from the stator. In the case of a stator and a rotor usually used, the circumferential velocity at the top end of the rotor is usually 1 m/sec or more, preferably 3 m/sec or more, more preferably 5 m/sec or more, and further preferably 6 m/sec or more, particularly preferably 8 m/sec or more, and most preferably 10 m/sec or more and usually 20 m/sec or less, preferably 15 m/sec or less, and more preferably 12 m/sec or less.

Furthermore, the amount of the dispersion medium is not limited. However, the volume ratio of the dispersion medium to slurry is usually 0.5 or more and preferably 1 or more and usually 5 or less. In the dispersion, a dispersion aid that can be readily removed after the dispersion may be used together with the dispersion medium. Examples of the dispersion aid include sodium chloride and sodium sulfate. The dispersion aids may be used alone or in any combination of two or more in any ratio.

The dispersion of metal oxide particles is preferably carried out by a wet process in the presence of a dispersion solvent. In addition to the dispersion solvent, any additional component may be present as long as the metal oxide particles can be properly dispersed. Examples of such an additional component include a binder resin and various kinds of additives.

Any dispersion solvent can be used without limitation, but the solvent that is used in the aforementioned coating liquid for forming an undercoat layer is preferably used because of no requirement of steps, such as exchange of solvent, after the dispersion. These dispersion solvents may be used alone or as a solvent mixture of two or more kinds in any combination and any ratio.

The amount of the dispersion solvent used is in the range of usually 0.1 part by weight or more and preferably 1 part by weight or more and usually 500 parts by weight or less and preferably 100 parts by weight or less, on the basis of 1 part by weight of metal oxide particles to be dispersed, from the viewpoint of productivity.

Furthermore, desirably, the rate of the solid components to the dispersion (slurry) is usually 8 mass % or more and preferably 10 mass % or more and usually 70 mass % or less and preferably 65 mass % or less. Here, the term "dispersion" means liquid itself to be dispersed and does not necessarily mean "coating liquid". That is, the dispersion after dispersion treatment may be directly used as a "coating liquid" or may be blended with a solid binder resin and/or a binder resin solution and other components to prepare "coating liquid".

The term "solid component" means metal oxide particles and a binder resin in the dispersion. A smaller mass ratio of the solid components to the entire dispersion may cause agglomeration, due to excess dispersion, of the metal oxide particles. A larger ratio may reduce the fluidity of the dispersion to cause poor dispersion.

The mechanical dispersion can be carried out at any temperature from the freezing point to the boiling point of a solvent (or solvent mixture), but is carried out at a temperature of usually 5° C. or higher and preferably 10° C. or higher and usually 200° C. or lower from the viewpoint of safe manufacturing operation.

[Treatment after Dispersion Treatment]

After the dispersion treatment using a dispersion medium, the metal oxide particles may be directly used in a coating liquid for forming an undercoat layer of the present invention, but, usually, it is preferable that the dispersion medium be separated from the slurry and subjected to further ultrasonic treatment. The ultrasonic treatment involves ultrasonic vibration to the metal oxide particles.

Conditions, such as a vibration frequency, for the ultrasonic treatment are not particularly limited, but ultrasonic vibration with a frequency of usually 10 kHz or more and preferably 15 kHz or more and usually 40 kHz or less and preferably 35 kHz or less from an oscillator is used.

Furthermore, the output of an ultrasonic oscillator is not particularly limited, but is usually 100 W to 5 kW.

In general, dispersion treatment of a small amount of slurry with ultrasound from a low output ultrasonic oscillator is more efficient compared to that of a large amount of slurry with ultrasound from a high output ultrasonic oscillator. Therefore, the amount of slurry to be treated at once is usually 1 L or more, preferably 5 L or more, and more preferably 10 L or more and usually 50 L or less, preferably 30 L or less, and more preferably 20 L or less. The output of an ultrasonic oscillator in such a case is preferably 200 W or more, more preferably 300 W or more, and most preferably 500 W or more and preferably 3 kW or less, more preferably 2 kW or less, and most preferably 1.5 kW or less.

The method of applying ultrasonic vibration to metal oxide particles is not particularly limited. For example, the treatment is carried out by directly immersing an ultrasonic oscillator in a container containing slurry, bringing an ultrasonic oscillator into contact with the outer wall of a container containing slurry, or immersing a container containing slurry in a liquid to which vibration is applied with an ultrasonic oscillator. Among these methods, a preferred method is the immersing of a container containing slurry in a liquid to which vibration is applied with an ultrasonic oscillator.

In such a case, the liquid to which vibration is applied with an ultrasonic oscillator is not limited, and examples thereof include water; alcohols such as methanol; aromatic hydrocarbons such as toluene; and oils such as a silicone oil. In particular, water is preferred, in consideration of safe manufacturing operation, cost, washing properties, and other factors.

In the immersion of the container containing slurry in a liquid to which vibration is applied with an ultrasonic oscillator, since the efficiency of the ultrasonic treatment varies depending on the temperature of the liquid, it is preferable to maintain the temperature of the liquid constant. The applied vibration may raise the temperature of the liquid that is subjected to the ultrasonic vibration. The temperature of the liquid subjected to the ultrasonic treatment is in the range of usually 5° C. or higher, preferably 10° C. or higher, and more preferably 15° C. or higher and usually 60° C. or lower, preferably 50° C. or lower, and more preferably 40° C. or lower.

The container for containing the slurry treated with ultrasound is not limited. For example, any container that is usually used for containing a coating liquid for forming an undercoat layer, which is used for forming a photosensitive layer of an electrophotographic photoreceptor, can be also used. Examples of the container include containers made of resins such as polyethylene or polypropylene, glass containers, and metal cans. Among them, metal cans are preferred. In particular, an 18-liter metal can prescribed in JIS Z 1602 is preferred because of its high resistances to organic solvents and impacts.

The slurry after dispersion or after ultrasonic treatment may be subjected to additional steps before use. For example, in order to remove coarse particles, the slurry may be filtered before use, according to need. The filtration medium in such a case may be any filtering material that is usually used for filtration, such as cellulose fiber, resin fiber, or glass fiber. Preferred forms of the filtration medium include a so-called wound filter, which is made of a fiber wound around a core material and has a large filtration area to achieve high efficiency. Any known core material can be used, and examples thereof include stainless steel core materials and core materials made of resins, such as polypropylene, that are not dissolved in the slurry and not dissolved in the solvent contained in the slurry.

To the resulting slurry, a solvent, a binder resin (binder), and other optional components (e.g., auxiliary agents) are further added to give a coating liquid for forming an undercoat layer. The metal oxide particles may be mixed with the solvent of the coating liquid for forming an undercoat layer, the binder resin, and the other optional components, in any step of before, during, or after the dispersion or ultrasonic treatment process. Therefore, the metal oxide particles may be mixed with the solvent of the coating liquid for forming an undercoat layer, the binder resin, and the other optional components, in any step of the dispersion process or before, during, or after the ultrasonic treatment process. Thus, mixing of the metal oxide particles with the solvent, the binder resin, or the other components may not necessarily be carried out after the dispersion or ultrasonic treatment.

Furthermore, the coating liquid for forming an undercoat layer may be prepared by extracting the metal oxide particles from the slurry and then mixing the metal oxide particles with the binder resin, the solvent, and the other components. In such a case, the order and the time of the mixing are not limited.

The coating liquid for forming an undercoat layer can be efficiently produced and also can have higher storage stability according to the method of the present invention. Therefore, an electrophotographic photoreceptor with higher quality can be efficiently obtained.

[III-3. Formation of Undercoat Layer]

The undercoat layer according to the present invention can be formed by applying the coating liquid for forming an undercoat layer according to the present invention onto an electroconductive support and drying it. The method of applying the coating liquid for forming an undercoat layer according to the present invention is not limited, and examples thereof include dip coating, spray coating, nozzle coating, spiral coating, ring coating, bar-coat coating, roll-coat coating, and blade coating. These coating methods may be carried out alone or in any combination of two or more kinds.

Examples of the spray coating include air spray, airless spray, electrostatic air spray, electrostatic airless spray, rotary atomizing electrostatic spray, hot spray, and hot airless spray. In consideration of the fineness of grains for obtaining a uniform thickness and adhesion efficiency, a preferred method is rotary atomizing electrostatic spray disclosed in Japanese Domestic Re-publication (Saikohyo) No. HEI 1-805198, that is, continuous conveyance without spacing in the axial direction with rotation of a cylindrical work. This can give an electrophotographic photoreceptor excellent in uniformity of thickness of the undercoat layer at overall high adhesion efficiency.

Examples of the spiral coating method include a method using an injection applicator or a curtain applicator, which is disclosed in Japanese Unexamined Patent Application Publication No. SHO 52-119651; a method of continuously spraying paint in the form of a line from a small opening, which is disclosed in Japanese Unexamined Patent Application Publication No. HEI 1-231966; and a method using a multi-nozzle body, which is disclosed in Japanese Unexamined Patent Application Publication No. HEI 3-193161.

In the case of the dip coating, in general, the total solid content in a coating liquid for forming an undercoat layer is in a range of usually 1 weight % or more and preferably 10 weight % or more and usually 80 mass % or less, preferably 50 weight % or less, and more preferably 35 weight % or less; and the viscosity is in a range of preferably 0.1 cps or more and preferably 100 cps or less, where 1 cps=$1\times10^{-3}$ Pa·s.

After the application, the coating is dried. It is preferable that the drying temperature and time be adjusted so that necessary and sufficient drying is performed. The undercoat layer is usually dried in air under normal temperature and normal pressure, but may be heated. In the heat drying, the drying temperature is in a range of usually 100° C. or higher, preferably 110° C. or higher, more preferably 115° C. or higher, and most preferably 120° C. or higher and usually 250° C. or lower, preferably 180° C. or lower, more preferably 170° C. or lower, and most preferably 140° C. or lower. The drying method is not limited. For example, a hot air dryer, a steam dryer, an infrared dryer, or far-infrared dryer can be used.

Furthermore, when the binder resin is a thermosetting resin, the resin is hardened during or after the drying by heating the resin to a desired temperature. When the binder resin is a light curing resin, the resin is hardened by irradiation with light emitted from, for example, an electric light bulb, a low-pressure mercury vapor lamp, a high-pressure mercury vapor lamp, a metal halide lamp, a xenon lamp, or a light-emitting diode. In such a case, it is preferable that conditions such as the lamp, output, wavelength, and emitting time are suitably controlled according to the characteristics of the light curing resin. For details, for example, Hikari Koka Gijutsu Zitsuyo Gaido (Photosetting Technology Practice Guide) (Technonet Co., Ltd., 2002) describes conditions, and it is preferable that hardening be performed under such conditions.

[IV. Photosensitive Layer]

The photosensitive layer can have any composition that can be applied to a known electrophotographic photoreceptor. Examples of the photoreceptor include a so-called single-layer photoreceptor, which has a photosensitive layer (i.e., monolayer photosensitive layer) of a monolayer dissolving or dispersing a photoconductive material such as a charge-generating material or a charge-transporting material in a binder resin; and a so-called multilayered photoreceptor, which has a photosensitive layer (i.e., multi layered photosensitive layer) consisting of a plurality of layers such as a charge-generating layer containing a charge-generating material and a charge-transporting layer containing a charge-transporting material. It is known that the monolayer and layered photoconductive materials have equivalent functions.

The photoreceptive layer of the electrophotographic photoreceptor of the present invention may be present in any known form, but is preferably a layered photoreceptor, by taking mechanical physical properties, electric characteristics, manufacturing stability, and other characteristics into comprehensive consideration. In particular, a normally layered photoreceptor in which an undercoat layer, a charge-generating layer, and a charge-transporting layer are deposited on an electroconductive support in this order is more preferable.

The photosensitive layer according to the present invention contains a binder resin (ester-containing resin) having an ester bond.

[IV-1. Binder Resin Having Ester Bond]

The photosensitive layer according to the present invention contains an ester-containing resin. The ester-containing resin is a binder resin having an ester bond, and any resin that contains ester bonds can be used.

Examples of the ester-containing resin include polycarbonate resins, polyester resins, and polyester polycarbonates. Among polyester resins, preferred are polyarylate resins. In particular, ester-containing resins that contain a bisphenol component or a biphenol component corresponding to a monomer of which the structure is shown below (Example 1) are preferred from the viewpoints of sensitivity and residual potential.

That is, the ester-containing resins containing a bisphenol component or a biphenol component corresponding to a monomer of which the structure is shown below (Example 1) are preferred from the viewpoints of sensitivity or residual potential of the electrophotographic photoreceptor of the present invention. In particular, among these ester-containing resins containing a bisphenol component or a biphenol component, polycarbonate resins and polyarylate resins are preferable. The polycarbonate resins are more preferred from the viewpoint of mobility.

The examples shown below are for mere illustration, and the present invention is not limited to the structures exemplified below.

[Chemical Formula 6]

[Example 1]

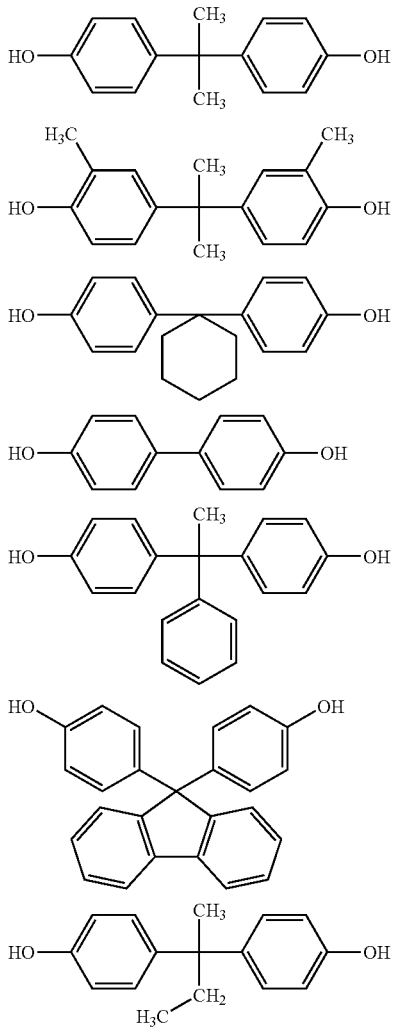

Furthermore, when the polycarbonate resin as the ester-containing resin contains a bisphenol component, it is preferred that the bisphenol component be a bisphenol derivative having a structure shown below (Example 2) because of its significant effects.

[Chemical Formula 7]

[Example 2]

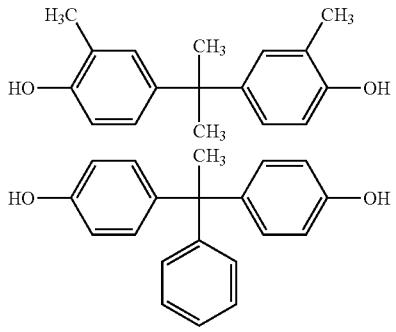

-continued

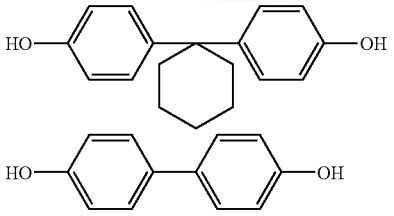

On the other hand, in order to improve the mechanical properties of the photosensitive layer, the ester-containing resin is preferably a polyester resin. In particular, a polyarylate resin is preferred. In such a case, the polyester resin or the polyarylate resin preferably contains a bisphenol component having a structure shown below (Example 3) as a monomer component.

[Chemical Formula 8]

[Example 3]

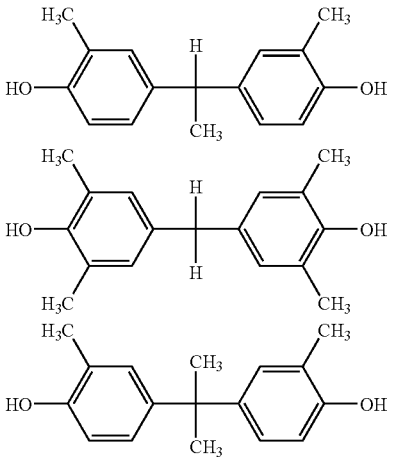

When the ester-containing resin used contains a bisphenol component having a structure shown above (Example 3) as a monomer component, the acid component corresponding to it is preferably a monomer having a structure shown below (Example 4). Furthermore, among the following examples, when both a component corresponding to terephthalic acid and a component corresponding to isophthalic acid are used, it is preferable that the molar ratio of the component corresponding to terephthalic acid is higher than that of the other.

[Chemical Formula 9]

[Example 4]

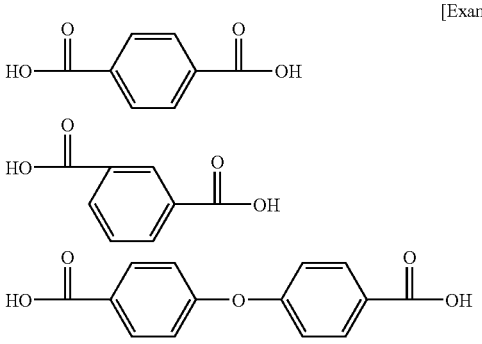

-continued

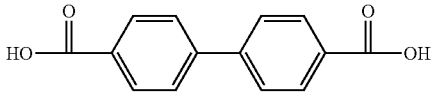

The exemplified bisphenol components, biphenol components, or acid components may be used alone or in any combination of two or more kinds in any ratio. Accordingly, one molecule of the ester-containing resin may contain two or more kinds of the exemplified components.

Furthermore, the ester-containing resin according to the present invention may contain another component, in addition to the bisphenol component, the biphenol component, and the acid component.

The ester-containing resin according to the present invention may have any viscosity-average molecular weight that does not significantly impair the effects of the present invention, but it is usually 10000 or more, preferably 20000 or more, and more preferably 30000 or more and usually 200000 or less, preferably 100000 or less, and more preferably 60000 or less. A smaller viscosity-average molecular weight of the ester-containing resin may decrease the mechanical strength of a photosensitive layer. A larger viscosity-average molecular weight may make it difficult to form a photosensitive layer using the coating liquid.

The viscosity-average molecular weight of the ester-containing resin is defined by measurement and calculation by the following method:

An ester-containing resin to be measured is dissolved in dichloromethane to prepare a solution with a concentration C of 6.00 g/L. The flow time t of the sample solution is measured in a thermostatic bath controlled at 20.0° C. with an Ubbelohde capillary viscometer having a flow time $t_0$ of 136.16 seconds for the solvent (dichloromethane). The viscosity-average molecular weight Mv is calculated by the following expressions:

$$a=0.438\times\eta_{sp}+1 \quad \eta_{sp}=(t/t_0)-1$$

$$b=100\times\eta_{sp}/C \quad C=6.00$$

$$\eta=b/a$$

$$Mv=3207\times\eta^{1.205}$$

The ester-containing resin according to the present invention may contain any amount of ester bonds. However, the ratio (weight ratio) of the ester bonds (—COO—) in an ester-containing resin molecule is usually 1% or more, preferably 5% or more, and more preferably 10% or more and usually 60% or less, preferably 50% or less, and more preferably 40% or less. A smaller amount of the ester bond in the ester-containing resin may impair the effects of the present invention, and a larger amount may deteriorate the electric characteristics of the electrophotographic photoreceptor.

The ratio of the ester bond in an ester-containing resin can be measured by, for example, $^1$H-NMR analysis.

The ester-containing resin according to the present invention may be produced by any method, but is preferably produced by interfacial polymerization. The interfacial polymerization is a process involving a polycondensation reaction proceeding at the interface of two or more solvents that are immiscible with each other (for example, organic solvent-aqueous solvent). Use of the ester-containing resin produced by the interfacial polymerization can improve the electric characteristics of an electrophotographic photoreceptor.

In an example of the interfacial polymerization, a binder resin is prepared by mixing dicarboxylic chloride dissolved in an organic solvent and a glycol component dissolved in alkaline water or the like at ambient temperature, separating the mixture into two phases, and performing a copolymerization reaction at the interface therebetween. Another example of two components is a combination of phosgene and a glycol aqueous solution. Furthermore, as in the condensation of polycarbonate oligomer by interfacial polymerization, the interface may be used as a site for polymerization, not for separating two components into two phases.

Any reaction solvent can be used within the scope that can progress interfacial polymerization, but an organic phase and an aqueous phase are usually used. In such a case, the organic phase is preferably methylene chloride, and the aqueous phase is preferably an alkaline aqueous solution. The organic phases and the aqueous phases may be respectively used alone or in any combination of two or more kinds.

Furthermore, a catalyst (usually condensation catalyst) is preferably incorporated in the reaction. The amount of the catalyst used in the reaction does not have limitation, and usually is 0.005 mol % or more and preferably 0.03 mol % or more and usually 0.1 mol % or less and preferably 0.08 mol % or less, on the basis of diol. A larger amount of the catalyst may require a large amount of work for extractive removal of the solvent in the washing process after the polycondensation.

The reaction temperature is not limited within the scope that the interfacial polymerization progresses, but is usually 10° C. or higher and usually 80° C. or lower, preferably 60° C. or lower, and more preferably 50° C. or lower. When the reaction temperature is too high, side reaction may not be controlled. On the other hand, a lower reaction temperature is a preferable condition for reaction control, but it may increase the refrigeration load to cause an increase in cost by that much.

The reaction time varies depending on reaction temperature, but is usually 0.5 minute or longer and preferably 1 minute or longer and usually 10 hours or shorter and preferably 4 hours or shorter.

The concentrations of the monomer, oligomer, and produced ester-containing resin in the organic phase and the aqueous phase are not limited. However, the concentrations of the monomer, oligomer, and ester-containing resin in the organic phase are preferably adjusted within ranges that the prepared product (composition containing the ester-containing resin) can be dissolved therein for retrieving the produced ester-containing resin by dissolving it in the organic phase. Specifically, the concentrations of the monomer, oligomer, and ester-containing resin in the organic phase are usually 5 to 40 weight %.

Furthermore, the ratio of the organic phase to the aqueous phase is not limited within the range that the interfacial polymerization progresses. However, the volume ratio of the organic phase to the aqueous phase is usually 0.2 time or more, preferably 0.5 time or more, and more preferably 0.8 times or more and usually 3 times or less, preferably 2 times or less, and more preferably 1.5 times or less. The degree of polymerization can be readily controlled by the ratio of an organic phase to an aqueous phase is adjusted within the above-mentioned range.

The amount of the solvent used is not limited. However, the amount of solvent is desirably controlled so that the concentration of the resin (ester-containing resin) produced in the organic phase by polycondensation is usually 5 weight % or more, preferably 8 weight % or more, and more preferably 10 weight % or more and usually 30 weight % or less, preferably 25 weight % or less, and more preferably 20 weight % or less. A smaller concentration of the resin produced in the organic phase may reduce the polymerization reaction rate, resulting in a decrease in productivity, and a larger concentration may cause inhomogeneous polymerization.

In general, the amount of an organic phase is adjusted such that the concentration of the resin produced in the organic phase is in the above-described proper range, and then the amount of an aqueous phase is adjusted such that the ratio of the amount of the aqueous phase to the amount of the organic phase becomes suitable. These are brought into contact by, for example, mixing. Then, a catalyst is optionally added to the mixture in order to adjust polycondensation conditions, and desired polycondensation is accomplished by an interfacial polycondensation process. Monomer or oligomer to be polymerized may be added to the organic phase or the aqueous phase at any stage of the polymerization.

The ester-containing resin according to the present invention is preferably a binder resin made of aromatic diol as raw material. In such a case, particularly preferable aromatic diol compounds are represented by the following Formula (iii):

[Chemical Formula 10]

(iii)

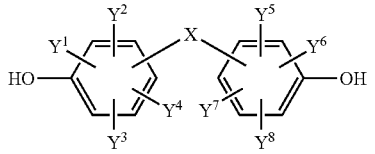

In Formula (iii), X represents:

[Chemical Formula 11]

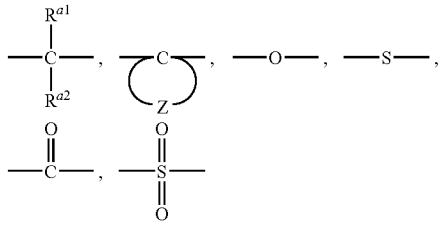

or a single bond, wherein $R^{a1}$ and $R^{a2}$ each independently represents a hydrogen atom, an alkyl group with 1 to 20 carbon atoms, an optionally substituted aryl group, or an alkyl halide group; and Z represents a substituted or unsubstituted carbon ring with 4 to 20 carbon atoms; and $Y^1$ to $Y^8$ each independently represents a hydrogen atom, a halogen atom, an alkyl group with 1 to 20 carbon atoms, an optionally substituted aryl group, or an alkyl halide group.

Use of aromatic diol compound represented by Formula (iii) as the raw material can improve electric characteristics of the electrophotographic photoreceptor.

[IV-2. Charge-Generating Layer]

The charge-generating layer contains a charge-generating material. Any known charge-generating material can be used within the scope that does not significantly impair the effects of the present invention.

Examples of the charge-generating material are various kinds of photoconductive materials including inorganic photoconductive materials such as selenium and alloys thereof and cadmium sulfide; and organic pigments such as phthalocyanine pigments, azo pigments, dithioketopyrrolopyrrole pigments, squalene (squalilium) pigments, quinacridone pigments, indigo pigments, perylene pigments, polycyclic quinone pigments, anthanthrone pigments, benzimidazole pigments, cyanine pigments, pyrylium pigments, thiapyrylium pigments, and squearic acid pigments. Among them, organic pigments are particularly preferred, and phthalocyanine pigments and azo pigments are more preferred. The phthalocyanine pigments can give photoreceptors with high sensitivity to laser light having a relatively long wavelength, and the azo pigments have sufficient sensitivity to white light and laser light having a relatively short wavelength. Thus, both pigments are excellent.

Among them, examples of the phthalocyanine pigments include various crystal forms of metal-free phthalocyanine and phthalocyanines with which metals such as copper, indium, gallium, tin, titanium, zinc, vanadium, silicon, and germanium, or oxides thereof, halides thereof, hydroxides thereof, alkoxides thereof, or the like are coordinated. In particular, preferred are crystal forms with high-sensitivity, e.g., metal-free phthalocyanines of X-type and Σ-type, titanyl phthalocyanine (alias: oxytitanium phthalocyanine) such as A-type (alias: β-type), B-type (alias: α-type), and D-type (alias: Y-type), vanadyl phthalocyanine, chloroindium phthalocyanine, chlorogallium phthalocyanine such as II-type, hydroxygallium phthalocyanine such as V-type, μ-oxo-gallium phthalocyanine dimer such as G-type and I-type, and μ-oxo-aluminum phthalocyanine dimer such as II-type. Among these phthalocyanine pigments, particularly preferred are A-type (β-type), B-type (α-type), and D-type (Y-type) oxytitanium phthalocyanine, II-type chlorogallium phthalocyanine, V-type hydroxygallium phthalocyanine, and G-type μ-oxo-gallium phthalocyanine dimer.

In particular, preferred is oxytitanium phthalocyanine showing a distinct main diffraction peak at a Bragg angle (2θ±0.2°) of 27.3° in a powder X-ray diffraction spectrum to CuKα characteristic X-ray. In such a case, particularly preferred is oxytitanium phthalocyanine showing main diffraction peaks at 9.5°, 24.1°, and 27.3°.

In general, the powder X-ray diffraction spectrum to CuKα characteristic X-rays can be measured by conventional X-ray diffractometry for solid powder.

Preferably, oxytitanium phthalocyanine further shows another distinct diffraction peak at a Bragg angle (2θ+0.2°) of 9.0° to 9.8° in the powder X-ray diffraction spectrum to CuKα characteristic X-rays.

In particular, oxytitanium phthalocyanine having peaks at Bragg angles (2θ±0.2°) of 9.0°, 9.6°, or 9.5° and 9.7° are preferred. That is, it is preferable that the oxytitanium phthalocyanine shows a distinct main diffraction peak at a Bragg angle (2θ=0.2°) of 9.0° or a distinct diffraction peak at a Bragg angle (2θ±0.2°) of 9.6° or distinct diffraction peaks at Bragg angles (2θ+0.2°) of 9.5° and 9.7° in the powder X-ray diffraction spectrum to CuKα characteristic X-rays.

However, the oxytitanium phthalocyanine preferably do not show a distinct diffraction peak at a Bragg angle (2θ+0.2°) of 26.3°.

Furthermore, examples of the phthalocyanine pigments preferably include oxytitanium phthalocyanine showing main diffraction peaks at Bragg angles (2θ±0.2°) of 9.3°, 13.2°, 26.2°, and 27.1° in the X-ray diffraction spectrum to CuKα characteristic X-rays, dihydroxysilicon phthalocyanine showing main diffraction peaks at 9.2°, 14.1°, 15.3°, 19.7°, and 27.1°, dichlorotin phthalocyanine showing main diffraction peaks at 8.5°, 12.2°, 13.8°, 16.9°, 22.4°, 28.4°, and 30.1°, hydroxygallium phthalocyanine showing main diffraction peaks at 7.5°, 9.9°, 12.5°, 16.3°, 18.6°, 25.1°, and 28.3°, and chlorogallium phthalocyanine showing diffraction peaks at 7.4°, 16.6°, 25.5°, and 28.3°.

In addition, the chlorine content in the oxytitanium phthalocyanine crystal is preferably 1.5 weight % or less. The chlorine content can be determined by elemental analysis.

Furthermore, in the oxytitanium phthalocyanine crystal, the ratio of chlorinated oxytitanium phthalocyanine represented by the following formula (5) to unsubstituted oxytitanium phthalocyanine represented by the following formula (6) is usually 0.070 or less, preferably 0.060 or less, and more preferably 0.055 or less, on the basis of the intensity of mass spectra. Furthermore, when a dry milling method is employed for forming an amorphous form in a manufacturing process, the ratio is preferably 0.02 or more, and when an acid-paste method is employed for forming an amorphous form, the ratio is preferably 0.03 or less. The amount of substituted chlorine can be measured according to a method described in Japanese Unexamined Patent Application Publication No. 2001-115054.

[Chemical Formula 12]

(5)

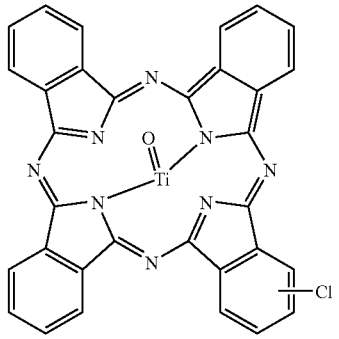

m/z: 610

(6)

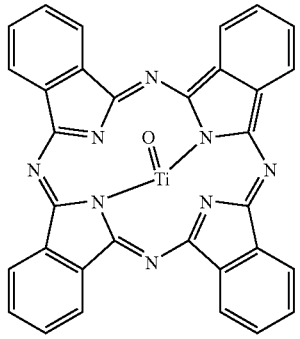

m/z: 576

The particle diameter of the oxytitanium phthalocyanine significantly varies depending on its production process, crystal formation, and other conditions, but is preferably 500 nm or less in consideration of dispersibility and is preferably 300 nm or less in consideration of coating characteristics for forming a film.

The oxytitanium phthalocyanine may be substituted with a substituent, such as a fluorine atom, a nitro group, or a cyano group, other than chlorine atom. Furthermore, the oxytitanium phthalocyanine may contain various kinds of oxytitanium phthalocyanine derivatives having a substituent such as a sulfone group.

The oxytitanium phthalocyanine may be produced by any process without limitation. For example, dichlorotitanium phthalocyanine is synthesized with phthalonitrile and titanium halide as raw materials; the dichlorotitanium phthalocyanine is hydrolyzed into an oxytitanium phthalocyanine composition intermediate, followed by purification; the oxytitanium phthalocyanine composition intermediate is converted into an amorphous oxytitanium phthalocyanine composition, which is then crystallized (crystallization) in a solvent.

This production process will now be described.

The titanium halide may be any halide that can give oxytitanium phthalocyanine, and titanium chloride is preferred. Examples of titanium chloride include titanium tetrachloride and titanium trichloride, and particularly preferred is titanium tetrachloride. Use of titanium tetrachloride can readily control the content of chlorinated oxytitanium phthalocyanine in the resulting oxytitanium phthalocyanine composition.

In addition, the titanium halides may be used alone or in any combination of two or more kinds in any ratio.

The synthesis of dichlorotitanium phthalocyanine from phthalonitrile and titanium halide as raw materials may be carried out at any reaction temperature within the range that the reaction proceeds, but is carried out usually at 150° C. or higher and preferably at 180° C. or higher. In the case that the titanium chloride is used as titanium halide, the reaction temperature is more preferably 190° C. or higher and usually 300° C. or lower, preferably 250° C. or lower, and more preferably 230° C. or lower, in order to control the content of chlorinated oxytitanium phthalocyanine.

In general, titanium chloride is mixed with a mixture of phthalonitrile and a reaction solvent. In such a case, titanium chloride may be directly mixed with the mixture at a temperature not higher than the boiling point thereof or may be mixed with the mixture after being mixed with a solvent having a high boiling point of 150° C. or more.

For example, in the case that phthalonitrile and titanium tetrachloride are used for producing oxytitanium phthalocyanine in diarylalkane as a reaction solvent, titanium tetrachloride is partly added to phthalonitrile at a low temperature of 100° C. or lower and then the moiety is added at a high temperature of 180° C. or higher to optimize production of oxytitanium phthalocyanine.

The resulting dichlorotitanium phthalocyanine is hydrolyzed, and the oxytitanium phthalocyanine composition intermediate obtained after purification is converted into an amorphous form. The amorphous form may be obtained by any method, for example, by pulverization with a known mechanical pulverizer such as a paint shaker, a ball mill, or a sand grind mill; or by a so-called acid-paste method involving dissolution of the intermediate in concentrated sulfuric acid and then solidification of it in cold water. The mechanical pulverization is preferred from the viewpoint of dark decay, while the acid-paste method is preferred from the viewpoint of sensitivity and environmental dependence.

A composition containing oxytitanium phthalocyanine (oxytitanium phthalocyanine composition) is obtained by crystallizing the resulting amorphous oxytitanium phthalocyanine composition using a known solvent. Examples of the solvent preferably used in this step include halogenated aromatic hydrocarbon solvents such as ortho-dichlorobenzene, chlorobenzene, and chloronaphthalene; halogenated hydrocarbon solvents such as chloroform and dichloroethane; aromatic hydrocarbon solvents such as methylnaphthalene, toluene, and xylene; ester-based solvents such as ethyl acetate and butyl acetate; ketone solvents such as methyl ethyl ketone and acetone; alcohols such as methanol, ethanol, butanol, and propanol; ether-based solvents such as ethyl ether, propyl ether, and butyl ether; monoterpene-type hydrocarbon solvents such as terpinolene and pinene; and fluid paraffin. Among them, for example, ortho-dichlorobenzene, toluene, methylnaphthalene, ethyl acetate, butyl ether, and pinene are preferred.

The solvents for crystallization may be used alone or in any combination of two or more kinds in any ratio.

The phthalocyanine pigment may be a mixed crystal state. Here, the mixed crystal state of the phthalocyanine pigment or that in a crystal state may be obtained by mixing respective constituents afterwards or by causing the mixed state in any production or treatment process of the phthalocyanine pigment, such as synthesis, pigment formation, or crystallization. Examples of such treatment are acid-paste treatment, milling treatment, and solvent treatment. To cause a mixed crystal state, for example, as described in Japanese Unexamined Patent Application Publication No. 10-48859, two different crystals are mixed and are then mechanically milled into an amorphous state, and then the mixture is converted into a specific crystal state by solvent treatment.

Examples of the azo pigments preferably include a variety of known bisazo pigments and trisazo pigments.

Preferable examples of the azo pigments are shown below. In the following structural formulae, $Cp^1$, $Cp^2$, and $Cp^3$ each independently represents a coupler.

[Chemical Formula 13]

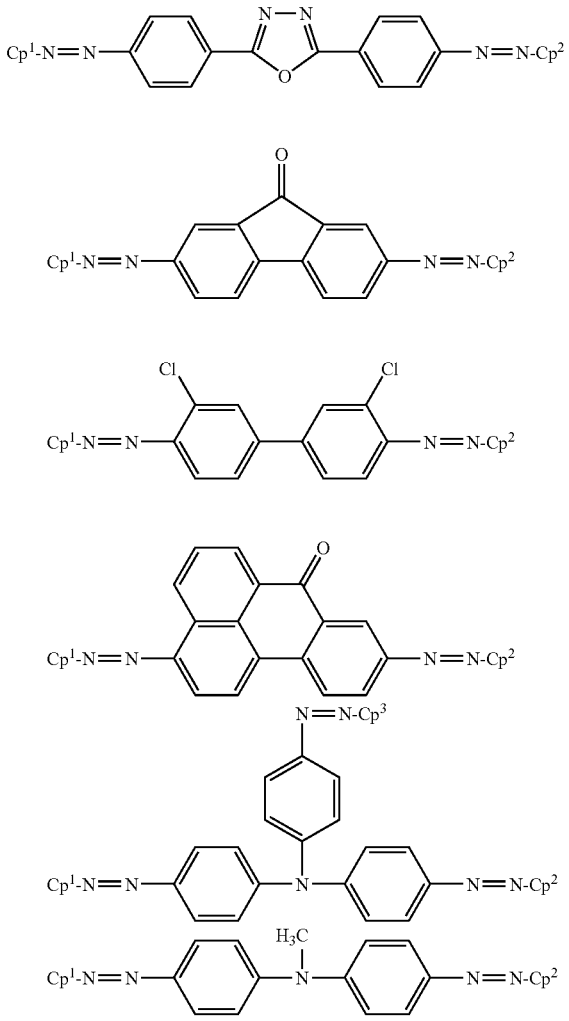

The couplers, $Cp^1$, $Cp^2$, and $Cp^3$, preferably have the following structures:
[Chemical Formula 14]
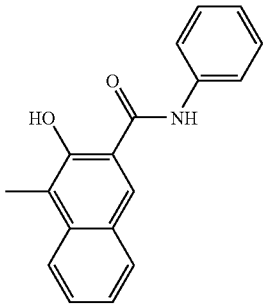
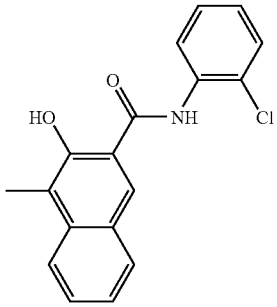
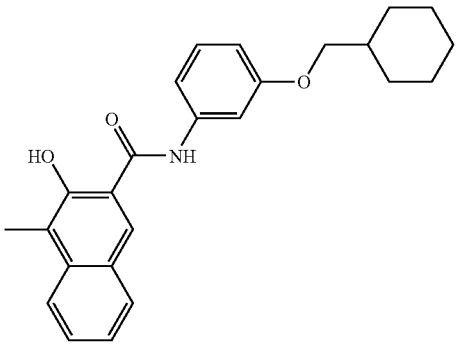
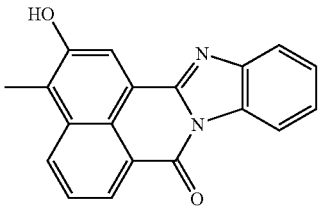
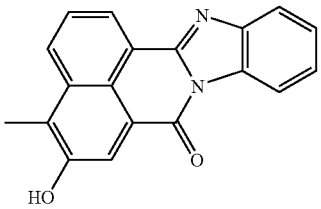
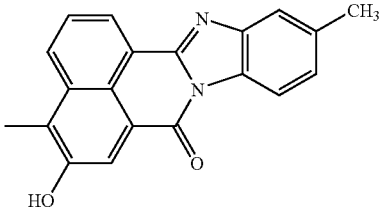
-continued
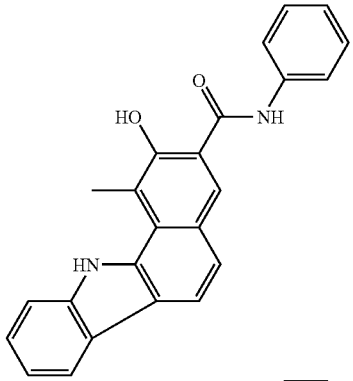
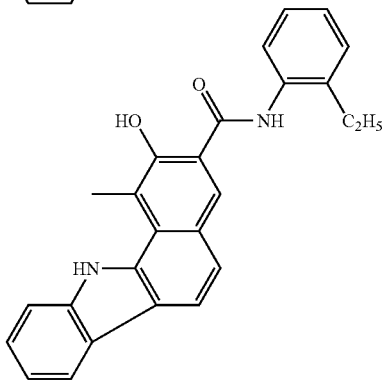
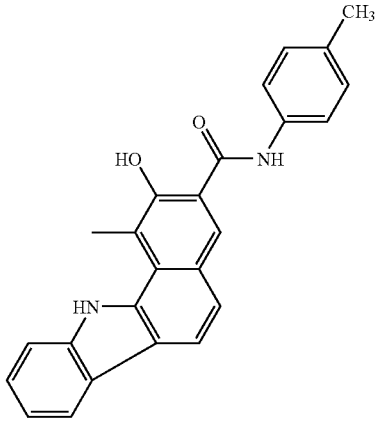
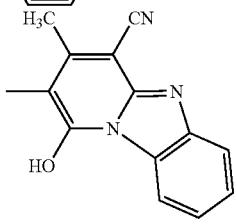
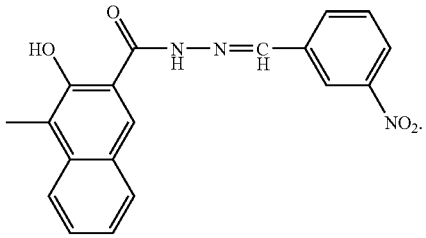
The charge-generating materials may be used alone or in any combination of two or more kinds in any ratio. Accordingly, the phthalocyanine pigment and the azo pigment may each be used in the form of a single compound, a mixture of two or more compounds, or in a mixed crystal state. In addition, the charge-generating material may be a combination of the phthalocyanine pigment with another charge-generating material, such as an azo pigment, a perylene pigment, a quinacridone pigment, a polycyclic quinone pigment, an indigo pigment, a benzimidazole pigment, a pyrylium salt, a thiapyrylium salt, or a squarelium salt.

The volume average particle diameter of the charge-generating material is not limited. When it is used in a multilayered photoreceptor, however, the volume average particle diameter of the charge-generating material is usually 1 μm or less and preferably 0.5 μm or less. The volume average particle diameter of the charge-generating material can be measured by a laser diffraction scattering method or a light-transmission centrifugal sedimentation method, as well as the dynamic light-scattering method described above.

In general, the charge-generating material is dispersed in a coating liquid for forming a charge-generating layer, and a photosensitive layer is formed by applying this coating liquid for forming a charge-generating layer. In this occasion, the charge-generating material may be preliminarily pulverized before being dispersed in the coating liquid for forming a charge-generating layer. The pre-pulverization may be carried out with any apparatus, and is usually carried out with, for example, a ball mill or a sand grind mill. The pulverizing medium to be applied to these pulverizers may be any medium that will not be powdered during the pulverization treatment and it can be easily separated after the dispersion treatment. Examples of such a medium include beads and balls of glass, alumina, zirconia, stainless steel, or ceramic. In the pre-pulverization, the charge-generating material is pulverized into a volume average particle diameter of preferably 500 μm or less and more preferably 250 μm or less. The volume average particle diameter of the charge-generating material may be measured by any method that is usually used by those skilled in the art, but is usually measured by a sedimentation method or a centrifugal sedimentation method.

The charge-generating material forms a charge-generating layer in a state of being bound with a binder resin. In the present invention, the ester-containing resin according to the present invention is used as the binder resin used in the charge-generating layer. However, the ester-containing resin according to the present invention may be used together with another binder resin exemplified below that does not significantly impair the effects of the present invention. When a charge-transporting layer contains an ester-containing resin, the binder resin contained in the charge-generating layer may be only a resin other than the ester-containing resin.

Examples of the binder resin that can be used in the charge-generating layer as the resin other than the ester-containing resin include insulating resins such as polyvinyl acetal-based resins, e.g. a polyvinyl butyral resin, a polyvinyl formal resin, and partially acetal-modified polyvinyl butyral resins in which the butyral groups are partially modified with, for example, formal or acetal, a polyarylate resin, a polycarbonate resin, a phenoxy resin, a polyvinyl chloride resin, a polyvinylidene chloride resin, a polyvinyl acetate resin, a polystyrene resin, an acrylic resin, a methacrylic resin, a polyacrylamide resin, a polyamide resin, a polyvinyl pyridine resin, a cellulose-based resin, a polyurethane resin, an epoxy resin, a silicone resin, a polyvinyl alcohol resin, a polyvinyl pyrrolidone resin, casein, vinyl chloride-vinyl acetate-based copolymers, e.g. a vinyl chloride-vinyl acetate copolymer, a hydroxyl-modified vinyl chloride-vinyl acetate copolymer, a carboxyl-modified vinyl chloride-vinyl acetate copolymer, and a vinyl chloride-vinyl acetate-maleic anhydride copolymer, a styrene-butadiene copolymer, a polyvinylidene chloride-acrylonitrile copolymer, a styrene-alkyd resin, a silicone-alkyd resin, and a phenol-formaldehyde resin; and organic photoconductive polymers such as poly-N-vinylcarbazole, polyvinylanthracene, and polyvinylperylene. Furthermore, polymethylmethacrylate, polyvinylacetate, polyvinylacetoacetal, polyvinylpropional, polysulfone, polyimide, cellulose ether, and vinyl polymers can be also used as the binder resin.

The binder resin in the charge-generating layer may be used alone or in any combination of two or more kinds in any ratio. Therefore, in the charge-generating layer, the ester-containing resin according to the present invention and another binder resin may be each used alone or in any combination of two or more kinds in any ratio.

In addition, when the charge-generating layer contains the ester-containing resin according to the present invention and another binder resin, the amount of the ester-containing resin in the total binder resin contained in the charge-generating layer is not limited, but is usually 60 weight % or more, preferably 80 weight % or more, and more preferably 90 weight % or more. A smaller amount of the ester-containing resin may deteriorate the electric characteristics of the photoreceptor. The upper limit is 100 weight %.

The ratios of the binder resin and the charge-generating material in the charge-generating layer are not limited within the scopes that do not significantly impair the effects of the present invention. However, the desirable amount of the charge-generating material is usually 10 parts by weight or more, preferably 30 parts by weight or more, and more preferably 50 parts by weight or more and usually 1000 parts by weight or less, preferably 500 parts by weight or less, and more preferably 300 parts by weight or less, on the basis of 100 parts by weight of the binder resin in the charge-generating layer. A smaller amount of the charge-generating material may not realize sufficient sensitivity or may not impart favorable electric characteristics to an electrophotographic photoreceptor. A larger amount may cause agglomeration of the charge-generating material to decrease the stability of the coating liquid that is used for forming a charge-generating layer.

The thickness of the charge-generating layer is not limited, but is usually 0.1 μm or more and more preferably 0.15 μm or more and usually 4 μm or less, preferably 2 μm or less, more preferably 0.8 μm or less, and most preferably 0.6 μm or less.

The charge-generating material is dispersed in a coating liquid for forming a photosensitive layer, and the method for the dispersion is not limited. For example, ultrasonic dispersion, ball-mill dispersion, attritor dispersion, or sand-mill dispersion is employed. In this process, it is effective for the dispersion to reduce the particle diameter of the charge-generating material to usually 0.5 μm or less, preferably 0.3 μm or less, and more preferably 0.15 μm or less.

Furthermore, the charge-generating layer may further contain an additional component that does not significantly impair the effects of the present invention. For example, the charge-generating layer may contain any additive. The additive is used for improving film-forming characteristics, flexibility, coating characteristics, contamination resistance, gas stability, light stability, or other characteristics. Examples of the additive include an antioxidant, a plasticizer, an ultraviolet absorber, an electron-attractive compound, a leveling agent, a visible light-shielding agent, a sensitizer, a dye, a pigment, and a surfactant. Examples of the antioxidant include hindered phenol compounds and hindered amine compounds. Examples of the dye and the pigment include various kinds of coloring compounds and azo compounds.

Examples of the surfactant include silicone oils and fluorine-base oils. Furthermore, an additive for suppressing residual potential or a dispersion aid for improving dispersion stability may be used.

The additives may be used alone or in any combination of two or more kinds in any ratio.

In addition, the charge-transporting layer may contain a charge-generating material within the scope that does not significantly impair the effects of the present invention.

[IV-3. Charge-Transporting Layer]

The charge-transporting layer contains a charge-transporting material. In the electrophotographic photoreceptor of the present invention, any known charge-transporting material can be used, within the scope that does not significantly impair the effects of the present invention.

In particular, the charge-transporting material preferably contains a predetermined charge-transporting material (hereinafter, optionally, referred to as "charge-transporting material of Formula (I)") represented by the following Formula (I):

[Chemical Formula 15]

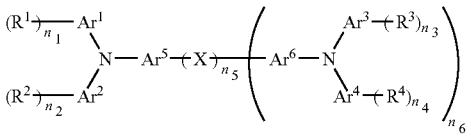

(I)

(In Formula (I), $Ar^1$ to $Ar^6$ each independently represents an optionally substituted aromatic moiety or an optionally substituted aliphatic moiety, X represents an organic moiety, $R^1$ to $R^4$ each independently represents an organic group, and $n_1$ to $n_6$ represent integers of 0 to 2).

In Formula (I), $Ar^1$ to $Ar^6$ each independently represents an optionally substituted aromatic moiety or an optionally substituted aliphatic moiety. Here, the valences of $Ar^1$ to $Ar^6$ are determined so that the structure represented by Formula (I) can be formed. Specifically, each of $Ar^2$ to $Ar^5$ is univalent or bivalent, and each of $Ar^1$ and $Ar^6$ is bivalent.

Examples of the aromatic moieties as $Ar^1$ to $Ar^6$ include moieties of aromatic hydrocarbons such as benzene, naphthalene, anthracene, pyrene, perylene, phenanthrene, and fluorene; and moieties of aromatic heterocycles such as thiophene, pyrrole, carbazole, and imidazole.

In addition, the number of carbon atoms of the aromatic moieties as $Ar^1$ to $Ar^6$ is not limited within the scope that does not significantly impair the effects of the present invention, but is usually 20 or less, preferably 16 or less, and more preferably 10 or less. A larger number of carbon atoms may decrease the stability of the arylamine compound represented by Formula (I), resulting in decomposition by oxidizing gas. Thus, ozone resistance may be decreased. Furthermore, ghosting due to memory may occur during formation of an image. The lower limit is usually 5 or more and preferably 6 or more, from the viewpoint of electric characteristics.

From the viewpoints described above, among the above-described aromatic moieties, aromatic hydrocarbon moieties are preferred, and a benzene moiety is more preferred as $Ar^1$ to $Ar^6$. Particularly preferred is all $Ar^1$ to $Ar^6$ are benzene moieties.

Examples of the aliphatic moieties as $Ar^1$ to $Ar^6$ include saturated aliphatic moieties, for example, branched or linear alkyl such as methane, ethane, propane, isopropane, and isobutane; and unsaturated aliphatic moieties, for example, alkenes such as ethylene and butylene.

Furthermore, the number of carbon atoms of the aliphatic moieties as $Ar^1$ to $Ar^6$ is not limited within the scope that does not significantly impair the effects of the present invention, but is usually 1 or more and usually 20 or less, preferably 16 or less, and more preferably 10 or less. In particular, in the case of the saturated aliphatic moiety, the number of carbon atoms is preferably 6 or less. In the case of the unsaturated aliphatic moiety, the number of carbon atoms is preferably 2 or more.

The substituents of $Ar^1$ to $Ar^6$ are not limited within the scope that does not significantly impair the effects of the present invention. Examples of the substituent include alkyl groups such as a methyl group, an ethyl group, a propyl group, an isopropyl group, and an allyl group; alkoxy groups such as a methoxy group, an ethoxy group, and a propoxy group; aryl groups such as a phenyl group, an indenyl group, a naphthyl group, an acenaphthyl group, a phenanthryl group, and a pyrenyl group; and heterocyclic groups such as an indolyl group, a quinolyl group, and a carbazolyl group. These substituents may form a ring through a linking group or by a direct bond.

The introduction of the substituent can control intramolecular charge of the charge-transporting material represented by Formula (I) to increase charge mobility. However, it may decrease charge mobility by distortion of the intramolecular conjugate plane and intermolecular steric interactions due to the increased molecular volume. Accordingly, the number of carbon atoms of the substituent is usually 1 or more and usually 6 or less, preferably 4 or less, and more preferably 2 or less.

The number of the substituents may be one or more. In addition, the substitution may be alone or in any combination of two or more kinds in any ratio. However, introduction of a plurality of substituents is effective for suppressing crystal precipitation of the charge-transporting material represented by Formula (I) and is preferred. However, a larger number of the substituents may contrarily decrease charge mobility due to intramolecular conjugate distortion and intermolecular steric interactions. Accordingly, the number of the substituents of each $Ar^1$ to $Ar^6$ is usually 2 or less per ring.

Preferably, the substituents of each $Ar^1$ to $Ar^6$ have small bulkiness for improving stability of the charge-transporting material represented by Formula (I) in a photosensitive layer and for improving electric characteristics. From these viewpoints, examples of the substituents of $Ar^1$ to $Ar^6$ are preferably a methyl group, an ethyl group, a butyl group, an isopropyl group, and a methoxy group.

In particular, when $Ar^1$ to $Ar^4$ are benzene moieties, they preferably have substituents. In such a case, examples of the substituent are preferably an alkyl group, and a methyl group is particularly preferred.

When $Ar^5$ or $Ar^6$ is a benzene moiety, examples of the substituent are preferably a methyl group and a methoxy group.

Furthermore, in Formula (I), at least one of $Ar^1$ to $Ar^4$ preferably has a fluorene structure. In such a case, the fluorene structure may be present at least as a partial skeleton. With this, the electrophotographic photoreceptor can exhibit high charge mobility, quick response, and low residual potential.

In Formula (I), X represents an optionally substituted organic moiety. Here, X has a valence so that the structure represented by Formula (I) can be formed. Specifically, the valence is bivalent or tervalent. In Formula (I), when $n_5$ is 2 (namely, there are two X's), the X's may be the same or different from each other.

Examples of X include an optionally substituted aromatic moiety; a saturated aliphatic moiety; a heterocyclic moiety; an organic group having an ether structure; and an organic moiety having a divinyl structure or the like.

The number of carbon atoms in the organic moiety X is not limited within the scope that does not significantly impair the effects of the present invention, but is usually 1 or more and 15 or less. In particular, X is preferably an aromatic moiety or a saturated aliphatic moiety. When X is an aromatic moiety, the number of carbon atoms of the aromatic moiety is preferably 6 or more and preferably 14 or less and more preferably 10 or less. More specifically, arylene groups such as a phenylene group and a naphthylene group are preferred. When X is a saturated aliphatic moiety, the number of carbon atoms in the saturated aliphatic moiety is preferably 10 or less and more preferably 8 or less.

X may have a substituent, and the substituent of X is not limited within the scope that does not significantly impair the effects of the present invention. Examples of the substituent include alkyl groups such as a methyl group, an ethyl group, a propyl group, an isopropyl group, and an allyl group; alkoxy groups such as a methoxy group, an ethoxy group, and a propoxy group; aryl groups such as a phenyl group, an indenyl group, a naphthyl group, an acenaphthyl group, a phenanthryl group, and a pyrenyl group; and heterocyclic groups such as an indolyl group, a quinolyl group, and a carbazolyl group. Among them, aryl groups, in particular, a phenyl group is preferred. Such substituents can improve electronic characteristics of a photoreceptor. Furthermore, in order to accelerate the charge mobility, alkyl groups, in particular, a methyl group and an ethyl group are preferred. Furthermore, these substituents may form a ring through a linking group or by a direct bond.

The number of carbon atoms of the substituent of X is not limited within the scope that does not significantly impair the effects of the present invention, but is usually 1 or more and usually 10 or less, preferably 6 or less, and more preferably 3 or less. From this view point, preferable examples of the substituent of X include a methyl group, an ethyl group, a butyl group, an isopropyl group, and a methoxy group.

X may have one or more substituents. In addition, the substituents may be one kind of substituent or in any combination of two or more kinds in any ratio. A plurality of substituents is preferred because it is effective for suppressing crystal precipitation of the charge-transporting material represented by Formula (I). However, a larger number of the substituents may contrarily decrease charge mobility by distortion of the intramolecular conjugate plane and intermolecular steric interactions. Accordingly, the number of the substituents of X is usually 2 or less per ring.

In Formula (I), $R^1$ to $R^4$ each independently represents an organic group.

The number of carbon atoms of $R^1$ to $R^4$ is not limited within the scope that does not significantly impair the effects of the present invention, but is usually 30 or less and preferably 20 or less.

In addition, each of organic groups $R^1$ to $R^4$ preferably has at least one of a hydrazone structure and a stilbene structure. In particular, in Formula (I), it is preferable that $R^1$ to $R^4$ each independently be an organic group with a hydrazone structure. In such a case, the nitrogen atom of each hydrazone structure of $R^1$ to $R^4$ is preferably bound to a carbon atom, and it is preferable that the hydrogen atom does not bind with the nitrogen atom by direct conjugation.

In particular, $R^1$ to $R^4$ preferably have a group represented by the following Formula (II):

[Chemical Formula 16]

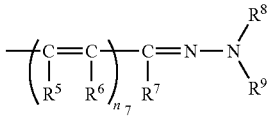

(II)

(In Formula (II), $R^5$ to $R^9$ each independently represents a hydrogen atom or an optionally substituted alkyl or aryl group, and n represents an integer of 0 to 5).

In Formula (II), $R^5$ to $R^9$ each independently represents a hydrogen atom or an optionally substituted alkyl or aryl group.

The number of the carbon atoms in the alkyl groups $R^5$ to $R^9$ is not limited within the scope that does not significantly impair the effects of the present invention, but is usually 10 or less, preferably 6 or less, and more preferably 3 or less. Examples of the alkyl groups $R^5$ to $R^9$ include a methyl group, an ethyl group, a propyl group, a butyl group, a hexyl group, and a stearyl group. Among them, a methyl group is preferred.

The number of carbon atoms of the aryl groups $R^5$ to $R^9$ is not limited within the scope that does not significantly impair the effects of the present invention, but is usually 16 or less, preferably 10 or less, and more preferably 6 or less. Examples of the aryl groups $R^5$ to $R^9$ include a phenyl group, an indenyl group, a naphthyl group, an acenaphthyl group, a phenanthryl group, and a pyrenyl group.

The alkyl group and aryl group may have a substituent. The substituents of $R^5$ to $R^9$ are not limited within the scope that does not significantly impair the effects of the present invention. Examples of the substituents include alkyl groups such as a methyl group, an ethyl group, a propyl group, an isopropyl group, and an allyl group; alkoxy groups such as a methoxy group, an ethoxy group, and a propoxy group; aryl groups such as a phenyl group, an indenyl group, a naphthyl group, an acenaphthyl group, a phenanthryl group, and a pyrenyl group; and heterocyclic groups such as an indolyl group, a quinolyl group, and a carbazolyl group.

These substituents may form a ring through a linking group or by a direct bond. Furthermore, the number of carbon atoms of the substituents of $R^5$ to $R^9$ is not limited within the scope that does not significantly impair the effects of the present invention, but is usually 10 or less.

Furthermore, in Formula (II), $n_7$ represents an integer of 0 or more and 5 or less and preferably 2 or less.

In the aforementioned Formula (I), $n_1$ represents an integer of 0 to 2 and is preferably 1 or 2. In particular, in Formula (I), when $R^1$ to $R^4$ are each independently an organic group having a hydrazone structure, $n_1$ is more preferably 1 or 2. That is, in Formula (I), it is more preferable that $Ar^1$ to $Ar^6$ each independently represents an optionally substituted aromatic moiety or an optionally substituted aliphatic moiety; X represent an organic moiety; $R^1$ to $R^4$ each independently represents an organic group having a hydrazone structure; $n_1$ represent 1 or 2; and $n_2$ to $n_6$ represent an integer of 0 to 2. With this, the electrophotographic photoreceptor of the present invention can more remarkably have advantages of high sensitivity and being hardly affected by transfer in the electrophotographic process. More preferably, $n_1$ represents 1.

Furthermore, in Formula (I), $n_2$ represents an integer of 0 to 2 and preferably represents 0 or 1.

In addition, in Formula (I), $n_3$ and $n_4$ each independently represents an integer of 0 to 2.

Furthermore, in Formula (I), $n_5$ and $n_6$ represent an integer of 0 to 2. When $n_5$ is 0, X represents a direct bond (direct coupling) (that is, $Ar^5$ and $Ar^6$ are directly bound to each other). When $n_6$ is 0, $n_5$ is preferably 0.

When both $n_5$ and $n_6$ are 1, X is preferably an alkylidene group, an arylene group, or a group having an ether structure.

Examples of the alkylidene group preferably include a phenylmethylidene group, a 2-methylpropylidene group, a 2-methylbutylidene group, and a cyclohexylidene group. Examples of the arylene group preferably include a phenylene group and a naphthylene group. Furthermore, examples of the group having an ether structure preferably include —O—$CH_2$—O—.

In Formula (I), both $n_5$ and $n_6$ are 0, $Ar^5$ is preferably a benzene moiety or a fluorene moiety. In particular, when $Ar^5$ is a benzene moiety, the benzene moiety is preferably substituted by an organic group such as an alkyl group or an alkoxy group. Among them, the substituent is preferably a methyl group or a methoxy group. In particular, the organic group is preferably bonded to the para-position with respect to the nitrogen atom.

Furthermore, in Formula (I), when $n_6$ is 2, X is preferably a benzene moiety.

Table 2 shows examples of specific combinations of $n_1$ to $n_6$ in Formula (I).

TABLE 2

| $n_1$ | $n_2$ | $n_3$ | $n_4$ | $n_5$ | $n_6$ |
|---|---|---|---|---|---|
| 1 | 0 | 0 | 0 | 0 | 0 |
| 1 | 1 | 0 | 0 | 0 | 0 |
| 1 | 0 | 1 | 0 | 0 | 1 |
| 1 | 1 | 1 | 1 | 0 | 1 |
| 2 | 2 | 0 | 0 | 0 | 0 |
| 2 | 0 | 0 | 0 | 0 | 0 |
| 2 | 2 | 2 | 2 | 1 | 1 |
| 1 | 1 | 1 | 0 | 2 | 1 |
| 1 | 1 | 1 | 1 | 1 | 2 |

Specific examples of preferable structure of the charge-transporting material represented by Formula (I) are shown below. In the following structural formulae of the charge-transporting material represented by Formula (I), R represents a hydrogen atom or an arbitrary substituent, and R's may be the same or different from each other. Examples of the substituent R preferably include organic groups such as alkyl groups, alkoxy groups, and aryl groups. In particular, a methyl group and a phenyl group are more preferred. In addition, R's may be the same or different from each other. Furthermore, n represents an integer of 0 to 2. In addition, Me represents a methyl group, and Et represents an ethyl group.

[Chemical Formula 17]

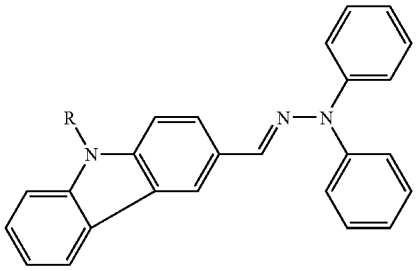

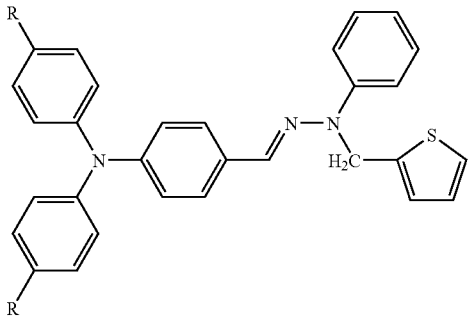

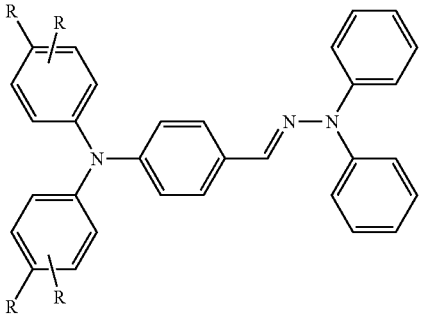

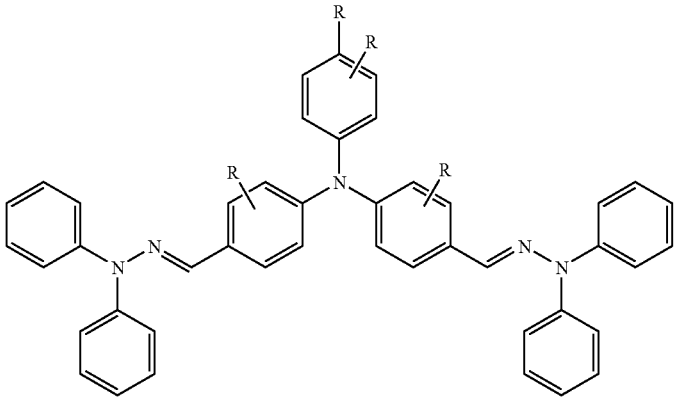

-continued
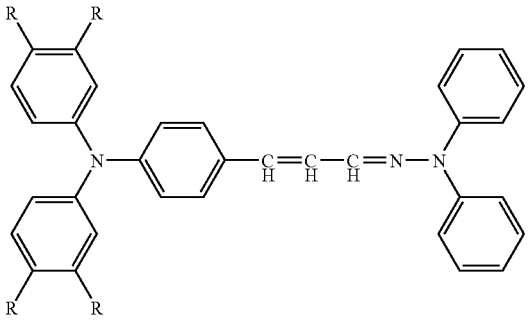
[Chemical Formula 18]
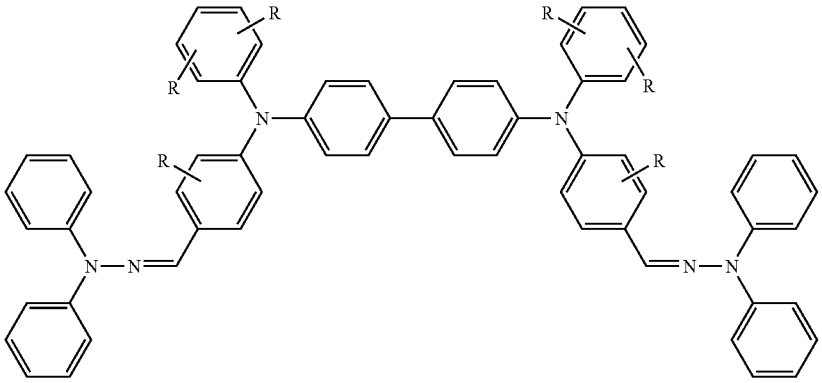
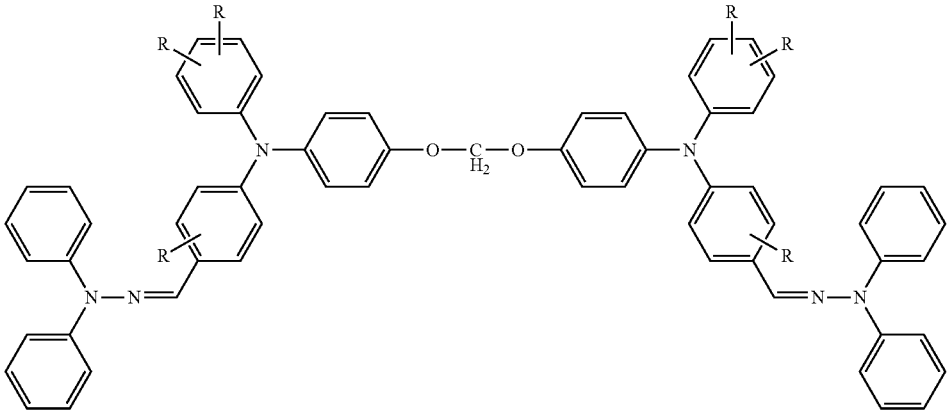

-continued
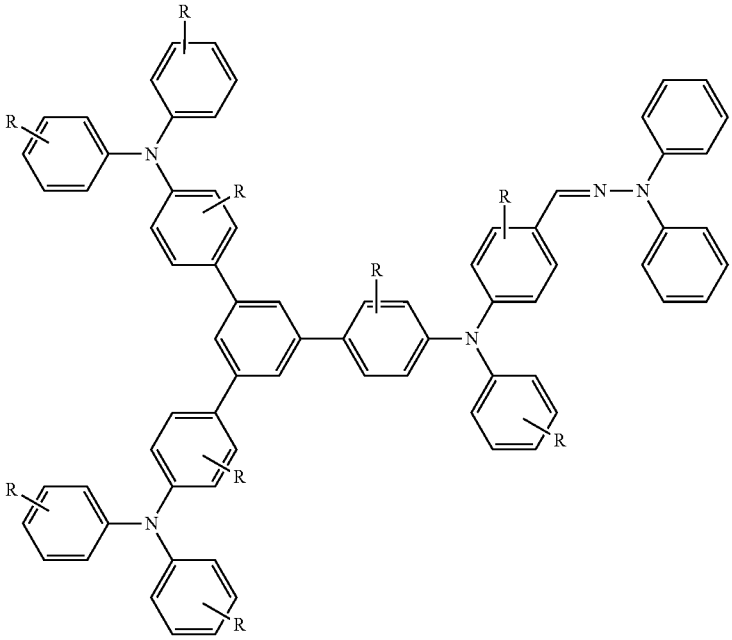
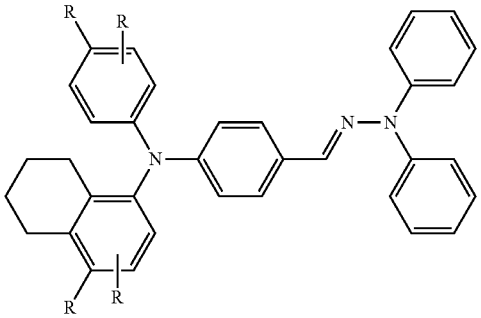
[Chemical Formula 19]
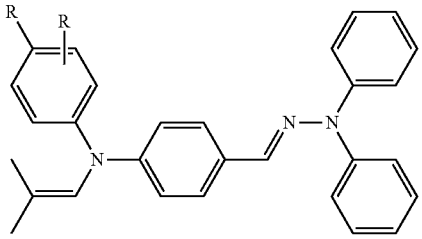
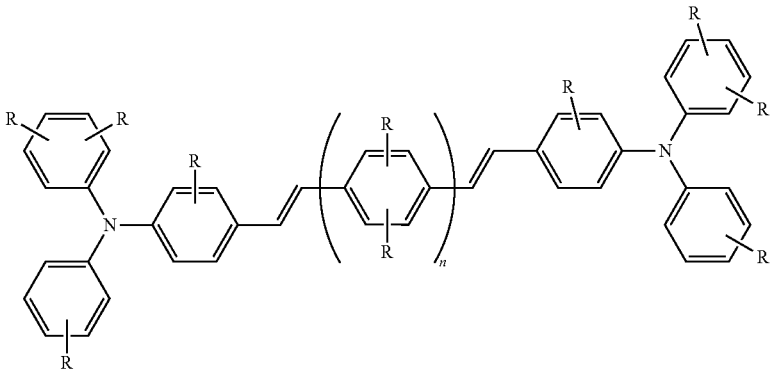

-continued
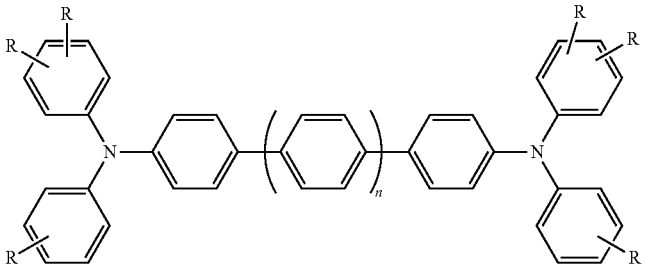
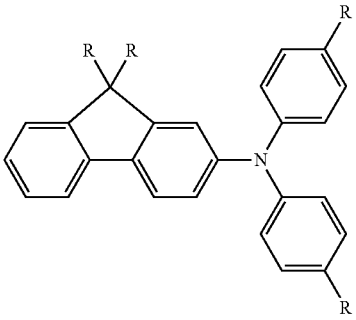
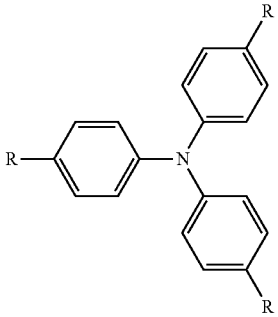
[Chemical Formula 20]
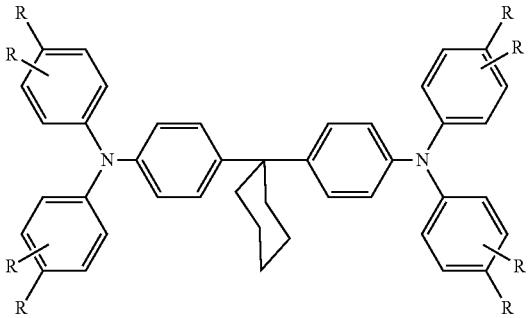
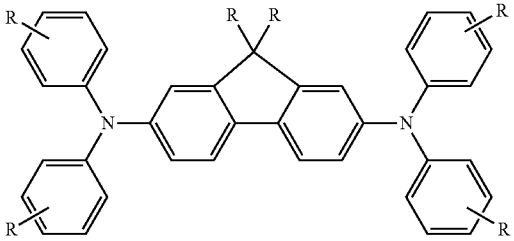
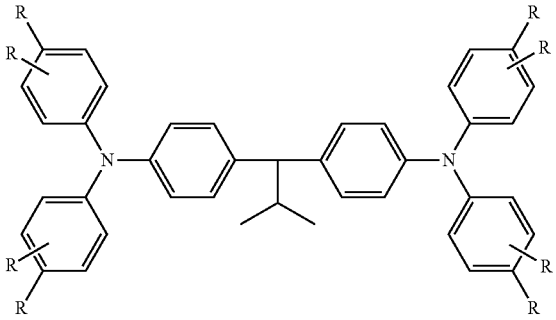
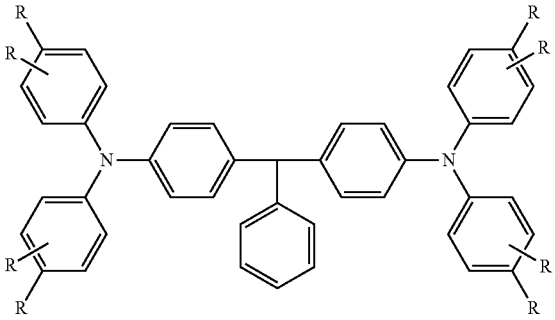
[Chemical Formula 21]
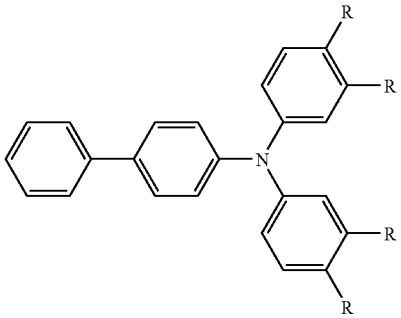
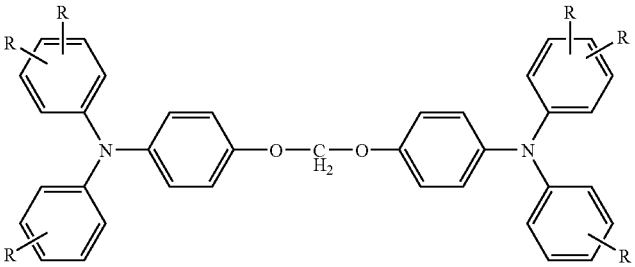

-continued
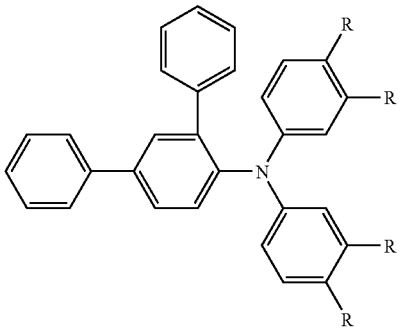
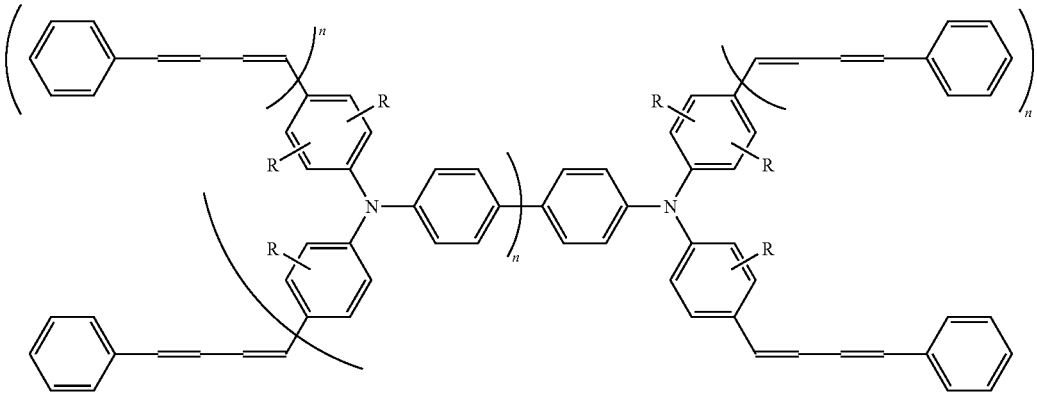
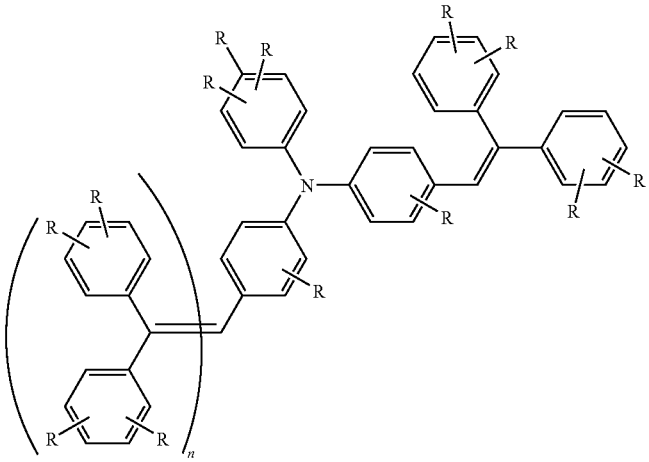
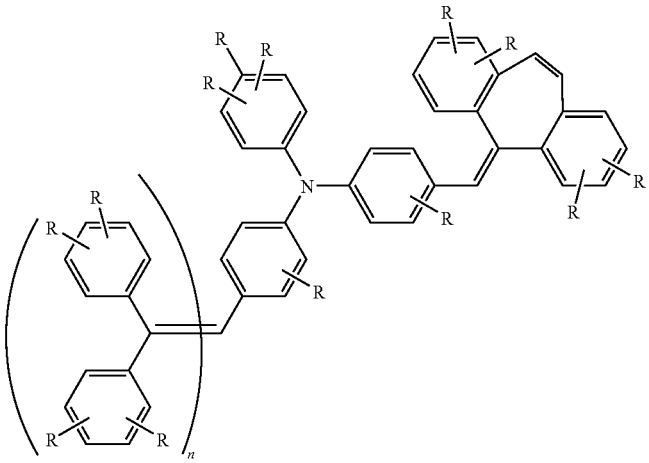

-continued
[Chemical Formula 22]
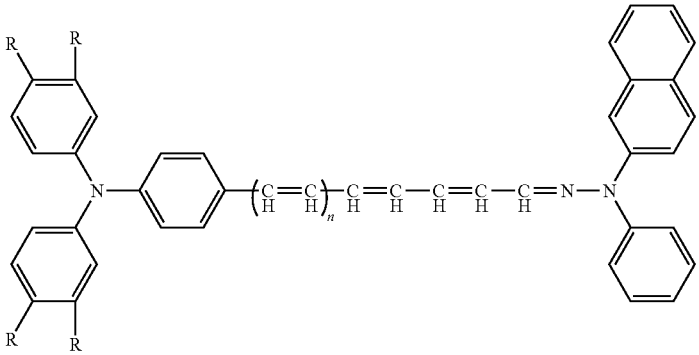
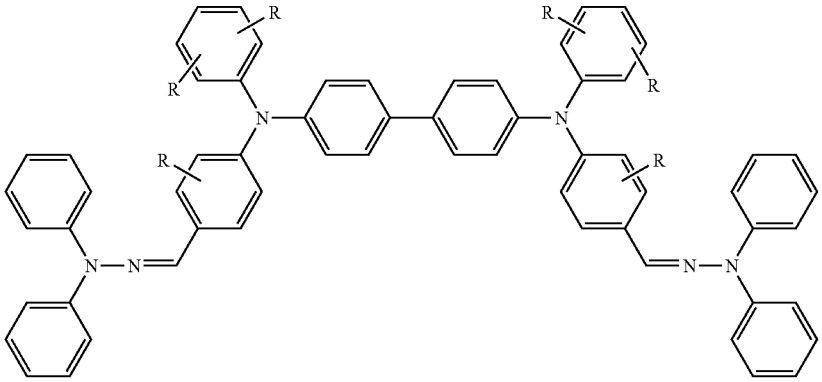
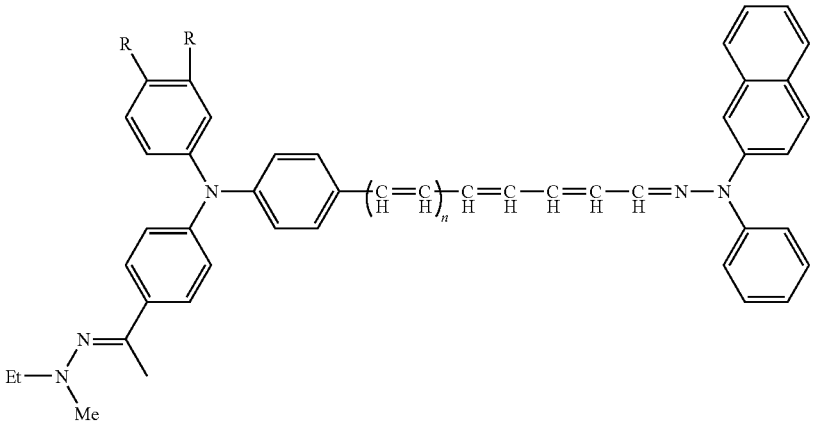
[Chemical Formula 23]
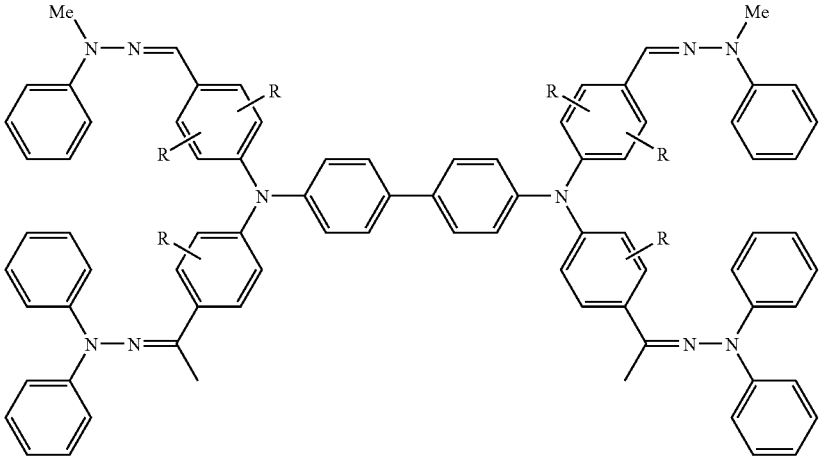

-continued
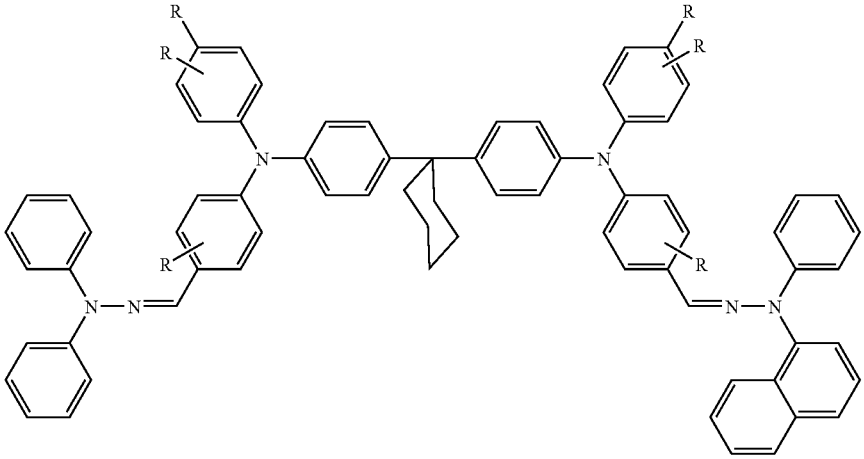
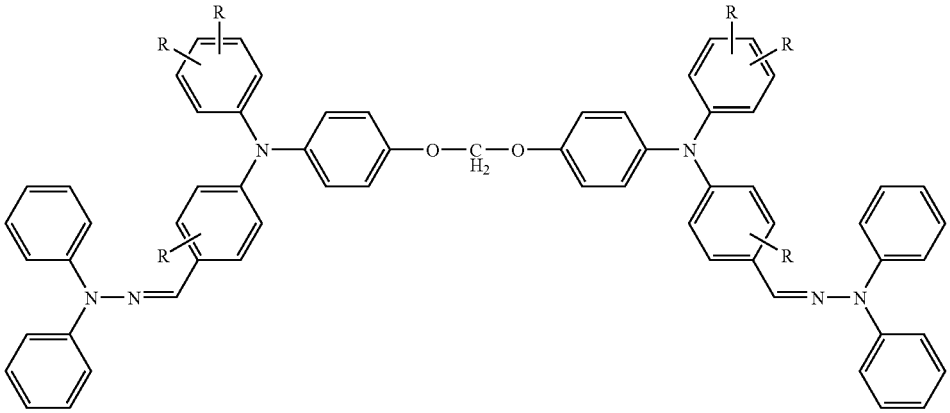
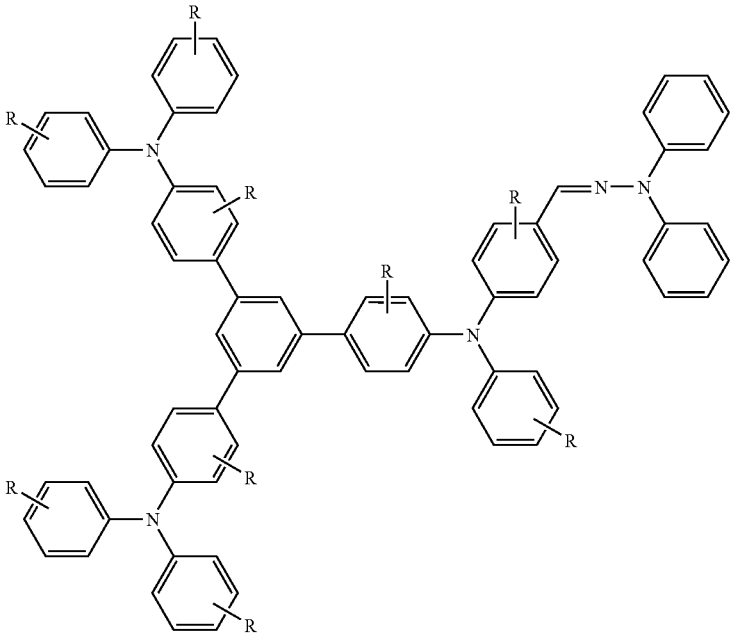

-continued

[Chemical Formula 24]

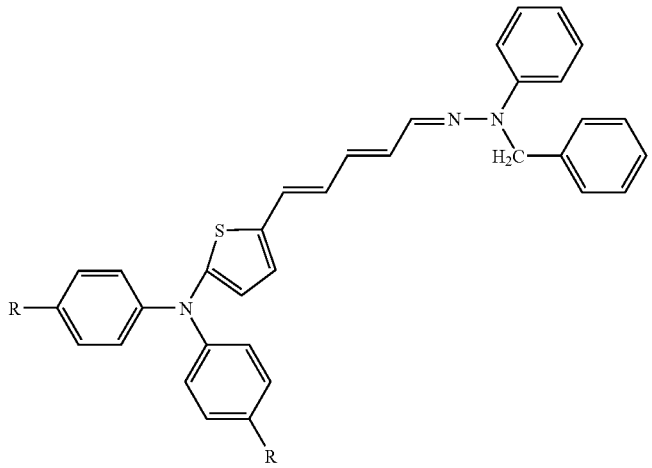

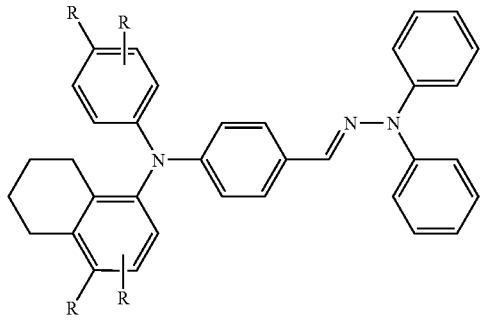

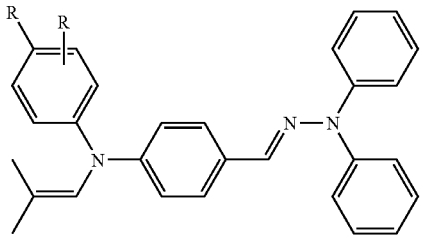

Furthermore, the charge-transporting materials may be those other than the charge-transporting materials represented by Formula (I). Such charge-transporting materials include aromatic nitro compounds such as 2,4,7-trinitrofluorenone; cyano compounds such as tetracyanoquinodimethane; electron-attractive materials, for example, quinone compounds such as diphenoquinone; heterocyclic compounds such as carbazole derivatives, indol derivatives, imidazole derivatives, oxazole derivatives, pyrazole derivatives, thiadiazole derivatives, benzofuran derivatives, pyrazoline derivatives, and oxadiazole derivatives; polymer compounds such as polyvinyl carbazole, polyvinyl pyrene, polyglycidyl carbazole, and polyacenaphthylene; polycyclic aromatic compounds such as pyrene and anthracene; hydrazone-based compounds such as p-diethylaminobenzaldehyde-N,N-diphenylhydrazone and N-methylcarbazole-3-carbaldehyde-N,N-diphenylhydrazone; styryl-based compounds such as 5-(4-(di-p-tolylamino)benzylidene)-5H-dibenzo(a,d)cycloheptene; triarylamine-based compounds such as p-tritolylamine; benzidine-based compounds such as N,N,N',N'-tetraphenylbenzidine; butadiene-based compounds; triphenylmethane-based compounds such as di-(p-ditolylaminophenyl)methane; aniline derivatives, hydrazone derivatives, aromatic amine derivatives, stilbene derivatives, butadiene derivatives, enamine derivatives, and products in which some of these compounds are bonded to each other; and electron-donating materials such as polymers having groups composed of these compounds in their main chains or side chains. Among them, carbazole derivatives, aromatic amine derivatives, stilbene derivatives, butadiene derivatives, enamine derivatives, hydrazone derivatives, styryl-based compounds, triarylamine-based compounds, benzidine-based compounds, and products in which some of these compounds are bonded to each other are preferable. Furthermore, carbazole derivatives, aromatic amine derivatives, stilbene derivatives, butadiene derivatives, enamine derivatives, and products in which some of these compounds are bonded to each other are more preferable.

Specific structures of preferable examples of these charge-transporting materials are shown below. These examples are merely shown for illustrative purposes, and any known charge-transporting material may be used within the scope of the present invention.

[Chemical Formula 25]
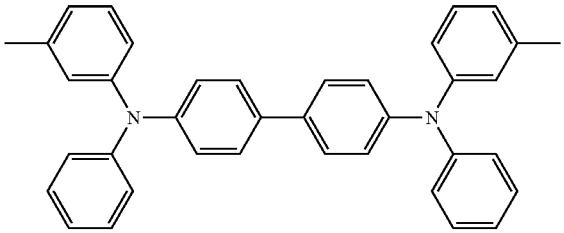
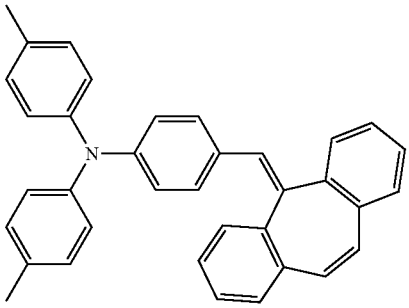
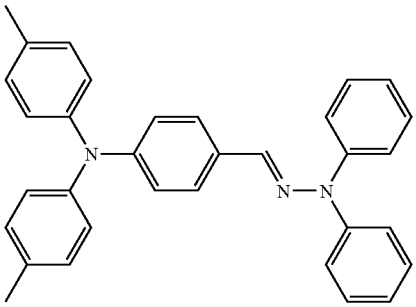
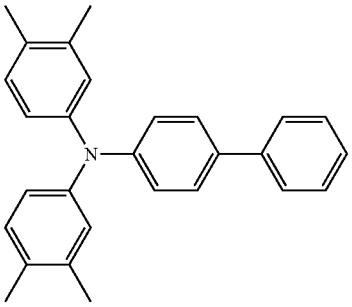
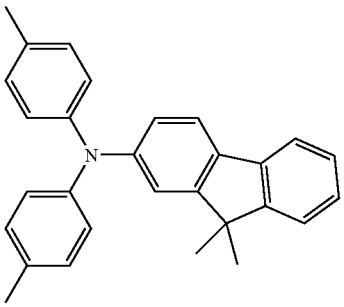
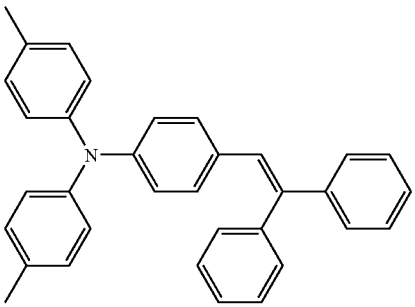
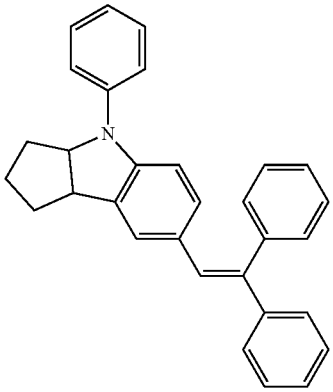
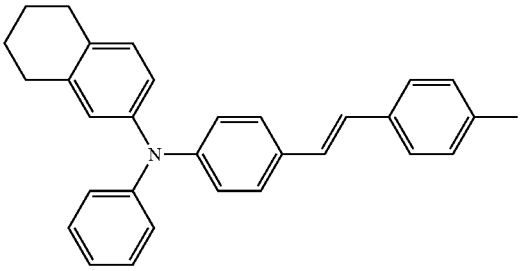
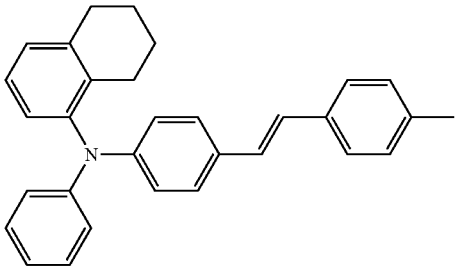
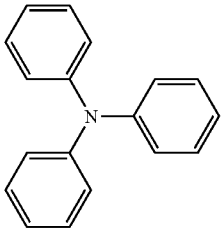

-continued
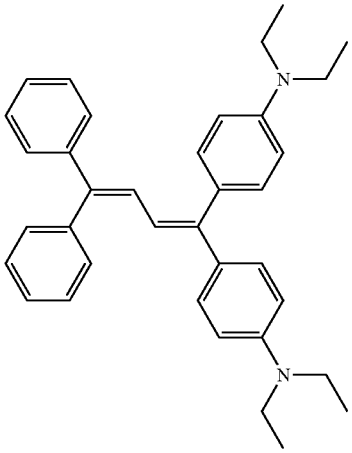
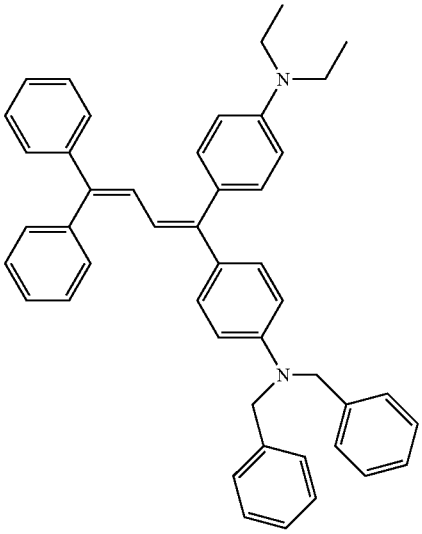
[Chemical Formula 26]
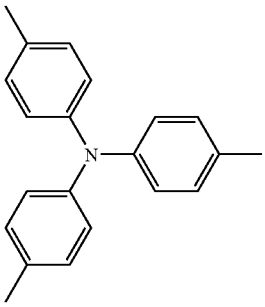
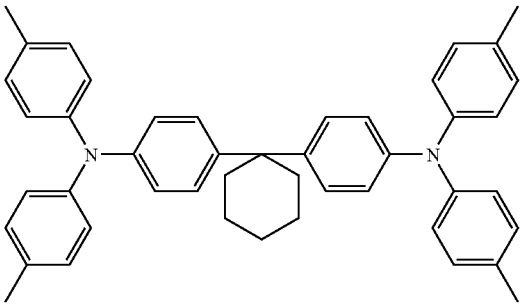
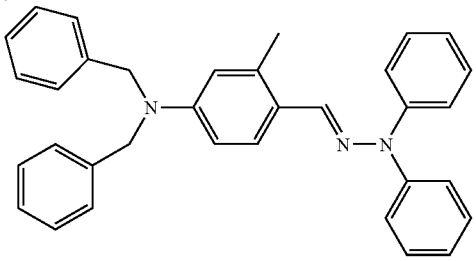
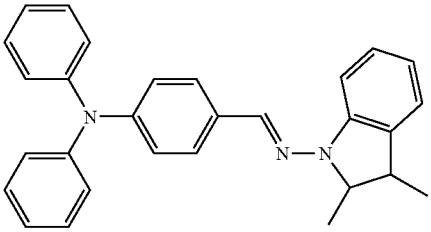
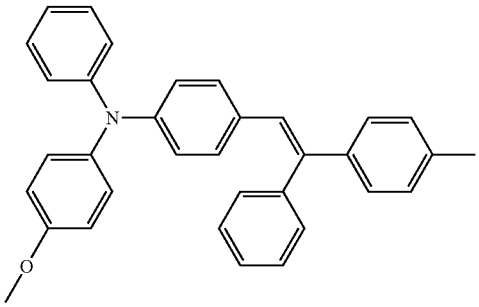
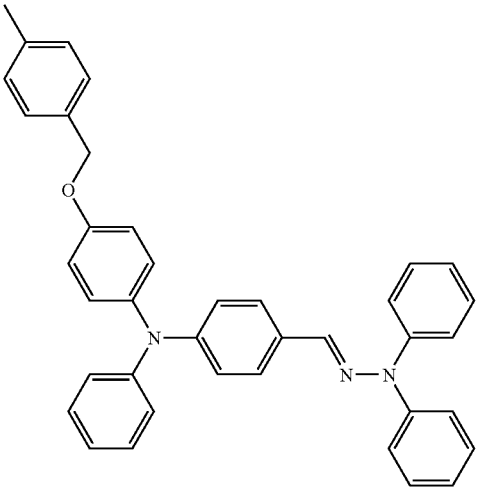

-continued
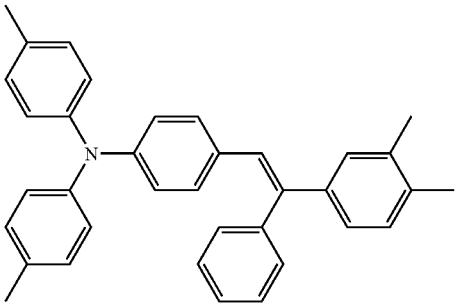
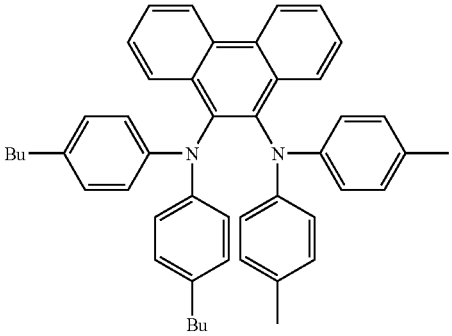
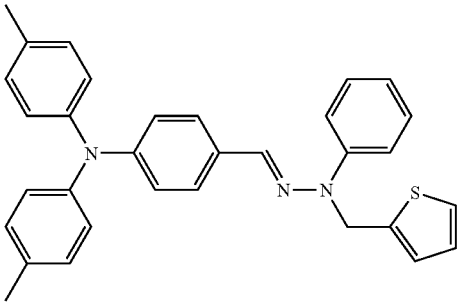
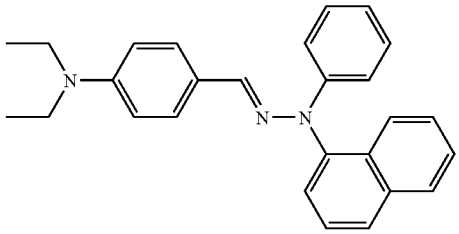
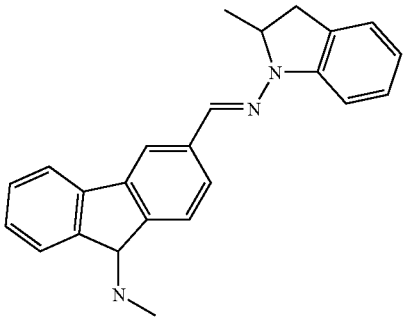
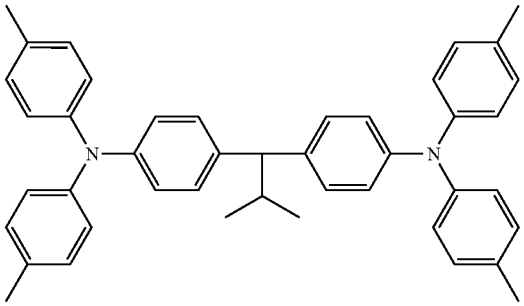
[Chemical Formula 27]
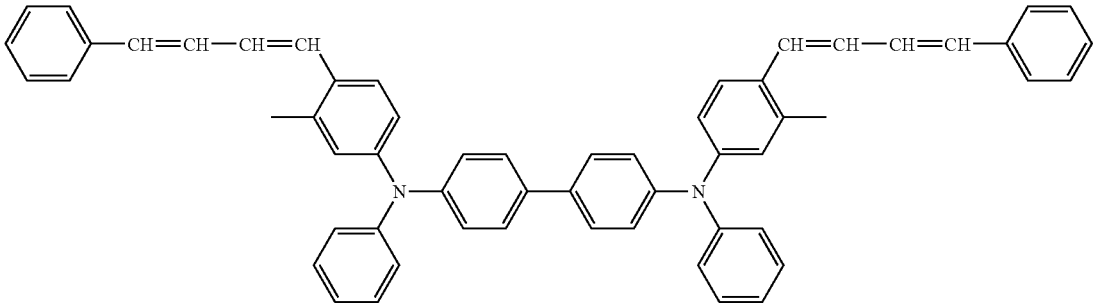
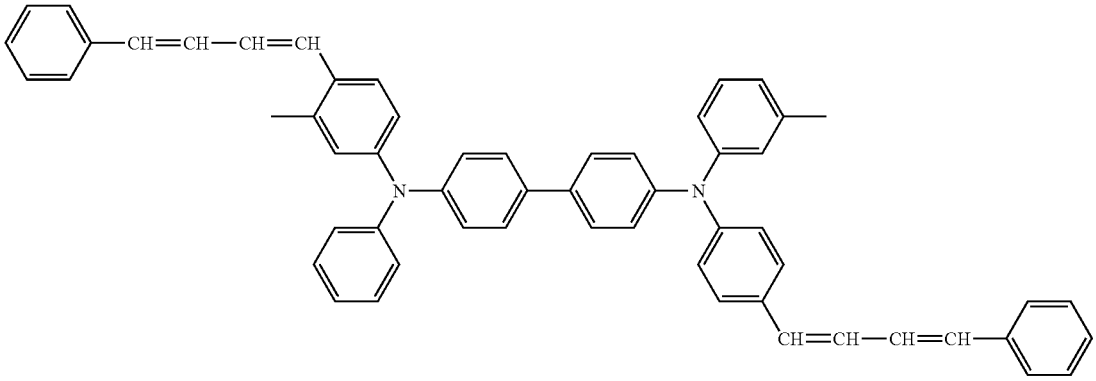

-continued

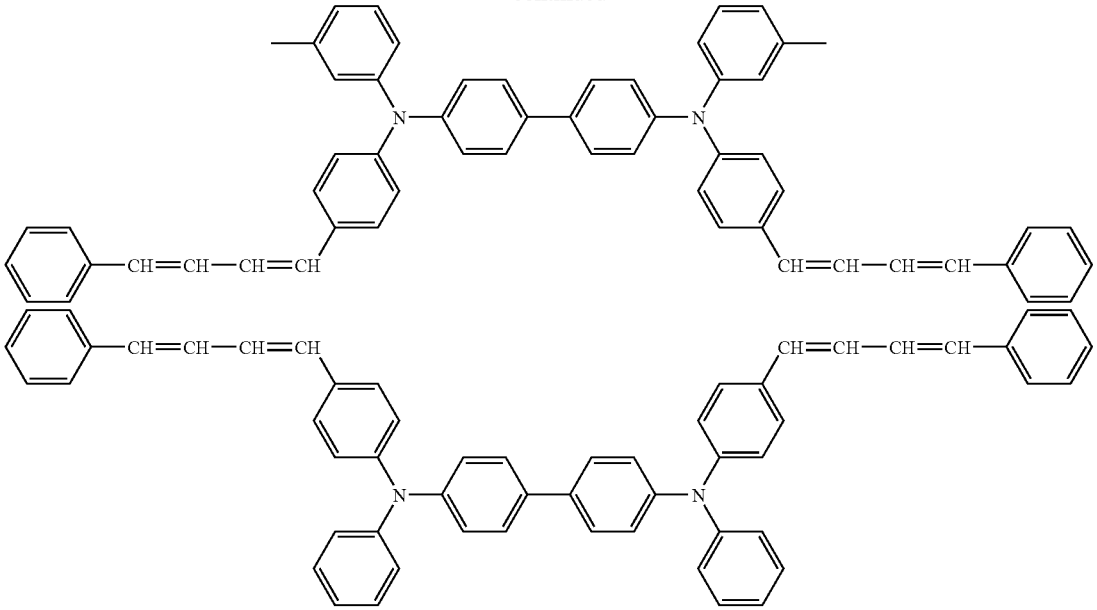

[Chemical Formula 28]

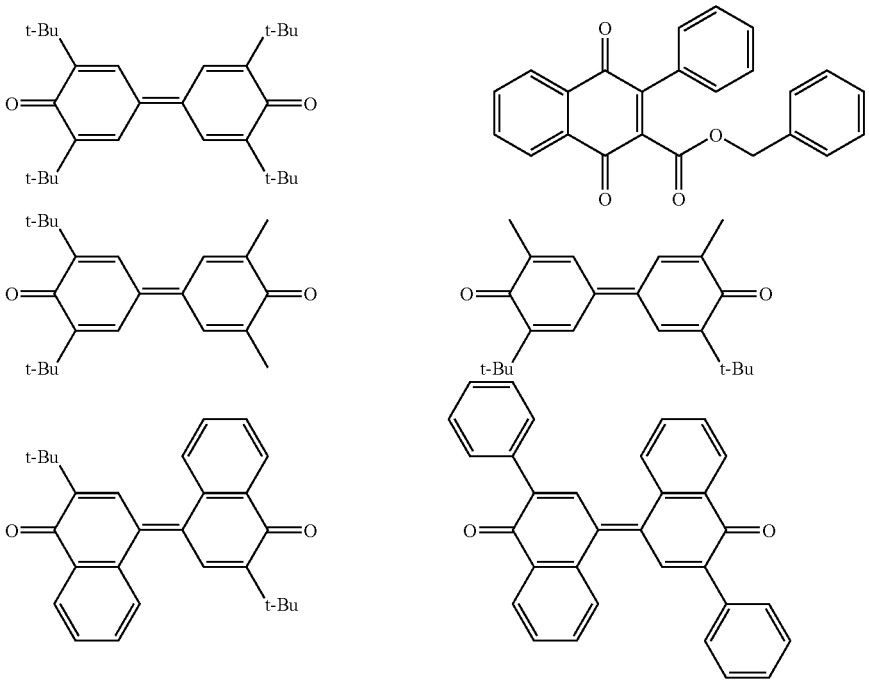

The charge-transporting material may be used alone or in any combination of two or more kinds in any ratio.

In the charge-transporting layer, the charge-transporting material is bound with a binder resin. The binder resin is used to ensure the strength of the layer.

In the present invention, the binder resin used in the charge-transporting layer is the ester-containing resin according to the present invention. However, the ester-containing resin according to the present invention may be used together with another binder resin exemplified below, within the scope that does not significantly impair the effects of the present invention. Furthermore, when the charge-generating layer contains the ester-containing resin, the charge-transporting layer may contain only a resin other than the ester-containing resin as the binder resin.

Examples of the binder resin, other than the ester-containing resin, used in the charge-transporting layer include butadiene resins, styrene resins, vinyl acetate resins, vinyl chloride resins, acrylic acid ester resins, methacrylic acid ester resins, vinyl alcohol resins, polymers and copolymers of vinyl compounds such as ethyl vinyl ether, polyvinyl butyral resins, polyvinyl formal resins, partially modified polyvinyl acetal, polycarbonate resins, polyester resins, polyarylate resins, polyamide resins, polyurethane resins, cellulose ester resins, phenoxy resins, silicone resins, silicone-alkyd resins, poly-N-vinylcarbazole resins, polysulfone resins, polyimide resins, and epoxy resins. These resins may be modified with a silicon reagent or any other reagent.

Among the binder resins other than the ester-containing resin, preferred are polymethylmethacrylate resins, styrene resins, vinyl polymers such as vinyl chloride and copolymers thereof, polycarbonate resins, polyarylate resins, polysulfone resins, polyimide resins, phenoxy resins, epoxy resins, and silicone resins; and partially cross-linked hardened products thereof.

Furthermore, among them, the polycarbonate resins and the polyarylate resins are particularly preferred. Furthermore, among the polycarbonate resins and the polyarylate resins, polycarbonate resins and polyarylate resins containing a bisphenol component or a biphenol component having a structure shown below are preferred from the viewpoints of sensitivity and residual potential. In particular, the polycarbonate resins are more preferred from the viewpoint of mobility.

The structures of monomers corresponding to the bisphenol component and the biphenol component that can be suitably used in the polycarbonate resins are shown below. However, these are merely exemplified for clarifying the concept, and accordingly the present invention is not limited to these monomers shown below within the scope of the present invention.

[Chemical Formula 29]

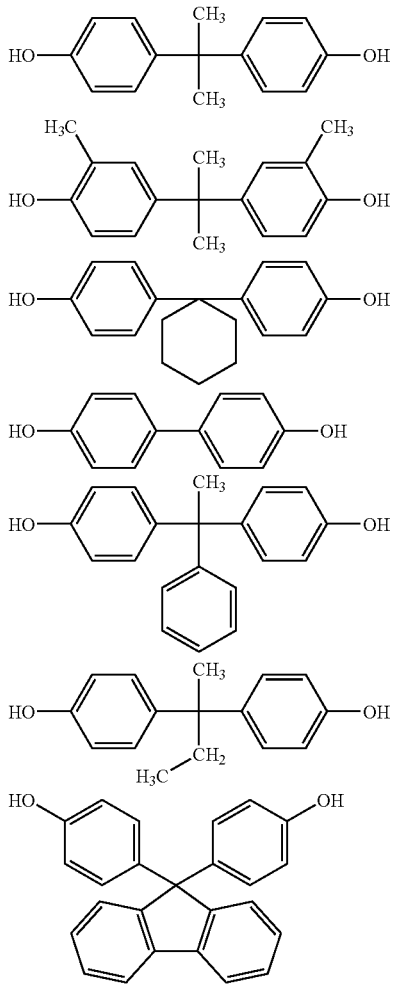

In particular, in order to achieve higher effects of the present invention, preferred are polycarbonate resins containing bisphenol components corresponding to the bisphenol derivatives shown by the following structures:

[Chemical Formula 30]

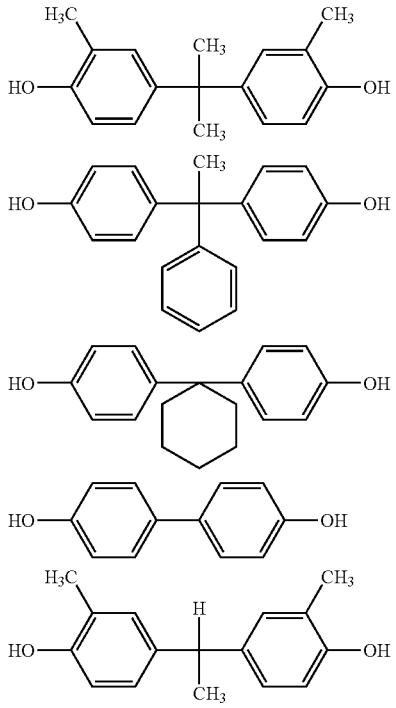

Furthermore, in order to improve mechanical characteristics, it is preferable to use a polyarylate resin. In such a case, preferred are bisphenol components corresponding to monomers represented by the following structural formulae:

[Chemical Formula 31]

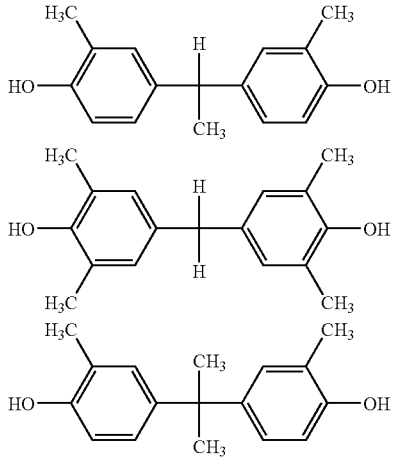

Furthermore, preferred acid components correspond to monomers represented by the following formulae:

[Chemical Formula 32]

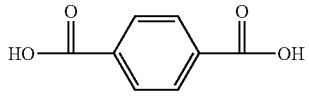

-continued

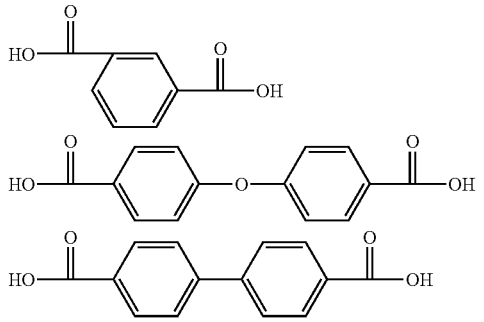

In addition, in the charge-transporting layer, the binder resins may be used alone or in any combination of two or more kinds in any ratio. Accordingly, in the charge-transporting layer, the ester-containing resins according to the present invention and the other binder resins are each alone or in any combination of two or more kinds in any ratio.

In addition, when the ester-containing resin according to the present invention and the other resin are used as the binder resin contained in the charge-transporting layer, the amount of the ester-containing resin to the total binder resin in the charge-transporting layer does not have limitation within the scope that does not significantly impair the effects of the present invention, but is usually 60 weight % or more, preferably 80 weight % or more, and more preferably 90 weight % or more. A smaller amount of the arylamine compound according to the present invention may decrease memory resistance of a photoreceptor to readily cause ghosting. The upper limit is 100 weight %.

The ratio of the charge-transporting material used in the charge-transporting layer to the binder resin is not limited within the scope that does not significantly impair the effects of the present invention. However, the amount of the charge-transporting material is usually 20 parts by weight or more, preferably 30 parts by weight or more from the viewpoint of a decrease in residual potential, and more preferably 40 parts by weight or more from the viewpoints of stability in repeated use and charge mobility, on the basis of 100 parts by weight of the binder resin. On the other hand, the amount is usually 200 parts by weight or less, preferably 150 parts by weight or less from the viewpoint of thermal stability of the photosensitive layer, more preferably 120 parts by weight or less from the viewpoint of compatibility between the charge-transporting material and the resin binder, more preferably 100 parts by weight or less from the viewpoint of printing resistance, and most preferably 80 parts by weight or less from the viewpoint of scratch resistance.

Furthermore, the thickness of the charge-transporting layer is not limited, but is usually 5 μm or more, from the viewpoints of a long service life and image stability, preferably 10 μm or more and more preferably 15 μm or more. The thickness is usually 60 μm or less and preferably 50 μm or less and is preferably 45 μm or less from the viewpoints of a long service life and image stability and further preferably 30 μm or less and most preferably 27 μm or less from the viewpoint of high resolution.

Furthermore, the charge-generating layer may contain any component, for example, any additive that does not significantly impair the effects of the present invention, as in the charge-transporting layer.

[IV-4. Single Photosensitive Layer]

A single photosensitive layer is composed of the charge-generating material dispersed in a charge-transporting layer having the blending ratio mentioned above. That is, the single photosensitive layer is composed of the charge-generating material dispersed in a matrix that contains a binder resin and a charge-transporting material as main components with a blending ratio similar to that of the charge-transporting layer.

In the single photosensitive layer, the kinds and the ratio of the charge-transporting material and the binder resin are the same as those described in the charge-transporting layer. Therefore, the single photosensitive layer contains the ester-containing resin according to the present invention.

Furthermore, the charge-generating material is the same kinds as those described above. However, in this case, it is desirable that the particle diameter of the charge-generating material be sufficiently small. Specifically, the particle diameter is usually 1 μm or less, preferably 0.5 μm or less, more preferably 0.3 μm or less, and most preferably 0.15 μm or less.

Furthermore, a smaller amount of charge-generating material dispersed in the photosensitive layer may cause insufficient sensitivity. A larger amount may cause a decrease in charging performance and a decrease in sensitivity. Accordingly, the amount of the charge-generating material in the single photosensitive layer is usually 0.1 weight % or more, preferably 0.5 weight % or more, more preferably 1 weight % or more, and most preferably 10 weight % or more and usually 50 weight % or less, preferably 45 weight % or less, and more preferably 20 weight % or less.

The thickness of the single photosensitive layer is not limited, and is usually 5 μm or more and preferably 10 μm or more and usually 100 μm or less, more preferably 50 μm or less, and more preferably 45 μm or less.

Furthermore, the single photosensitive layer may also contain any component that does not significantly impair the effects of the present invention. For example, this layer may contain additives, like the charge-generating layer.

[IV-5. Method for Forming Photosensitive Layer]

Each layer (charge-generating layer, charge-transporting layer, or single photosensitive layer) constituting a photosensitive layer may be formed by any method without limitation, but, usually, the layers are formed in series by repeating the coating and drying steps of coating liquids each of which containing materials constituting each layer (coating liquid for a charge-generating layer, coating liquid for a charge-transporting layer, and coating liquid for a single photosensitive layer) onto an undercoat layer by a known method, such as dip coating, spray coating, or ring coating.

For example, the charge-generating layer can be formed by preparing a coating liquid by dissolving or dispersing a charge-generating material, a binder resin, and other components in a solvent; applying this coating liquid onto an undercoat layer in the case of a normally laminated photosensitive layer or onto a charge-transporting layer in the case of a reversely laminated photosensitive layer; and drying the liquid.

The charge-transporting layer can be formed by preparing a coating liquid by dissolving or dispersing a charge-transporting material, a binder resin, and other components in a solvent; applying this coating liquid onto the charge-generating layer in the case of a normally laminated photosensitive layer or onto the undercoat layer in a case of a reversely laminated photosensitive layer; and drying the liquid.

Furthermore, the single photosensitive layer can be formed by preparing a coating liquid by dissolving or dispersing a charge-generating material, a charge-transporting material, a binder resin, and other components in a solvent; applying this coating liquid onto an undercoat layer; and drying the liquid.

The solvent (or dispersion medium) used for dissolving the binder resin in the preparation of the coating liquid is not limited within the scope that does not significantly impair the effects of the present invention. Examples of the solvent include saturated aliphatic solvents such as pentane, hexane, octane, and nonane; (halo)aromatic solvents such as toluene, xylene, anisole, benzene, toluene, xylene, and chlorobenzene; halogenated aromatic solvents such as chlorobenzene, dichlorobenzene, and chloronaphthalene; amide solvents such as dimethylformamide, N-methyl-2-pyrrolidone, N,N-dimethylformamide, and N,N-dimethylacetamide; alcohol solvents such as methanol, ethanol, isopropanol, n-butanol, benzyl alcohol, 1-hexanol, and 1,3-dibutanediol; aliphatic polyols such as glycerin and ethylene glycol; chained, branched, or cyclic ketone solvents such as acetone, cyclohexanone, methyl ethyl ketone, 4-methoxy-4-methyl-2-pentanone, and methyl isobutyl ketone; ester solvents such as methyl formate, methyl acetate, ethyl acetate, and n-butyl acetate; halogenated hydrocarbon solvents such as methylene chloride, chloroform, and 1,2-dichloroethane; chained or cyclic ether solvents such as diethyl ether, dimethoxy ethane, tetrahydrofuran, 1,4-dioxane, methyl cellosolve, ethyl cellosolve, and ethylene glycol monomethyl ether; ether ketone solvents such as 4-methoxy-4-methyl-2-pentanone; aprotic polar solvents such as acetonitrile, dimethyl sulfoxide, sulforane, and hexamethyl phosphate triamide; nitrogen-containing compounds such as n-butylamine, isopropanolamine, diethylamine, triethanolamine, ethylenediamine, and triethylamine; sulfoxide solvents such as dimethylsulfoxide; mineral oils such as ligroin; and water. Among these solvents, particularly preferred are alcohol solvents, aromatic hydrocarbon solvents, ether solvents, and ether ketone solvents, and more preferred are toluene, xylene, 1-hexanol, 1,3-butanediol, tetrahydrofuran, and 4-methoxy-4-methyl-2-pentanone. Furthermore, among them, those that do not dissolve the undercoat layer are particularly preferable.

In addition, these solvents may be used alone or in any combination of two or more kinds in any ratio. Examples of solvents that are preferably used in combination include ether solvents, alcohol solvents, amide solvents, sulfoxide solvents, sulfoxide solvents, and ether ketone solvents. Among them, preferred are 1,2-dimethoxyethane and alcohol solvents such as 1-propanol. In particular, ether solvents are preferred, from the viewpoints of crystal form stability and dispersion stability of the phthalocyanine when the coating liquid is prepared using oxytitanium phthalocyanine as the charge-generating material.

The solid content in the coating liquid for a monolayer-type photoreceptor or a charge-transporting layer is usually 5 weight % or more and preferably 10 weight % or more and usually 40 weight % or less and preferably 35 weight % or less. In addition, the viscosity of these coating liquids is usually 10 mPa·s or more and preferably 50 mPa·s or more and usually 500 mPa·s or less and preferably 400 mPa·s or less.

On the other hand, in the coating liquid for a charge-generating layer, the solid content is usually 0.1 weight % or more and preferably 1 weight % or more and usually 15 weight % or less and preferably 10 weight % or less. In addition, the viscosity of the coating liquid is usually 0.01 mPa·s or more and preferably 0.1 mPa·s or more and usually 20 mPa·s or less and preferably 10 mPa·s or less.

The coating liquid may be applied by any method, for example, dip coating, spray coating, spin coating, bead coating, wire-bar coating, blade coating, roller coating, air-knife coating, curtain coating, or any other known coating method.

The coating liquid may be dried by any method, and is preferably dried by contact drying at room temperature and then heat drying at a temperature ranging from 30 to 200° C. for 1 minute to 2 hours with or without ventilation. The heating temperature may be constant or may be changed during the drying process.

[V. Other Layers]

The electrophotographic photoreceptor of the present invention may include any other layer other than the undercoat layer and photosensitive layer.

For example, a protective layer (surface protective layer) or an overcoat layer may be disposed on the outermost layer of the photoreceptor in order to prevent wear of the photosensitive layer or prevent or reduce deterioration of the photosensitive layer, which is caused by materials or the like generated from a charging device or other portions. For example, the protective layer can be made of a thermoplastic or thermosetting polymer as a main component or be made of a suitable binding resin containing an electroconductive material or a copolymer of a charge-transportable compound, such as a triphenylamine skeleton described in Japanese Unexamined Patent Application Publication No. HEI 9-190004 or HEI 10-252377.

Examples of the electroconductive material can include, but are not limited to, aromatic amino compounds such as TPD (N,N'-diphenyl-N,N'-bis-(m-tolyl)benzidine, and metal oxides such as antimonium oxide, indium oxide, tin oxide, titanium oxide, tin oxide-antimonium oxide, aluminum oxide, and zinc oxide. The electroconductive materials may be used alone or in any combination of two or more kinds in any ratio.

The binder resin used in the protective layer may be any known resin, and examples thereof include polyamide resins, polyurethane resins, polyester resins, epoxy resins, polyketone resins, polycarbonate resins, polyvinyl ketone resins, polystyrene resins, polyacrylamide resins, and siloxane resins. In addition, copolymers of such resins and charge-transportable skeletons, such as a triphenyl amine skeleton described in Japanese Unexamined Patent Application Publication No. HEI 9-190004 or HEI 10-252377, can be used. These binder resins may be used alone or in any combination of two or more kinds in any ratio.

Furthermore, the protective layer preferably has an electric resistance of 109 to $10^{14}$ Ω·cm. An electric resistance higher than $10^{14}$ Ω·cm may increase the residual charge to form a foggy image. On the other hand, an electric resistance lower than $10^{9}$ Ω·cm may cause a blur image or a decreased resolution.

In addition, the protective layer must be designed to ensure the transmission of light for image exposure.

Furthermore, the surface layer may contain, for example, a fluorine resin, a silicone resin, a polyethylene resin, or a polystyrene resin in order to decrease friction resistance and wear of the photoreceptor surface and to increase transfer efficiency of toner from the photoreceptor to a transfer belt or paper. The surface layer may also contain particles of these resins or inorganic compounds.

These layers other than the undercoat layer and the photosensitive layer may be formed by any method, but, usually, the layers are formed in series by repeating the coating and drying steps of coating liquids each of which containing materials constituting each layer by a known coating method, as in the photosensitive layer.

[VI. Advantage of Electrophotographic Photoreceptor of the Present Invention]

The electrophotographic photoreceptor of the present invention has advantages in that it has high sensitivity and is hardly affected by the transfer in an electrophotographic process. In particular, since the electrophotographic photoreceptor is hardly affected by the transfer in the electrophotographic process, significant deterioration in various characteristics of the photoreceptor is suppressed even after the electrophotographic process. Accordingly, the electrophotographic photoreceptor of the present invention exhibits low fatigue deterioration after repeated use and high stability of electric characteristics, in particular, high stability of image quality.

The electrophotographic photoreceptor of the present invention can usually form an image with high quality under various operation environments. In addition, this photoreceptor exhibits excellent duration stability and hardly causes image defects, such as black spots and color spots that are probably caused by dielectric breakdown. Accordingly, the electrophotographic photoreceptor of the present invention can form an image with high quality with suppressed environmental influence. Such advantages are probably derived from dispersion with a wet dispersing mill using a dispersion medium having an average particle diameter within the above-mentioned range. This deduction will now be elucidated with reference to conventional technologies.

Conventional pulverizers used for pulverization or dispersion of microparticles have been developed. The technology described in Japanese Unexamined Patent Application Publication No. 2006-35167 is an example.

However, conventional techniques are still insufficient for forming images with higher quality, in various aspects, such as the image quality and the stability of a coating liquid produced.

However, a coating liquid for forming an undercoat layer that has high performance and stability when used can be achieved by conducting dispersion with a wet dispersion mill using a dispersion medium having an average particle diameter within the above-mentioned range. Furthermore, an electrophotographic photoreceptor having the undercoat layer obtained by applying and drying such a coating liquid can exhibit favorable electric characteristics in various environments, and an image-forming apparatus having such an electrophotographic photoreceptor can form high-quality images. In addition, advantageously, such an apparatus hardly causes image defects, such as black spots and color spots that are probably caused by, for example, dielectric breakdown.

Furthermore, the electrophotographic photoreceptor of the present invention generally has stable electric characteristics even at low temperature and low humidity and thus shows excellent electric characteristics. Investigation of the present inventors has revealed the following fact: In some cases that the electrophotographic photoreceptor of the present invention is not used, exposure-charging repeating characteristics at low temperature and low humidity are not stabilized and so often cause image defects, such as black spots and color spots, in the formed images. Accordingly, such an image-forming apparatus or an electrophotographic cartridge cannot form clear and stable images.

[VII. Toner]

When an image is formed using the electrophotographic photoreceptor of the present invention, toner as a developer for developing a latent image preferably has a specific sphericity (hereinafter, optionally, referred to as "toner of the present invention"). The image-forming apparatus of the present invention can form high-quality images with the toner having such a specific sphericity.

[Sphericity of Toner]

In the toner of the present invention, the toner particles preferably have shapes that are similar to each other and have higher sphericities. In such toner, charge density will be barely localized in toner particles, which results in uniform development properties, and improved image quality. However, when the shape of the toner is enormously close to a complete sphere, the formed image may have defects caused by contamination by toner remaining on the surface of the electrophotographic photoreceptor due to insufficient cleaning of the toner after the image formation. In such a case, forceful cleaning is necessary to avoid insufficient cleaning. Such forceful cleaning readily causes wear or scratch on the electrophotographic photoreceptor, which may decrease the service life of the electrophotographic photoreceptor. Furthermore, since the completely spherical toner cannot be produced at low cost, it does not have industrial availability.

In consequence, the toner of the present invention has an average sphericity of usually 0.940 or more, preferably 0.950 or more, and more preferably 0.960 or more, which is measured with a flow type particle image analyzer. There is no upper limit in the average sphericity, that is, the average sphericity is 1.000 or less, preferably 0.995 or less, and more preferably 0.990 or less.

The average sphericity is used as a simple method for quantitatively expressing the shapes of toner particles. In the present invention, sphericity is measured with a flow-type particle image analyzer FPIA-2000 manufactured by Sysmex Co., and the sphericity (a) of particles measured is calculated by the following Equation (X):

$$\text{Sphericity } a = L_0/L \quad \text{(X)}$$

(in Equation (X), $L_0$ represents a circumferential length of a circle having the same projected area as a particle image, and L represents a circumferential length of a particle image in the image processing).

The sphericity is an index of irregularity of toner particles and is 1.00 when the toner is completely spheric. The sphericity value decreases with an increase of complexity of the surface shape.

A specific method of measuring the average sphericity is as follows: A surfactant (preferably alkylbenzenesulfonate) as a dispersion agent is added to 20 mL of water in a container from which impurities are preliminarily removed, and about 0.05 g of a sample (toner) to be measured is added thereto. The resulting suspension containing the sample is irradiated with ultrasound for 30 seconds. The particle concentration is adjusted to 3800 to 8000 particles/μL (microliter), and the sphericity distribution of particles having diameters corresponding to circles of 0.60 μm or more and less than 160 μm is measured with the flow type particle image analyzer.

[Kind of Toner]

The toner of the present invention is not limited as long as the average sphericity is within the range mentioned above. Various kinds of toners are usually available according to the process of production, and any kind of toner can be used in the present invention.

The kind of the toner will now be described together with the method of manufacturing the toner.

The toner of the present invention may be produced by any conventional method. For example, the toner may be produced by a polymerization process or a melt suspension process. Furthermore, toner spherified by treating so-called pulverized toner with, for example, heat can be used, and preferred are toner particles produced in an aqueous medium, i.e., toner produced by a so-called polymerization process.

Examples of the polymerized toner include suspension polymerized toner and emulsion polymerized agglomerated toner. In particular, the emulsion polymerization and agglomeration, which is a method for producing toner by agglomeration of polymer resin microparticles with, for example, a colorant in a liquid medium, can adjust the particle diameter and sphericity of the toner by controlling agglomeration conditions and is thereby preferred.

Furthermore, in order to improve mold release properties, fixability at low temperature, offset properties at high temperature, or filming resistance of the toner, proposed is toner containing a material having a low softening point (so-called wax). In a melt-kneading pulverization process, it is difficult to increase the amount of a wax added to the toner, and the highest amount of the wax may be 5 weight % to that of the polymer (binder resin). On the other hand, in polymerized toner, the material having a low softening point can be used in a high concentration (5 to 30 weight %). Here, the polymer is a raw material constituting the toner and is obtained by, for example, polymerization of a polymerizable monomer when the toner is produced by emulsion polymerization and agglomeration described below.

Toner produced by emulsion polymerization and agglomeration will now be described in further detail.

When toner is produced by emulsion polymerization and agglomeration, the production process usually includes a polymerization step, a mixing step, an agglomeration step, a fusion step, and a washing/drying step. That is, in general, polymer primary particles are prepared by emulsion polymerization (polymerization step); the dispersion containing the polymer primary particles is optionally mixed with a dispersion agent such as a colorant (pigment), a wax, or a charge controlling agent (mixing step); a flocculant is added to this dispersion to agglomerate the primary particles into particle agglomerate (agglomeration step); a step of adhesion of microparticles is optionally conducted, and then fusion for obtaining particles is performed (fusion step); and the obtained particles are washed and dried (washing/drying step) to give mother particles.

[Polymerization Step]

Any polymer microparticles (polymer primary particles) can be used. Accordingly, either the microparticles prepared by polymerizing a monomer in a liquid medium by suspension polymerization or emulsion polymerization or microparticles prepared by pulverizing agglomerate of a polymer such as a resin may be used as the polymer primary particles. However, polymerization, particularly emulsion polymerization, more particularly a process using a wax as a seed for emulsion polymerization is preferred. When a wax is used as a seed for emulsion polymerization, microparticles having a structure in which the wax is wrapped with the polymer can be produced as the polymer primary particles. With this process, the wax can be contained in the toner without exposing to the surface of the toner. Consequently, the apparatus is not contaminated with the wax, and the charging characteristics of the toner are not deteriorated. In addition, the low temperature fixability, high-temperature offset properties, filming resistance, and mold release properties of the toner can be improved.

A process for obtaining polymer primary particles by conducting emulsion polymerization using a wax as a seed will now be described.

The emulsion polymerization may be conducted according to a conventional process. In general, a wax is dispersed in a liquid medium in the presence of an emulsifier into wax microparticles. Then, the wax microparticles are mixed with a polymerization initiator and a monomer for giving a polymer by polymerization (i.e., a compound having a polymerizable carbon-carbon double bond) and, optionally, for example, a chain transfer agent, a pH adjuster, a polymerization-controlling agent, an antifoam, a protective colloid, and an internal additive, for polymerization with agitating. As a result, an emulsion of the liquid medium dispersing polymer microparticles (i.e., polymer primary particles) having a structure in which the wax is wrapped with the polymer in the liquid medium can be obtained. Examples of the structure in which the wax is wrapped with the polymer include a core-shell type, a phase-separation type, and an occlusion type. The core-shell type is preferred.

(i. Wax)

Any wax that is known for this application can be used, and examples thereof include olefin waxes such as low molecular weight polyethylene, low molecular weight polypropylene, and copolymerized polyethylene; paraffin waxes; silicone waxes having an alkyl group; fluorine-containing resin waxes such as low molecular weight polytetrafluoroethylene; higher fatty acids such as stearic acid; long-chain aliphatic alcohols such as eicosanol; ester waxes having a long-chain aliphatic group, such as behenyl behenate, montanate, and stearyl stearate; ketones having a long-chain alkyl group, such as distearyl ketone; plant waxes such as hydrogenated castor oil and carnauba wax; esters or partial esters prepared from polyol and long-chain fatty acid, such as glycerin and pentaerythritol; higher fatty acid amide such as oleic acid amide and stearic acid amide; and low molecular weight polyester. Among them, those having at least one endothermic peak at 50 to 100° C. in differential scanning calorimetry (DSC) are preferred.

Among waxes, for example, the ester waxes, the paraffin waxes, the olefin waxes such as low molecular weight polypropylene and copolymerized polyethylene, and the silicone waxes can exhibit mold release properties at a small amount and are preferred. The paraffin waxes are particularly preferred.

The waxes may be used alone or in any combination of two or more kinds in any ratio.

The wax may be used at any amount. However, the amount of the wax is usually 3 parts by weight or more and preferably 5 parts by weight or more and usually 40 parts by weight or less and preferably 30 parts by weight or less, on the basis of 100 parts by weight of a polymer. A smaller amount of the wax may reduce the range of the fixing temperature width, and a larger amount may contaminate the apparatus to decrease image quality.

(ii. Emulsifier)

Any emulsifier can be used within the scope that does not significantly impair the effects of the present invention. For example, any of nonionic, anionic, cationic, and amphoteric surfactants can be used.

Examples of the nonionic surfactant include polyoxyalkylene alkyl ethers such as polyoxyethylene lauryl ether, polyoxyalkylene alkylphenyl ethers such as polyoxyethylene octylphenyl ether, and sorbitan fatty acid esters such as sorbitan monolaurate.

Examples of the anionic surfactant include fatty acid salts such as sodium stearate and sodium oleate, alkylarylsulfonic acid salts such as sodium dodecylbenzenesulfonate, and alkylsulfuric acid ester salts such as sodium laurylsulfate.

Examples of the cationic surfactant include alkylamine salts such as laurylamine acetate and quaternary ammonium salts such as lauryltrimethylammonium chloride.

Examples of the amphoteric surfactant include alkylbetaines such as laurylbetaine.

Among them, nonionic surfactants and anionic surfactants are preferred.

The emulsifiers may be used alone or in any combination of two or more kinds in any ratio.

The amount of the emulsifier to be blended is not limited within the scope that does not significantly impair the effects of the present invention, but is usually 1 to 10 parts by weight, on the basis of 100 parts by weight of the polymerizable monomer.

(iii. Liquid Medium)

The liquid medium is usually an aqueous medium, and water is particularly preferred. However, the quality of the liquid medium affects coarsening of particles due to reagglomeration in the liquid medium, and higher electric conductivity of the liquid medium tends to decrease dispersion stability over time. Accordingly, when an aqueous medium such as water is used as the liquid medium, deionized water or distilled water demineralized such that the electric conductivity is usually 10 μS/cm or less and preferably 5 μS/cm or less is preferably used. The electric conductivity is measured with a conductometer (Personal SC meter model SC72 with a detector SC72SN-11 manufactured by Yokogawa Corp.) at 25° C.

The liquid medium may be used at any amount, but the amount is usually about 1 to 20 times the polymerizable monomer on the basis of weight.

Wax microparticles are prepared by dispersing the wax in this liquid medium in the presence of an emulsifier. The emulsifier and the wax in the liquid medium may be added to the liquid medium in any order, but, in general, the emulsifier is first blended with the liquid medium, and then the wax is mixed therewith. The emulsifier may be continuously blended with the liquid medium.

(iv. Polymerization Initiator)

After the preparation of the wax microparticles, a polymerization initiator is added to the liquid medium. Any polymerization initiator can be used within the scope that does not significantly impair the effects of the present invention, and examples thereof include persulfates such as sodium persulfate and ammonium persulfate; organic peroxides such as t-butyl hydroperoxide, cumene hydroperoxide, and p-methane hydroperoxide; and inorganic peroxides such as hydrogen peroxide. Among them, inorganic peroxides are preferred. The polymerization initiators may be used alone or in any combination of two or more kinds in any ratio.

Furthermore, the polymerization initiator may be a redox polymerization initiator. In such cases, a persulfate or an organic or inorganic oxide is used with a reducing organic compound such as ascorbic acid, tartaric acid, or citric acid or a reducing inorganic compound such as sodium thiosulfate, sodium bisulfite, or sodium methabisulfite. The reducing inorganic compounds may be alone or in any combination of two or more kinds in any ratio.

The polymerization initiator is also used in any amount, but the amount is usually 0.05 to 2 parts by weight on the basis of 100 parts by weight of the polymerizable monomer.

(v. Polymerizable Monomer)

After the preparation of the wax microparticles, in addition to the polymerization initiator, a polymerizable monomer is added to the liquid medium. Any polymerizable monomer can be used. For example, a monofunctional monomer, such as a styrene, (meth)acrylate, an acrylamide, a monomer having a Bronsted acid group (hereinafter, optionally, abbreviated to "acidic monomer"), or a monomer having a Bronsted basic group (hereinafter, optionally, abbreviated to "basic monomer"), is mainly used. In addition, a multifunctional monomer may be used together with a monofunctional monomer.

Examples of the styrenes include styrene, methylstyrene, chlorostyrene, dichlorostyrene, p-tert-butylstyrene, p-n-butylstyrene, and p-n-nonylstyrene.

Examples of (meth)acrylates include methyl acrylate, ethyl acrylate, propyl acrylate, n-butyl acrylate, isobutyl acrylate, hydroxyethyl acrylate, 2-ethylhexyl acrylate, methyl methacrylate, ethyl methacrylate, propyl methacrylate, n-butyl methacrylate, isobutyl methacrylate, hydroxyethyl methacrylate, and 2-ethylhexyl methacrylate.

Examples of the acrylamides include acrylamide, N-propylacrylamide, N,N-dimethylacrylamide, N,N-dipropylacrylamide, and N,N-dibutylacrylamide.

Examples of the acidic monomer include monomers having a carboxyl group, such as acrylic acid, methacrylic acid, maleic acid, fumaric acid, or cinnamic acid; monomers having a sulfonate group, such as sulfonated styrene; and monomers having a sulfonamide group, such as vinylbenzenesulfonamide.

Examples of the basic monomer include aromatic vinyl compounds having an amino group, such as aminostyrene; monomers having a nitrogen-containing heterocycle, such as vinylpyridine and vinylpyrrolidone; and (meth)acrylates having an amino group, such as dimethylaminoethyl acrylate and diethylaminoethyl methacrylate.

Furthermore, the acidic monomer and the basic monomer may be present as salts with counter ions.

Examples of the multifunctional monomer include divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol diacrylate, and diarylphthalate. In addition, monomers having a reactive group, such as glycidyl methacrylate, N-methylol acrylamide, and acrolein can be used. Among them, preferred are radical polymerizable difunctional monomers, in particular, divinylbenzene and hexanediol diacrylate.

Among them, at least styrene, (meth)acrylate, and acidic monomers having a carboxyl group are preferred as the polymerizable monomers. In particular, styrene is preferred among styrenes, butyl acrylate is preferred among (meta) acrylates, and acrylic acid is preferred among the acidic monomers having a carboxyl group.

The polymerizable monomers may be used alone or in any combination of two or more kinds in any ratio.

When a wax is used as a seed for emulsion polymerization, an acidic monomer or a basic monomer is preferably used together with another monomer. The use of the acidic monomer or the basic monomer can improve dispersion stability of the polymer primary particles.

In such a case, the acidic monomer or the basic monomer is blended in any ratio, but the amount of the acidic monomer or the basic monomer is usually 0.05 part by weight or more, preferably 0.5 part by weight or more, and more preferably 1 part by weight or more and usually 10 parts by weight or less and preferably 5 parts by weight or less, on the basis of 100 parts by weight of the total polymerizable monomer. When the amount of the acidic monomer or the basic monomer is lower than the above-mentioned range, the dispersion stability of the polymer primary particles may be deteriorated. When the amount is higher than the upper limit, the charging characteristics of toner may be adversely affected.

When a multifunctional monomer is additionally used, the amount is not limited, but the amount of the multifunctional monomer is usually 0.005 part by weight or more, preferably 0.1 part by weight or more, and more preferably 0.3 part by weight or more and usually 5 parts by weight or less, preferably 3 parts by weight or less, and more preferably 1 part by weight or less, on the basis of 100 parts by weight of the polymerizable monomer. The use of the multifunctional monomer can improve fixability of the toner. When the amount of the multifunctional monomer is lower than the above-mentioned range, the offset properties at high temperature may be decreased. When the amount is higher than the upper limit, the fixability at low temperature may be decreased.

The process of blending the polymerizable monomer with the liquid medium is not particularly limited. For example, the polymerizable monomer may be added at once, continuously, or intermittently with the liquid medium, and is preferably continuously blended from the viewpoint of control of the reaction. When a plurality of polymerizable monomers is used, the polymerizable monomers may be separately compounded or may be previously mixed and then blended with the liquid medium. In addition, the composition of the polymerizable monomer mixture may be changed during the process of the blending with the liquid medium.

(vi. Chain Transfer Agent and Others)

After the preparation of the wax microparticles, additives such as a chain transfer agent, a pH adjuster, a polymerization-controlling agent, an antifoam, a protective colloid, and an internal additive, in addition to the polymerization initiator and the polymerizable monomer, are added to the liquid medium according to need. Any additive may be used within the scope that does not significantly impair the effects of the present invention. These additives may be used alone or in any combination of two or more kinds in any ratio.

Any known chain transfer agent can be used, and examples thereof include t-dodecyl mercaptan, 2-mercaptoethanol, diisopropyl xanthogene, carbon tetrachloride, and trichlorobromomethane. The ratio of the chain transfer agent is usually 5 parts by weight or less, on the basis of 100 parts by weight of the polymerizable monomer.

Any known protective colloid that is used in this application can be used. Examples thereof include polyvinyl alcohols such as partially or completely saponified polyvinyl alcohol, and cellulose derivatives such as hydroxyethyl cellulose.

The internal additive improves adhesion, cohesiveness, fluidity, charging property, and surface resistance of the toner. Examples of such internal additive include silicone oils, silicone varnishes, and fluorine-base oils.

(vii. Polymer Primary Particle)

Polymer primer particles are prepared by mixing the polymerization initiator, a polymerizable monomer, and optional additives with a liquid medium, and agitating the mixture for polymerization. The polymer primary particles can be obtained in the form of emulsion in the liquid medium.

The polymerization initiator, the polymerizable monomer, and the additives may be added to the liquid medium in any order and may be mixed and agitated by any method.

Furthermore, the temperature of the polymerization reaction (emulsion polymerization reaction) is not limited as long as the reaction proceeds. However, the polymerization temperature is usually 50° C. or higher, preferably 60° C. or higher, and more preferably 70° C. or higher and usually 120° C. or lower, preferably 100° C. or lower, and more preferably 90° C. or lower.

The volume average particle diameter of the polymer primary particles is not particularly limited, but is usually 0.02 μm or more, preferably 0.05 μm or more, and more preferably 0.1 μm or more and usually 3 μm or less, preferably 2 μm or less, and more preferably 1 μm or less. A smaller volume average particle diameter may preclude control of the agglomeration rate, and a larger volume average particle diameter may make a large particle diameter of toner due to excess agglomeration. Consequently, toner having a target particle diameter cannot be obtained in some cases. The volume average particle diameter can be measured with a particle size analyzer based on a dynamic light-scattering method described below.

In the present invention, the volume particle size distribution is measured by a dynamic light-scattering method. In this method, the particle size distribution is determined by detecting the velocity of Brownian motion of minutely dispersed particles by irradiating the particles with laser light and detecting the scattering (Doppler shift) of light beams having different phases depending on the velocity. In actual measurement, the volume particle diameter is measured using an ultrafine particle size distribution analyzer (model UPA-EX150, hereinafter abbreviated to UPA-EX, manufactured by Nikkiso Co., Ltd.) based on a dynamic light-scattering system under the following conditions:

Upper limit of the measurement: 6.54 μm
Lower limit of the measurement: 0.0008 μm
Channel number: 52
Measurement time: 100 second
Measurement temperature: 25° C.
Particle transparency: absorptive
Particle refractive index: N/A (not applicable)
Particle shape: non-spherical
Density: 1 g/cm$^3$
Dispersion medium: Water
Refractive index of dispersion medium: 1.333

The measurement is conducted with a sample that is prepared by diluting a dispersion of the particles with the liquid medium so that the sample concentration index is in the range of 0.01 to 0.1 and applying the sample to dispersion treatment with an ultrasonic cleaner. The volume average particle diameter according to the present invention is the arithmetic average calculated from the results of the volume particle size distribution.

In the polymer constituting the polymer primary particles, at least one of the peak molecular weights in gel permeation chromatography is usually 3000 or more, preferably 10000 or more, and more preferably 30000 or more and usually 100000 or less, preferably 70000 or less, and more preferably 60000 or less. When the peak molecular weight is within the above-mentioned range, the durability, storage stability, and fixability of toner tend to be improved. Here, the peak molecular weight is a reduced value by polystyrene, and components insoluble in the solvent are removed before the measurement. The peak molecular weight can be measured as in the case of the toner described below.

In particular, when the polymer is a styrene resin, the lower limit of the number average molecular weight of the polymer in gel permeation chromatography is usually 2000 or more, preferably 2500 or more, and more preferably 3000 or more, and the upper limit thereof is usually 50000 or less, preferably 40000 or less, and more preferably 35000 or less. In addition, the lower limit of the weight average molecular weight of the polymer is usually 20000 or more, preferably 30000 or more, and more preferably 50000 or more, and the upper limit thereof is usually 1000,000 or less and preferably 500,000 or less. When the polymer is a styrene resin having at least one, preferably both, of the number average molecular weight and the weight average molecular weight in such a range, the resulting toner can have favorable durability, storage stability, and fixability. Furthermore, the polymer may have two main peaks in the molecular weight distribution. The styrene resin means a polymer containing styrene and/or styrene derivatives in an amount of usually 50 weight % or more and preferably 65 weight % or more, on the basis of the total polymer.

It is preferable that the softening point (hereinafter, optionally, abbreviated to "Sp") of the polymer be usually 150° C. or lower and preferably 140° C. or lower, from the viewpoint of low-energy fixing, and be usually 80° C. or higher and preferably 100° C. or higher, from the viewpoints of high-temperature offset properties and durability. Here, the softening point of a polymer can be determined as a temperature at the intermediate point of a strand from the initiation to the termination of the flow when 1.0 g of a sample is measured by a flow tester with a nozzle size of 1 mm×10 mm under conditions of a load of 30 kg, preliminary heating at 50° C. for 5 minutes, and at a heating rate of 3° C./min.

The glass-transition temperature (Tg) of the polymer is usually 80° C. or lower and preferably 70° C. or lower. When the glass-transition temperature (Tg) of the polymer is too high, low-energy fixation may be impossible. The lower limit of the glass-transition temperature (Tg) of the polymer is usually 40° C. or higher and preferably 50° C. or higher. When the glass-transition temperature (Tg) of the polymer is too low, the blocking resistance may be decreased. Here, the glass-transition temperature (Tg) of the polymer can be determined as a temperature at the intersection of two tangent lines, where the tangent lines are drawn at the initial portions of the transition (inflection) in a curve measured with a differential scanning calorimeter at a heating rate of 10° C./min.

The softening point and the glass-transition temperature (Tg) of the polymer can be controlled within the above-mentioned ranges by adjusting, for example, the kind of the polymer and the composition, the molecular weights of the monomers.

[Mixing Step and Agglomeration Step]

An emulsion of the polymer and agglomerate (agglomerated particles) containing a pigment is prepared by mixing pigment particles with an emulsion dispersing the polymer primary particles for agglomeration. On this occasion, a dispersion is preferably prepared by previously dispersing pigment particles homogeneously in a liquid medium with, for example, a surfactant and then mixing this dispersion with the emulsion of polymer primary particles. The liquid medium for the pigment particle dispersion is usually an aqueous solvent such as water, and the pigment particle dispersion is prepared as an aqueous dispersion. Furthermore, on this occasion, for example, a wax, a charge controlling agent, a mold-releasing agent, and an internal additive may be optionally mixed with the emulsion. Furthermore, in order to maintain the stability of the pigment particle dispersion, the emulsifier described above may be used.

Any polymer primary particles obtained by emulsion polymerization can be used. The polymer primary particles may be one kind or in any combination of two or more kinds in any ratio. Furthermore, polymer primary particles (hereinafter, optionally, referred to as "concomitant polymer particles") prepared using raw materials and reaction conditions that are different from those of the above-described emulsion polymerization may be additionally used.

The concomitant polymer particles may be, for example, microparticles prepared by suspension polymerization or pulverization. The raw material of the concomitant polymer particles can be a resin. Examples of the resin include the (co)polymers of the monomers applied to the above-described emulsion polymerization; monopolymers or copolymers of vinyl monomers such as vinyl acetate, vinyl chloride, vinyl alcohol, vinyl butyral, and vinyl pyrrolidone; thermoplastic resins such as saturated polyester resins, polycarbonate resins, polyamide resins, polyolefin resins, polyarylate resins, polysulfone resins, and polyphenylene ether resins; and thermosetting resins such as unsaturated polyester resins, phenol resins, epoxy resins, urethane resins, and rosin-modified maleic acid resins. These concomitant polymer particles may be also used as one kind or in any combination of two or more kinds in any ratio. However, the rate of the concomitant polymer particles is usually 5 weight % or less, preferably 4 weight % or less, and more preferably 3 weight % or less, on the basis of the total of the polymer primary particles and the concomitant polymer particles.

Any pigment can be used depending on application without limitation. However, the pigment is usually present in the form as colorant particles, and the pigment particles preferably have a smaller difference in density from the polymer primary particles in an emulsion polymerization and agglomeration process. Such a smaller difference in density gives a homogeneous agglomeration state when the polymer primary particles and the pigment are agglomerated. Accordingly, the characteristics of the obtained toner can be improved. The density of the polymer primary particles is usually 1.1 to 1.3 g/cm$^3$.

From the aforementioned viewpoint, the true density of the pigment particles measured with a pycnometer in accordance with JIS K 5101-11-1:2004 is usually 1.2 g/cm$^3$ or more and preferably 1.3 g/cm$^3$ or more and usually less than 2.0 g/cm$^3$, preferably 1.9 g/cm$^3$ or less, and more preferably 1.8 g/cm$^3$ or less. In the case that the true density of the pigment is large, in particular, the precipitation property in a liquid medium tends to be impaired. In addition, in consideration of, for example, storage stability and sublimation, the pigment is preferably carbon black or an organic pigment.

Examples of the pigment satisfying the above-mentioned conditions include yellow pigments, magenta pigments, and cyan pigments shown below. As a black pigment, carbon black or those toned into black by mixing a yellow pigment, the magenta pigment, and a cyan pigment shown below can be used.

Among them, carbon black used as the black pigment is present in the form of aggregate of highly fine primary particles and easily causes coarsening of carbon black particles due to reagglomeration when it is dispersed as a pigment particle dispersion. The degree of agglomeration of the carbon black particles has a correlation with the size of impurities (the amount of the remaining undecomposed organic materials) contained in the carbon black, that is, a larger amount of impurities results in prominent coarsening due to agglomeration after dispersion.

For determination of the amount of impurities, the ultraviolet absorbance of toluene extract from carbon black measured by the following procedure is usually 0.05 or less and preferably 0.03 or less. In general, carbon black produced by a channel process includes larger amounts of impurities. Accordingly, the carbon black used in toner of the present invention is preferably produced by a furnace process.

The ultraviolet absorbance ($\lambda c$) of carbon black is determined by the following process: 3 g of carbon black is sufficiently dispersed in 30 mL of toluene, and then this mixture is filtered through No. 5C filter paper. Then, the filtrate is transferred to a square quartz cell with a 1 cm light path and is subjected to measurement of absorbance ($\lambda s$) at a wavelength of 336 nm using a commercially available ultraviolet spectrophotometer. As a reference, toluene is subjected to measurement of absorbance ($\lambda o$) by the same method, and the ultraviolet absorbance is determined by $\lambda c=\lambda s-\lambda o$. An example of the commercially available spectrophotometer is an ultraviolet and visible spectrophotometer (UV-3100PC) manufactured by Shimadzu Corp.

Typical examples of the yellow pigment include condensed azo compounds and isoindolinone compounds. Specifically preferred are C.I. Pigment Yelllows 12, 13, 14, 15, 17, 62, 74, 83, 93, 94, 95, 109, 110, 111, 128, 129, 147, 168, 180, and 185.

Examples of the magenda pigment include condensed azo compounds, diketopyrrolopyrrole compounds, anthraquinones, quinacridone compounds, basic dye lake compounds, naphthol compounds, benzimidazollone compounds, thioindigo compounds, and perylene compounds. Specifically preferred are C.I. Pigment Reds 2, 3, 5, 6, 7, 23, 48:2, 48:3, 48:4, 57:1, 81:1, 122, 144, 146, 166, 169, 177, 184, 185, 202, 206, 207, 209, 220, 221, 238, and 254, and C.I. Pigment Violet 19.

Among them, the quinacridone pigments denoted as C.I. Pigment Reds 122, 202, 207, and 209, and C.I. Pigment Violet 19 are particularly preferable. These quinacridone pigments have bright tint and high light resistance and are therefore suitable as a magenta pigment. Among the quinacridone pigments, a compound denoted as C.I. Pigment Red 122 is particularly preferred.

Examples of the cyan pigment include copper phthalocyanine compounds and their derivatives, anthraquinone compounds, and basic dye lake compounds. Specifically preferred are C.I. Pigment Blues 1, 7, 15, 15:1, 15:2, 15:3, 15:4, 60, 62, and 66.

The pigments may be used alone or in any combination of two or more kinds in any ratio.

The pigment is dispersed in a liquid medium to form a pigment particle dispersion and then mixed with an emulsion containing polymer primary particles. On this occasion, the amount of the pigment particles in the pigment particle dispersion is usually 3 parts by weight or more and preferably 5 parts by weight or more and usually 50 parts by weight or less and preferably 40 parts by weight or less, on the basis of 100 parts by weight of the liquid medium. In the case that the amount of the colorant is higher than the above-mentioned range, such a high pigment concentration may cause reagglomeration of the pigment particles with high possibility. In the case that the amount is less than the above-mentioned range, dispersion of the particles may be excess to make it difficult to obtain suitable particle size distribution.

The amount of the pigment to that of the polymer contained in the polymer primary particles is usually 1 weight % or more and preferably 3 weight % or more and usually 20 weight % or less and preferably 15 weight % or less. A smaller amount of the pigment may decrease the image density, while a larger amount may preclude control of the agglomeration.

The pigment particle dispersion may contain a surfactant. Any surfactant can be used, and examples thereof are the emulsifiers exemplified in the description of the emulsion polymerization. Among them, preferred are nonionic surfactants, anionic surfactants such as alkylarylsulfonic acid salts, e.g., sodium dodecylbenzenesulfonate, and polymer surfactants. The surfactants may be used alone or in any combination of two or more kinds in any ratio.

The rate of the pigment to that of the pigment particle dispersion is usually 10 to 50 weight %.

The liquid medium of the pigment particle dispersion is usually an aqueous medium and preferably water. The polymer primary particles and the water quality of the pigment particle dispersion affect coarsening due to reagglomeration of particles, and higher electric conductivity tends to decrease dispersion stability over time. Accordingly, deionized water or distilled water demineralized such that the electric conductivity is usually 10 μS/cm or less and preferably 5 μS/cm or less is preferably used. The electric conductivity is measured with a conductometer (Personal SC meter model SC72 with a detector SC72SN-11 manufactured by Yokogawa Corp.) at 25° C.

When the pigment is mixed with an emulsion containing polymer primary particles, the emulsion may contain a wax. The wax may be identical to those described in the emulsion polymerization. The wax may be mixed with the emulsion containing polymer primary particles in any step before, during, or after the mixing of the pigment.

Furthermore, when the pigment is mixed with an emulsion containing polymer primary particles, the emulsion may contain a charge controlling agent.

Any charge controlling agent that is known for this application can be used. Examples of positive charge controlling agents include nigrosin dyes, quaternary ammonium salts, triphenylmethane compounds, imidazole compounds, and polyamine resins. Examples of negative charge controlling agents include azo complex compounds dyes containing atoms such as Cr, Co, Al, Fe, or B; metal salts or metal complexes of salicylic acid and alkylsalicylic acids; calix arene compounds, metal salts or metal complexes of benzilic acid, amide compounds, phenol compounds, naphthol compounds, and phenolamide compounds. Among them, in order to avoid color tone interference of the toner, colorless or light-colored compounds are preferred. In particular, preferred positive charge controlling agents are quaternary ammonium salts and imidazole compounds, and preferred negative charge controlling agents are alkylsalicylic acid complexes containing atoms such as Cr, Co, Al, Fe, or B and calix arene compounds. The charge controlling agents may be used alone or in any combination of two or more kinds in any ratio.

The charge controlling agent may be used in any amount, but the amount is usually 0.01 part by weight or more and preferably 0.1 parts by weight or more and usually 10 parts by weight or less and preferably 5 parts by weight or less, on the basis of 100 parts by weight of the polymer. The desired charge density cannot be obtained if the amount of the charge controlling agent is too small or too large.

The charge controlling agent may be mixed with the emulsion containing polymer primary particles in any step before, during, or after the mixing of the pigment.

The charge controlling agent is desirably emulsified in a liquid medium (usually aqueous medium) and then the mixing is conducted during the agglomeration step, as in the case of the pigment particles.

After the mixing of the pigment with the emulsion containing the polymer primary particles, the polymer primary particles and the pigment are agglomerated. As described above, the pigment is applied to the mixing in the form of a pigment particle dispersion.

Any agglomeration process can be employed, and examples thereof include heating, admixing an electrolyte, and control of pH. Among them, preferred is admixing an electrolyte.

Examples of the electrolyte used for agglomeration include chlorides such as NaCl, KCl, LiCl, $MgCl_2$, and $CaCl_2$; inorganic salts such as sulfates, e.g., $Na_2SO_4$, $K_2SO_4$, $Li_2SO_4$, $MgSO_4$, $CaSO_4$, $ZnSO_4$, $Al_2(SO_4)_3$, and $Fe_2(SO_4)_3$; and organic salts such as $CH_3COONa$ and $C_6H_5SO_3Na$. Among them, preferred are inorganic salts having two or more valents, i.e., multivalent metal cations.

The electrolytes may be used alone or in any combination of two or more kinds in any ratio.

The amount of the electrolyte can be changed depending on the kind of the electrolyte, and is usually 0.05 part by weight or more and preferably 0.1 part by weight or more and usually 25 parts by weight or less, preferably 15 parts by weight or less, and more preferably 10 parts by weight or less, on the basis of 100 parts by weight of solid components in the emulsion. In the case of that an electrolyte is contained in the agglomeration, a smaller amount of the electrolyte may reduce the rate of the agglomeration reaction, whereby fine powder with a diameter of 1 μm or less remains after the agglomeration reaction or the average particle diameter of the agglomerate does not reach the desired size. A larger amount of the electrolyte may accelerate the rate of the agglomeration reaction to preclude the control of the particle diameter, resulting in yielding of agglomerate containing coarse particles and irregular-shaped particles.

The obtained agglomerates are preferably spherified by sequentially heating in the liquid medium, as in the case of secondary agglomerate (agglomerate after fusion step) described below. The heating may be conducted under conditions similar to those in the case of secondary agglomerate (conditions similar to those described in the description of the fusion step).

In the agglomeration by heating, the temperature conditions are not limited as long as agglomeration proceeds. Specifically, the temperature is usually 15° C. or higher and preferably 20° C. or higher but not higher than the glass-transition temperature (Tg) of the polymer of the polymer primary particles and preferably 55° C. or lower. The agglomeration time is not limited, and is usually 10 minutes or longer and preferably 60 minutes or longer and usually 300 minutes or shorter and preferably 180 minutes or shorter.

Furthermore, the agglomeration is preferably conducted under agitation. Any device can be used for the agitation, and preferred is one having a double helical blade.

The obtained agglomerate may be directly applied to the next step (encapsulation step), i.e., a step of forming a resin coat layer or may be sequentially heated in the liquid medium and then applied to an encapsulation step. Desirably, after the agglomeration step, the encapsulation step is carried out, and the fusion step is preferably carried out by heating at a temperature not lower than the glass-transition temperature (Tg) of the capsulated resin microparticles, which makes the process simple and can prevent deterioration of the toner (such as heat deterioration).

[Encapsulation Step]

After the formation of agglomerate, the agglomerate is preferably provided with a resin coat layer, according to need. In the capsulation step of forming the resin coat layer on the agglomerate, the surface of the agglomerate is coated with a resin coat layer. With this, the produced toner is provided with the resin coat layer. In the encapsulation step, the toner may not be completely coated with the resin, but the toner containing a pigment can be obtained in such a state that the pigment is not substantially exposed to the surface of the toner particle. The thickness of the resin coat layer is not limited, but is usually within the range of 0.01 to 0.5 μm.

The method of forming the resin coat layer is not particularly limited, and may be, for example, spray drying, mechanical particle composite processing, in-situ polymerization, or in-liquid particle coating.

In the case that the resin coat layer is formed by the spray drying, for example, agglomerate to be the inner layer and resin microparticles to be the resin coat layer are dispersed in an aqueous medium to prepare a dispersion, and this dispersion is sprayed and then dried to form a resin coat layer on the surface of the agglomerate.

In the case that the resin coat layer is formed by the mechanical particle composite processing. For example, agglomerate to be the inner layer and resin microparticles to be the resin coat layer are dispersed in a gas phase, and the resin coat layer of resin microparticles is formed on the surface of the agglomerate by applying mechanical force at a narrow gap. A device, for example, a hybridization system (manufactured by Nara Machinery Co., Ltd.) or a mechanofusion system (manufactured by Hosokawa Micron Ltd.), can be used.

Furthermore, in the in-situ polymerization, for example, a resin coat layer is formed on the surface of agglomerate, i.e., the inner layer, by dispersing the agglomerate in water, mixing a monomer and a polymerization initiator to be adsorbed on the agglomerate surface, and heating the mixture for polymerizing the monomer.

In the in-liquid particle coating, for example, agglomerate for forming an inner layer and resin microparticles for forming an outer layer are allowed to be reacted or bonded to each other in an aqueous medium to form a resin coat layer on the surface of the agglomerate being the inner layer.

The resin microparticles used for forming the outer layer are particles having a particle diameter smaller than that of the agglomerate and containing the resin as a main component. The resin microparticles are not particularly limited as long as they are polymers. However, from the viewpoint of control of the thickness of the outer layer, the resin microparticles are preferably the polymer primary particles, the agglomerate, or fusion particles fused with the agglomerate. The resin microparticles similar to these polymer primary particles or the like can be produced as in the case of the polymer primary particles used in the inner layer.

The amount of the resin microparticles is not limited, but is usually 1 weight % or more and preferably 5 weight % or more and usually 50 weight % or less and preferably 25 weight % or less, on the basis of the amount of the toner particles.

Furthermore, in order to effectively perform the binding or fusion of the resin microparticle to the agglomerate, in general, the particle diameter of the resin microparticles is preferably about 0.04 to 1 μm.

The polymer component (resin component) used in the resin coat layer has a glass-transition temperature (Tg) of usually 60° C. or higher and preferably 70° C. or higher and usually 110° C. or lower. Furthermore, the polymer component used in the resin coat layer preferably has a glass-transition temperature (Tg) which is at least 5° C. or higher and preferably at least 10° C. or higher than that of the polymer primary particles. A lower glass-transition temperature (Tg) may make it difficult to preserve the polymer component under ambient conditions, and a higher glass-transition temperature (Tg) may cause insufficient fusion properties.

Furthermore, the resin coat layer preferably contains a polysiloxane wax, which can advantageously improve the offset properties at high temperature. An example of the polysiloxane wax is a silicone wax having an alkyl group.

The content of the polysiloxane wax in the toner is not limited, but is usually 0.01 weight % or more, preferably 0.05 weight % or more, and more preferably 0.08 weight % or more and usually 2 weight % or less, preferably 1 weight % or less, and more preferably 0.5 weight % or less. A smaller amount of the polysiloxane wax in the resin coat layer may cause insufficient offset properties at high temperature, and a larger amount may reduce the blocking resistance.

The polysiloxane wax may be added to the resin coat layer by any process, and, for example, emulsion polymerization is performed using the polysiloxane wax as a seed, and the resulting resin microparticles and agglomerate for forming an inner layer are reacted or bonded to each other in an aqueous medium to form a resin coat layer containing the polysiloxane wax on the surface of the agglomerate forming the inner layer.

[Fusion Step]

In the fusion step, the agglomerate is heated for fusion integration of a polymer constituting the agglomerate.

In the case that capsulated resin microparticles are formed by providing the resin coat layer to the agglomerate, heating treatment causes fusion integration of the polymer constituting the agglomerate and the resin coat layer on the surface thereof. With this, the pigment particles are not substantially exposed to the microparticle surfaces.

The temperature of the heating treatment in the fusion step is not lower than the glass-transition temperature (Tg) of the polymer primary particles constituting the agglomerate. In the case that the resin coat layer is formed, the temperature is not lower than the glass-transition temperature (Tg) of the polymer component forming the resin coat layer. The temperature conditions are not limited, but the temperature is preferably at least 5° C. or higher than the glass-transition temperature (Tg) of the polymer component forming the resin coat layer. There is no upper limit, but the highest temperature preferably does not exceed "a temperature that is 50° C. higher than the glass-transition temperature (Tg) of the polymer component that forms the resin coat layer".

The heating time is changed depending on the treatment ability and production scale, but is usually 0.5 to 6 hours.

[Washing and Drying Step]

In the case that each of the above-described steps is carried out in a liquid medium, toner can be obtained by washing the capsulated resin particles after the fusion step and removing the liquid medium by drying. The washing and the drying may be carried out by any method without limitation.

[Physical Values on Toner Particle Diameter]

The volume average particle diameter (Dv) of the toner of the present invention is not limited within the scope that does not significantly impair the effects of the present invention, but is usually 4 μm or more and preferably 5 μm or more and usually 10 μm or less and preferably 8 μm or less. A smaller volume average particle diameter (Dv) of the toner may decrease the stability of image quality, and a larger volume average particle diameter may decrease the resolution.

The toner of the present invention has a value (Dv/Dn) obtained by dividing the volume average particle diameter (Dv) by a number average particle diameter (Dn) of usually 1.0 or more and usually 1.25 or less, preferably 1.20 or less, and more preferably 1.15 or less. The value (Dv/Dn) defines a particle size distribution state, and a value closer to 1.0 means a sharper particle size distribution. A sharper particle size distribution makes charging characteristics uniform and is desirable.

Furthermore, the volume fraction in the particle diameter of 25 μm or more of the toner of the present invention is usually 1% or less, preferably 0.5% or less, more preferably 0.1% or less, and most preferably 0.05% or less. It is preferred that this value be small. The smaller value means that the rate of coarse powder contained in the toner is small. A small amount of coarse powder decreases consumption of the toner in continuous development and stabilizes the image quality and is preferable. It is most preferable that coarse powder having a particle diameter of 25 μm or more be not present at all, but it is difficult to actually realize this. Accordingly, in general, 0.005% or less coarse powder having a particle diameter of 25 μm or more may be present.

The volume fraction of the particle diameter of 15 μm or more of the toner of the present invention is usually 2% or less, preferably 1% or less, and more preferably 0.1% or less. It is most preferable that coarse powder having a particle diameter of 15 μm or more be not present at all, but it is difficult to actually realize this. Accordingly, in general, 0.01% or less coarse powder having a particle diameter of 15 μm or more may be present.

In the toner of the present invention, the number fraction in the particle diameter of 5 μm or less is usually 15% or less and preferably 10% or less, which is effective for avoiding fogged images and is desirable.

Here, the volume average particle diameter (Dv), the number average particle diameter (Dn), the volume fraction, and the number fraction of the toner can be measured as follows: The particle diameter of the toner is measured using a Coulter Counter Multicizer II or III (manufactured by Beckman Coulter, Inc.), which is connected to an interface and a general personal computer that outputs the number distribution and the volume distribution. The electrolyte used is Isotone II. In the measurement, 0.1 to 5 mL of a surfactant (preferably alkylbenzenesulfonic acid) serving as a dispersion agent is added to 100 to 150 mL of the electrolyte, and 2 to 20 mg of a sample (toner) to be measured is added thereto. The electrolyte suspending the sample is subjected to dispersion treatment for about 1 to 3 minutes using an ultrasonic dispersing device and is subjected to measurement with the Coulter Counter Multicizer II or III at an aperture of 100 μm. Thus, the number and the volume of the toner particles are measured, and the number distribution and the volume distribution are calculated to determine the volume average particle diameter (Dv) and the number average particle diameter (Dn).

[Physical Properties Relating to Toner Molecular Weight]

In THF-soluble components in the toner of the present invention, at least one of the peak molecular weights in gel permeation chromatography is usually 10,000 or more, preferably 20,000 or more, and more preferably 30,000 and usually 150,000 or less, preferably 100,000 or less, and more preferably 70,000 or less. THF means tetrahydrofuran. When all the peak molecular weights are lower than this range, the mechanical durability in a monocomponent nonmagnetic development system may be deteriorated. When all the peak molecular weights are higher than this range, the fixability at low temperature and the strength after fixation may be deteriorated.

Furthermore, the amount of THF-insoluble components of the toner is usually 10% or more and preferably 20% or more and usually 60% or less and preferably 50% or less when measured by a gravimetric method by celite filtration described below. When the amount does not reside within this range, it may be difficult to achieve compatibility of mechanical durability and fixability at low temperature.

The peak molecular weight of the toner of the present invention is measured with a measurement apparatus: HLC-8120GPC (manufactured by Tosoh Corp.) under the following conditions:

The column is stabilized in a heat chamber at 40° C., and tetrahydrofuran (THF) serving as a solvent is fed to the column at this temperature at a flow rate of 1 mL (milliliter)/min. Toner is dissolved in THF, and the solution is filtered through a 0.2 μm filter. The filtrate is used as a sample.

The measurement is conducted by injecting 50 to 200 μL of a THF solution containing 0.05 to 0.6 mass % (as resin concentration) of sample into the apparatus. In the measurement of the molecular weight of the sample (resin component in toner), the molecular weight distribution of the sample is calculated from the relationship between the logarithimic value of a calibration curve prepared using several monodisperse polystyrene standard samples and a count number. The standard polystyrene samples used for preparation of the calibration curve are, for example, those manufactured by Pressure Chemical Co. or Toyo Soda Kogyo Co., Ltd. and having the following molecular weights: $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. At least about 10 standard polystyrene samples are preferably used. The analyzer is an RI (refractive index) analyzer.

A combination of commercially available polystyrene gel columns is used in the above measurement for precisely measuring the molecular weight in the range of $10^3$ to $2\times10^6$. For example, a combination of μ-styragel 500, 103, 104, and 105 manufactured by Waters Co., Ltd. and a combination of shodexes KA801, 802, 803, 804, 805, 806 and 807 manufactured by Showa Denko K.K. are preferred.

The toner components insoluble in tetrahydrofuran (THF) can be measured as follows: 1 g of a sample (toner) is added to 100 g of THF, followed by leaving to stand at 25° C. for 24 hours for dissolution. The mixture is filtered through 10 g of celite. The solvent of the filtrate is evaporated, and the THF-soluble components are quantitatively determined. The THF-insoluble components can be calculated by subtracting the amount of the THF-soluble components from 1 g.

[Softening Point and Glass-Transition Temperature of Toner]

The softening point (Sp) of the toner of the present invention is not limited within the scope that does not significantly impair the effects of the present invention, but is usually 150° C. or lower and preferably 140° C. or lower from the viewpoint of low-energy fixation. The softening point is usually 80° C. or higher and preferably 100° C. or higher from the viewpoints of high-temperature offset properties and durability.

Here, the softening point (Sp) of the toner can be defined as a temperature at the intermediate point of a strand from the initiation to the termination of flow, when 1.0 g of a sample is measured with a flow tester having a nozzle size of 1 mm by 10 mm under conditions of a load of 30 kg, preliminary heating at 50° C. for 5 minutes, and at a heating rate of 3° C./min.

The glass-transition temperature (Tg) of the toner of the present invention is not limited within the scope that does not significantly impair the effects of the present invention. A glass-transition temperature (Tg) of usually 80° C. or lower and preferably 70° C. or lower is desirable for low-energy fixation. Furthermore, from a viewpoint of blocking resistance, the glass-transition temperature (Tg) is usually 40° C. or higher and preferably 50° C. or higher.

The glass-transition temperature (Tg) of the toner can be defined as a temperature at the intersection of two tangent lines drawn at the initial portion of the transition (inflection) of a curve measured with a differential scanning calorimeter at a heating rate of 10° C./min.

The softening point (Sp) and the glass-transition temperature (Tg) highly depend on the kind of the polymer contained in the toner and its composition. Therefore, the softening point (Sp) and the glass-transition temperature (Tg) of the toner can be controlled by optimizing the kind and composition of the polymer, or can be controlled by controlling the molecular weight of the polymer, gel composition, or the kind and amount of low-melting point components, such as a wax.

[Wax in Toner]

In the toner of the present invention containing a wax, the average particle diameter of the wax dispersed in the toner particles is usually 0.1 μm or more and preferably 0.3 μm or more and usually 3 μm or less and more preferably 1 μm or less. A smaller dispersed particle diameter cannot achieve an improvement in filming resistance of the toner, and a larger dispersed particle diameter may impair charging characteristics or heat resistance due to wax exposed to the surface of the toner.

The dispersed particle diameter of the wax can be determined by observing flaked toner with an electron microscope or by dissolving out polymers in the toner with an organic solvent that does not dissolve the wax, filtering the solution, and measuring the wax particles remaining on the filter with a microscope.

The amount of the wax in the toner is not limited within the range that the effects of the present invention are not significantly impaired, but is usually 0.05 weight % or more and preferably 0.1 weight % or more and usually 20 weight % or less and preferably 15 weight % or less. A smaller amount of the wax may narrow the fixation temperature width, and a larger amount may contaminate the apparatus, resulting in a decrease in image quality.

[Externally Added Microparticles]

In order to improve fluidity, charging stability, and blocking resistance at high temperature of the toner, the surface of the toner particles may be coated with externally added microparticles.

The toner particle surfaces may be coated with externally added microparticles by, for example, mixing secondary agglomerates and externally added microparticles in a liquid medium during a process of producing the toner, and heating the mixture for fixing the externally added microparticles on the toner particles; or mixing or fixing externally added microparticles to the toner particles, which are prepared by separating, washing, and drying secondary agglomerates from a liquid medium, by a dry system.

Examples of a mixer used for mixing the toner particles and the externally added microparticles in the dry system include a Henschel mixer, a super mixer, a Nauta mixer, a V-shaped mixer, a Loedige mixer, a double-cone mixer, and a drum-type mixer. In particular, it is preferable to use a high-speed agitating mixer such as a Henschel mixer or a super mixer so that the mixing is performed by uniform agitation by adjusting, for example, the blade shape, rotation speed, time, and the number of driving-termination cycles.

Examples of the apparatus used for the fixing externally added microparticles to the toner particles in the dry system include a compression shear apparatus that can apply a compressive shear stress to the particles and a particle surface fusion apparatus that can fuse the particle surfaces.

The compression shearing apparatus generally has a narrow gap between head faces, between a head face and a wall face, or between wall faces that can relatively move and can apply a compression stress and a shear stress to the surfaces of the particles that are forced to pass through the gap substantially without being pulverized. An example of such a compression shearing apparatus is a Mechanofusion system manufactured by Hosokawa Micron Ltd.

The particle surface fusion apparatus is generally configured such that the externally added microparticles are firmly fixed to the base microparticles by instantly heating a mixture of the base microparticles and the externally added microparticles to a temperature higher than the starting temperature of fusion of the base microparticles by, for example, a hot air flow. Examples of the particle surface fusion apparatus include surfusing system by Nippon Pneumatic Mfg. Co., Ltd.

Any externally added microparticle known for this application can be used, and examples thereof include inorganic microparticles and organic microparticles.

Examples of the inorganic microparticles include particles of carbides such as silicon carbide, boron carbide, titanium carbide, zirconium carbide, hafnium carbide, vanadium carbide, tantallum carbide, niobium carbide, tungsten carbide, chromium carbide, molybdenum carbide, and calcium carbide; nitrides such as boron nitride, titanium nitride, zirconium nitride, and silicon nitride; borides such as zirconium boride; oxides and hydroxides such as silica, colloidal silica, titanium oxide, aluminum oxide, calcium oxide, magnesium oxide, zinc oxide, copper oxide, zirconium oxide, cerium oxide, talc, and hydrotalcite; various titanate compounds such as calcium titanate, magnesium titanate, strontium titanate, and barium titanate; phosphate compounds such as tricalcium phosphate, calcium dihydrogen phosphate, calcium hydrogen phosphate, and substituted calcium phosphate in which the phosphate ion is partially substituted with another anion; sulfides such as molybdenum disulfide; fluorides such as magnesium fluoride and carbon fluoride; metal soaps such as aluminum stearate, calcium stearate, zinc stearate, and magnesium stearate; talc; bentonite; and various carbon blacks such as electroconductive carbon black. Furthermore, magnetic materials such as magnetite, maghematite, and intermediates of magnetite and maghematite can be used.

Examples of the organic microparticles include microparticles of styrene resins, acrylic resins such as methyl polyacrylate and methyl polymethacrylate, epoxy resins, melamine resins, tetrafloroethylene resins, trifloroethylene resins, polyvinyl chloride, polyethylene, and polyacrylonitrile.

Among these externally added microparticles, particularly preferred are silica, titanium oxide, alumina, zinc oxide, and carbon black.

The externally added microparticles may be used alone or in any combination of two or more kinds in any ratio.

The surfaces of these inorganic or organic microparticles may be treated with a hydrophobic agent such as a silane coupling agent, a titanate coupling agent, a silicone oil, a modified silicone oil, a silicone varnish, a fluorinated silane coupling agent, a fluorinated silicone oil, or a coupling agent having an amino group or a tertiary ammonium base. These treatment agents may be used alone or in any combination of two or more kinds in any ratio.

The number average particle diameter of the externally added microparticles is not limited within the range that does not significantly impair the effects of the present invention, and is usually 0.001 μm or more and preferably 0.005 μm or more and usually 3 μm or less and preferably 1 μm or less. The externally added microparticles may be a mixture of those having different average particle diameters. The average particle diameter of externally added microparticles can be determined by, for example, observation with an electron microscope or conversion from the BET specific surface area.

The amount of the externally added microparticles in the toner is not limited within the range that does not significantly impair the effects of the present invention, but the amount of the externally added microparticles in the total weight of the toner and the externally added microparticles is usually 0.1 weight % or more, preferably 0.3 weight % or more, and more preferably 0.5 weight % or more and usually 10 weight % or less, preferably 6 weight % or less, and more preferably 4 weight % or less. A smaller amount of the externally added microparticles may cause insufficient fluidity and charging stability, and a larger amount may impair fixability.

[Toner and Others]

The charging characteristics of the toner of the present invention may be either a negative charging property or a positive charging property and can be set depending on the system of an image-forming apparatus used. The charging characteristics of the toner can be controlled by properly selecting and adjusting the proportion of components, such as a charge controlling agent, constituting the toner particle and by properly selecting and adjusting the proportion of the externally added microparticles.

The toner of the present invention can be used as a monocomponent developer or a dicomponent developer mixed with a carrier.

When the toner is used as a dicomponent developer, the carrier forming the developer together with the toner may be, for example, a known magnetic material such as an iron, ferrite, or magnetite carrier; a carrier having a resin coating on the surface thereof; or a magnetic resin carrier.

Examples of the coating resin of the carrier include, but not limited to, generally known styrene resins, acrylic resins, styrene-acryl copolymer resins, silicone resins, modified silicone resins, and fluorine resins.

The average particle diameter of the carrier is not particularly limited, but is preferably 10 to 200 μm. These carriers are preferably used in an amount of 5 to 100 parts by weight on the basis of 1 part by weight of the toner.

The formation of a full-color image by an electrophotographic system can be conducted according to a common process using color toners of magenta, cyan, and yellow, and an optional black toner.

[Advantages of Use of the Toner in Accordance with the Present Invention]

The photoreceptor of the present invention can give a high-quality image that hardly has fogs, even if the image is formed using the toner having the specific sphericity. This advantage will now be described by comparison with a conventional technology.

Copiers and printers require, not only stability in image formation, i.e., reduced image defects, but also higher image qualities such as higher resolution and higher gradation performance. In order to achieve these requirements, toner having an average particle diameter of about 3 to 8 μm and a narrow particle size distribution has been used.

Conventionally, the toner is mainly produced by a melt-kneading pulverization process, i.e., fusing and kneading a binder resin and a colorant into a homogeneous mixture and pulverizing the mixture. However, in the melt-kneading pulverization process, it is difficult to efficiently produce toner that can meet the higher image quality.

Accordingly, a process forming toner particles in an aqueous medium, a so-called polymerized toner, has been recommended. For example, Japanese Unexamined Patent Application Publication No. HEI 5-88409 discloses dispersion polymerized toner. Japanese Unexamined Patent Application Publication No. HEI 11-143125 discloses emulsion polymerized agglomerated toner. The emulsion polymerization and agglomeration process is a method that produces toner by agglomerating polymer resin microparticles and a colorant in a liquid medium. Since the diameter and sphericity of the toner particles can be adjusted by controlling agglomeration conditions, the various performances required to toner can be readily optimized. Therefore, the emulsion polymerization and agglomeration process is particularly advantageous and preferred.

Furthermore, a method in which a material having a low softening point (so-called wax) is added to toner has been proposed in order to improve, for example, mold release properties, fixability at low temperature, offset properties at high temperature, and filming resistance of the toner. In a melt-kneading pulverization process, it is difficult to increase the amount of the wax contained in the toner, and the upper limit is probably 5% on the basis of the amount of the binder resin. On the other hand, polymerized toner can contain a large amount (5 to 30%) of a material having a low softening point, as disclosed in Japanese Unexamined Patent Application Publication Nos. HEI 5-88409 and HEI 11-143125.

However, though an image formed by using the toner described in Japanese Unexamined Patent Application Publication No. HEI 5-88409 or HEI 11-143125 has high image quality, fogging readily occurs. Accordingly, it is difficult to achieve high-level compatibility of a high resolution or a high gradation performance and less fogging.

On the other hand, an image having high quality such as a high resolution and a high gradation performance and, simultaneously, less image defects such as fogs can be formed using the toner of the present invention when the image is formed with the electrophotographic photoreceptor according to the present invention.

[VIII. Image-Forming Apparatus]

Regarding an embodiment of an image-forming apparatus (image-forming apparatus of the present invention) using the electrophotographic photoreceptor of the present invention, the main structure of the apparatus will now be described with reference to FIG. 7. However, the embodiment is not limited to the following description, and many modifications can be conducted within the scope of the present invention.

Figure 7:
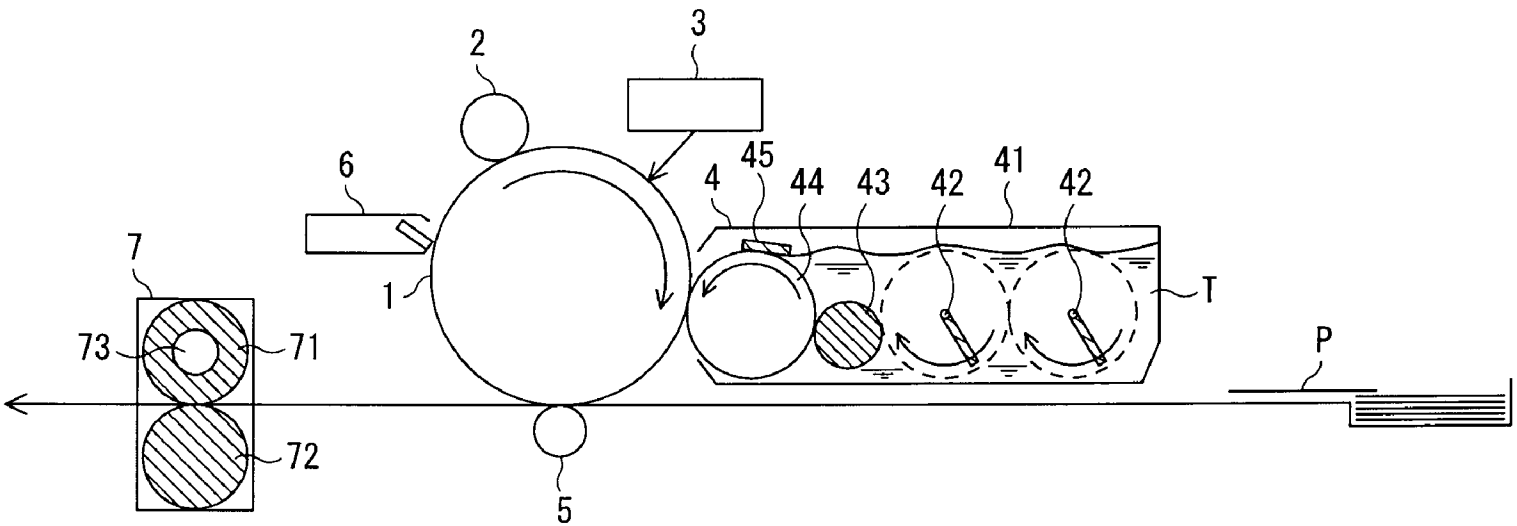
FIG. 7 is a schematic view illustrating the main structure of an embodiment of an image-forming apparatus provided with an electrophotographic photoreceptor of the present invention.

As shown in FIG. 7, the image-forming apparatus includes an electrophotographic photoreceptor 1, a charging device (charging means) 2, an exposure device (exposure means; image exposure means) 3, a development device (development means) 4, and a transfer device (transfer means) 5. Furthermore, the image-forming apparatus optionally include a cleaning device (cleaning means) 6 and a fixation device (fixation means) 7.

The photoreceptor 1 of the image-forming apparatus of the present invention is the above-described electrophotographic photoreceptor of the present invention. That is, in the image-forming apparatus of the present invention including an electrophotographic photoreceptor, charging means for charging the electrophotographic photoreceptor, image exposure means for forming an electrostatic latent image by subjecting the charged electrophotographic photoreceptor to image exposure, development means for developing the electrostatic latent image with toner, and transfer means for transferring the toner to a transfer object, the electrophotographic photoreceptor includes an undercoat layer containing metal oxide particles and a binder resin on an electroconductive support, and a photosensitive layer disposed on the undercoat layer. The metal oxide particles have a volume average particle diameter Mv of 0.1 μm or less and a 90% cumulative particle diameter D90 of 0.3 μm or less which are measured by a dynamic light-scattering method in a liquid of the undercoat layer dispersed in a solvent mixture of methanol and 1-propanol at a weight ratio of 7:3. The photosensitive layer contains a binder resin having an ester bond (ester-containing resin according to the present invention).

The electrophotographic photoreceptor 1 is the above-described electrophotographic photoreceptor of the present invention without any additional requirement. FIG. 7 shows, as such an example, a drum photoreceptor having the above-described photosensitive layer on the surface of a cylindrical electroconductive support. Along the outer surface of this electrophotographic photoreceptor 1, a charging device 2, an exposure device 3, a development device 4, a transfer device 5, and a cleaning device 6 are arranged.

The charging device 2 charges the electrophotographic photoreceptor 1 so that the surface of the electrophotographic photoreceptor 1 is uniformly charged to a predetermined potential. It is preferable that the charging device be in contact with the electrophotographic photoreceptor 1 in order to efficiently utilize the effects of the present invention. The arrangement of the charging device 2 in the contact with the photoreceptor 1 is preferable for reducing the size of the image-forming apparatus. However, in conventional technologies, such arrangement tends to make the exposure-charging repeating characteristics under low temperature and low humidity unstable and frequently cause image defects such as black spots and color spots in an image formed. In contrast, in the present invention, the exposure-charging repeating characteristics under low temperature and low humidity are stabilized, and the occurrence of image defects can be inhibited, even if the charging device is arranged as described above. Therefore, in the present invention, the charging device 2 is preferably in contact with the photoreceptor 1.

FIG. 7 shows a roller charging device (charging roller) as an example of the charging device 2, but other charging devices, for example, corona charging devices, such as corotron or scorotron, and contact charging devices, such as a brush, can be also used.

In many cases, the electrophotographic photoreceptor 1 and the charging device 2 are integrated into a cartridge (hereinafter, optionally, referred to as "photoreceptor cartridge") that is detachable from the body of an image-forming apparatus. Such a design is also desirable in the present invention and makes it possible, for example, to replace the photoreceptor cartridge to a new one by detaching the used cartridge from the image-forming apparatus body and attaching the new one to the image-forming apparatus body, when the electrophotographic photoreceptor 1 and the charging device 2 are degraded by the use. In addition, in many cases, toner described below is also stored in a toner cartridge detachable from an image-forming apparatus body. When the toner in the toner cartridge is exhausted in use, the toner cartridge can be detached from the image-forming apparatus body, and a new toner cartridge can be attached to the apparatus body. Such a design is also desirable in the present invention. Furthermore, a cartridge including all the electrophotographic photoreceptor 1, the charging device 2, and the toner may be used. As described above, the structure in which the charging device 2 is in contact with the photoreceptor 1 can exhibit significant effect and is desirable.

The exposure device 3 may be any kind that can form an electrostatic latent image on a photosensitive surface of the electrophotographic photoreceptor 1 by exposure (image exposure) to the electrophotographic photoreceptor 1, and examples thereof include halogen lamps, fluorescent lamps, lasers such as a semiconductor laser and a He—Ne laser, and LEDs (light-emitting diodes). Furthermore, the exposure may be conducted by a photoreceptor internal exposure system. Any light can be used for the exposure. For example, the exposure may be carried out with monochromatic light having a wavelength of 780 nm; monochromatic light having a slightly shorter wavelength of 600 to 700 nm; or monochromatic light having a shorter wavelength of 350 to 600 nm. Among them, the exposure is carried out with monochromatic light having preferably a short wavelength of 350 to 600 nm and more preferably a wavelength of 380 to 500 nm. In particular, an image-forming apparatus including a combination of the electrophotographic photoreceptor of the present invention and exposure means conducting exposure with light having a wavelength of 350 to 600 nm exhibits a high initial charging potential and high sensitivity, which can form a high-quality image.

The development device 4 develops the electrostatic latent image. The development device 4 may be any kind, and examples thereof include dry development systems such as cascade development, one-component conductive toner development, and two-component magnetic brush development; and wet development systems. The development device 4 shown in FIG. 7 includes a development tank 41, agitators 42, a supply roller 43, a development roller 44, a control member 45, and the development tank 41 containing toner T. In addition, the development device 4 may be provided with an optional refill device (not shown) for refilling the toner T. This refill device can refill the development tank with toner T from a container such as a bottle or a cartridge.

The supply roller 43 is made of, for example, an electroconductive sponge. The development roller 44 is, for example, a metal roller made of, e.g., iron, stainless steel, aluminum, or nickel or a resin roller made of such a metal roller coated with, e.g., a silicone resin, a urethane resin, or a fluorine resin. The surface of this development roller 44 may be optionally smoothed or roughened.

The development roller 44 is arranged between the electrophotographic photoreceptor 1 and the supply roller 43 and abuts on both the electrophotographic photoreceptor 1 and the supply roller 43. The supply roller 43 and the development roller 44 are rotated by a rotary drive mechanism (not shown). The supply roller 43 carries the toner T stored and supplies it to the development roller 44. The development roller 44 carries the toner T supplied from the supply roller 43 and brings it into contact with the surface of the electrophotographic photoreceptor 1.

The control member 45 is made of, for example, a resin blade of, e.g., a silicone resin or a urethane resin; a metal blade of, e.g., stainless steel, aluminum, copper, brass, or phosphor bronze; a blade made of such a metal blade coated with a resin. The control member 45 abuts on the development roller 44 and is biased toward the development roller 44 at a predetermined force (a usual blade line pressure is 5 to 500 g/cm) by, for example, a spring. The control member 45 may have an optional function charging the toner T by frictional electrification with tonor T.

The agitators 42 are each rotated by a rotary drive mechanism and agitate and transfer the toner T to the supply roller 43. The shapes and sizes of the blade of the agitators 42 may be different from each other.

The toner T may be of any kind, and polymerized toner prepared by suspension polymerization or emulsion polymerization, as well as powder toner, can be used. In the use of the polymerized toner, a small particle diameter of about 4 to 8 μm is particularly preferred, and various shapes of toner may be used from a spherical shape to a non-spherical shape such as a potato-like shape. Among various toners, the polymerized toner exhibits superior charging uniformity and transferring characteristics and can be suitably used for forming an image with higher quality.

In particular, the use of the toner of the present invention as the toner T is preferable. A combination of the toner of the present invention and the photoreceptor of the present invention can allow an image-forming apparatus to form a high-quality image simultaneously satisfies high resolution, high gradation performance, and less defects such as fogs.

The transfer device 5 may be of any kind, and devices employing, for example, electrostatic transfer such as corona transfer, roller transfer, or belt transfer; pressure transfer; or adhesive transfer can be used. The transfer device 5 includes a transfer charger, a transfer roller, and a transfer belt that are arranged so as to face the electrophotographic photoreceptor 1. The transfer device 5 transfers a toner image formed in the electrophotographic photoreceptor 1 to a transfer material (transfer object, paper, medium) P by a predetermined voltage (transfer voltage) with a polarity opposite to that of the charged potential of the toner T. In the present invention, it is effective that the transfer device 5 is in contact with the photoreceptor via the transfer material.

The cleaning device 6 may be of any kind, and examples thereof include a brush cleaner, a magnetic brush cleaner, an electrostatic brush cleaner, a magnetic roller cleaner, and a blade cleaner. The cleaning device 6 collects remaining toner adhering to the photoreceptor 1 by scraping the remaining toner with a cleaning member. The cleaning device 6 is unnecessary when the amount of toner remaining on the surface of the photoreceptor is small or substantially zero.

The fixation device 7 is composed of an upper fixation member (fixation roller) 71 and a lower fixation member (fixation roller) 72, and the fixation member 71 or 72 is provided with a heating device 73 therein. FIG. 7 shows an example of the heating device 73 provided inside the upper fixation member 71. The upper and lower fixation members 71 and 72 may be known thermal fixation members, for example, a fixation roller in which a pipe of a metal material, such as stainless steel or aluminum, is coated with a silicone rubber, a fixation roller having a fluorine resin coating, or a fixation sheet. The upper and lower fixation members 71 and 72 may have a structure for supplying a mold-releasing agent, such as a silicone oil, for improving mold release properties or may have a structure for applying a pressure to each other with, for example, a spring.

The toner transferred onto a recording paper P is heated to be melted when the recording paper P passes through between the upper fixation member 71 and the lower fixation member 72 that are heated to a predetermined temperature, and then is fixed on the recording paper P by cooling thereafter.

The fixation device may be of any kind, and examples thereof include, in addition to that described here, devices employing a system of heat roller fixation, flash fixation, oven fixation, or pressure fixation.

In the electrophotographic apparatus having a structure described above, an image is recorded as follows: The surface (photosensitive surface) of the photoreceptor 1 is charged to a predetermined potential (for example, −600 V) with the charging device 2. The charging may be conducted by a direct-current voltage or by a direct-current voltage superimposed by an alternating-current voltage.

Subsequently, the charged photosensitive surface of the photoreceptor 1 is exposed with the exposure device 3 depending on the image to be recorded. Thereby, an electrostatic latent image is formed in the photosensitive surface. This electrostatic latent image formed in the photosensitive surface of the photoreceptor 1 is developed by the development device 4.

In the development device 4, the toner T supplied by the supply roller 43 is spread into a thin layer with the control member (developing blade) 45 and, simultaneously, is charged by friction so as to have a predetermined polarity (here, the toner is charged into negative polarity, which is the same as the polarity of the charge potential of the photoreceptor 1). This toner T is held on the development roller 44 and is conveyed and brought into contact with the surface of the photoreceptor 1.

The charged toner T held on the development roller 44 comes into contact with the surface of the photoreceptor 1, so that a toner image corresponding to the electrostatic latent image is formed on the photosensitive surface of the photoreceptor 1. This toner image is transferred to a recording paper P with the transfer device 5. Thereafter, the toner remaining on the photosensitive surface of the photoreceptor 1 without being transferred is removed with the cleaning device 6.

After the transfer of the toner image to the recording paper P, the recording paper P passes through the fixation device 7 to thermally fix the toner image on the recording paper P. Thereby, an image is recorded.

The image-forming apparatus may have a structure that can conduct, for example, a neutralization step, in addition to the above-described structure. The neutralization step neutralizes the electrophotographic photoreceptor by exposing the electrophotographic photoreceptor with light. Examples of such a device for the neutralization include fluorescent lamps or LEDs. In many cases, the intensity of the light used in the neutralization step has an exposure energy at least 3 times that of the exposure light. However, it is preferable that the image-forming apparatus of the present invention do not conduct the neutralization step. This point will now be described with reference to a conventional technology.

A requirement for current image-forming apparatuses, in particular, printers, is to eliminate that are not indispensable for reductions in size and cost of the apparatus.

In an image-forming apparatus using an electrophotographic system, generally, charging means, exposure means, development means, and transfer means are indispensable, but neutralization means and cleaning means are not essential for forming an image and are merely desirable means for forming a higher quality image.

In particular, since the neutralization means occupies a large space for mounting and is expensive, image-forming apparatuses are required to be accomplished without this means. However, the omission of the neutralization step in the electrophotographic process signifies that the electrophotographic photoreceptor after completion of the formation step of an image is not subjected to a refreshing step before the subsequent step, and, thereby, differences in electric characteristics of the image-formed portions and the image-unformed portions caused by the exposure and the transfer may be created in the subsequent step. In particular, a change in image concentration caused by charge by the transfer of the photoreceptor to a polarity opposite to that by the charging means, so-called transfer memory, has become a severe problem in association with increased requirement for a higher quality image (for example, refer to Japanese Unexamined Patent Application Publication Nos. 7-295268 and 2003-316035).

Thus, in association with speeding up of the electrophotographic process and reductions in size and cost in recent years, demanded as characteristics of the image-forming apparatus including the electrophotographic process are those not causing the image memory without a neutralization step, as described above.

In the electrophotographic photoreceptor of the present invention, generally, a high-quality image can be formed without image memory, even if it is used as an electrophotographic photoreceptor in an image-forming process with no neutralization step. Whereby, the image-forming apparatus of the present invention can form a high-quality image without image memory, even if the apparatus does not have the neutralization means.

The structure of the image-forming apparatus may be further modified. For example, the image-forming apparatus may have a mechanism that conducts steps such as a pre-exposure step and a supplementary charging step, that performs offset printing, or that includes a full-color tandem system using different toners.

In the case that a combination of the photoreceptor 1 and the charging device 2 integrated into a cartridge, it is preferable that the cartridge further includes the development device 4. Furthermore, a combination of the photoreceptor 1 and, according to need, one or more of the charging device 2, the exposure device 3, the development device 4, the transfer device 5, the cleaning device 6, and the fixation device 7 may be integrated into an integral cartridge (electrophotographic cartridge) that is detachable from an electrophotographic apparatus body such as a copier or a laser beam printer. That is, the electrophotographic cartridge of the present invention includes the electrophotographic photoreceptor and at least one of the charging means for charging the electrophotographic photoreceptor, the image exposure means for forming an electrostatic latent image by conducting image exposure to the charged electrophotographic photoreceptor, the development means for developing the electrostatic latent image with toner, the transfer means for transferring the toner to a transfer object, the fixation means for fixing the toner transferred on the transfer object, and the cleaning means for collecting the toner adhering to the electrophotographic photoreceptor, wherein the electrophotographic photoreceptor includes an undercoat layer containing metal oxide particles and a binder resin on an electroconductive support, and a photosensitive layer disposed on the undercoat layer, and wherein it is preferable that the metal oxide particles have a volume average particle diameter Mv of 0.1 μm or less and a 90% cumulative particle diameter D90 of 0.3 μm or less which are measured by a dynamic light-scattering method in a liquid of the undercoat layer dispersed in a solvent mixture of methanol and 1-propanol at a weight ratio of 7:3 and that the binder resin contain an ester bond (ester-containing resin according to the present invention).

In this case, as in the cartridge described in the above embodiment, for example, even if the photoreceptor 1 or another member is deteriorated, the maintenance of an image-forming apparatus can be readily performed by detaching the electrophotographic cartridge from the image-forming apparatus body and attaching a new electrophotographic cartridge to the image-forming apparatus body.

The image-forming apparatus and the electrophotographic cartridge of the present invention can stably form a high-quality image even if repeatedly used. That is, since the electrophotographic photoreceptor according to the present invention has high sensitivity and is hardly affected by the transferring during the electrophotographic process, the image-forming apparatus and the electrophotographic cartridge of the present invention are hardly deteriorated by fatigue during repeated use and can stably form a high-quality image.

Furthermore, conventionally, in the case that a transfer device 5 is in contact with a photoreceptor via a transfer material, the quality of an image is readily deteriorated. However, the image-forming apparatus and the electrophotographic cartridge of the present invention hardly cause such quality deterioration and are hence effective.

EXAMPLES

The present invention will now be described in further detail with reference to Examples and Comparative Examples, but is not limited thereto within the scope of the present invention. In the description of Examples, the term "part(s)" means "part(s) by weight" unless otherwise specified, and the term "%" means "mass %" unless otherwise specified. In the description of Examples, the term "Me" denotes a methyl group.

Example Group 1

Example 1-1

[Coating Liquid for an Undercoat Layer]

Surface-treated titanium oxide was prepared by mixing rutile titanium oxide having an average primary particle diameter of 40 nm ("TTO55N" manufactured by Ishihara Sangyo Co., Ltd.) and methyldimethoxysilane ("TSL8117" manufactured by Toshiba Silicone Co., Ltd.) in an amount of 3 weight % on the basis of the amount of the titanium oxide with a Henschel mixer. 1 kilogram of raw material slurry composed of a mixture of 50 parts of the surface-treated titanium oxide and 120 parts of methanol was subjected to dispersion treatment for 1 hour using zirconia beads with a diameter of about 100 μm (YTZ, manufactured by Nikkato Corp.) as dispersion media and an Ultra Apex Mill (model UAM-015, manufactured by Kotobuki Industries Co., Ltd.) having a mill capacity of about 0.15 L under liquid circulation conditions of a rotor peripheral velocity of 10 m/sec and a liquid flow rate of 10 kg/h to give a titanium oxide dispersion.

The titanium oxide dispersion, a solvent mixture of methanol/1-propanol/toluene, and a pelletized polyamide copolymer composed of ∈-caprolactam [compound represented by the following Formula (A)]/bis(4-amino-3-methylcyclohexyl)methane [compound represented by the following Formula (B)]/hexamethylene diamine [compound represented by the following Formula (C)]/decamethylenedicarboxylic acid [compound represented by the following Formula (D)]/octadecamethylenedicarboxylic acid [compound represented by the following Formula (E)] at a molar ratio of 60%/15%/5%/15%/5% were mixed with agitation under heat to dissolve the pelletized polyamide. The resulting solution was subjected to ultrasonic dispersion treatment for 1 hour with an ultrasonic oscillator at a frequency of 25 kHz and an output of 1200 W and then filtered through a PTFE membrane filter with a pore size of 5 μm (Mitex LC manufactured by Advantech Co., Ltd.) to give a coating liquid 1-A for forming an undercoat layer wherein the weight ratio of the surface-treated titanium oxide/copolymerized polyamide was 3/1, the weight ratio of methanol/1-propanol/toluene in the solvent mixture was 7/1/2, and the solid content was 18.0 weight %.

The particle size distribution of this coating liquid 1-A for forming an undercoat layer measured using the aforementioned UPA is shown in Table 3.

[Chemical Formula 33]

A

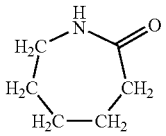

B

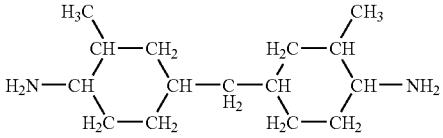

-continued

C

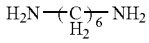

D

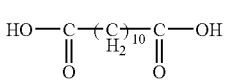

E

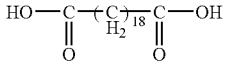

This coating liquid 1-A for forming an undercoat layer was applied to a non-anodized aluminum cylinder (outer diameter: 30 mm, length: 351 mm, thickness: 1.0 mm) by dipping to form an undercoat layer with a dried thickness of 1.5 μm.

This undercoat layer (94.2 $cm^2$) was immersed in a solvent mixture of 70 g of methanol and 30 g of 1-propanol and was sonicated with an ultrasonic oscillator at an output of 600 W for 5 minutes to prepare an undercoat layer dispersion. The particle size distribution of the metal oxide particles in the dispersion was measured with a UPA. The volume average particle diameter Mv was 0.09 μm and the 90% cumulative particle diameter D90 was 0.12 μm.

Then, as a charge-generating material, 20 parts of D-form oxytitanium phthalocyanine and 280 parts of 1,2-dimethoxyethane were mixed and pulverized in a sand grind mill for 2 hours for microparticle dispersion treatment.

Then, this microparticle treatment liquid was mixed with a binder liquid prepared by dissolving polyvinyl butyral (trade name "Denka Butyral" #6000C, manufactured by Denki Kagaku Kogyo K.K.) in a solvent mixture of 253 parts of 1,2-dimethoxyethane and 85 parts of 4-methoxy-4-methyl-2-pentanone, and 230 parts of 1,2-dimethoxyethane to prepare a dispersion (charge-generator).

This dispersion (charge generator) was applied to the aluminum cylinder provided with the undercoat layer by dipping to form a charge-generating layer having a dried thickness of 0.3 μm (0.3 $g/m^2$).

Then, 50 parts of a charge-transporting material represented by the following compound (CT-1):

[Chemical Formula 34]

CT-1

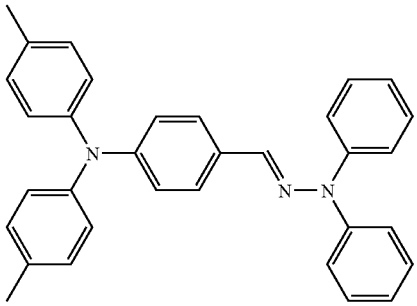

100 parts of a binder resin of polycarbonate having a repeating unit represented by the following structure (compound (P-1), viscosity-average molecular weight: about 30000, m:n=1:1, method of polymerization: described in Example 5 of Japanese Patent Application No. 2002-3828):

[Chemical Formula 35]

P-1

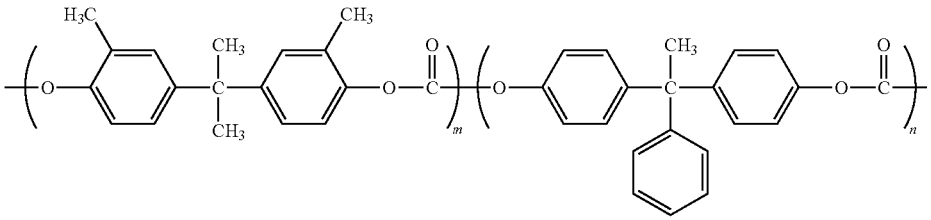

8 parts of antioxidant having the following structure:

[Chemical Formula 36]

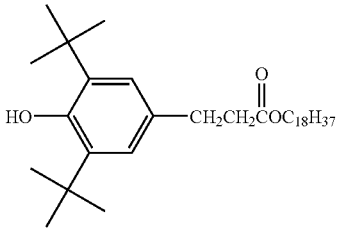

and 0.05 part of a silicone oil leveling agent (trade name: KF96, manufactured by Shin-Etsu Chemical Co., Ltd.) were dissolved in 640 parts of a solvent mixture of tetrahydrofuran/toluene (weight ratio: 8/2). The resulting solution was applied onto the charge-generating layer by dipping to form a charge-transporting layer with a dried thickness of 18 μm to give a photoreceptor drum 1-E1 having a laminated photosensitive layer.

The photosensitive layer (94.2 $cm^2$) of the resulting photoreceptor 1-E1 was removed by dissolving the layer in 100 $cm^3$ of tetrahydrofuran by sonication with an ultrasonic oscillator at an output of 600 W for 5 minutes, and then the photoreceptor 1-E1 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA. The volume average particle diameter Mv was 0.08 μm and the 90% cumulative particle diameter D90 was 0.11 μm.

Example 1-2

A photoreceptor 1-E2 was produced as in Example 1-1 except that the binder resin used was, instead of the compound (P-1), the following compound (compound (P-2), viscosity-average molecular weight: about 40,000, method of polymerization: described in Example 3 of Japanese Patent Application No. 2002-3828):

[Chemical Formula 37]

P-2

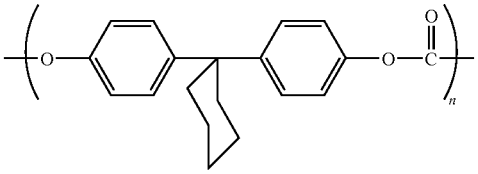

Example 1-3

A photoreceptor 1-E3 was produced as in Example 1-1 except that the binder resin used was, instead of the compound (P-1), the following compound (compound (P-3), viscosity-average molecular weight: about 30000, m:n=3:7, method of polymerization: described in Example 4 of Japanese Patent Application No. 2002-3828):

[Chemical Formula 38]

P-3

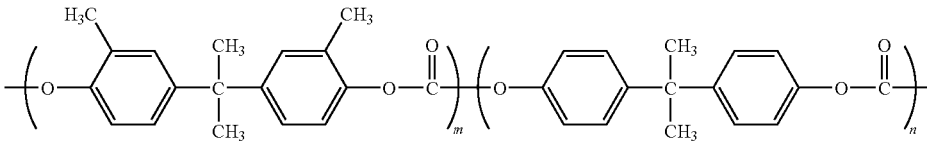

Example 1-4

A photoreceptor 1-E4 was produced as in Example 1-1 except that 70 parts of the charge-transporting material was used, instead of 50 parts, and that the binder resin used was, instead of the compound (P-1), the following compound (compound (P-4), viscosity-average molecular weight: about 30,000, m:n=3:7, polymerization: a method in accordance with the method described in example 1 of Japanese Unexamined Patent Application Publication No. HEI 10-288845):

[Chemical Formula 39]

P-4

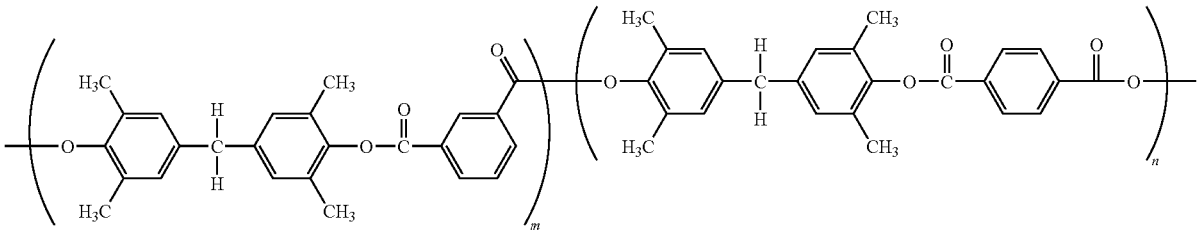

Example 1-5

A photoreceptor 1-E5 was produced as in Example 1-1 except that 70 parts of the charge-transporting material was used, instead of 50 parts, and that the binder resin used was, instead of the compound (P-1), the following compound (compound (P-5), viscosity-average molecular weight: about 30,000, method of polymerization: described in manufacturing Example 10 of Japanese Unexamined Patent Application Publication No. 2006-53549):

[Chemical Formula 40]

P-5

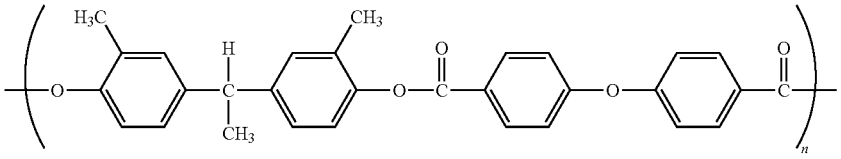

Example 1-6

A coating liquid 1-B for forming an undercoat layer was prepared as in Example 1-1 except that the dispersion media used in the Ultra Apex Mill was zirconia beads having a diameter of about 50 μm (YTZ manufactured by Nikkato Corp.), and the physical properties thereof were measured as in Example 1-1. The results are shown in Table 3.

The coating liquid 1-B for forming an undercoat layer was applied to a non-anodized aluminum cylinder (outer diameter: 30 mm, length: 351 mm, thickness: 1.0 mm) by dipping to form an undercoat layer with a dried thickness of 1.5 μm.

This undercoat layer (94.2 $cm^2$) was immersed in a solvent mixture of 70 g of methanol and 30 g of 1-propanol and was sonicated with an ultrasonic oscillator at an output of 600 W for 5 minutes to prepare an undercoat layer dispersion. The particle size distribution of the metal oxide particles in the dispersion was measured with the UPA as in Example 1-1. The volume average particle diameter Mv was 0.08 μm and the 90% cumulative particle diameter D90 was 0.12 μm.

A charge-generating layer and a charge-transporting layer were formed on the resulting undercoat layer as in Example 1-1 to give a photoreceptor 1-E6.

The photosensitive layer (94.2 $cm^2$) of the resulting photoreceptor 1-E6 was removed by dissolving the layer in 100 $cm^3$ of tetrahydrofuran by sonication with an ultrasonic oscillator at an output of 600 W for 5 minutes, and then the photoreceptor 1-E6 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 1-1. The volume average particle diameter Mv was 0.08 μm and the 90% cumulative particle diameter D90 was 0.11 μm.

Example 1-7

A coating liquid 1-C for forming an undercoat layer was prepared as in Example 1-5 except that the rotor peripheral velocity of the Ultra Apex Mill was 12 m/sec, and physical properties thereof were measured as in Example 1-1. The results are shown in Table 3.

A photoreceptor 1-E7 was produced as in Example 1-1 except that the coating liquid 1-C for forming an undercoat layer was used.

Example 1-8

A photoreceptor 1-P1 was produced as in Example 1-1 except that the compound (P-1) as the binder resin was prepared by melt polymerization instead of interfacial polymerization.

Example 1-9

A photoreceptor 1-P2 was produced as in Example 1-5 except that the compound (P-5) as the binder resin was prepared by solution polymerization instead of interfacial polymerization.

Comparative Example 1-1

Rutile titanium oxide having an average primary particle diameter of 40 nm ("TTO55N" manufactured by Ishihara Sangyo Co., Ltd.) and methyldimethoxysilane in an amount of 3 weight % on the basis of the amount of the titanium oxide were mixed with a ball mill to prepare slurry. After drying the slurry, the residue was washed with methanol and dried to yield hydrophobed titanium oxide particles. This hydrophobed titanium oxide particles were dispersed in a mixture solvent of methanol/1-propanol with a ball mill to give dispersion slurry of hydrophobed titanium oxide particles. This dispersion slurry, a solvent mixture of methanol/1-propanol/toluene (weight ratio: 7/1/2), and a pelletized copolymerized polyamide composed of ∈-caprolactam/bis(4-amino-3-methylcyclohexyl)methane/hexamethylene diamine/decamethylenedicarboxylic acid/octadecamethylenedicarboxylic acid (molar %: 60/15/5/15/5) were mixed with agitating under heat, thereby dissolving the pelletized polyamide. The resulting solution was subjected to ultrasonic dispersion treatment to give a coating liquid 1-D for forming an undercoat layer containing the hydrophobed titanium oxide/copolymerized polyamide at a weight ratio of 3/1 and having a solid content of 18.0%.

An undercoat layer was formed on an aluminum cylinder by dip coating as in Example 1-1 using this coating liquid 1-D for forming an undercoat layer.

This undercoat layer (94.2 $cm^2$) was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 1-1. The volume average particle diameter Mv was 0.11 μm and the 90% cumulative particle diameter D90 was 0.20 μm.

A photoreceptor 1-P3 was produced as in Example 1-1 except that the coating liquid 1-D for forming an undercoat layer was used.

The photosensitive layer (94.2 $cm^2$) of the resulting photoreceptor 1-P3 was removed by dissolving the layer in 100 $cm^3$ of tetrahydrofuran by sonication with an ultrasonic oscillator at an output of 600 W for 5 minutes, and then the photoreceptor 1-P3 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 1-1. The volume average particle diameter Mv was 0.11 μm and the 90% cumulative particle diameter D90 was 0.18 μm.

[Evaluation of Electric Characteristics]

The electrophotographic photoreceptors produced in the Examples and Comparative Example were mounted on an electrophotographic characteristic evaluation device produced according to a standard of The Society of Electrophotography of Japan (Zoku Denshi Shashin Gizyutsu no Kiso to Oyo (Fundamentals and Applications of Electrophotography II) edited by The Society of Electrophotography of Japan, published by Corona Publishing Co., Ltd., pp. 404-405) and subjected to evaluation of electric characteristics through the following cycle of charging (negative polarity), exposure, potential measurement, and nuetralization.

The photoreceptor was charged such that the initial surface potential was −700 V and then was irradiated with monochromatic light of 780 nm, which emitted from a halogen lamp and was monochromatized through an interference filter. The irradiation energy (half-decay exposure energy) required for the surface potential to reach −350 V was measured (μJ/$cm^2$) as sensitivity (E1/2). In addition, the surface potential (VL1) at 100 ms after the irradiation with exposure light having an intensity of 1.0 μJ/$cm^2$ was measured (−V).

Furthermore, a positive polar corotron charging device was mounted between the potential measurement and nuetralization in the process described above for simulation of transfer. The drum was rotated at a velocity of 1 cycle/sec with neutralization light at an off state, and 4000 cycles of positive and negative charging were repeated. Then, the neutralization light was turned on again, and the surface potential (VL2) after exposure was measured (−V) as in VL1. Here, the negative charging was a condition for setting the initial surface potential to −700 V by the scorotron, and the positive charge was corotron charging at a constant output of 7 kV.

The magnitude of influence of positive charging repetition on electrophotographic photoreceptive characteristics was evaluated by calculating ΔVL=VL2−VL1.

Table 4 shows these results. In Table 4, "α" in the undercoat layer column represents the coating liquid 1-A, 1-B, or 1-C for forming an undercoat layer, and "β" represents the coating liquid 1-D for forming an undercoat layer.

TABLE 3

| | Coating liquid | Volume average particle diameter (μm) | 90% cumulative particle diameter (μm) |
|---|---|---|---|
| Example 1-1 | 1-A | 0.09 | 0.13 |
| Example 1-6 | 1-B | 0.08 | 0.12 |
| Example 1-7 | 1-C | 0.08 | 0.11 |
| Comparative Example 1-1 | 1-D | 0.11 | 0.20 |

TABLE 4

| | | Specification of photoreceptor | | Electric Characteristics | | | |
|---|---|---|---|---|---|---|---|
| | Photoreceptor | Binder Resin | Undercoat Layer | E½ (μJ/$cm^2$) | VL1 (−V) | VL2 (−V) | ΔVL (V) |
| Example 1-1 | 1-E1 | P-1 | α | 0.091 | 61 | 82 | 13 |
| Example 1-2 | 1-E2 | P-2 | α | 0.094 | 73 | 89 | 16 |
| Example 1-3 | 1-E3 | P-3 | α | 0.093 | 68 | 86 | 18 |
| Example 1-4 | 1-E4 | P-4 | α | 0.101 | 73 | 105 | 32 |
| Example 1-5 | 1-E5 | P-5 | α | 0.094 | 55 | 75 | 20 |
| Example 1-6 | 1-E6 | P-1 | α | 0.092 | 63 | 80 | 17 |
| Example 1-7 | 1-E7 | P-1 | α | 0.090 | 63 | 79 | 16 |
| Example 1-8 | 1-P1 | P-1 | α | 0.094 | 66 | 85 | 19 |
| Example 1-9 | 1-P2 | P-5 | α | 0.097 | 79 | 92 | 23 |
| Comparative Example 1-1 | 1-P3 | P-1 | β | 0.095 | 70 | 92 | 22 |

The results shown in Table 4 elucidate that each photoreceptor of the present invention exhibits high sensitivity and excellent electric characteristics. Furthermore, comparison of photoreceptors prepared using the same binder resin shows that the use of the undercoat layer according to the present invention can reduce influence of repeated positive charging.

[Evaluation of Image]

The electrophotographic photoreceptors 1-E1 and 1-E2 produced in Examples were each mounted in a cyan drum cartridge (including an integrated cartridge consisting of a contact-type charging roller member, a blade cleaning member, and a development member) of a commercially available tandem-type color printer (Microline 3050c, manufactured by Oki Data Corp.) compatible with A3 printing and were mounted in the printer. First, an image of cyan color was printed on 100 size A4 transparent films MC502 manufactured by Mitsubishi Chemical Media Co., Ltd. at a temperature of 35° C. and a humidity of 80% by setting the medium type to transparent sheet and by longitudinal feeding. Subsequently, a cyan solid image was printed on size A3 paper, and the image was evaluated.

Microline 3050c specification:

Four-stage tandem

Color: 21 ppm, monochrome: 26 ppm 1200 dpi

Contact-type roller charging (direct-current voltage application)

LED exposure

No neutralization light

Visual observation confirmed that the solid images printed using the photoreceptors 1-E1 and 1-E2 of Examples on the size A3 paper had no difference in concentration between the transparent sheet-feeding area (portion of the photoreceptor damaged by transfer through the transparent sheet) and the transparent sheet-non-feeding area (portion of the photoreceptor damaged by direct transfer). It was confirmed that only the photoreceptors of the present invention were able to form satisfactory images.

Example Group 2

Example 2-1

A coating liquid 2-A for forming an undercoat layer that was identical to the coating liquid 1-A for forming an undercoat layer was prepared as in Example 1-1, and a photoreceptor drum 2-E1 that was identical to the photoreceptor drum 1-E1 was produced using the coating liquid 2-A.

The photosensitive layer (94.2 $cm^2$) of the resulting photoreceptor 2-E1 was removed by dissolving the layer in 100 $cm^3$ of tetrahydrofuran by sonication with an ultrasonic oscillator at an output of 600 W for 5 minutes, and then the photoreceptor 2-E1 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA. The volume average particle diameter was 0.08 μm and the 90% cumulative particle diameter was 0.11 μm.

Example 2-2

A photoreceptor 2-E2 was produced as in Example 2-1 except that the charge-transporting material was, instead of the compound (CT-1), the following compound (CT-2):

[Chemical Formula 41]

CT-2

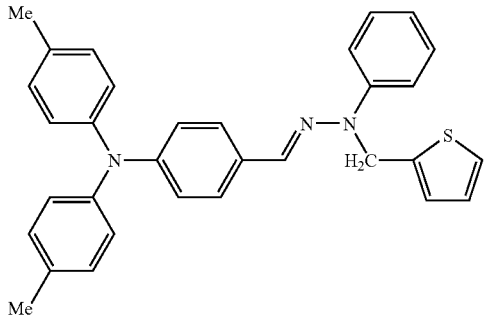

Example 2-3

A photoreceptor 2-E3 was produced as in Example 2-1 except that the charge-transporting material was, instead of the compound (CT-1), the following compound (CT-3):

[Chemical Formula 42]

CT-3

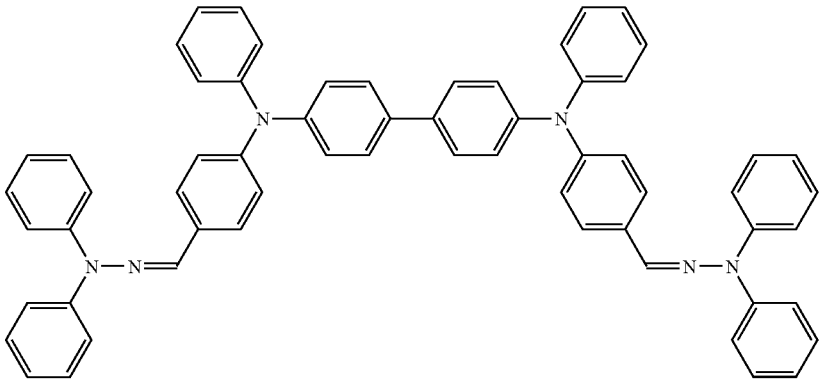

Example 2-4

A photoreceptor 2-E4 was produced as in Example 2-1 except that the charge-transporting material was, instead of the compound (CT-1), the following compound (CT-4):

[Chemical Formula 43]

CT-4

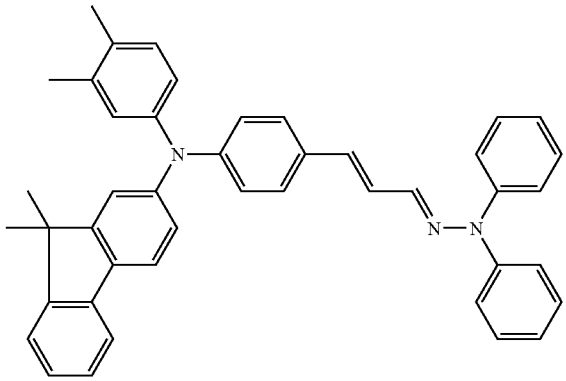

Example 2-5

A coating liquid 2-B for forming an undercoat layer that was identical to the coating liquid 1-B for forming an undercoat layer was prepared as in Example 1-6, and a photoreceptor 2-E5 that was identical to the photoreceptor 1-E6 was produced using the coating liquid 2-B.

The photoreceptor layer (94.2 $cm^2$) of the resulting photoreceptor 2-E5 was removed by dissolving the layer in 100 $cm^3$ of tetrahydrofuran by sonication with an ultrasonic oscillator at an output of 600 W for 5 minutes, and then the photoreceptor 2-E5 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 2-1. The volume average particle diameter was 0.08 μm and the 90% cumulative particle diameter was 0.12 μm.

Example 2-6

As in Example 1-7, a coating liquid 2-C for forming an undercoat layer that was identical to the coating liquid 1-C for forming an undercoat layer was prepared.

This coating liquid 2-C for forming an undercoat layer was applied to an aluminum cylinder to form an undercoat layer by dipping as in Example 2-1.

This undercoat layer (94.2 $cm^2$) was immersed in a solvent mixture of 70 g of methanol and 30 g of 1-propanol and was sonicated with an ultrasonic oscillator at an output of 600 W for 5 minutes to prepare an undercoat layer dispersion. The particle size distribution of the metal oxide particles in the dispersion was measured with the UPA as in Example 2-1. The volume average particle diameter was 0.08 μm and the 90% cumulative particle diameter was 0.11 μm.

Then, a photoreceptor 2-E6 was produced as in Example 1 except that the coating liquid 2-C for forming an undercoat layer was used.

The photosensitive layer (94.2 $cm^2$) of the resulting photoreceptor 2-E6 was removed by dissolving the layer in 100 $cm^3$ of tetrahydrofuran by sonication with an ultrasonic oscillator at an output of 600 W for 5 minutes, and then the photoreceptor 2-E6 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 2-1. The volume average particle diameter was 0.08 μm and the 90% cumulative particle diameter was 0.11 μm.

Comparative Example 2-1

A coating liquid 2-D for forming an undercoat layer that was identical to the coating liquid 1-D for forming an undercoat layer was prepared as in Comparative Example 1-1, and a photoreceptor 2-P1 that was identical to the photoreceptor 1-P3 was produced using the coating liquid 2-D. The photosensitive layer (94.2 $cm^2$) of the resulting photoreceptor 2-P1 was removed by dissolving the layer in 100 $cm^3$ of tetrahydrofuran by sonication with an ultrasonic oscillator at an output of 600 W for 5 minutes, and then the photoreceptor 2-P1 after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Example 2-1. The volume average particle diameter was 0.11 μm and the 90% cumulative particle diameter was 0.18 μm.

Comparative Example 2-2

A photoreceptor 2-P2 (sic) was produced as in Comparative Example 2-2 except that the compound (CT-3) was used as the charge-transporting material instead of the compound (CT-1).

[Evaluation of Electric Characteristics]

Electric characteristics of the electrophotographic photoreceptors produced in Examples and Comparative Examples were evaluated as in Examples 1-1 to 1-9 and Comparative Example 1-1.

Table 5 shows these results. In Table 5, "α" in the undercoat layer column represents the coating liquid 2-A, 2-B, or 2-C for forming an undercoat layer, and "β" represents the coating liquid 2-D for forming an undercoat layer.

TABLE 5

| | Specification of photoreceptor | | | Electric Characteristics | | | |
|---|---|---|---|---|---|---|---|
| | Photoreceptor | charge-transporting material | Undercoat Layer | E½ (μJ/cm²) | VL1 (−V) | VL2 (−V) | ΔVL (V) |
| Example 2-1 | 2-E1 | CT-1 | α | 0.091 | 61 | 82 | 13 |
| Example 2-2 | 2-E2 | CT-2 | α | 0.104 | 73 | 93 | 20 |
| Example 2-3 | 2-E3 | CT-3 | α | 0.096 | 35 | 40 | 5 |
| Example 2-4 | 2-E4 | CT-4 | α | 0.094 | 58 | 74 | 16 |
| Example 2-5 | 2-E5 | CT-1 | α | 0.092 | 65 | 75 | 10 |
| Example 2-6 | 2-E6 | CT-1 | α | 0.100 | 70 | 82 | 12 |
| Comparative Example 2-1 | 2-P1 | CT-1 | β | 0.095 | 70 | 88 | 16 |
| Comparative Example 2-2 | 2-P2 | CT-3 | β | 0.102 | 81 | 102 | 21 |

The results shown in Table 5 elucidate that all photoreceptors of Examples and Comparative Examples exhibited satisfactory initial electric characteristics with slight differences, the photoreceptors of Examples were less affected by the repeated positive charging and had more stable characteristics than the photoreceptors of Comparative Examples.

[Evaluation of Image]

The electrophotographic photoreceptors 2-E1 and 2-E2 produced in Examples were subjected to evaluation of image as in the photoreceptors 1-E1 and 1-E2.

Visual observation confirmed that the solid images printed using the photoreceptors 2-E1 and 2-E2 of Examples on the size A3 paper had no difference in concentration between the transparent sheet-feeding area (portion of the photoreceptor of which damage due to transfer is small because of the presence of the transparent sheet having a high dielectric constant) and the non-transparent sheet-feeding area (portion of the photoreceptor damaged by direct transfer).

From the above results, it was confirmed that only the photoreceptors of the present invention could form good images.

Subsequently, the same experiment was conducted using a magenta cartridge, and a small difference in the image concentration was confirmed.

In addition, fatigue due to transfer was observed using common size A4 paper instead of the transparent sheet, and a smaller difference in the image concentration was observed.

Example Group 3

Example 3-1

Surface-treated titanium oxide was prepared by mixing rutile titanium oxide having an average primary particle diameter of 40 nm ("TTO55N" manufactured by Ishihara Sangyo Co., Ltd.) and methyldimethoxysilane ("TSL8117" manufactured by Toshiba Silicone Co., Ltd.) in a concentration of 3 mass % on the basis of the titanium oxide with a Henschel mixer. One kilogram of raw material slurry (solid content: 25.0 mass %) composed of a mixture of 50 parts of the surface-treated titanium oxide and 150 parts of methanol was subjected to dispersion treatment for 2 hours using zirconia beads with a diameter of about 50 μm (YTZ manufactured by Nikkato Corp.) as dispersion medium and the Ultra Apex Mill (model UAM-015, manufactured by Kotobuki Industries Co., Ltd.) having a mill capacity of about 0.15 L under liquid circulation conditions of a rotor peripheral velocity of 10 m/sec and a liquid flow rate of 10 kg/h to give a titanium oxide dispersion 3-A.

The viscosity and the particle size distribution of the titanium oxide dispersion 3-A were measured as follows: The viscosity was measured by a process in accordance with JIS Z 8803 using an E-type viscometer (Product name: ED, manufactured by Tokimec Inc.). The particle size distribution was measured with a particle size analyzer (Microtrac UPA model 9340, manufactured by Nikkiso Co., Ltd.) at 25° C. by diluting the dispersion with a solvent mixture of methanol/1-propanol=7/3 such that the sample concentration index (signal level) ranged from 0.6 to 0.8.

A cumulative curve was obtained by defining the total volume of metal oxide particles as 100%. The particle size at a point of 50% in the cumulative curve was defined as the volume average particle diameter (median diameter), and the particle size at a point of 90% in the cumulative curve was defined as the "90% cumulative particle diameter". The results are shown in Table 7.

The titanium oxide dispersion 3-A, a solvent mixture of methanol/1-propanol/toluene, and a pelletized copolymerized polyamide composed of ∈-caprolactam [compound represented by Formula (A)]/bis(4-amino-3-methylcyclohexyl)methane [compound represented by Formula (B)]/hexamethylene diamine [compound represented by Formula (C)]/decamethylenedicarboxylic acid [compound represented by Formula (D)]/octadecamethylenedicarboxylic acid [compound represented by Formula (E)] at a molar ratio of 60%/15%/5%/15%/5% were mixed with agitation under heat to dissolve the pelletized polyamide.

Then, the solution was subjected to ultrasonic dispersion treatment with an ultrasonic oscillator at an output of 1200 W for 1 hour and then filtered through a PTFE membrane filter with a pore size of 5 μm (Mitex LC, manufactured by Advantech Co., Ltd.) to give a coating liquid 3-P for forming an undercoat layer containing the surface-treated titanium oxide/copolymerized polyamide at a mass ratio of 3/1 in a solvent mixture of methanol/1-propanol/toluene with a mass ratio of 7/1/2. This coating liquid 3-P for forming an undercoat layer was subjected to the measurement of the particle size distribution of titanium oxide, as in the titanium oxide dispersion 3-A. The results are shown in Table 7.

Example 3-2

A titanium oxide dispersion 3-B was prepared by dispersion treatment as in Example 3-1 except that 1 kg of raw material slurry was composed of 50 parts of surface-treated titanium oxide and 61 parts of methanol and had a solid content of 45.0 mass %. The viscosity and the particle size distribution of the titanium oxide dispersion 3-B were measured as in Example 3-1. The results are shown in Table 7.

A coating liquid 3-Q for forming an undercoat layer containing the surface-treated titanium oxide/copolymerized polyamide at a mass ratio of 3/1 in a solvent mixture of methanol/1-propanol/toluene with a mass ratio of 7/1/2 was prepared using the titanium oxide dispersion 3-B, as in Example 3-1. The particle size distribution was measured as in Example 3-1. The results are shown in Table 7.

Example 3-3

A titanium oxide dispersion 3-C was prepared by dispersion treatment as in Example 3-1 except that 1 kg of raw material slurry was composed of 50 parts of the surface-treated titanium oxide and 33 parts of methanol and had a solid content of 60.0 mass %. The viscosity and the particle size distribution of the titanium oxide dispersion 3-C were measured as in Example 3-1. The results are shown in Table 7.

A coating liquid 3-R for forming an undercoat layer containing the surface-treated titanium oxide/copolymerized polyamide at a mass ratio of 3/1 in a solvent mixture of methanol/1-propanol/toluene with a mass ratio of 7/1/2 was prepared using the titanium oxide dispersion 3-C, as in Example 3-1. The particle size distribution was measured as in Example 3-1. The results are shown in Table 7.

Example 3-4

A titanium oxide dispersion 3-D was prepared by dispersion treatment as in Example 3-1 except that 1 kg of raw material slurry was composed of 50 parts of the surface-treated titanium oxide and 450 parts of methanol and had a solid content of 10.0 mass %. The viscosity and the particle size distribution of the titanium oxide dispersion 3-D were measured as in Example 3-1. The results are shown in Table 7.

A coating liquid 3-S for forming an undercoat layer containing the surface-treated titanium oxide/copolymerized polyamide at a mass ratio of 3/1 in a solvent mixture of methanol/1-propanol/toluene with a mass ratio of 7/1/2 was prepared using the titanium oxide dispersion 3-D, as in Example 3-1. The particle size distribution was measured as in Example 3-1. The results are shown in Table 7.

Example 3-5

A titanium oxide dispersion 3-E was prepared using zirconia beads with a diameter of about 30 μm (YTZ, manufactured by Nikkato Corp.) as dispersion medium of Example 3-1 with the Ultra Apex Mill (model UAM-015, manufactured by Kotobuki Industries Co., Ltd.) having a mill capacity of about 0.15 L under liquid circulation conditions of a rotor peripheral velocity of 12 m/sec and a liquid flow rate of 10 kg/h for 2 hours. The viscosity and the particle size distribution of the titanium oxide dispersion 3-E were measured as in Example 3-1. The results are shown in Table 7.

A coating liquid 3-T for forming an undercoat layer containing the surface-treated titanium oxide/copolymerized polyamide at a mass ratio of 3/1 in a solvent mixture of methanol/1-propanol/toluene with a mass ratio of 7/1/2 was prepared using the titanium oxide dispersion 3-E, as in Example 3-1. The particle size distribution was measured as in Example 3-1. The results are shown in Table 7.

Comparative Example 3-1

A titanium oxide dispersion 3-F was prepared by dispersion treatment as in Example 3-1 except that 1 kg of raw material slurry was composed of 50 parts of the surface-treated titanium oxide and 950 parts of methanol and had a solid content of 5.0 mass %. The viscosity and the particle size distribution of the titanium oxide dispersion 3-F were measured as in Example 3-1. The results are shown in Table 7.

A coating liquid 3-U for forming an undercoat layer containing the surface-treated titanium oxide/copolymerized polyamide at a mass ratio of 3/1 in a solvent mixture of methanol/1-propanol/toluene with a mass ratio of 7/1/2 was prepared using the titanium oxide dispersion 3-F, as in Example 3-1. The particle size distribution was not able to be measured as in Example 3-1 because of precipitation or separation of titanium oxide.

Comparative Example 3-2

Dispersion treatment was conducted as in Example 3-1 except that 1 kg of raw material slurry was composed of 50 parts of the surface-treated titanium oxide and 12.5 parts of methanol and had a solid content of 80.0 mass %, but the slurry having low fluidity clogged in the pipe, and the operation had to be discontinued.

Comparative Example 3-3

A titanium oxide dispersion 3-G (solid content: 29.4 mass %) was prepared by mixing 50 parts of surface-treated titanium oxide and 120 parts of methanol and dispersing the mixture with a ball mill using alumina balls having a diameter of about 5 mm (HD, manufactured by Nikkato Corp.) for 5 hours. The viscosity and the particle size distribution of the titanium oxide dispersion 3-G were measured as in Example 3-1. The results are shown in Table 7.

A coating liquid 3-V for forming an undercoat layer containing the surface-treated titanium oxide/copolymerized polyamide at a mass ratio of 3/1 in a solvent mixture of methanol/1-propanol/toluene with a mass ratio of 7/1/2 was prepared using the titanium oxide dispersion 3-G, as in Example 3-1. The particle size distribution was measured as in Example 3-1. The results are shown in Table 7.

TABLE 6

| No. | Titanium oxide dispersion | Solid content in dispersion (mass %) | Average particle diameter of dispersion medium | Peripheral velocity of rotor (m/s) |
|---|---|---|---|---|
| Example 3-1 | 3-A | 25 | 50 μm | 10 |
| Example 3-2 | 3-B | 45 | 50 μm | 10 |
| Example 3-3 | 3-C | 60 | 50 μm | 10 |
| Example 3-4 | 3-D | 10 | 50 μm | 10 |
| Example 3-5 | 3-E | 25 | 30 μm | 12 |
| Comparative Example 3-1 | 3-F | 5 | 50 μm | 10 |
| Comparative Example 3-2 | — | 80 | 50 μm | 10 |
| Comparative Example 3-3 | 3-G | 25 | 5 mm | — |

TABLE 7

| | Titanium oxide dispersion | | | | Coating liquid for forming undercoat layer | | |
|---|---|---|---|---|---|---|---|
| No. | No. | Volume average particle diameter (μm) | 90% cumulative particle diameter (μm) | Viscosity (cps) | No. | Volume average particle diameter (μm) | 90% cumulative particle diameter (μm) |
| Example 3-1 | 3-A | 0.07 | 0.12 | 4 | 3-P | 0.08 | 0.15 |
| Example 3-2 | 3-B | 0.07 | 0.13 | 20 | 3-Q | 0.08 | 0.16 |
| Example 3-3 | 3-C | 0.09 | 0.16 | 700 | 3-R | 0.09 | 0.17 |
| Example 3-4 | 3-D | 0.09 | 0.17 | 3 | 3-S | 0.09 | 0.18 |
| Example 3-5 | 3-E | 0.07 | 0.10 | 4 | 3-T | 0.07 | 0.10 |
| Comparative Example 3-1 | 3-F | 0.48 | 1.00 | 2 | 3-U | Not measured because of precipitation or separation | |
| Comparative Example 3-2 | — | Operation was discontinued because of low fluidity of slurry | | | — | — | — |
| Comparative Example 3-3 | 3-G | 0.13 | 0.24 | 4.5 | 3-V | 0.13 | 0.21 |

In the preparation of the titanium oxide dispersion according to the present invention, a significantly low solid content in the dispersion leads to agglomeration (Comparative Example 3-1), whereas a significantly high solid content causes low fluidity that precludes the operation of the bead mill (Comparative Example 3-2). Accordingly, the solid content in the titanium oxide dispersion is preferably 8 mass % or more, more preferably 10 mass % or more, and particularly preferably 15 mass % or more and preferably 70 mass % or less, more preferably 60 mass % or less, and particularly preferably 50 mass % or less.

Example 3-6

The coating liquid 3-P for forming an undercoat layer, which was prepared in Example 3-1, was applied to a cut aluminum tube with an outer diameter of 24 mm, a length of 236.5 mm, and a thickness of 0.75 mm by dipping to form an undercoat layer with a dried thickness of 2 μm. Observation of the surface of the undercoat layer with a scanning electron microscope confirmed substantially no agglomeration in the surface.

Figure 8:
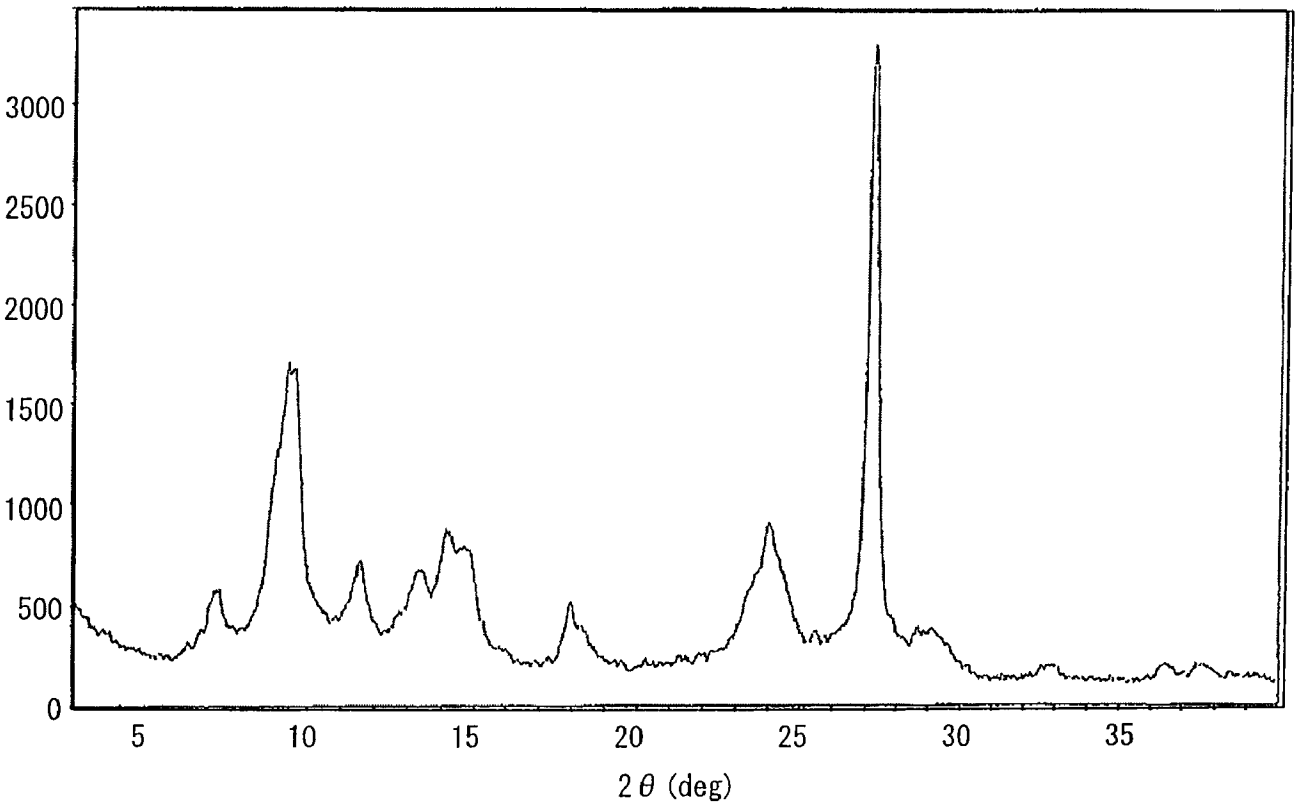
FIG. 8 is a powder X-ray diffraction spectrum pattern of oxytitanium phthalocyanine used as a charge-generating material in Examples, to CuKα characteristic X-ray.

A dispersion was prepared by mixing 20 parts by mass of oxytitanium phthalocyanine, as a charge-generating material, having a powder X-ray diffraction spectrum pattern to CuKα characteristic X-ray, shown in FIG. 8, and exhibiting a main diffraction peak at a Bragg angle (2θ±0.2°) of 27.3° and 280 parts by mass of 1,2-dimethoxyethane and subjecting the mixture to dispersion treatment in a sand grind mill for 2 hours. Then, this dispersion was mixed with 10 parts by mass of polyvinyl butyral (trade name "Denka Butyral" #6000C, manufactured by Denki Kagaku Kogyo K.K.), 253 parts by mass of 1,2-dimethoxyethane, and 85 parts by mass of 4-methoxy-4-methyl-2-pentanone. The mixture was further mixed with 234 parts by mass of 1,2-dimethoxyethane, and the resulting mixture was treated with an ultrasonic dispersing device and then filtered through a PTFE membrane filter with a pore size of 5 μm (Mitex LC, manufactured by Advantech Co., Ltd.) to give a coating liquid for forming a charge-generating layer. This coating liquid for forming a charge-generating layer was applied onto the undercoat layer by dipping to form a charge-generating layer having a dried thickness of 0.4 μm.

Then, on this charge-generating layer was applied a coating liquid for forming a charge-transporting layer prepared by dissolving 56 parts of a hydrazone compound shown below:

[Chemical Formula 44]

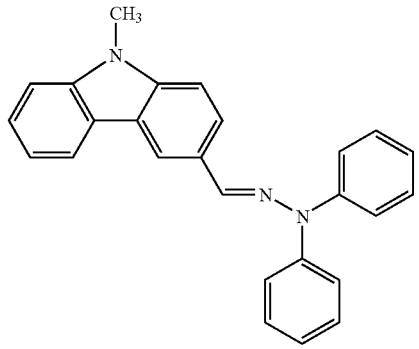

14 parts of a hydrazone compound shown below:

[Chemical Formula 45]

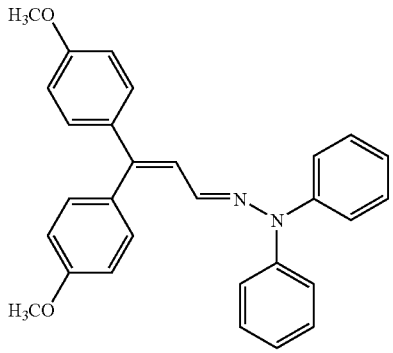

100 parts of a polycarbonate resin having a repeating structure shown below:

[Chemical Formula 46]

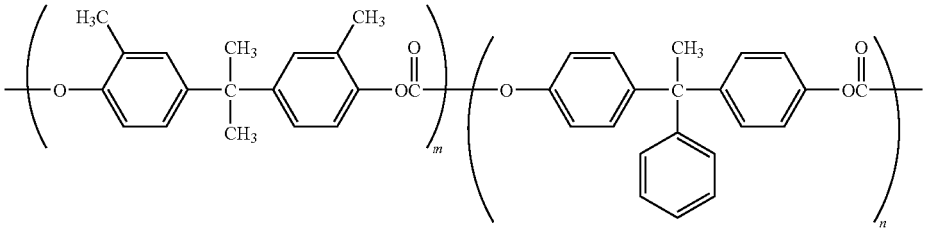

(m:n = 1:1)

and 0.05 part by mass of a silicone oil in 640 parts by mass of a solvent mixture of tetrahydrofuran/toluene (8/2). By the air-drying at room temperature for 25 minutes, a layer with a thickness of 17 μm was given. The layer was further dried at 125° C. for 20 minutes to form an electrophotographic photoreceptor having a charge-transporting layer. The thus prepared electrophotographic photoreceptor was used as photoreceptor 3-P1.

The photoreceptor was mounted in an electrophotographic characteristic evaluation device produced in accordance with a standard of The Society of Electrophotography of Japan (Zoku Denshi Shashin Gizyutsu no Kiso to Oyo (Fundamentals and Applications of Electrophotography II) edited by The Society of Electrophotography of Japan, published by Corona Publishing Co., Ltd., pp. 404-405) and was charged such that the surface potential was −700 V and then was irradiated with a 780 nm laser at an intensity of 5.0 μJ/cm$^2$. The surface potential VL at 100 ms after the exposure was measured at 25° C. and a relative humidity of 50% (hereinafter, optionally, referred to as NN circumstances) and at 5° C. and a relative humidity of 10% (hereinafter, optionally, referred to as LL circumstances). These values VL(NN) and VL(LL) are shown in Table 8.

The dielectric breakdown strength of the photoreceptor 3-P1 was measured as follows: The photoreceptor was fixed at a temperature of 25° C. and a relative humidity of 50%, and a charging roller having a volume resistivity of about 2 MΩ·cm and having a length about 2 cm shorter than that of the drum at both ends was pressed on the photoreceptor for applying a direct-current voltage of −3 kV, and the time until dielectric breakdown was measured. The results are shown in Table 8.

Example 3-7

A photoreceptor 3-P2 was produced as in Example 3-6 except that the undercoat layer was formed using the coating liquid 3-R for forming an undercoat layer. The surface of the undercoat layer was observed with a scanning electron microscope as in Example 3-6 to confirm substantially no agglomeration. The photoreceptor 3-P2 was evaluated as in Example 3-6, and the results are shown in Table 8.

Example 3-8

A photoreceptor 3-P3 was produced as in Example 3-6 except that the undercoat layer was formed with the coating liquid 3-T for forming an undercoat layer. The surface of the undercoat layer was observed with a scanning electron microscope as in Example 3-6 to confirm substantially no agglomeration. The photoreceptor 3-P3 was evaluated as in Example 3-6, and the results are shown in Table 8.

Comparative Example 3-4

A photoreceptor 3-Q1 was produced as in Example 3-6 except that the coating liquid 3-V for forming an undercoat layer described in Comparative Example 3-3 was used as a coating liquid for forming an undercoat layer. The surface of the undercoat layer was observed with a scanning electron microscope as in Example 3-6 to confirm a large number of titanium oxide agglomerations. The photoreceptor 3-Q1 was evaluated as in Example 3-6, and the results are shown in Table 8.

TABLE 8

| No. | Coating liquid | Photoreceptor | VL (NN) | VL (LL) | Time until dielectric breakdown |
|---|---|---|---|---|---|
| Example 3-6 | 3-P | 3-P1 | −76 V | −173 V | 20 min |
| Example 3-7 | 3-R | 3-P2 | −77 V | −174 V | 16 min |
| Example 3-8 | 3-T | 3-P3 | −83 V | −176 V | 22 min |
| Comparative Example 3-4 | 3-V | 3-Q1 | −76 V | −151 V | 3 min |

The electrophotographic photoreceptors (3-P1 to 3-P3) of the present invention had homogeneous undercoat layers without agglomeration and exhibited low potential variation due to environmental variation and high resistance to dielectric breakdown.

Example 3-9

The coating liquid 3-P for forming an undercoat layer, which was prepared in Example 3-1, was applied to a cut aluminum tube with an outer diameter of 30 mm, a length of 285 mm, and a thickness of 0.8 mm by dipping to form an undercoat layer with a dried thickness of 2.4 μm. The surface of the undercoat layer was observed with a scanning electron microscope to confirm substantially no agglomeration.

A coating liquid for forming a charge-generating layer was prepared as in Example 3-6 and was applied onto the undercoat layer by dipping to form a charge-generating layer having a dried thickness of 0.4 μm.

Then, on this charge-generating layer was applied a coating liquid containing 60 parts of a composition (A) described in Japanese Unexamined Patent Application Publication No. 2002-080432 as a charge-transporting material having the following main structure:

[Chemical Formula 47]

composition A

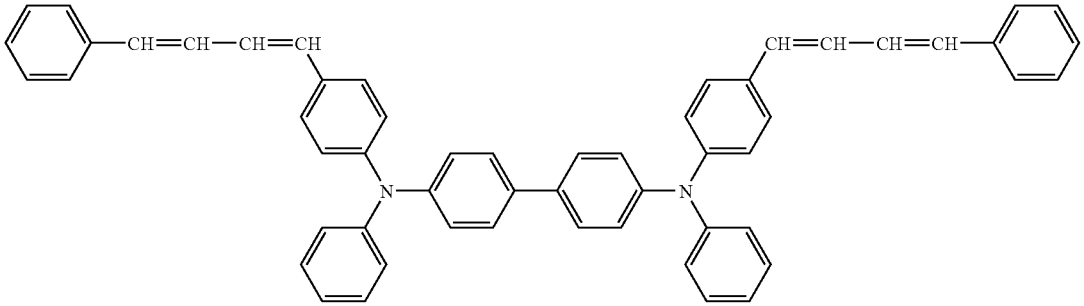

100 parts of a polycarbonate resin having a repeating structure shown below:

[Chemical Formula 48]

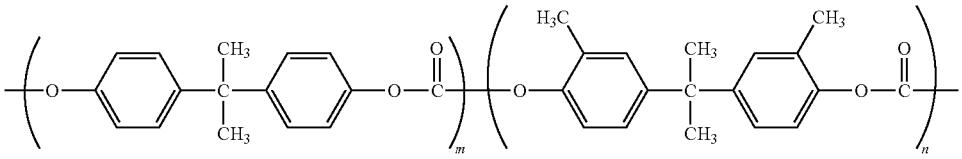

(m:n = 7:3)

and 0.05 part by mass of a silicone oil in 640 parts by mass of a solvent mixture of tetrahydrofuran/toluene (8/2) to give a charge-transporting layer with a dried thickness of 10 μm. The layer was further dried to form an electrophotographic photoreceptor having the charge-transporting layer.

The produced photoreceptor was mounted on a cartridge (having a scorotron charging member and a blade cleaning member as an imaging unit cartridge) of a color printer (product name: InterColor LP-1500C, manufactured by Seiko Epson Corp.) to form a full-color image. The printed image was satisfactory. The number of small color spots observed in 1.6 cm square in the image is shown in Table 9.

Example 3-10

An electrophotographic photoreceptor was produced as in Example 3-9 except that the coating liquid 3-R for forming an undercoat layer described in Example 3-3 was used as a coating liquid for forming an undercoat layer. A full-color image was formed as in Example 3-9 using this electrophotographic photoreceptor. The printed image was satisfactory. The number of small color spots observed in 1.6 cm square in the image is shown in Table 9.

Example 3-11

An electrophotographic photoreceptor was produced as in Example 3-9 except that the coating liquid 3-T for forming an undercoat layer described in Example 3-5 was used as a coating liquid for forming an undercoat layer. A full-color image was formed as in Example 3-9 using this electrophotographic photoreceptor. The printed image was satisfactory. The number of small color spots observed in 1.6 cm square in the image is shown in Table 9.

Comparative Example 3-5

An electrophotographic photoreceptor was produced as in Example 3-9 except that the coating liquid 3-V for forming an undercoat layer described in Comparative Example 3-3 was used as a coating liquid for forming an undercoat layer. A full-color image was formed as in Example 3-9 using this electrophotographic photoreceptor. The printed image had many color spots and was not satisfactory. The number of small color spots observed in 1.6 cm square in the image is shown in Table 9.

TABLE 9

| No. | Titanium oxide dispersion | Coating liquid for forming undercoat layer | Number of small color spots (#) |
|---|---|---|---|
| Example 3-9 | 3-A | 3-P | 10 |
| Example 3-10 | 3-C | 3-R | 15 |
| Example 3-11 | 3-E | 3-T | 9 |
| Comparative Example 3-5 | 3-G | 3-V | 50 |

Example 3-12

The coating liquid 3-P for forming an undercoat layer was applied to a cut aluminum tube with an outer diameter of 24 mm, a length of 236.5 mm, and a thickness of 0.75 mm by dipping to form an undercoat layer with a dried thickness of 2 μm.

After mixing 1.5 part of a charge-generating material represented by the following formula:

[Chemical Formula 49]

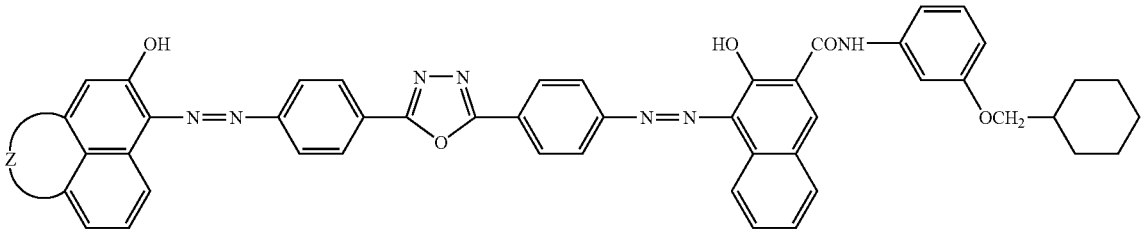

where Z denotes a mixture of 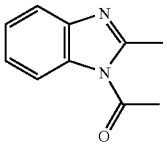 and 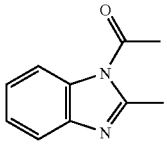

and 30 parts of 1,2-dimethoxyethane, the material was pulverized in a sand grind mill for 8 hours for microparticle dispersion treatment. Then, the mixture was mixed with a binder liquid prepared by dissolving 0.75 part of polyvinyl butyral (trade name "Denka Butyral" #6000C, manufactured by Denki Kagaku Kogyo K.K.) and 0.75 part of a phenoxy resin (PKHH, a product of Union Carbide Corp.) in 28.5 parts of 1,2-dimethoxyethane. Finally, 13.5 parts of an arbitrary liquid mixture of 1,2-dimethoxyethane and 4-methoxy-4-methyl-2-pentanone was added to the mixture to prepare a coating liquid for forming a charge-generating layer containing 4.0 mass % solid components (pigment and resin). This coating liquid for forming a charge-generating layer was applied onto the undercoat layer by dipping and drying it to form a charge-generating layer having a dried thickness of 0.6 μm.

Then, on this charge-generating layer applied was a coating liquid for forming a charge-transporting layer prepared by dissolving 67 parts of a triphenylamine compound shown below:

[Chemical Formula 50]

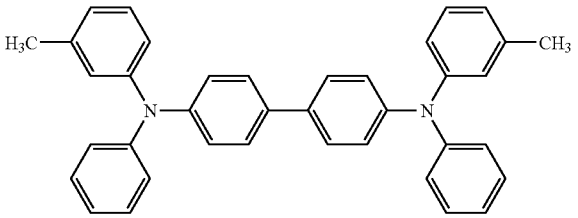

100 parts of a polycarbonate resin having a repeating structure shown below:

[Chemical Formula 51]

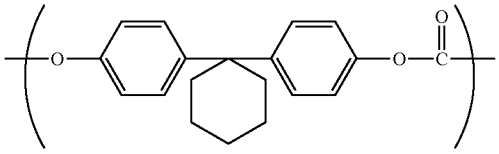

0.5 part of a compound having the following structure:

[Chemical Formula 52]

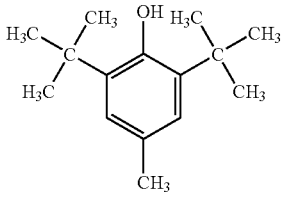

and 0.02 part by weight of a silicone oil in 640 parts by weight of a solvent mixture of tetrahydrofuran/toluene (8/2). The applied liquid was air-dried at room temperature for 25 minutes to give a charge-transporting layer with a dried thickness of 25 μm. The layer was further dried at 125° C. for 20 minutes to form an electrophotographic photoreceptor having the charge-transporting layer.

The resulting electrophotographic photoreceptor was mounted in an electrophotographic characteristic evaluation device produced in accordance with a standard of The Society of Electrophotography of Japan (Zoku Denshi Shashin Gizyutsu no Kiso to Oyo (Fundamentals and Applications of Electrophotography II) edited by The Society of Electrophotography of Japan, published by Corona Publishing Co., Ltd., pp. 404-405), and electric characteristics thereof were evaluated by the cycle of charging, exposure, potential measurement, and neutralization, according to the following procedure.

The initial surface potential of the photoreceptor that was charged by discharging with a scorotron charging device at a grid voltage of −800 V in a dark place was measured. Then, the photoreceptor was irradiated with monochromatic light of 450 nm emitted from a halogen lamp and monochromatized through an interference filter. The irradiation energy ($\mu J/cm^2$) required for the surface potential to reach −350 V was measured as sensitivity E1/2. The initial charging potential was −708 V, and the sensitivity E1/2 was 3.288 $\mu J/cm^2$. A larger value of the initial charging potential (a larger absolute value of the potential) represents a better charging property, and a lower value of the sensitivity represents a higher sensitivity.

Comparative Example 3-6

An electrophotographic photoreceptor was produced as in Example 3-12 except that the coating liquid 3-V for forming an undercoat layer described in Comparative Example 3-3 was used as a coating liquid for forming an undercoat layer. The electric characteristics of this electrophotographic photoreceptor were evaluated as in Example 3-12. The initial charging potential was −696 V and the sensitivity E1/2 was 3.304 μJ/cm$^2$.

The results in Example 3-12 and Comparative Example 3-6 elucidate that the electrophotographic photoreceptor of the present invention had high sensitivity to exposure to monochromatic light having a wavelength of 350 to 600 nm.

The electrophotographic photoreceptors of the present invention had excellent photoreceptive characteristics and high resistance to dielectric breakdown and also had significantly excellent performances, i.e., reduced image defects such as color spots.

Example Group 4

Example 4-1

Surface-treated titanium oxide was prepared by mixing rutile titanium oxide having an average primary particle diameter of 40 nm ("TTO55N", manufactured by Ishihara Sangyo Co., Ltd.) and methyldimethoxysilane ("TSL8117", manufactured by Toshiba Silicone Co., Ltd.) in an amount of 3 weight % on the basis of the amount of the titanium oxide in a Henschel mixer. Five kilograms of raw material slurry (slurry specific gravity: about 1.03) composed of a mixture of 50 parts of the surface-treated titanium oxide and 117 parts of methanol was subjected to dispersion treatment for 5 hours with a wet agitating mill, shown in FIGS. 5(A) and 5(B), having a mill pulverization capacity of about 1.5 L (effective volumetric capacity: about 0.75 L) and equipped with a rotating screen of 0.03 mm mesh sieve for centrifugal separation, using zirconia beads with a diameter of about 100 μm (YTZ, manufactured by Nikkato Corp.) as a dispersion medium at a filling rate of about 85% under liquid circulation conditions of a rotor peripheral velocity of 6 m/sec and a liquid flow rate of about 60 kg/h to give a titanium oxide dispersion.

The titanium oxide dispersion, a solvent mixture of methanol/1-propanol/toluene, and a pelletized copolymerized polyamide composed of ∈-caprolactam [compound represented by Formula (A)]/bis(4-amino-3-methylcyclohexyl) methane [compound represented by Formula (B)]/hexamethylene diamine [compound represented by Formula (C)]/decamethylenedicarboxylic acid [compound represented by Formula (D)]/octadecamethylenedicarboxylic acid [compound represented by Formula (E)] at a molar ratio of 60%/15%/5%/15%/5% were mixed with agitation under heat to dissolve the pelletized polyamide. The resulting mixture was subjected to ultrasonic dispersion treatment for 1 hour with an ultrasonic oscillator at an output of 1200 W and then filtered through a PTFE membrane filter with a pore size of 5 μm (Mitex LC, manufactured by Advantech Co., Ltd.) to give a coating liquid 4-A for forming an undercoat layer containing the surface-treated titanium oxide/copolymerized polyamide at a weight ratio of 3/1 in the solvent mixture of methanol/1-propanol/toluene with a weight ratio of 7/1/2 and having a solid content of 18.0 weight %.

For the coating liquid 4-A for forming an undercoat layer, the rate of viscosity change due to storage at room temperature for 120 days (the value obtained by dividing the difference of viscosities at the manufacturing and after storage for 120 days by the viscosity at the manufacturing time) and the particle size distribution of titanium oxide at the manufacturing were measured. The viscosity was measured by a process in accordance with JIS Z 8803 using an E-type viscometer (Product name: ED, manufactured by Tokimec Inc.). The particle size distribution was measured with a particle size analyzer (product name: MICROTRAC UPA model: 9340, manufactured by Nikkiso Co., Ltd.,). The results are shown in Table 10.

Example 4-2

A coating liquid 4-B for forming an undercoat layer was prepared as in Example 4-1 except that dispersion was conducted using zirconia beads having a diameter of about 50 μm (YTZ, manufactured by Nikkato Corp.) as dispersion medium, a rotating screen of 0.02 mm mesh sieve for centrifugal separation, and liquid circulation conditions of a liquid flow rate of about 30 kg/h. The physical properties were measured as in Example 4-1. The results are shown in Table 10.

Example 4-3

A coating liquid 4-C for forming an undercoat layer was prepared as in Example 4-2 except that the peripheral velocity of rotor for dispersion was 12 m/sec. The physical properties were measured as in Example 4-1. The results are shown in Table 10.

Example 4-4

A coating liquid 4-D for forming an undercoat layer was prepared as in Example 4-2 except that dispersion was conducted using zirconia beads having a diameter of about 30 μm (YTZ, manufactured by Nikkato Corp.) as dispersion medium and a rotating screen of 0.01 mm mesh sieve for centrifugal separation. The physical properties were measured as in Example 4-1. The results are shown in Table 10.

Example 4-5

A coating liquid 4-E for forming an undercoat layer was prepared as in Example 4-2 except that a wet agitating mill shown in FIG. 6 was used instead of the wet agitating mill (refer to FIGS. 5(A) and 5(B)) used in Example 4-2. The physical properties were measured as in Example 4-1. The results are shown in Table 10.

Comparative Example 4-1

A coating liquid 4-F for forming an undercoat layer was prepared as in Example 4-1 except that a dispersion slurry liquid prepared by mixing 50 parts of surface-treated titanium oxide of Example 1 and 117 parts of methanol and dispersing the mixture using alumina balls with a diameter of about 5 mm (HD, manufactured by Nikkato Corp.) for 5 hours was directly used without conducting the step of dispersion using the wet agitating mill shown in FIGS. 5(A) and 5(B). The physical properties were measured as in Example 4-1 except that the solid content was 0.015 weight % (metal oxide particle concentration: 0.011 weight %). The results are shown in Table 10.

Comparative Example 4-2

A coating liquid 4-G for forming an undercoat layer was prepared as in Comparative Example 4-1 except that zirconia balls with a diameter of about 5 mm (YTZ, manufactured by Nikkato Corp.) were used for ball mill dispersion in Comparative Example 4-1. The physical properties were measured as in Comparative Example 4-1. The results are shown in Table 10.

Comparative Example 4-3

A coating liquid 4-H for forming an undercoat layer was prepared as in Comparative Example 4-1 except that Aluminum Oxide C (aluminum oxide particles), manufactured by Nippon Aerosil Co., Ltd., having an average primary particle diameter of 13 nm was used instead of the surface-treated titanium oxide used in Comparative Example 4-1 and dispersion was conducted with an ultrasonic oscillator at an output of 600 W for 6 hours instead of the dispersion with a ball mill. The physical properties were measured as in Example 4-1. The results are shown in Table 10.

The surface potential VL(NN) under the NN circumstances and the surface potential VL(LL) under the LL circumstances of the photoreceptor were measured as in Example 3-6. The results are shown in Table 11.

Example 4-7

A photoreceptor 4-P2 was produced as in Example 4-6 except that the thickness of the undercoat layer was 3 μm. The surface of the undercoat layer was observed with a scanning electron microscope as in Example 4-6 to confirm substantially no agglomeration. The photoreceptor 4-P2 was evaluated as in Example 4-6. The results are shown in Table 11.

TABLE 10

[Physical properties of coating liquids for forming an undercoat layer]

| Example | Coating liquid | Medium | Diameter of medium | Peripheral velocity of rotor | Liquid flow rate | Dispersion time | Mv (μm) | D90 (μm) | Mp (μm) | Mv/Mp | D84 (μm) | D16 (μm) | SD (μm) | Rate of change in viscosity |
|---|---|---|---|---|---|---|---|---|---|---|---|---|---|---|
| Example 4-1 | 4-A | zirconia | 100 μm | 6 m/s | 60 kg/h | 5 h | 0.074 | 0.108 | 0.055 | 1.341 | 0.101 | 0.053 | 0.024 | 5% increment |
| Example 4-2 | 4-B | zirconia | 50 μm | 6 m/s | 30 kg/h | 5 h | 0.068 | 0.100 | 0.052 | 1.308 | 0.091 | 0.047 | 0.022 | 2% increment |
| Example 4-3 | 4-C | zirconia | 50 μm | 12 m/s | 30 kg/h | 5 h | 0.062 | 0.096 | 0.045 | 1.378 | 0.086 | 0.039 | 0.024 | 3% increment |
| Example 4-4 | 4-D | zirconia | 30 μm | 6 m/s | 30 kg/h | 5 h | 0.055 | 0.085 | 0.040 | 1.375 | 0.079 | 0.033 | 0.023 | 2% increment |
| Example 4-5 | 4-E | zirconia | 50 μm | 6 m/s | 30 kg/h | 5 h | 0.071 | 0.103 | 0.054 | 1.315 | 0.093 | 0.050 | 0.022 | 2% increment |
| Comparative Example 4-1 | 4-F | alumina | 5 mm | — | — | 5 h | 0.133 | 0.203 | 0.090 | 1.478 | 0.158 | 0.076 | 0.041 | 39% increment |
| Comparative Example 4-2 | 4-G | zirconia | 5 mm | — | — | 5 h | 1.252 | 3.363 | 0.874 | 1.432 | 1.984 | 0.084 | 0.950 | 28% increment |
| Comparative Example 4-3 | 4-H | — | — | — | — | 6 h | 0.176 | 0.254 | 0.101 | 1.743 | 0.164 | 0.067 | 0.049 | 45% increment |

SD = (D84 − D16)/2

The results shown in Table 10 elucidate that the coating liquids 4-A to 4-E for forming an undercoat layer prepared by the method of the present invention had small average particle diameters and narrow particle diameter distributions and thereby exhibited high liquid stability and formed uniform undercoat layers. In addition, the change in the viscosity was small even if the coating liquids 4-A to 4-E for forming an undercoat layer were stored for a long period of time. Thus, the stability was high. Furthermore, the undercoat layers formed by the application of the coating liquids for forming an undercoat layer were highly homogeneous to reduce light scattering. Thus, high regular reflection rate was observed.

Example 4-6

An undercoat layer was formed on a cut aluminum tube as in Example 3-6 except that the coating liquid 4-A for forming an undercoat layer was used as a coating liquid for forming an undercoat layer. The surface of this undercoat layer was observed with a scanning electron microscope to confirm substantially no agglomeration.

A charge-generating layer and a charge-transporting layer were formed on this undercoat layer as in Example 3-6 to produce an electrophotographic photoreceptor. This electrophotographic photoreceptor was used as a photoreceptor 4-P1.

In order to evaluate dielectric breakdown strength of the photoreceptor 4-P1, time until dielectric breakdown was measured as in Example 3-6. The results are shown in Table 11.

Example 4-8

A coating liquid 4-A2 for forming an undercoat layer was prepared as in Example 4-1 except that the weight ratio (titanium oxide/copolymerized polyamide) of titanium oxide and a copolymerized polyamide was 2/1.

A photoreceptor 4-P3 was produced as in Example 4-6 except that the coating liquid 4-A2 was used as a coating liquid for forming an undercoat layer. The surface of the undercoat layer was observed with a scanning electron microscope as in Example 4-6 to confirm substantially no agglomeration. The photoreceptor 4-P3 was evaluated as in Example 4-6. The results are shown in Table 11.

Example 4-9

A photoreceptor 4-Q1 was produced as in Example 4-6 except that the coating liquid 4-B for forming an undercoat layer described in Example 4-2 was used as a coating liquid for forming an undercoat layer. The surface of the undercoat layer was observed with a scanning electron microscope as in Example 4-6 to confirm substantially no agglomeration. In addition, as the surface state of this undercoat layer, the surface roughness was measured with the aforementioned AFM (VN-8000 system, manufactured by Keyence Corp.) to confirm a homogeneous surface with significantly low roughness having an Ra of 4.3 nm, an Ry of 47.5 nm, and an Rz of 37.3 nm, on average. The photoreceptor 4-Q1 was evaluated as in Example 4-6. The results are shown in Table Example 4-10

A photoreceptor 4-Q2 was produced as in Example 4-9 except that the thickness of the undercoat layer was 3 μm. The surface of the undercoat layer was observed with a scanning electron microscope as in Example 4-6 to confirm substantially no agglomeration. The photoreceptor 4-Q2 was evaluated as in Example 4-6. The results are shown in Table 11.

Example 4-11

A photoreceptor 4-R1 was produced as in Example 4-6 except that the coating liquid 4-C for forming an undercoat layer described in Example 4-3 was used as a coating liquid for forming an undercoat layer. The surface of the undercoat layer was observed with a scanning electron microscope as in Example 4-6 to confirm substantially no agglomeration. The photoreceptor 4-R1 was evaluated as in Example 4-6. The results are shown in Table 11.

Example 4-12

A photoreceptor 4-R2 was produced as in Example 4-11 except that the thickness of the undercoat layer was 3 μm. The surface of the undercoat layer was observed with a scanning electron microscope as in Example 4-6 to confirm substantially no agglomeration. The photoreceptor 4-R2 was evaluated as in Example 4-6. The results are shown in Table 11.

Example 4-13

A coating liquid 4-C2 for forming an undercoat layer was prepared as in Example 4-3 except that the weight ratio of titanium oxide and a copolymerized polyamide was titanium oxide/copolymerized polyamide=2/1.

A photoreceptor 4-R3 was produced as in Example 4-11 except that the coating liquid 4-C2 was used as a coating liquid for forming an undercoat layer. The surface of the undercoat layer was observed with a scanning electron microscope as in Example 4-6 to confirm substantially no agglomeration. The photoreceptor 4-R3 was evaluated as in Example 4-6. The results are shown in Table 11.

Example 4-14

A photoreceptor 4-S1 was produced as in Example 4-6 except that the coating liquid 4-D for forming an undercoat layer described in Example 4-4 was used as a coating liquid for forming an undercoat layer. The surface of the undercoat layer was observed with a scanning electron microscope as in Example 4-6 to confirm substantially no agglomeration. In addition, the surface state of this undercoat layer was measured as in Example 4-6 to confirm a homogeneous surface with significantly low roughness having an Ra of 3.7 nm, an Ry of 30.6 nm, and an Rz of 19.5 nm, on average. The photoreceptor 4-S1 was evaluated as in Example 4-6. The results are shown in Table 11.

Example 4-15

A photoreceptor 4-S2 was produced as in Example 4-14 except that the thickness of the undercoat layer was 3 μm. The surface of the undercoat layer was observed with a scanning electron microscope as in Example 4-6 to confirm substantially no agglomeration. The photoreceptor 4-S2 was evaluated as in Example 4-6. The results are shown in Table 11.

Example 4-16

A coating liquid 4-D2 for forming an undercoat layer was prepared as in Example 4-4 except that the weight ratio of titanium oxide and a copolymerized polyamide was titanium oxide/copolymerized polyamide=2/1.

A photoreceptor 4-S3 was produced as in Example 4-14 except that the coating liquid 4-D2 was used as a coating liquid for forming an undercoat layer. The surface of the undercoat layer was observed with a scanning electron microscope as in Example 4-6 to confirm substantially no agglomeration. The photoreceptor 4-S3 was evaluated as in Example 4-6. The results are shown in Table 11.

Comparative Example 4

A photoreceptor 4-T1 was produced as in Example 4-6 except that the coating liquid 4-F for forming an undercoat layer described in Comparative Example 4-1 was used as a coating liquid for forming an undercoat layer. The surface of the undercoat layer was observed with a scanning electron microscope as in Example 4-6 to confirm a large number of titanium oxide agglomerations. In addition, the surface state of this undercoat layer was measured as in Example 4-9 to confirm an inhomogeneous surface with high roughness having an Ra of 12.7 nm, an Ry of 140.1 nm, and an Rz of 98.8 nm, on average. The photoreceptor 4-T1 was evaluated as in Example 4-6. The results are shown in Table 11.

Comparative Example 4-5

A photoreceptor 4-T2 was produced as in Comparative Example 4-4 except that the thickness of the undercoat layer was 3 μm. The surface of the undercoat layer was observed with a scanning electron microscope as in Example 4-6 to confirm a large number of titanium oxide agglomerations. The photoreceptor 4-T2 was evaluated as in Example 4-6. The results are shown in Table 11.

Comparative Example 4-6

A photoreceptor 4-U1 was produced as in Example 4-6 except that the coating liquid 4-G for forming an undercoat layer described in Comparative Example 4-2 was used as a coating liquid for forming an undercoat layer. The surface of the undercoat layer was observed with a scanning electron microscope as in Example 4-6 to confirm a large number of titanium oxide agglomerations. In the undercoat layer of the photoreceptor 4-U1, the components were inhomogeneous and the thickness was uneven. Consequently, the electric characteristics were not evaluated.

TABLE 11

[Electric characteristics of photoreceptor and time until dielectric breakdown]

| | Photoreceptor | Titanium/copolymerized polyamide (weight ratio) | Thickness of undercoat layer (μm) | VL(NN) (V) | VL(LL) (V) | Time until dielectric breakdown (min) |
|---|---|---|---|---|---|---|
| Example 4-6 | 4-P1 | 3/1 | 2 | −74 | −180 | 19.0 |
| Example 4-7 | 4-P2 | 3/1 | 3 | — | — | — |
| Example 4-8 | 4-P3 | 2/1 | 2 | −92 | −199 | 23.1 |
| Example 4-9 | 4-Q1 | 3/1 | 2 | −73 | −170 | 19.4 |
| Example 4-10 | 4-Q2 | 3/1 | 3 | −84 | −188 | — |
| Example 4-11 | 4-R1 | 3/1 | 2 | −73 | −158 | 17.8 |
| Example 4-12 | 4-R2 | 3/1 | 3 | −80 | −170 | — |
| Example 4-13 | 4-R3 | 2/1 | 2 | −95 | −198 | 20.5 |
| Example 4-14 | 4-S1 | 3/1 | 2 | −83 | −169 | 17.2 |
| Example 4-15 | 4-S2 | 3/1 | 3 | −86 | −187 | — |
| Example 4-16 | 4-S3 | 2/1 | 2 | −96 | −197 | 21.7 |
| Comparative Example 4-4 | 4-T1 | 3/1 | 2 | −79 | −151 | 2.8 |
| Comparative Example 4-5 | 4-T2 | 3/1 | 3 | −82 | −175 | — |
| Comparative Example 4-6 | 4-U1 | 3/1 | 2 | — | — | — |

The results of the electron microscopic observation and surface roughness measurement with AFM in Examples 4-6 to 4-16 and Comparative Examples 4-4 to 4-6 confirmed that the electrophotographic photoreceptors of the present invention had homogeneous undercoat layers without agglomeration. In addition, the results shown in Table 11 elucidate that the electrophotographic photoreceptors of the present invention have high resistance to dielectric breakdown.

Example 4-17

The coating liquid 4-B for forming an undercoat layer, which was prepared in Example 4-2, was applied to a cut aluminum tube with an outer diameter of 30 mm, a length of 285 mm, and a thickness of 0.8 mm by dipping to form an undercoat layer with a dried thickness of 2.4 μm. The surface of the undercoat layer was observed with a scanning electron microscope to confirm substantially no agglomeration.

This undercoat layer (94.2 $cm^2$) was immersed in a solvent mixture of 70 g of methanol and 30 g of 1-propanol and was sonicated with an ultrasonic oscillator at an output of 600 W for 5 minutes to give an undercoat layer dispersion. The particle size distribution of the agglomerated metal oxide particles (secondary particles) in the dispersion was measured as in Example 4-1. The volume average particle diameter Mv was 0.070 μm and the 90% cumulative particle diameter D90 was 0.103 μm.

A coating liquid for forming a charge-generating layer was prepared as in Example 4-6 and was applied onto the undercoat layer by dipping to form a charge-generating layer having a dried thickness of 0.4 μm.

Then, a charge-transporting layer was formed on this charge-generating layer as in Example 3-9 to produce an electrophotographic photoreceptor.

The photosensitive layer (94.2 $cm^2$) of this electrophotographic photoreceptor was removed by dissolving the layer in 100 $cm^3$ of tetrahydrofuran by sonication with an ultrasonic oscillator at an output of 600 W for 5 minutes, and then the photoreceptor after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured as in Example 4-1. The volume average particle diameter Mv was 0.076 μm and the 90% cumulative particle diameter D90 was 0.119 μm.

The produced photoreceptor was mounted in a cartridge of a color printer (product name: InterColor LP-1500C, manufactured by Seiko Epson Corp.) to form a full-color image. The printed image was satisfactory. The number of small color spots observed in 1.6 cm square in the image is shown in Table 12.

The coating liquid for forming an undercoat layer was stored for 3 months. A photoreceptor was produced using the coating liquid stored for 3 months as described above, and a full-color image was formed using the photoreceptor. The number of small color spots observed in 1.6 cm square in the formed image is shown in Table 12 as image defects after 3 months.

Example 4-18

A full-color image was formed as in Example 4-17 except that the coating liquid 4-C for forming an undercoat layer described in Example 4-3 was used as a coating liquid for forming an undercoat layer. The resulting image was satisfactory. The number of small color spots observed in 1.6 cm square in the image is shown in Table 12.

Furthermore, as in Example 4-17, a full-color image was formed after 3 months storage, and the image defects after 3 months were measured. The results are shown in Table 12.

Example 4-19

A full-color image was formed as in Example 4-17 except that the coating liquid 4-D for forming an undercoat layer described in Example 4-4 was used as a coating liquid for forming an undercoat layer. The resulting image was satisfactory. The number of small color spots observed in 1.6 cm square in the image is shown in Table 12.

Furthermore, as in Example 4-17, a full-color image was formed after 3 months storage, and the image defects after 3 months were measured. The results are shown in Table 12.

Comparative Example 4-7

An electrophotographic photoreceptor was produced as in Example 4-17 except that the coating liquid 4-F for forming an undercoat layer described in Comparative Example 4-1 was used as a coating liquid for forming an undercoat layer.

The undercoat layer (94.2 $cm^2$) of this electrophotographic photoreceptor was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured as in Example 4-1. The volume average particle diameter Mv was 0.113 μm and the 90% cumulative particle diameter D90 was 0.196 μm.

In addition, the photosensitive layer (94.2 $cm^2$) of this electrophotographic photoreceptor was removed by dissolving the layer in 100 $cm^3$ of tetrahydrofuran by sonication with an ultrasonic oscillator at an output of 600 W for 5 minutes, and then the photoreceptor after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured as in Example 4-1. The volume average particle diameter Mv was 0.123 μm and the 90% cumulative particle diameter D90 was 0.193 μm.

A full-color image was formed as in Example 4-17 using the electrophotographic photoreceptor. A large number of color spots were observed, and satisfactory image was not formed. The number of small color spots observed in 1.6 cm square in the image is shown in Table 12.

Furthermore, as in Example 4-17, a full-color image was formed with the photoreceptor formed of the coating liquid after 3 months storage, and the image defects after 3 months were measured. The results are shown in Table 12.

TABLE 12

[Image evaluation by image-forming apparatus]

| | Medium | Diameter of medium | Peripheral velocity of rotor | Titanium oxide/copolymerized polyamide (weight ratio) | Thickness of undercoat layer | Image defect (small color spot) | Image defect after 3 months (small color spot) |
|---|---|---|---|---|---|---|---|
| Example 4-17 | zirconia | 50 μm | 6 m/s | 3/1 | 2.4 μm | 9 | 9 |
| Example 4-18 | zirconia | 50 μm | 12 m/s | 3/1 | 2.4 μm | 7 | 10 |
| Example 4-19 | zirconia | 30 μm | 12 m/s | 3/1 | 2.4 μm | 6 | 5 |
| Comparative Example 4-7 | alumina | 5 mm | — | 3/1 | 2.4 μm | 30 | 110 |

The results shown in Table 12 elucidate that the electrophotographic photoreceptors of the present invention have excellent photoreceptive characteristics and high resistance to dielectric breakdown and also exhibited significantly excellent performances, i.e., reduced image defects such as color spots. Furthermore, in the case that the coating liquid for forming an undercoat layer of the present invention, the electrophotographic photoreceptor formed of the coating liquid for an undercoat layer after the storage treatment was as satisfactory as that formed of the coating liquid before the storage treatment.

Example 4-20

The photoreceptor 4-Q1 produced in Example 4-9 was fixed at 25° C. and a relative humidity of 50%, and a charging roller having a volume resistivity of about 2 MΩ·cm and having a length about 2 cm shorter than that of the drum at both ends was pressed on the photoreceptor, and a direct-current voltage of −1 kV was applied to the photoreceptor for 1 minute and then a direct-current voltage of −1.5 kV for 1 minute. The voltage applied was decreased by −0.5 kV every 1 minute. Dielectric breakdown occurred when a direct-current voltage of −4.5 kV was applied.

Example 4-21

A photoreceptor was produced as in Example 4-9 except that the coating liquid 4-D for forming an undercoat layer was used instead of the coating liquid 4-B for forming an undercoat layer used in Example 4-9. A variable direct-current voltage was applied to the photoreceptor as in Example 4-20. Dielectric breakdown occurred when a direct-current voltage of −4.5 kV was applied.

Comparative Example 4-8

The photoreceptor 4-T1 produced in Comparative Example 4-4 was used instead of the photoreceptor 4-Q1 produced in Example 4-9 and with a variable direct-current voltage was applied thereto as in Example 4-21. Dielectric breakdown occurred when a direct-current voltage of −3.5 kV was applied.

Example 4-22

The photoreceptor 4-Q1 produced in Example 4-9 was mounted in a printer ML1430 (including an integrated cartridge consisting of a contact-type charging roller member and a monochrome development member) manufactured by Samsung Co., Ltd., and image formation was repeated at a printing concentration of 5% for observing image defects due to dielectric breakdown. No image defect was observed in 50000 images formed.

Comparative Example 4-9

The photoreceptor 4-T1 produced in Comparative Example 4-4 was mounted in a printer ML1430 manufactured by Samsung Co., Ltd. Image formation was repeated at a printing concentration of 5% for observing image defects caused by dielectric breakdown, and image defect was observed in 35000 images formed.

Example 4-23

An electrophotographic photoreceptor was produced as in Example 3-12 except that the coating liquid 4-B for forming an undercoat layer was used as a coating liquid for forming an undercoat layer.

The electrophotographic photoreceptors produced above were evaluated for electric characteristics, i.e., the cycle of charging, exposure, potential measurement, and neutralization as in Example 3-12.

The initial charging potential was −708 V, and the sensitivity E1/2 was 3.288 μJ/cm$^2$.

Comparative Example 4-10

An electrophotographic photoreceptor was produced as in Example 4-23 except that the coating liquid 4-F for forming an undercoat layer described in Comparative Example 4-1 was used as a coating liquid for forming an undercoat layer. The electrophotographic photoreceptor was evaluated for electric characteristics as in Example 4-23. The initial charging potential was −696 V and the sensitivity E1/2 was 3.304 4 μJ/cm$^2$.

The results of Example 4-23 and Comparative Example 4-10 elucidate that the electrophotographic photoreceptor of the present invention exhibits high sensitivity, in particular, when the exposure is conducted with a monochromatic light of a wavelength of 350 to 600 nm.

Example Group 5

Manufacturing Example 5-1

A coating liquid 5-A for forming an undercoat layer that is identical to the coating liquid 1-A for forming an undercoat layer was prepared as in Example 1-1.

The particle size distribution of this coating liquid 5-A for forming an undercoat layer was measured with the aforementioned UPA. The results are shown in Table 13.

This coating liquid 5-A for forming an undercoat layer was applied to a non-anodized aluminum cylinder (outer diameter: 30 mm, length: 375.8 mm, thickness: 0.75 mm) by dipping to form an undercoat layer with a dried thickness of 1.5 μm.

A pigment dispersion was prepared by pulverizing and mixing 10 parts by weight of oxytitanium phthalocyanine exhibiting a strong diffraction peak at a Bragg angle (2θ±0.2) of 27.3° in X-ray diffraction by CuKα and having a powder X-ray diffraction spectrum shown in FIG. 8 and 150 parts by weight of 1,2-dimethoxyethane in a sand grind mill. Then, 160 parts by weight of the resulting pigment dispersion was mixed with 100 parts by weight of a 1,2-dimethoxyethane solution containing 5% of polyvinyl butyral (trade name: #6000C, manufactured by Denki Kagaku Kogyo K.K.) and an adequate amount of 1,2-dimethoxyethane to give a dispersion with a final solid content of 4.0%.

This dispersion was applied to the aluminum cylinder provided with the undercoat layer by dipping to form a charge-generating layer having a dried thickness of 0.3 μm.

Then, a charge-transporting layer was formed on the charge-generating layer as in Example 1-1 to give a photoreceptor drum 5-A1 having a laminated photosensitive layer.

Manufacturing Example 5-2

A coating liquid 5-B for forming an undercoat layer was prepared as in Manufacturing Example 5-1 except that zirconia beads having a diameter of about 50 μm (YTZ, manufactured by Nikkato Corp.) were used as dispersion medium in dispersion with the Ultra Apex Mill. The physical properties were measured as in Manufacturing Example 5-1. The results are shown in Table 13.

This coating liquid 5-B for forming an undercoat layer was applied to a non-anodized aluminum cylinder (outer diameter: 30 mm, length: 375.8 mm, thickness: 1.0 mm) by dipping to form an undercoat layer with a dried thickness of 1.5 μm.

The undercoat layer (94.2 cm$^2$) was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Manufacturing Example 5-1. The volume average particle diameter was 0.08 μm and the 90% cumulative particle diameter was 0.12 μm.

A charge-generating layer and a charge-transporting layer were formed on the obtained undercoat layer as in Manufacturing Example 5-1 to give a photoreceptor 5-B1.

The photosensitive layer (94.2 cm$^2$) of this photoreceptor 5-B1 was removed by dissolving the layer in 100 cm$^3$ of tetrahydrofuran by sonication with an ultrasonic oscillator at an output of 600 W for 5 minutes, and then the photoreceptor after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured as in Manufacturing Example 5-1 with the UPA. The volume average particle diameter was 0.08 μm and the 90% cumulative particle diameter was 0.12 μm.

This result confirmed that the data obtained from the dispersions prepared by dispersing undercoat layers in a solvent mixture of methanol and 1-propanol at a weight ratio of 7:3 and the data obtained from the dispersions prepared by removing the photosensitive layers from the electrophotographic photoreceptors by dissolution and then dispersing the undercoat layers in a solvent mixture of methanol and 1-propanol at a weight ratio of 7:3 were the same as those shown in Table 13 where the coating liquids for forming an undercoat layer themselves were measured.

Manufacturing Example 5-3

A coating liquid 5-C for forming an undercoat layer was prepared as in Manufacturing Example 5-2 except that the peripheral velocity of rotor for dispersion with the Ultra Apex Mill was 12 m/sec. The physical properties were measured as in Manufacturing Example 5-1. The results are shown in Table 13.

A photoreceptor 5-C1 was produced as in Manufacturing Example 5-1 except that the coating liquid 5-C for forming an undercoat layer was used.

Comparative Manufacturing Example 5-1

Rutile titanium oxide having an average primary particle diameter of 40 nm ("TTO55N" manufactured by Ishihara Sangyo Co., Ltd.) and methyldimethoxysilane ("TSL8117" manufactured by Toshiba Silicone Co., Ltd.) in an amount of 3 weight % on the basis of the amount of the titanium oxide were charged into a high-speed fluidized mixing kneader ("SMG300", manufactured by Kawata Co. Inc.) and were high-speed mixed at a rotor peripheral velocity of 34.5 m/sec, and the resulting surface-treated titanium oxide was dispersed in a solvent mixture of methanol/1-propanol with a mill using alumina balls having a diameter of 5 mm to form a dispersion slurry of hydrophobed titanium oxide. This dispersion slurry, a solvent mixture of methanol/1-propanol/toluene (weight ratio: 7/1/2), and the pelletized copolymerized polyamide used in Manufacturing Example 5-1 were dissolved through mixing with agitation under heat, and the mixture was then subjected to an ultrasonic dispersion treatment to give a coating liquid 5-D for forming an undercoat layer containing hydrophobed titanium oxide/copolymerized polyamide at a weight ratio of 3/1 and having a solid content of 18.0%.

A photoreceptor 5-D1 was produced exactly as in Manufacturing Example 5-1 except that the coating liquid 5-D for forming an undercoat layer was used.

TABLE 13

| | Coating liquid | Medium | Diameter of medium | Peripheral velocity of rotor | Volume average particle diameter (μm) | 90% cumulative particle diameter (μm) |
|---|---|---|---|---|---|---|
| Manufacturing Example 5-1 | 5-A | zirconia | 100 μm | 10 m/s | 0.09 | 0.13 |
| Manufacturing Example 5-2 | 5-B | zirconia | 50 μm | 10 m/s | 0.08 | 0.12 |
| Manufacturing Example 5-3 | 5-C | zirconia | 50 μm | 12 m/s | 0.08 | 0.11 |
| Comparative Manufacturing Example 5-1 | 5-D | alumina | 5 mm | — | 0.13 | 0.21 |

[Evaluation of Electric Characteristics]

Electric characteristics (Sensitivity (E1/2) and surface potential after exposure treatment (VL: corresponding to VL1 in Examples 1-1 to 1-9 and Comparative Example 1-1)) of the electrophotographic photoreceptors 5-A1 to 5-D1 produced in Manufacturing Examples 5-1 to 5-3 and Comparative Manufacturing Example 5-1 were evaluated as in Examples 1-1 to 1-9 and Comparative Example 1-1. The results are shown in Table 14.

TABLE 14

| | Photoreceptor | Specification of photoreceptor: Photosensitive layer | Specification of photoreceptor: Coating liquid for forming undercoat layer | Electric characteristics: E½ (μJ/cm²) | Electric characteristics: VL (−V) |
|---|---|---|---|---|---|
| Manufacturing Example 5-1 | 5-A1 | Identical | 5-A | 0.091 | 61 |
| Manufacturing Example 5-2 | 5-B1 | | 5-B | 0.092 | 66 |
| Manufacturing Example 5-3 | 5-C1 | | 5-C | 0.100 | 70 |
| Comparative Manufacturing Example 5-1 | 5-D1 | | 5-D | 0.095 | 70 |

The results shown in Table 14 elucidate that all photoreceptors in the Manufacturing Examples and the Comparative Manufacturing Example exhibit favorable initial electric characteristics, and there are no differences in characteristics between the processes having neutralization steps.

[Evaluation of Image]

Example 5-1

The neutralization light from a cyan drum cartridge of a commercially available tandem-type LED color printer, Microline Pro 9800PS-E (manufactured by Oki Data Corp.), compatible with A3 printing was blocked with black tape to null the neutralization step, and the electrophotographic photoreceptor 5-A1 of Manufacturing Example 5-1 was mounted in the cartridge and was loaded in the printer.

Specification of Microline Pro 9800PS-E:

Four-stage tandem, color: 36 ppm, monochrome: 40 ppm 1200 dpi

Contact-type roller charging (direct-current voltage application)

LED exposure

Neutralization light provided

A pattern having a boldface character G in white on the upper area and a halftone portion from the central area to the lower area of an A3 region was sent as an input of printing data from a personal computer to the printer. The resulting output image was visually evaluated.

Since the neutralization step is null in the printer used for the evaluation, the character G in the upper area of the pattern may be memorized on the photoreceptor and adversely affect the image formation in the next rotation, depending on the performance of a photoreceptor. That is, the character G may appear in the halftone portion as an image memory. The degree of appearance of the memory image in an area that should be essentially even was classified into five ranks. The results are shown in Table 15.

Example 5-2

Image evaluation of the photoreceptor 5-B1 of Manufacturing Example 5-2 was conducted as in Example 5-1. The results are shown in Table 15.

Example 5-3

Image evaluation of the photoreceptor 5-C1 of Manufacturing Example 5-3 was conducted as in Example 5-1. The results are shown in Table 15.

Comparative Example 5-1

Image evaluation of the photoreceptor 5-D1 of Comparative Manufacturing Example 5-1 was conducted as in Example 5-1. The results are shown in Table 15.

Comparative Example 5-2

The black tape blocking the neutralization light in Example 1 was removed to make the neutralization light alive, and the photoreceptor 5-D1 of Comparative Manufacturing Example 5-1 was mounted in the cartridge and was set on the printer. Then, image evaluation of the photoreceptor 5-D1 was conducted as in Example 5-1. The results are shown in Table 15.

TABLE 15

| | Photoreceptor | Undercoat layer | Neutralization light | Image memory |
|---|---|---|---|---|
| Example 5-1 | 5-A1 | 5-A | null | 2 |
| Example 5-2 | 5-B1 | 5-B | null | 2 |
| Example 5-3 | 5-C1 | 5-C | null | 2 |
| Comparative Example 5-1 | 5-D1 | 5-D | null | 4 |
| Comparative Example 5-2 | 5-D1 | 5-D | alive | 1 |

(In the degree of image memory, rank 1 indicates the best and rank 5 indicates the worst.)

As shown in Comparative Example 5-2, when the neutralization step is performed, the appearance of the image memory is low regardless of the kind of the electrophotographic photoreceptor.

On the other hand, when the neutralization step is not performed, image memory readily appears due to the effect of the prior image formation. However, as obvious from comparison of the results in Examples 5-1 to 5-3 and Comparative Example 5-1, even if the neutralization step was not performed, the appearance of image memory could be suppressed by applying the electrophotographic photoreceptor having the undercoat layer according to the present invention, and thereby a favorable image could be formed.

Example Group 6

Example 6-1

Rutile titanium oxide having an average primary particle diameter of 40 nm ("TTO55N" manufactured by Ishihara Sangyo Co., Ltd.) and methyldimethoxysilane ("TSL8117" manufactured by Toshiba Silicone Co., Ltd.) in an amount of 3 weight % on the basis of the amount of the titanium oxide were mixed with a Henschel mixer to give surface-treated titanium oxide. One kilogram of raw material slurry composed of a mixture of 50 parts of the surface-treated titanium oxide and 120 parts of methanol was subjected to dispersion treatment for 2 hours using zirconia beads with a diameter of about 50 μm (YTZ manufactured by Nikkato Corp.) as a dispersion medium and an Ultra Apex Mill (model UAM-015, manufactured by Kotobuki Industries Co., Ltd.) having a mill capacity of about 0.15 L under liquid circulation conditions of a rotor peripheral velocity of 10 m/sec and a liquid flow rate of 10 kg/h to give a titanium oxide dispersion. In a portion in contact with liquid of to the Ultra Apex Mill, the inner liner of a stator was made of zirconia toughened alumina (ZTA) having a Young's modulus of 240 GPa at 20° C., and upper and lower covers of the stator, a separator, and a rotor were made of yttrium oxide semi-stabilized zirconia having a Young's modulus of 210 GPa at 20° C.

The titanium oxide dispersion, a solvent mixture of methanol/1-propanol/toluene, and a pelletized copolymerized polyamide composed of ∈-caprolactam [compound represented by Formula (A)]/bis(4-amino-3-methylcyclohexyl) methane [compound represented by Formula (B)]/hexamethylene diamine [compound represented by Formula (C)]/decamethylenedicarboxylic acid [compound represented by Formula (D)]/octadecamethylenedicarboxylic acid [compound represented by Formula (E)] at a molar ratio of 60%/15%/5%/15%/5%, which is described in Example of Japanese Unexamined Patent Application Publication No. HEI 4-31870, were mixed with agitation under heat to dissolve the pelletized polyamide. The resulting mixture was subjected to ultrasonic dispersion treatment for 1 hour using an ultrasonic oscillator at a frequency of 25 kHz and an output of 1200 W and then filtered through a PTFE membrane filter with a pore size of 5 μm (Mitex LC, manufactured by Advantech Co., Ltd.) to give a coating liquid 6-A for forming an undercoat layer for an electrophotographic photoreceptor containing the hydrophobed titanium oxide/copolymerized polyamide at a weight ratio of 3/1 in the solvent mixture of methanol/1-propanol/toluene with a weight ratio of 7/1/2 and having a solid content of 18.0 weight %

For the coating liquid 6-A for forming an undercoat layer, the rate of a change in viscosity during storage at room temperature for 120 days (the value obtained by dividing the difference of viscosities at the manufacturing and after storage for 120 days by the viscosity at the manufacturing) and the particle size distribution of titanium oxide at the manufacturing were measured. The viscosity was measured by a method in accordance with JIS Z 8803 using an E-type viscometer (Product name: ED, manufactured by Tokimec Inc.). The particle size distribution was measured with the UPA. The results are shown in Table 2. The particle size distribution was measured at 25° C. with a particle size analyzer (product name: MICROTRAC UPA U150, model: 9230, manufactured by Leeds & Northrup Co.) after dilution with a solvent mixture of methanol/1-propanol=7/3 (weight ratio) such that the sample concentration index (signal level) ranged from 0.6 to 0.8.

From the particle size distribution obtained in this measurement, the average particle diameter (hereinafter, optionally, referred to as "average particle diameter based on Equation (A)") was calculated by the following Equation (A):

[Expression 2]

$$Mv = \frac{\sum (n \cdot v \cdot d)}{\sum (n \cdot v)} \qquad \text{Expression (A)}$$

Furthermore, the number average diameter Mp; the volume median diameter which was the particle diameter at a point of 50% in a cumulative curve (i.e., the volume average particle diameter Mv) when the cumulative curve was defined from the minimum particle size where the total volume of the titanium oxide particles was 100%,; and the 90% cumulative particle diameter D90 which was the particle size at a point of 90% in the cumulative curve were measured. The results are shown in Table 16.

This coating liquid 6-A was diluted with a solvent mixture of methanol/1-propanol=7/3 (weight ratio) such that the solid content was 0.015 weight % (metal oxide particle concentration: 0.011 weight %), and the difference in absorbance of the resulting dispersion at a wavelength of 400 nm and a wavelength of 1000 nm was measured with an ultraviolet and visible spectrophotometer (UV-1650PC, manufactured by Shimadzu Corp.). The absorbance difference was 0.688 (Abs).

The undercoat layer of the coating liquid 6-A formed on an electroconductive support was evaluated for the ratio of reflection as follows:

The coating liquid 6-A was applied to an aluminum tube (extruded mirror surface tube, a cut tube with a cut pitch of 0.6 mm, or a cut tube with a cut pitch of 0.95 mm) having an outer diameter of 30 mm, a length of 250 mm, and a thickness of 0.8 mm to form an undercoat layer having a dried thickness of 2 μm.

The reflectance of the undercoat layer to light of 480 nm was measured with a multispectrophotometer (MCPD-3000, manufactured by Otsuka Electronics Co., Ltd.). A halogen lamp was used as a light source, and the light source and the tip of a fiber-optic cable mounted on a detector were arranged at a position apart from the surface of the undercoat layer by 2 mm in the vertical direction. The surface of the undercoat layer was irradiated with light from the direction perpendicular to the surface, and reflected light in the opposite direction on the same axis was detected. The light reflected from the surface of a cut aluminum tube without the undercoat layer was measured, and this reflectance was defined as 100%. The light reflected from the surface of the undercoat layer was measured, and the ratio of this value to the above value was defined as regular reflection rate (%). The regular reflection rate of the extruded mirror surface tube was 57.4%, that of the cut tube with a cut pitch of 0.6 mm was 57.3%, and that of the cut tube with a cut pitch of 0.95 mm was 57.8%.

Example 6-2

A coating liquid 6-B for forming an undercoat layer of an electrophotographic photoreceptor was prepared using the surface-treated titanium oxide described in Example 6-1 and silica (KEP-30, manufactured by Nippon Shokubai Co., Ltd.) with an average primary particle diameter of 300 nm at titanium oxide/silica=4/3 (weight ratio), as a metal oxide particle composition instead of the surface-treated titanium oxide used in Example 6-1. The coating liquid 6-B finally contained the metal oxide particle composition/copolymerized polyamide at a weight ratio of 3/1 in the solvent mixture of methanol/1-propanol/toluene with a weight ratio of 7/1/2 and having a solid content of 18.0%. The physical properties of this coating liquid 6-B for forming an undercoat layer were measured as in Example 6-1. The results are shown in Table 16.

Comparative Example 6-1

A coating liquid 6-C for forming an undercoat layer of an electrophotographic photoreceptor was prepared as in Example 6-1 except that an Ultra Apex Mill (model UAM-015, manufactured by Kotobuki Industries Co., Ltd.) having a liquid-contacting portion made of SUS304 stainless steel was used instead of the mill described in Example 6-1. The physical properties of this coating liquid 6-C for forming an undercoat layer were measured as in Example 6-1. The results are shown in Table 16.

TABLE 16

[Physical properties of coating liquid for forming undercoat layer]

| | Coating liquid | Rate of change in viscosity | Average particle diameter by Equation (A) | Number average diameter Mp | Volume average particle diameter Mv | 90% cumulative particle diameter D90 |
|---|---|---|---|---|---|---|
| Example 6-1 | 6-A | 2% increment | 0.085 μm | 0.063 μm | 0.08 μm | 0.13 μm |
| Example 6-2 | 6-B | 4% increment | 0.082 μm | 0.062 μm | 0.08 μm | 0.12 μm |
| Comparative Example 6-1 | 6-C | 39% increment | 0.133 μm | 0.090 μm | 0.13 μm | 0.55 μm |

Example 6-3

The coating liquid 6-A prepared in Example 6-1 was applied to a cut aluminum tube having an outer diameter of 24 mm, a length of 236.5 mm, and a thickness of 0.75 mm by dipping to form an undercoat layer having a dried thickness of 2 μm. The surface of this undercoat layer was observed with a scanning electron microscope to confirm substantially no agglomeration. The surface state of this undercoat layer was measured with Micromap manufactured by Ryoka Systems Inc. at a measurement wavelength of 552 nm, at a magnification of objective lens of 40 times, with a measurement area of 190 μm by 148 μm, and with background shape correction (Term) of cylinder with Wave-mode. The in-plane root mean square roughness (RMS) was 43.2 nm, the in-plane arithmetic mean roughness (Ra) was 30.7 nm, and the in-plane maximum roughness (P-V) was 744 nm.

A coating liquid for forming a charge-generating layer was prepared as in Example 3-6. This coating liquid for forming a charge-generating layer was applied on the undercoat layer by dipping to form a charge-generating layer having a dried thickness of 0.4 μm.

Then, a charge-transporting layer was formed on this charge-generating layer as in Example 3-6 to produce an electrophotographic photoreceptor. This electrophotographic photoreceptor was used as electrophotographic photoreceptor 6-P1.

In order to evaluate resistance to dielectric breakdown of the electrophotographic photoreceptor 6-P1, time until the occurrence of dielectric breakdown was measured as in Example 3-6. The results are shown in Table 17.

Furthermore, the surface potential VL(NN) under the NN circumstances and the surface potential VL(LL) under the LL circumstances were measured as in Example 3-6. The results are shown in Table 17.

Example 6-4

An electrophotographic photoreceptor 6-P2 was produced as in Example 6-3 except that the coating liquid 6-B described in Example 6-2 was used as the coating liquid for forming an undercoat layer. The surface of the undercoat layer was observed with a scanning electron microscope as in Example 6-3 to confirm substantially no agglomeration. Furthermore, the electrophotographic photoreceptor 6-P2 was evaluated as in Example 6-3. The results are shown in Table 17.

Comparative Example 6-2

An electrophotographic photoreceptor 6-P3 was produced as in Example 6-3 except that the coating liquid 6-C described in Comparative Example 6-1 was used as the coating liquid for forming an undercoat layer. The surface of the undercoat layer was observed with a scanning electron microscope as in Example 6-3 to confirm a large number of agglomerations and coarse metal particles. Furthermore, the electrophotographic photoreceptor 6-P3 was evaluated as in Example 6-3. The results are shown in Table 17.

TABLE 17

| | Electro-photographic photoreceptor | VL (NN) | VL (LL) | Time until dielectric breakdown |
|---|---|---|---|---|
| Example 6-3 | 6-P1 | −30 V | −60 V | 9 minutes |
| Example 6-4 | 6-P2 | −35 V | −71 V | 14 minutes |
| Comparative Example 6-2 | 6-P3 | not charged | not charged | — |

The photoreceptors 6-P1 and 6-P2 produced in Examples 6-3 and 6-4, respectively, exhibit satisfactory electric characteristics (VL under NN circumstances and under LL circumstances) and leakage resistance (time until dielectric breakdown), where the photoreceptor produced in Comparative Example 6-2 does not exhibit a blocking function as an undercoat layer at all.

Example 6-5

The coating liquid 6-A prepared in Example 6-1 was applied to a cut aluminum tube having an outer diameter of 30 mm, a length of 285 mm, and a thickness of 0.8 mm by dipping as the coating liquid for forming an undercoat layer having a dried thickness of 2.4 μm. The surface of this undercoat layer was observed with a scanning electron microscope to confirm substantially no agglomeration.

This undercoat layer (94.2 $cm^2$) was immersed in a solvent mixture of 70 g of methanol and 30 g of 1-propanol and was sonicated with an ultrasonic oscillator at an output of 600 W for 5 minutes to prepare an undercoat layer dispersion. The particle size distribution of the metal oxide particles in the dispersion was evaluated as in Example 6-1. The volume median diameter (i.e., volume average particle diameter Mv) was 0.078 μm. and the 90% cumulative particle diameter was 0.108 μm.

A coating liquid for forming a charge-generating layer prepared as in Example 6-3 was applied onto the undercoat layer by dipping to form a change-generating layer having a dried thickness of 0.4 μm.

Then, a charge-transporting layer was formed on the charge-generating layer as in Example 3-9 to produce an electrophotographic photoreceptor 6-P4.

The photosensitive layer (94.2 $cm^2$) of this electrophotographic photoreceptor was removed by dissolving the layer in 100 $cm^3$ of tetrahydrofuran by sonication with an ultrasonic oscillator at an output of 600 W for 5 minutes, and then the photoreceptor after the sonication treatment was immersed in a solvent mixture of 70 g of methanol and 30 g of 1-propanol was sonicated with an ultrasonic oscillator at an output of 600 W for 5 minutes to give an undercoat layer dispersion. The particle size distribution of the metal oxide agglomeration secondary particles in the dispersion was measured as in Example 6-1. The volume average particle diameter was 0.079 μm, and the 90% cumulative particle diameter was 0.124 μm.

The produced photoreceptor was mounted in a cartridge of a color printer (product name: InterColor LP-1500C, manufactured by Seiko Epson Corp.) to form a full-color image. The printed image was satisfactory. The number of small color spots observed in 1.6 cm square in the image is shown in Table 18.

The coating liquid 6-A for forming an undercoat layer was stored for 3 months. An electrophotographic photoreceptor was similarly produced using the coating liquid stored for 3 months, and a full-color image was formed. The number of small color spots observed in 1.6 cm square in the formed image is shown in Table 18 as image defects after 3 months of storage.

The electrophotographic photoreceptor of the present invention has satisfactory photoreceptive characteristics and high resistance to dielectric breakdown with less image defects such as color spots, thus exhibiting significantly excellent performance.

TABLE 18

[Image evaluation by image-forming apparatus]

| | Electro-photographic photoreceptor | Thickness of undercoat layer | Image defect (small color spot) | Image defect after 3 months (small color spot) |
|---|---|---|---|---|
| Example 6-5 | 6-P4 | 2.4 μm | 11 | 9 |

Example 6-6

An electrophotographic photoreceptor 6-P5 was produced as in Example 3-12 except that the coating liquid 6-A for forming an undercoat layer was used as the coating liquid for forming an undercoat layer.

Electric characteristics of the electrophotographic photoreceptors produced above were evaluated by the cycle of charging, exposure, potential measurement, and neutralization as in Example 3-12.

The initial charging potential was −708 V, and the sensitivity E1/2 was 3.288 μJ/$cm^2$. A larger value in the initial charging potential (a larger absolute value of the potential) represents a better charging property, and a lower value in the sensitivity represents a higher sensitivity. The electrophotographic photoreceptor of the present invention was excellent in the sensitivity for monochromatic exposure light of 350 to 600 nm.

Example Group 7

Example 7-1

One kilogram of raw material slurry composed of a mixture of 50 parts of aluminum oxide having an average primary particle diameter of 13 nm (Aluminium Oxide C, manufactured by Degussa AG) and 120 parts of methanol was subjected to dispersion treatment for 2 hours with zirconia beads having a diameter of about 50 μm (YTZ, manufactured by Nikkato Corp.) as a dispersion medium and an Ultra Apex Mill (model UAM-015, manufactured by Kotobuki Industries Co., Ltd.) having a mill capacity of about 0.15 L under liquid circulation conditions of a rotor peripheral velocity of 10 m/sec and a liquid flow rate of 10 kg/h to give an aluminum oxide dispersion. In a portion in contact with liquid of to the Ultra Apex Mill, the internal liner of a stator was made of zirconia toughened alumina (ZTA) having a Young's modulus of 240 GPa at 20° C., upper and lower covers of the stator, a separator, and a rotor were made of high-density polyethylene having a flexural modulus of 1000 MPa that was measured in accordance with JIS K 7171 1994 under conditions of a temperature of 23° C.±2° C. and a relative humidity of 50%±10%.

The aluminum oxide dispersion, a solvent mixture of methanol/1-propanol/toluene, and a pelletized copolymerized polyamide composed of ∈-caprolactam [compound represented by Formula (A)]/bis(4-amino-3-methylcyclohexyl) methane [compound represented by Formula (B)]/hexamethylene diamine [compound represented by Formula (C)]/decamethylenedicarboxylic acid [compound represented by Formula (D)]/octadecamethylenedicarboxylic acid [compound represented by Formula (E)] at a molar ratio of 60%/15%/5%/15%/5%, which is described in Example of Japanese Unexamined Patent Application Publication No. HEI 4-31870, were mixed with agitation under heat to dissolve the pelletized polyamide. The resulting mixture was subjected to ultrasonic dispersion treatment with an ultrasonic oscillator for 1 hour at a frequency of 25 kHz and an output of 1200 W and then filtered through a PTFE membrane filter with a pore size of 5 μm (Mitex LC manufactured by Advantech Co., Ltd.) to give a coating liquid 7-A for forming an undercoat layer for an electrophotographic photoreceptor containing aluminum oxide/copolymerized polyamide at a weight ratio of 1/1 in methanol/1-propanol/toluene with a weight ratio of 7/1/2 and having a solid content of 18.0%.

The particle size distribution of the aluminum oxide was measured immediately after the coating liquid 7-A for forming an undercoat layer was produced. The particle size distribution was measured at 25° C. with a particle size analyzer (product name: MICROTRAC UPA U150, model: 9230, manufactured by Leeds & Northrup Co.) after dilution with a solvent mixture of methanol/1-propanol=7/3 (weight ratio) such that the sample concentration index (SIGNAL LEVEL) ranged from 0.6 to 0.8. From the measured particle size distribution, the average particle diameter calculated by Equation (A), the number average diameter Mp, the volume median diameter (i.e., the volume average particle diameter Mv) which was the particle diameter at a point of 50% in a cumulative curve that was defined from the minimum particle size where the total volume of the titanium oxide particles was 100%, and the 90% cumulative particle diameter which was the particle size at a point of 90% in the cumulative curve were measured. The results are shown in Table 19.

This coating liquid 7-A was diluted with a solvent mixture of methanol/1-propanol=7/3 (weight ratio) such that the solid content was 0.015 weight % (metal oxide particle concentration: 0.0075 weight %), and the difference in absorbance of the diluted dispersion at a wavelength of 400 nm and a wavelength of 1000 nm was measured with an ultraviolet and visible spectrophotometer (UV-1650PC, manufactured by Shimadzu Corp.). The absorbance difference was 0.014 (Abs).

The ratio of regular reflection rate of the undercoat layer formed on an electroconductive support using the coating liquid 7-A was evaluated as in Example 6-1.

As the result, the extruded mirror surface tube had a regular reflection rate of 64.6%, the cut tube with a cut pitch of 0.6 mm had that of 65.4% in, and the cut tube with a cut pitch of 0.95 mm had that of 57.2%.

Example 7-2

A coating liquid 7-B for forming an undercoat layer for an electrophotographic photoreceptor was prepared as in Example 7-1 except that polyurethane having a flexural modulus of 780 MPa was used instead of the high-density polyethylene used in Example 7-1. Physical properties of this coating liquid 7-B for forming an undercoat layer were measured as in Example 7-1. The results are shown in Table 19.

TABLE 19

[Physical properties of coating liquid for forming undercoat layer]

| | Coating liquid | Rate of change in viscosity | Average particle diameter by Equation (A) | Number average diameter Mp | Volume average particle diameter Mv | 90% cumulative particle diameter |
|---|---|---|---|---|---|---|
| Example 7-1 | 7-A | 2% increment | 0.084 μm | 0.062 μm | 0.09 μm | 0.15 μm |
| Example 7-2 | 7-B | 2% increment | 0.082 μm | 0.062 μm | 0.08 μm | 0.14 μm |

The ratios of zirconia mixed in the coating liquids 7-A and 7-B were measured by the following process:

Preparation of Samples

An appropriate amount of each of the coating liquids 7-A and 7-B was put on an ashing plate, and the ashing plate was heated on a hot plate to evaporate the solvent. The remainder was ground with a pestle into a powder, and 0.08 g of the powder was weighed with a balance and was shaped into a tablet sample.

Preparation of Standard

A standard sample containing about 1% Zr was prepared by mixing zirconia beads and a titanium oxide powder. About 0.01 g of the zirconia beads was weighed with a balance. Titania powder was added to the zirconia beads to the total amount of about 1 g, and 0.08 g of the resulting mixture was weighed with a balance and was compressed into a tablet sample.

Measurement Conditions

The measurement was conducted with Rigaku ZSK100e using an Rhl target. In Al-KA, the tube voltage was 50 kV, the tube current was 120 mA, the analyzing crystal was PET, and the detector was PC. In Zr-KA, the tube voltage was 30 kV, the tube current was 120 mA, the analyzing crystal was LiF1, and the detector was SC. The mix rate of zirconia was 0% in both Examples 7-1 and 7-2.

Example 7-3

The coating liquid 7-A prepared in Example 7-1 was applied to a cut aluminum tube having an outer diameter of 24 mm, a length of 236.5 mm, and a thickness of 0.75 mm by dipping to form an undercoat layer with a dried thickness of 2 μm. The surface of the undercoat layer was observed by a scanning electron microscope to confirm substantially no agglomeration.

A coating liquid for forming a charge-generating layer was prepared as in Example 3-6. This coating liquid for forming a charge-generating layer was applied onto the undercoat layer by dipping to form a charge-generating layer having a dried thickness of 0.4 μm.

Then, a charge-transporting layer was formed on this charge-generating layer as in Example 3-6 to produce an electrophotographic photoreceptor. This electrophotographic photoreceptor was used as an electrophotographic photoreceptor 7-P1.

In order to evaluate the resistance to dielectric breakdown of the photoreceptor 7-P1, time until the occurrence of dielectric breakdown was measured as in Example 3-6. The results are shown in Table 20.

The surface potential VL(NN) under the NN circumstances and the surface potential VL(LL) under the LL circumstances of the photoreceptor were measured as in Example 3-6. The results are shown in Table 20.

Example 4

An electrophotographic photoreceptor 7-P2 was produced as in Example 7-3 except that the coating liquid 7-B described in Example 7-2 was used as the coating liquid for forming an undercoat layer. The surface of the undercoat layer was observed with a scanning electron microscope as in Example 7-3 to confirm substantially no agglomeration. The electrophotographic photoreceptor 7-P2 was evaluated as in Example 7-3, and the results are shown in Table 20.

TABLE 20

| | Electrophotographic photoreceptor | VL (NN) | VL (LL) | Time until dielectric breakdown |
|---|---|---|---|---|
| Example 7-3 | 7-P1 | −30 V | −60 V | 9 minutes |
| Example 7-4 | 7-P2 | −31 V | −61 V | 9 minutes |

The photoreceptors 7-P1 and 7-P2 produced in Examples 7-3 and 7-4, respectively, were satisfactory in both electric characteristics (VL under NN circumstances and under LL circumstances) and leakage resistance (time until the occurrence of dielectric breakdown).

Example 7-5

The coating liquid 7-A prepared in Example 7-1 was applied to a cut aluminum tube having an outer diameter of 30 mm, a length of 285 mm, and a thickness of 0.8 mm by dipping to form an undercoat layer with a dried thickness of 2.4 μm. The surface of the undercoat layer was observed by a scanning electron microscope to confirm substantially no agglomeration.

The undercoat layer (94.2 $cm^2$) was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured as in Example 7-1. The volume median diameter (i.e., volume average particle diameter Mv) was 0.09 μm, and the 90% cumulative particle diameter was 0.14 μm.

The coating liquid for forming a charge-generating layer prepared as in Example 7-3 was applied on the undercoat layer by dipping to form a charge-generating layer having a dried thickness of 0.4 μm.

Then, a charge-transporting layer was formed on the charge-generating layer as in Example 3-9 to produce an electrophotographic photoreceptor 7-P4.

The photosensitive layer (94.2 $cm^2$) of this electrophotographic photoreceptor was removed by dissolving the layer in 100 $cm^3$ of tetrahydrofuran by sonication with an ultrasonic oscillator at an output of 600 W for 5 minutes, and then the photoreceptor after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide agglomeration secondary particles in the dispersion was measured as in Example 7-1. The volume average particle diameter was 0.09 μm, and the 90% cumulative particle diameter was 0.14 μm.

The produced photoreceptor was mounted in a cartridge of a color printer (product name: InterColor LP-1500C, manufactured by Seiko Epson Corp.) to form a full-color image. The printed image was satisfactory. The number of small color spots observed in 1.6 cm square in the image is shown in Table 21.

The coating liquid 7-A for forming an undercoat layer was stored for 3 months. An electrophotographic photoreceptor was similarly produced using the coating liquid stored for 3 months, and a full-color image was formed. The number of small color spots observed in 1.6 cm square in the formed image is shown in Table 21 as image defects after 3 months storage.

The electrophotographic photoreceptor of the present invention had satisfactory photoreceptive characteristics and high resistance to dielectric breakdown and had low image defects such as color spots, thus exhibiting significantly excellent performance.

TABLE 21

[Image evaluation by image-forming apparatus]

| | Electro-photographic photoreceptor | Thickness of undercoat layer | Image defect (small color spot) | Image defect after 3 months (small color spot) |
|---|---|---|---|---|
| Example 7-5 | 7-P4 | 2.4 μm | 10 | 7 |

Example 7-6

An electrophotographic photoreceptor 7-P5 was produced as in Example 3-12 except that the coating liquid 7-A for forming an undercoat layer was used as the coating liquid for forming an undercoat layer.

The electric characteristics of the electrophotographic photoreceptor produced were evaluated as in Example 3-12 through cycles of charging, exposure, potential measurement, and neutralization.

As a result, the initial charging potential was −708 V, and the sensitivity E1/2 was 3.288 μJ/$cm^2$. A larger value in the initial charging potential (a larger absolute value of the potential) represents a better charging property, and a lower value in the sensitivity represents a higher sensitivity. The electrophotographic photoreceptor of the present invention exhibited excellent sensitivity to monochromatic exposure light of 350 to 600 nm.

Example Group 8

Manufacturing Example 8-1

A coating liquid 8-A for forming an undercoat layer that is identical to the coating liquid 1-A for forming an undercoat layer was prepared as in Example 1-1.

The particle size distribution of this coating liquid 8-A for forming an undercoat layer was measured with the UPA, and the results are shown in Table 22.

This coating liquid 8-A for forming an undercoat layer was applied to a non-anodized aluminum cylinder (outer diameter: 30 mm, length: 375.8 mm, thickness: 0.75 mm) by dipping to form an undercoat layer with a dried thickness of 1.5 μm.

A charge-generating layer was formed on this undercoat layer as in Manufacturing Example 5-1.

Then, a charge-transporting layer was formed on the charge-generating layer as in Example 1-1 to produce a photoreceptor drum 8-A1 having a laminated photosensitive layer.

Manufacturing Example 8-2

A coating liquid 8-B for forming an undercoat layer was prepared as in Manufacturing Example 8-1 except that zirconia beads having a diameter of about 50 μm (YTZ, manufactured by Nikkato Corp.) as the dispersion medium used for dispersion with an Ultra Apex Mill. The physical properties were measured as in Manufacturing Example 8-1. The results are shown in Table 22.

The coating liquid 8-B for forming an undercoat layer was applied to a non-anodized aluminum cylinder (outer diameter: 30 mm, length: 375.8 mm, thickness: 1.0 mm) by dipping to form an undercoat layer with a dried thickness of 1.5 μm.

The undercoat layer (94.2 $cm^2$) was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured as in Example 8-1 with the UPA. The volume average particle diameter was 0.08 μm, and the 90% cumulative particle diameter was 0.12 μm.

A charge-generating layer and a charge-transporting layer were formed on the undercoat layer as in Manufacturing Example 8-1 to produce a photoreceptor 8-B1.

The photosensitive layer (94.2 $cm^2$) of the photoreceptor 8-B1 was removed by dissolving the layer in 100 $cm^3$ of tetrahydrofuran by sonication with an ultrasonic oscillator at an output of 600 W for 5 minutes, and then the photoreceptor after the sonication treatment was immersed in a solvent mixture of 70 g of methanol and 30 g of 1-propanol and was sonicated with an ultrasonic oscillator at an output of 600 W for 5 minutes to give an undercoat layer dispersion. The particle size distribution of the metal oxide particles in the dispersion was measured with the UPA as in Manufacturing Example 8-1. The volume average particle diameter was 0.08 μm, and the 90% cumulative particle diameter was 0.12 μm.

The data, shown in Table 22, obtained using a coating liquid for forming an undercoat layer itself were identical to data obtained using a dispersion prepared by dispersing the undercoat layer formed with a coating liquid in a solvent mixture of methanol and 1-propanol with a weight ratio of 7:3 or data obtained using a dispersion prepared by removing a photosensitive layer from an electrophotographic photoreceptor and dispersing the undercoat layer formed with a coating liquid in a solvent mixture of methanol and 1-propanol with a weight ratio of 7:3.

Manufacturing Example 8-3

A coating liquid 8-C for forming an undercoat layer was prepared as in Manufacturing Example 8-2 except that the rotor peripheral velocity for dispersion with an Ultra Apex Mill was 12 m/sec. The physical properties were measured as in Manufacturing Example 8-1. The results are shown in Table 22.

A photoreceptor 8-C1 was produced as in Manufacturing Example 8-1 except that the coating liquid 8-C for forming an undercoat layer was used.

Comparative Manufacturing Example 8-1

A coating liquid 8-D for forming an undercoat layer that was identical to the coating liquid 5-D for forming an undercoat layer was prepared as in Comparative Manufacturing Example 5-1.

A photoreceptor 8-D1 was produced as in Manufacturing Example 8-1 except that the coating liquid 8-D for forming an undercoat layer was used. A photoreceptor 8-D2 was produced as in the photoreceptor 8-D1 except that the length of the aluminum cylinder was 351 mm.

TABLE 22

| | Coating liquid | Medium | Diameter of medium | Peripheral velocity of rotor | Volume average particle diameter (μm) | 90% cumulative particle diameter (μm) |
|---|---|---|---|---|---|---|
| Manufacturing Example 8-1 | 8-A | zirconia | 100 μm | 10 m/s | 0.09 | 0.13 |
| Manufacturing Example 8-2 | 8-B | zirconia | 50 μm | 10 m/s | 0.08 | 0.12 |
| Manufacturing Example 8-3 | 8-C | zirconia | 50 μm | 12 m/s | 0.08 | 0.11 |
| Comparative Manufacturing Example 8-1 | 8-D | alumina | 5 mm | — | 0.13 | 0.21 |

[Evaluation of Electric Characteristics]

Electric characteristics (sensitivity (E1/2) and surface potential after exposure treatment (VL: corresponding to VL1 in Examples 1-1 to 1-9 and Comparative Example 1-1)) of the electrophotographic photoreceptors 8-A1 to 8-D1 and 8-D2 produced in Manufacturing Examples 8-1 to 8-3 and Comparative Manufacturing Example 8-1 were evaluated as in Examples 1-1 to 1-9 and Comparative Example 1-1. The photoreceptor 8-D2 had the same layer structure as that of the photoreceptor 8-D1, and the measurement values were the same as those of the photoreceptor 8-D2. The results are shown in Table 23.

TABLE 23

| | Photoreceptor | Specification of photoreceptor | | Electric characteristics | |
|---|---|---|---|---|---|
| | | Photosensitive layer | Coating liquid for forming undercoat layer | E½ (μJ/cm²) | VL (−V) |
| Manufacturing Example 8-1 | 8-A1 | Identical | 8-A | 0.091 | 61 |
| Manufacturing Example 8-2 | 8-B1 | | 8-B | 0.092 | 66 |
| Manufacturing Example 8-3 | 8-C1 | | 8-C | 0.100 | 70 |
| Comparative Manufacturing Example 8-1 | 8-D1 | | 8-D | 0.095 | 70 |

The results shown in Table 23 elucidate that all photoreceptors in Manufacturing Examples and Comparative Manufacturing Example exhibited satisfactory initial electric characteristics and there were no differences in the initial electric characteristics.

[Production of Toner for Development]

Preparation of Wax-Long Chain Polymerizable Monomer Dispersion T1

Twenty seven parts (540 g) of paraffin wax (HNP-9, manufactured by Nippon Seiro Co., Ltd., surface tension: 23.5 mN/m, melting point: 82° C., heat of fusion: 220 J/g, half value width of fusion peak: 8.2° C., half value width of crystallization peak: 13.0° C.), 2.8 parts of stearyl acrylate (manufactured by Tokyo Kasei Kogyo Co., Ltd.), 1.9 parts of a 20 weight % sodium dodecylbenzenesulfonate aqueous solution (Neogen S20A, manufactured by Daiichi Industries, Ltd., hereinafter, optionally, abbreviated as "20% DBS aqueous solution"), and 68.3 parts of desalted water were heated to 90° C. and were agitated with a homomixer (model: Mark II f, manufactured by Tokusyu Kika Kogyo Co., Ltd.) at a rate of 8000 rpm for 10 minutes.

Then, the resulting dispersion was heated to 90° C., and circulation emulsification with a homogenizer (model: 15-M-8PA, manufactured by Gaulin) was initiated under a pressure of about 25 MPa. While the volume average particle diameter was measured with an UPA-EX, the dispersion was continued to a volume average particle diameter of 250 nm in order to prepare a wax-long chain polymerizable monomer dispersion T1 (solid content of the emulsion=30.2 weight %).

Preparation of Silicone Wax Dispersion T2

Twenty seven parts (540 g) of an alkyl-modified silicone wax (melting point: 72° C.), 1.9 parts of a 20% DBS aqueous solution, and 71.1 parts of desalted water were put in a 3L stainless steel container and were heated to 90° C. and agitated with a homomixer (model: Mark II f, manufactured by Tokusyu Kika Kogyo Co., Ltd.) at a rate of 8000 rpm for 10 minutes.

Then, the resulting dispersion was heated to 99° C., and circulation emulsification with a homogenizer (model: 15-M-8PA, manufactured by Gaulin) was initiated under a pressure of about 45 MPa, and while measuring the volume average particle diameter with an UPA-EX, dispersion was continued to a volume average particle diameter of 240 nm to prepare a silicone wax dispersion T2 (solid content of the emulsion=27.4 weight %).

Preparation of Polymer Primary Particle Dispersion T1

Into a reactor (internal capacity: 21 liters, internal diameter: 250 mm, height: 420 mm) equipped with an agitator (three blades), a heater/cooler, a concentrator, and a device for charging various raw materials and additives, 35.6 parts by weight (712.12 g) of the wax-long chain polymerizable monomer dispersion T1 and 259 parts of desalted water were charged and heated to 90° C. under a nitrogen stream with agitation at a rate of 103 rpm.

Thereafter, a mixture of the following monomers and an emulsifier aqueous solution was added to the resulting mixture over a period of 5 hours from the initiation of the polymerization, where the initiation of the polymerization was defined as the starting time of the dropwise addition of the mixture of the monomers and the emulsifier aqueous solution. Thirty minutes after the initiation of the polymerization, the following initiator aqueous solution was added over a period of 4.5 hours. Furthermore, 5 hours after the initiation of the polymerization, the following initiator aqueous solution was added over a period of 2 hours, and the polymerization was continued at a rate of 103 rpm at an internal temperature of 90° C. for further 1 hour.

[Monomers]

Styrene: 76.8 parts (1535.0 g)
Butyl acrylate: 23.2 parts
Acrylic acid: 1.5 parts
Trichlorobromomethane: 1.0 part
Hexanediol diacrylate: 0.7 part

[Emulsifier Aqueous Solution]

20% DBS aqueous solution: 1.0 part
Desalted water: 67.1 parts

[Initiator Aqueous Solution]

8% Hydrogen peroxide aqueous solution: 15.5 parts
8% L(+)-Ascorbic acid aqueous solution: 15.5 parts

[Additional Initiator Aqueous Solution]

8% L(+)-Ascorbic acid aqueous solution: 14.2 parts

After completion of the polymerization reaction, the reaction system was cooled to obtain a milky white polymer primary particle dispersion T1. The volume average particle diameter measured with an UPA-EX was 280 nm, and the solid content was 21.1 weight %.

Preparation of Polymer Primary Particle Dispersion T2

Into a reactor (internal capacity: 21 liters, internal diameter: 250 mm, height: 420 mm) equipped with an agitator (three blades), a heater/cooler, a concentrator, and a device for charging various raw materials and additives, 23.6 parts by weight (472.3 g) of the silicone wax dispersion T2, 1.5 parts by weight of a 20% DBS aqueous solution, and 324 parts of desalted water were charged and heated to 90° C. under a nitrogen stream, and 3.2 parts of an 8% hydrogen peroxide aqueous solution and 3.2 parts of an 8% L(+)-ascorbic acid aqueous solution were simultaneously added thereto with agitation at a rate of 103 rpm.

Five minutes after the addition, a mixture of the following monomers and an emulsifier aqueous solution was added thereto over 5 hours since the initiation of the polymerization (5 minutes after the simultaneous addition of 3.2 parts of the 8% hydrogen peroxide aqueous solution and 3.2 parts of the 8% L(+)-ascorbic acid aqueous solution), and the following initiator aqueous solution was further added over 6 hours since the initiation of the polymerization, and the polymerization was further continued at a rate of 103 rpm at an internal temperature of 90° C. for 1 hour.

[Monomers]

Styrene: 92.5 parts (1850.0 g)

Butyl acrylate: 7.5 parts

Acrylic acid: 1.5 parts

Trichlorobromomethane: 0.6 part

[Emulsifier Aqueous Solution]

20% DBS aqueous solution: 1.5 parts

Desalted water: 66.2 parts

[Initiator Aqueous Solution]

8% Hydrogen peroxide aqueous solution: 18.9 parts

8% L(+)-Ascorbic acid aqueous solution: 18.9 parts

After completion of the polymerization reaction, the reaction system was cooled to obtain a milky white polymer primary particle dispersion T2. The volume average particle diameter measured with an UPA-EX was 290 nm, and the solid content was 19.0 weight %.

Preparation of Colorant Dispersion T

Into a container having an internal capacity of 300 L and equipped with an agitator (propeller blade), 20 parts (40 kg) of carbon black (Mitsubishi Carbon Black MA100S, manufactured by Mitsubishi Chemical Corp.) that was prepared by a furnace process and had an ultraviolet absorption of 0.02 in a toluene extract and a true density of 1.8 g/cm$^3$, 1 part of a 20% DBS aqueous solution, 4 parts of a nonionic surfactant (Emargen 120, manufactured by Kao Corp.), and 75 parts of deionized water having an electric conductivity of 2 μS/cm were charged for predispersion to give a pigment premix liquid. The electric conductivity was measured with a conductometer (Personal SC meter model SC72 with a detector SC72SN-11, manufactured by Yokogawa Corp.).

The 50% volume cumulative diameter $Dv_{50}$ of the carbon black in the dispersion after the premix was about 90 μm. The premix liquid was supplied to a wet bead mill as raw material slurry for one-pass dispersion. The stator had an internal diameter of ϕ75 mm, the separator had a diameter of ϕ 60 mm, and the distance between the separator and the disk was 15 mm. The medium for dispersion was zirconia beads (true density: 6.0 g/cm$^3$) with a diameter of 50 μm. Since the stator having an effective internal capacity of about 0.5 L was filled with 0.35 L of the medium, the filling rate of the medium was 70%. The rotation velocity of the rotor was maintained constant (the peripheral velocity at the rotor end: about 11 m/sec), and the remix slurry was continuously supplied to the mill at a supply rate of about 50 L/hr from a supply port with a non-pulsing metering pump and was continuously discharged from a discharging port to give a black colorant dispersion T. The volume average particle diameter measured with an UPA-EX was 150 nm, and the solid content was 24.2 weight %.

Preparation of Mother Particles T for Development

Polymer primary particle dispersion T1: 95 parts as solid components (998.2 g as solid components)

Polymer primary particle dispersion T2: 5 parts as solid components

Colorant microparticle dispersion T: 6 parts as colorant solid components

20% DBS aqueous solution: 0.1 part as solid components

Toner was produced using these components by the following process:

The polymer primary particle dispersion T1 and the 20% DBS aqueous solution were charged in a mixer (capacity: 12 liters, internal diameter: 208 mm, height: 355 mm) equipped with an agitator (double helical blade), a heater/cooler, a concentrator, and a device for charging various raw materials and additives and were mixed at an internal temperature of 12° C. at a rate of 40 rpm for 5 minutes into a homogeneous mixture. Subsequently, a 5% ferrous sulfate aqueous solution (0.52 part as $FeSO_4.7H_2O$) was added to the mixture at an internal temperature of 12° C. at a rate 250 rpm over 5 minutes, and then the colorant microparticle dispersion T was added thereto over 5 minutes. The resulting mixture was continuously mixed at an internal temperature of 12° C. at a rate of 250 rpm into a homogeneous mixture, and a 0.5% aluminum sulfate aqueous solution (0.10 part of solid components on the basis of the resin solid components) was dropwise added thereto under the same conditions. Then, under a rate of 250 rpm, the internal temperature was increased up to 53° C. over 75 minutes and then was increased up to 56° C. over 170 minutes.

The particle diameter was measured with a precise particle size distribution measuring device (Multisizer III, manufactured by Beckman Coulter Inc.; hereinafter, optionally, abbreviated to "Multisizer") with a 100 μm aperture diameter. The 50% volume diameter was 6.7 μm.

Then, at a rate of 250 rpm, the polymer primary particle dispersion T2 was added thereto over 3 minutes. The resulting mixture was continuously stirred under the same conditions for 60 minutes. The rotation speed was decreased to 168 rpm, and immediately after reduction of the rotation speed, the 20% DBS aqueous solution (6 parts as solid components) was added thereto over 10 minutes. The resulting mixture was heated to 90° C. under a rate of 168 rpm over 30 minutes and was maintained at this temperature for 60 minutes.

Then, the mixture was cooled to 30° C. over 20 minutes, and the resulting slurry was extracted and was filtered by suction with an aspirator through a filter paper No. SC (manufactured by Toyo Roshi Co., Ltd.). The cake remaining on the filter paper was transferred to a stainless steel container having an internal capacity of 10 L and equipped with an agitator (propeller blade), and 8 kg of deionized water with an electric conductivity of 1 μS/cm was added thereto. The resulting mixture was agitated at a rate of 50 rpm into a homogeneous dispersion and was continuously agitated for further 30 minutes.

Then, the mixture was filtered by suction with an aspirator through a filter paper No. 5C (manufactured by Toyo Roshi Co., Ltd.) again. The solid remaining on the filter paper was transferred to a container having an internal capacity of 10 L, equipped with an agitator (propeller blade), and containing 8 kg of deionized water having an electric conductivity of 1 μS/cm, and the resulting mixture was agitated at a rate of 50 rpm for 30 minutes into a homogeneous dispersion. This process was repeated five times to give a filtrate having an electric conductivity of 2 μS/cm. The electric conductivity was measured with a conductometer (Personal SC meter model SC72 with a detector SC72SN-11, manufactured by Yokogawa Corp.).

The resulting cake was bedded in a stainless steel vat of about 20 mm height and was dried in a fan dryer set at 40° C. for 48 hours to give mother particles T for development.

Preparation of Toner T for Development

One hundred parts (1000 g) of the mother particles T for development were charged in a Henschel mixer having an internal capacity of 10 L (diameter: 230 mm, height: 240 mm) and equipped with an agitator ($Z/A_0$ blade) and a deflector arranged at the upper portion so as to be perpendicular to the wall, and then 0.5 part of silica microparticles hydrophobed with a silicone oil and having a volume average primary particle diameter of 0.04 μm, 2.0 parts of silica microparticles hydrophobed with a silicone oil and having a volume average primary particle diameter of 0.012 μm were added thereto. The resulting mixture was agitated at 3000 rpm for 10 minutes and was then passed through a 150-mesh sieve to give toner T for development. The toner T had a volume average particle diameter of 7.05 μm and a Dv/Dn of 1.14 when it was measured with a Multisizer II, and an average sphericity of 0.963 measured with an FPIA 2000.

[Evaluation of Image]

Example 8-1

The photoreceptor 8-A1 produced in Manufacturing Example 8-1 and the toner T for development were mounted in a black drum cartridge and a black toner cartridge, respectively, of a commercially available tandem-type LED color printer, Microline Pro 9800PS-E (manufactured by Oki Data Corp.) compatible with A3 printing, and the cartridges were loaded in the printer.

Example 8-2

Images were evaluated as in Example 8-1 using the photoreceptor 8-B1 in Manufacturing Example 8-2. The results are shown in Table 24.

Example 8-3

Images were evaluated as in Example 8-1 using the photoreceptor 8-C1 in Manufacturing Example 8-3. The results are shown in Table 24.

Comparative Example 8-1

Images were evaluated as in Example 8-1 using the photoreceptor 8-D1 in Comparative Manufacturing Example 8-1. The results are shown in Table 24.

Comparative Example 8-2

The photoreceptor 8-D2 was mounted in a black drum cartridge of a commercially available color printer, Microline 3050c (manufactured by Oki Data Corp.), and the cartridge was loaded in the printer. As the toner, commercially available toner produced by a melt-kneading pulverization process for this printer was used. The average sphericity of this toner was 0.935. The fog value of a white image and the dot omission of a gradation image were evaluated as in Example 8-1 using this image-forming apparatus. The results are shown in Table 24.

TABLE 24

| | Photoreceptor | Undercoat layer | Average sphericity of toner | Fog value | Corresponding concentration |
|---|---|---|---|---|---|
| Example 8-1 | 8-A1 | 8-A | 0.963 | 0.9 | 0.06 |
| Example 8-2 | 8-B1 | 8-B | 0.963 | 0.9 | 0.06 |
| Example 8-3 | 8-C1 | 8-C | 0.963 | 0.8 | 0.06 |
| Comparative Example 8-1 | 8-D1 | 8-D | 0.963 | 1.3 | 0.11 |
| Comparative Example 8-2 | 8-D2 | 8-D | 0.935 | 0.9 | 0.11 |

With this image-forming apparatus, a white image and a gradation image (test charts of The Imaging Society of Japan) were printed out, and fog value of the white image and dot omission of the gradation image were evaluated. The results are shown in Table 24.

The fog value was determined by measuring the degree of whiteness of paper before the printing with a whiteness meter adjusted such that the degree of whiteness of a standard sample was 94.4, printing full-page white on the paper according to a signal input to the above-mentioned laser printer, and then measuring the degree of whiteness of this paper again to determine the difference in the degree of whitenesses between before and after the printing. A larger difference value represents that the paper after the printing has a large number of small black spots and is blackened, i.e., low image quality.

The gradation image was evaluated by determining the concentration standard printed without dot omission. A smaller concentration value represents better printing that allows printing of a lighter portion.

As shown in Table 24, in the image-forming apparatus using toner with low sphericity produced in Comparative Example 8-2 exhibits a low fog value regardless of the kind of the electrophotographic photoreceptor, but a high concentration for drawing the gradation image, resulting in insufficient resolution.

On the other hand, each of the image-forming apparatuses using toner having an average sphericity of 0.940 or more of Examples 8-1 to 8-3 and Comparative Example 8-1 exhibits a low fog value and sufficient drawing of the gradation image only when the apparatus includes an electrophotographic photoreceptor having the undercoat layer according to the present invention. In Comparative Example 8-1 using the electrophotographic photoreceptor having a conventionally known undercoat layer, fogs readily occur and the resolution is not sufficiently increased. As obvious from the evaluation results of Examples, a photosensitive layer provided on an undercoat layer containing metal oxide particles having a specific particle size distribution can more precisely convert exposure light for recording into a latent image, as in the electrophotographic photoreceptor according to the present invention.

[Industrial Applicability]

The present invention can be applied to any industrial field, in particular, can be preferably applied to, for example, printers, facsimile machines, and copiers of electrophotographic systems.

Although the present invention has been described in detail with reference to certain preferred embodiments, those skilled in the art will recognize that various modifications will be made without departing from the purpose and scope of the present invention.

The present application is based on Japanese Patent Application (Patent Application No. 2006-139534) filed on May 18, 2006, Japanese Patent Application (Patent Application No. 2006-139535) filed on May 18, 2006, Japanese Patent Application (Patent Application No. 2006-138776) filed on May 18, 2006, Japanese Patent Application (Patent Application No. 2006-139537) filed on May 18, 2006, Japanese Patent Application (Patent Application No. 2006-139585) filed on May 18, 2006, Japanese Patent Application (Patent Application No. 2006-140860) filed on May 18, 2006, Japanese Patent Application (Patent Application No. 2006-140861) filed on May 18, 2006, and Japanese Patent Application (Patent Application No. 2006-140862) filed on May 18, 2006, the entire contents of which are hereby incorporated by reference.

The invention claimed is:

1. An electrophotographic photoreceptor comprising an undercoat layer comprising metal oxide particles and a binder resin on an electroconductive support, and a photosensitive layer disposed on the undercoat layer, wherein the metal oxide particles comprise secondary particles having a volume average particle diameter of 0.1 μm or less and a 90% cumulative particle diameter of 0.3 μm or less which are measured by a dynamic light-scattering method in a liquid of the undercoat layer dispersed in a solvent mixture of methanol and 1-propanol at a weight ratio of 7:3; and the photosensitive layer comprises a binder resin having an ester bond.

2. The electrophotographic photoreceptor according to claim 1, wherein the binder resin having an ester bond is polycarbonate or polyester.

3. The electrophotographic photoreceptor according to claim 2, wherein the polyester is polyarylate.

4. The electrophotographic photoreceptor according to claim 1, wherein the binder resin having an ester bond is produced by interfacial polymerization.

5. The electrophotographic photoreceptor according to claim 1, wherein the photosensitive layer comprises a compound represented by Formula (I):

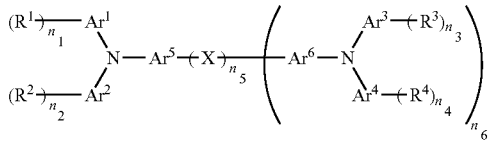

(I)

wherein, in Formula (I), $Ar^1$ to $Ar^6$ each independently represents an aromatic moiety, an aromatic moiety having a substituent, an aliphatic moiety, or an aliphatic moiety having a substituent;

X represents an organic moiety;

$R^1$ to $R^4$ each independently represents an organic group having a hydrazone structure;

$n_1$ represents 1 or 2; and $n_2$ to $n_6$ each represents an integer of 0 to 2.

6. The electrophotographic photoreceptor according to claim 5, wherein, in Formula (I), all of $Ar^1$ to $Ar^6$ are benzene moieties.

7. An image-forming apparatus comprising:

eletrophotographic photoreceptor according to claim 1;

charging means for charging the electrophotographic photoreceptor;

image exposure means for forming an electrostatic latent image by conducting image exposure to the charged electrophotographic photoreceptor;

development means for developing the electrostatic latent image with toner; and transfer means for transferring the toner to a transfer object.

8. An electrophotographic cartridge comprising:

an eletrophotographic photoreceptor according to claim 1; and at least one selected from charging means for charging the electrophotographic photoreceptor, image exposure means for forming an electrostatic latent image by conducting image exposure to the charged electrophotographic photoreceptor, development means for developing the electrostatic latent image with toner, transfer means for transferring the toner to a transfer object, fixing means for fixing the toner transferred to the transfer object, and cleaning means for recovering the toner adhering to the electrophotographic photoreceptor.

* * * * *